US007736278B2

(12) United States Patent
Lull et al.

(10) Patent No.: US 7,736,278 B2
(45) Date of Patent: Jun. 15, 2010

(54) RELEASABLE CONNECTION MECHANISM FOR VARIABLE STRIDE EXERCISE DEVICES

(75) Inventors: Andrew P. Lull, Boulder, CO (US); Keith M. Weier, Lafayette, CO (US); Zachary D. Krapfl, Boulder, CO (US); Chester F. Kowalewski, Broomfield, CO (US); Jonathan B. Watt, Broomfield, CO (US)

(73) Assignee: Nautilus, Inc., Vancouver, WA (US)

( * ) Notice: Subject to any disclaimer, the term of this patent is extended or adjusted under 35 U.S.C. 154(b) by 1006 days.

(21) Appl. No.: 11/158,887

(22) Filed: Jun. 21, 2005

(65) Prior Publication Data

US 2006/0003868 A1 Jan. 5, 2006

Related U.S. Application Data

(63) Continuation-in-part of application No. 11/086,607, filed on Mar. 21, 2005, and a continuation-in-part of application No. 10/875,049, filed on Jun. 22, 2004, now Pat. No. 7,462,134.

(60) Provisional application No. 60/582,145, filed on Jun. 22, 2004, provisional application No. 60/582,232, filed on Jun. 22, 2004, provisional application No. 60/555,434, filed on Mar. 22, 2004, provisional application No. 60/480,668, filed on Jun. 23, 2003.

(51) Int. Cl.
*A63B 22/04* (2006.01)
*A63B 22/06* (2006.01)

(52) U.S. Cl. ..... 482/52; 482/57

(58) Field of Classification Search ..... 482/51–53, 482/57, 70, 79–80
See application file for complete search history.

(56) References Cited

U.S. PATENT DOCUMENTS

| | | | | |
|---|---|---|---|---|
| 347,101 | A | 8/1886 | Ferry | |
| 834,461 | A | 10/1906 | Fair | |
| 1,652,102 | A | 12/1927 | Elmer et al. | |
| 2,661,973 | A | 12/1953 | Sweger | |
| 2,941,834 | A | 6/1960 | Appleton et al. | |
| 4,768,775 | A * | 9/1988 | Marshall | 482/73 |
| 5,279,529 | A | 1/1994 | Eschenbach | |

(Continued)

OTHER PUBLICATIONS

"Nautilus Home Health & Fitness Catalog", Nautilus, Inc., pp. 1-56 (2004).

(Continued)

*Primary Examiner*—Steve R Crow
(74) *Attorney, Agent, or Firm*—Dorsey & Whitney LLP

(57) ABSTRACT

The present invention provides for a variable stride exercise device having a variable size close curved striding path during use. The exercise device described and depicted herein utilizes various configurations of linkage assemblies, cam members, and other components, connected with a frame to allow a user to dynamically vary his stride path during exercise. An exercise device conforming to aspects of the present invention provides a foot path that adapts to the change in stride length rather than forcing the user into a fixed size path. Some embodiments of the exercise device include a lockout device that selectively eliminates the variable stride features of the exercise device and allows the user to exercise in a stepping motion. Other aspects of the present invention relate to a releasable connection mechanism that can be used to selectively and/or automatically limit or eliminate the variable stride feature of an exercise device.

27 Claims, 70 Drawing Sheets

U.S. PATENT DOCUMENTS 5,290,211 A 3/1994 Stearns
5,387,167 A 2/1995 Johnston
5,527,246 A 6/1996 Rodgers, Jr.
5,540,637 A 7/1996 Rodgers, Jr.
5,549,526 A 8/1996 Rodgers, Jr.
5,562,574 A 10/1996 Miller
5,573,480 A 11/1996 Rodgers, Jr.
5,577,985 A 11/1996 Miller
5,591,107 A 1/1997 Rodgers, Jr.
5,593,371 A 1/1997 Rodgers, Jr.
5,593,372 A 1/1997 Rodgers, Jr.
5,595,553 A 1/1997 Rodgers, Jr.
5,611,756 A 3/1997 Miller
5,611,757 A 3/1997 Rodgers, Jr.
5,637,058 A 6/1997 Rodgers, Jr.
5,653,662 A 8/1997 Rodgers, Jr.
5,683,333 A 11/1997 Rodgers, Jr.
5,690,589 A 11/1997 Rodgers, Jr.
5,738,614 A 4/1998 Rodgers, Jr.
5,743,834 A 4/1998 Rodgers, Jr.
5,759,136 A 6/1998 Chen
5,762,588 A 6/1998 Chen
5,766,113 A 6/1998 Rodgers, Jr.
5,772,558 A 6/1998 Rodgers, Jr.
5,779,598 A 7/1998 Lee
5,779,599 A 7/1998 Chen
5,788,609 A 8/1998 Miller
5,792,026 A 8/1998 Maresh et al.
5,792,028 A 8/1998 Jarvie
5,792,029 A 8/1998 Gordon
5,803,871 A 9/1998 Stearns et al.
5,813,949 A 9/1998 Rodgers, Jr.
5,836,854 A 11/1998 Kuo
5,848,954 A 12/1998 Stearns et al.
5,857,941 A 1/1999 Maresh et al.
5,879,271 A 3/1999 Stearns et al.
5,882,281 A 3/1999 Stearns et al.
D408,477 S 4/1999 Arnold et al.
5,893,820 A 4/1999 Maresh et al.
5,911,649 A 6/1999 Miller
5,913,751 A 6/1999 Eschenbach
5,916,065 A 6/1999 McBride et al.
5,919,118 A 7/1999 Stearns et al.
5,921,894 A 7/1999 Eschenbach
5,924,962 A 7/1999 Rodgers, Jr.
5,938,567 A 8/1999 Rodgers, Jr.
5,971,892 A 10/1999 Lee
5,993,359 A 11/1999 Eschenbach
6,027,431 A 2/2000 Stearns et al.
6,042,512 A 3/2000 Eschenbach
6,045,487 A 4/2000 Miller
6,045,488 A 4/2000 Eschenbach
6,053,847 A 4/2000 Stearns et al.
6,063,009 A 5/2000 Stearns et al.
6,077,196 A 6/2000 Eschenbach
6,077,198 A 6/2000 Eschenbach
6,080,086 A 6/2000 Maresh et al.
6,090,014 A 7/2000 Eschenbach
6,126,574 A 10/2000 Stearns et al.
6,152,859 A 11/2000 Stearns
6,168,552 B1 1/2001 Eschenbach
6,171,215 B1 1/2001 Stearns et al.
6,196,948 B1 3/2001 Stearns et al.
6,206,804 B1 3/2001 Maresh
6,210,305 B1 4/2001 Eschenbach
6,217,486 B1 4/2001 Rosenow
6,254,514 B1 7/2001 Maresh et al.
6,302,825 B1 10/2001 Stearns et al.
6,302,830 B1 10/2001 Stearns
6,338,698 B1 1/2002 Stearns et al.
6,340,340 B1 1/2002 Stearns et al.
6,361,476 B1 * 3/2002 Eschenbach ..... 482/52
6,454,682 B1 9/2002 Kuo
6,461,279 B1 10/2002 Kuo
6,485,395 B1 11/2002 Stearns et al.
6,554,750 B2 4/2003 Stearns et al.
6,612,969 B2 9/2003 Eschenbach
6,626,802 B1 9/2003 Rodgers, Jr.
6,648,801 B2 11/2003 Stearns et al.
6,689,019 B2 2/2004 Ohrt et al.
D489,101 S 4/2004 Giannelli et al.
6,719,666 B1 4/2004 Lo et al.
6,755,769 B2 6/2004 Johnston
6,849,034 B2 2/2005 Eschenbach
RE38,803 E 9/2005 Rodgers, Jr.
7,033,306 B2 4/2006 Graber
7,169,087 B2 1/2007 Ercanbrack et al.
7,172,531 B2 2/2007 Rodgers, Jr.
7,214,168 B2 5/2007 Rodgers, Jr.
7,316,633 B2 1/2008 Liao et al.
7,462,134 B2 12/2008 Lull et al.
2002/0165066 A1 11/2002 Stearns
2004/0132583 A1 7/2004 Ohrt et al.
2004/0147375 A1 7/2004 Stevens
2004/0192514 A1 9/2004 Piaget et al.
2004/0214693 A1 10/2004 Piaget et al.
2004/0248709 A1 12/2004 Rodgers, Jr.
2005/0037898 A1 2/2005 Chang
2005/0043145 A1 2/2005 Anderson et al.
2005/0049117 A1 3/2005 Rodgers, Jr.
2005/0124466 A1 6/2005 Rodgers, Jr.
2005/0124467 A1 6/2005 Rodgers, Jr.
2005/0202939 A1 9/2005 Lull et al.
2005/0209056 A1 9/2005 Daly et al.
2005/0209059 A1 9/2005 Crawford et al.
2005/0209060 A1 9/2005 Lull
2005/0209061 A1 9/2005 Crawford et al.
2005/0233864 A1 10/2005 Smith et al.
2005/0277519 A1 12/2005 Moon
2006/0003868 A1 1/2006 Lull et al.
2006/0166791 A1 * 7/2006 Liao et al. ..... 482/52
2006/0293154 A1 12/2006 Graber
2007/0087906 A1 4/2007 Rodgers, Jr.
2007/0087907 A1 4/2007 Rodgers, Jr.
2008/0312045 A1 12/2008 Lull et al.

OTHER PUBLICATIONS

Schwinn Original Airdyne, Schwinn company web page, 3 pages (Apr. 2001).
Supplementary European Search Report dated Mar. 30, 2009 in counterpart European patent application No. 05 76 2526.
U.S. Appl. No. 12/636,814, Filed Dec. 14, 2009, Ohrt et al.

* cited by examiner

RELEASABLE CONNECTION MECHANISM FOR VARIABLE STRIDE EXERCISE DEVICES

CROSS-REFERENCE TO RELATED APPLICATIONS

The present application claims the benefit of U.S. Provisional Application No. 60/582,145, filed Jun. 22, 2004; and U.S. Provisional Application No. 60/582,232, filed Jun. 22, 2004, which are both hereby incorporated herein by reference.

The present application is a continuation-in-part of U.S. application Ser. No. 11/086,607, filed Mar. 21, 2005, which claims the benefit of U.S. Provisional Application No. 60/555,434, filed Mar. 22, 2004; U.S. Provisional Application No. 60/582,145, filed Jun. 22, 2004; and U.S. Provisional Application No. 60/582,232, filed Jun. 22, 2004; and which is also a continuation-in-part of U.S. application Ser. No. 10/875,049, filed Jun. 22, 2004, which claims the benefit of U.S. Provisional Application No. 60/480,668, filed Jun. 23, 2003 and U.S. Provisional Application No. 60/555,434, filed Mar. 22, 2004, which are all hereby incorporated herein by reference.

INCORPORATION BY REFERENCE

U.S. patent application Ser. No. 10/789,182, filed on Feb. 26, 2004; U.S. patent application Ser. No. 09/823,362, filed on Mar. 30, 2001, now U.S. Pat. No. 6,689,019; and U.S. Provisional Application No. 60/451,102, filed on Feb. 28, 2003 are all hereby incorporated herein by reference.

BACKGROUND OF THE INVENTION a. Field of the Invention

This invention relates to exercise devices, and more particularly, to releasable connection mechanisms used with stationary striding exercise devices utilizing various linkage assembly configurations with components having various shapes and sizes to provide a footpath that can be dynamically varied by the user while exercising.

b. Background Art

A variety of exercise devices exist that allow a user to exercise by simulating a striding motion. Some of these exercise devices include a pair of foot-engaging links wherein first ends of each foot link are supported for rotational motion about a pivot point, and second ends of each foot link are guided in a reciprocal path of travel. The connection configuration of the two foot links may permit the user's foot to travel in a generally oval path of travel. However, the resulting foot travel path is a predetermined or fixed path that is defined by the structural configuration of the machine and can be varied only by manually changing physical parameters of the equipment. Thus, these exercise devices confine the range of motion of a user's foot by fixing the path traveled by the first and second ends of the foot links.

BRIEF SUMMARY OF THE INVENTION

Aspects of the present invention involve an exercise device that provides a variable size foot path during use. More particularly, the exercise device includes a pair of foot platforms on which the user places his or her feet, and wherein each foot platform is operably connected with a corresponding linkage assembly. The foot platforms travel through a closed curved path of travel that varies as a function, at least in part, of the forces imparted by the user during exercise. Other aspects of the present invention involve a releasable connection mechanism for variable stride exercise devices. Embodiments of the releasable connection mechanism provide for selective and/or automated coupling of various elements of the linkage assemblies on the exercise devices so as to eliminate or limit the user's ability to dynamically vary his stride path. As such, the releasable connection mechanism can be used to allow a user to selectively configure the exercise device with a fixed stride path.

In one aspect of the present invention, an exercise device includes: a frame; at least one swing link pivotally connected with the frame; at least one crank arm pivotally connected with the frame and configured to rotate about a crank axis; at least one link movingly coupled with the at least one crank arm and operably coupled with the at least one swing link, the at least one link coupled with the at least one crank arm to allow relative movement between the at least one link and the at least one crank arm along at least a first portion of the at least one link; and at least one locking member movable to operably engage the at least one link and the crank arm to reduce relative movement between the at least one link and the at least one crank arm along at least the first portion of the at least one link.

In another form of the present invention, an exercise device includes: a frame; at least one crank arm pivotally connected with the frame; at least one roller rotatably connected with the at least one crank arm; at least one linkage assembly operably coupled with the frame and including a cam member rollingly engaged with the at least one roller to allow the at least one roller to roll along at least a first portion of the cam member; and at least one locking member selectively movable to operably engage the at least one roller and the cam member to limit movement of the at least one roller rolling along at least the first portion of the cam member.

In yet another form of the present invention, an exercise device includes: a frame; at least one crank arm pivotally connected with the frame and configured to rotate about a crank axis; at least one linkage assembly operably coupled with the frame and including at least one link movingly coupled with the at least one crank arm, providing a variable stride path; and a means for selectively engaging the at least one link and the crank arm to limit the variable stride path.

The features, utilities, and advantages of various embodiments of the invention will be apparent from the following more particular description of embodiments of the invention as illustrated in the accompanying drawings and defined in the appended claims.

DETAILED DESCRIPTION OF THE INVENTION

Aspects of the present invention involve a variable stride exercise device providing a variable size close curved striding path during use. In some embodiments of the invention, the close curved striding path resembles an ellipse with a major and minor axis. The exercise devices described and depicted herein utilize various configurations of linkage assemblies, cam members, and other components, connected with a frame to allow a user to dynamically vary his stride path during exercise. With reference to an embodiment providing an ellipse-like path, the major axis and/or the minor axis of the ellipse is modified, either lengthened or shortened, as a function of the user's stride. For example, if a user is exercising at a first exertion level and increases his exertion to a second level, his stride may lengthen due to the increase in exertion level. An exercise device conforming to aspects of the present invention provides a foot path that adapts to the change in stride length rather than forcing the user into a fixed size path as in some prior art devices. A user's exertion level may have several components impacting the stride length provided by the machine, such as leg power and frequency, torso power and frequency, and (in embodiments with arm supports or exercise components) arm power and frequency.

Other aspects of the present invention involve a releasable connection mechanism for variable stride exercise devices. Embodiments of the releasable connection mechanism provide for selective and/or automated coupling of various elements of the linkage assemblies on the exercise devices so as to limit or eliminate the user's ability to dynamically vary his stride path. As such, the releasable connection mechanism can be used to allow a user to selectively configure the exercise device with a fixed stride path. Embodiments of the releasable connection mechanism may also be used to automatically fix or limit the stride path of the exercise device to eliminate potentially awkward initial linkage movements during start-up of the exercise device. Once the exercise device is in use, the present invention may act to automatically restore the variable stride capabilities.

The embodiments are described herein with respect to the primary intended use of the embodiments. As such, the devices are described with the perspective of a user facing the front of the exercise machine. For example, components designated as "right" are on the right side of the device from the perspective of a user operating the device. Additionally, the primary intended use is for a forward pedaling stride, such as when a person, walks, climbs, jogs, or runs forwardly. It is possible, however, that users will operate the machines standing backward, will pedal backward, or will stand and pedal backward. Aspects of the invention are not necessarily limited to the orientation of a user or any particular user's stride.

Figure 1A:
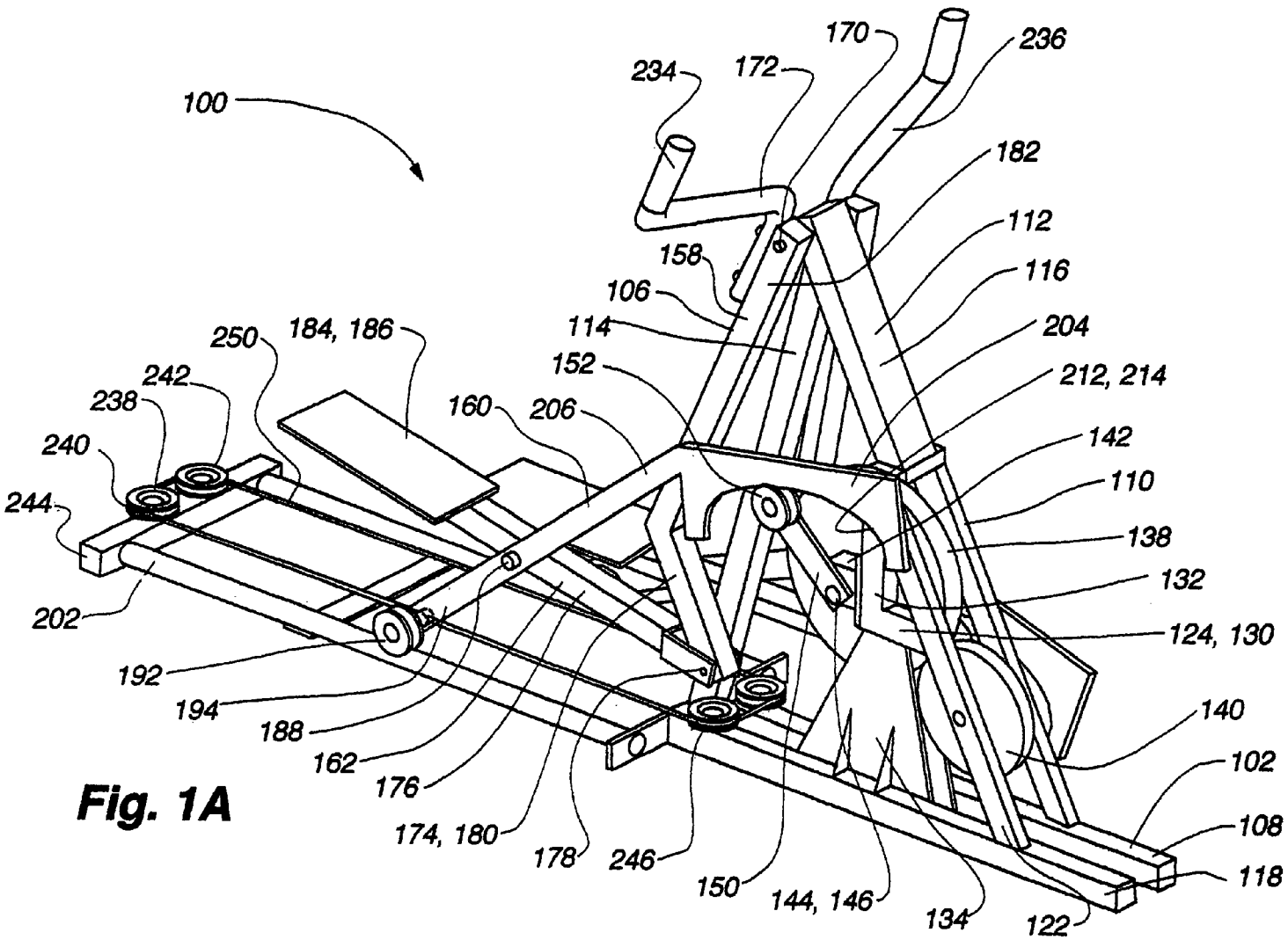
FIG. 1A is a right side isometric view of a first embodiment of a variable stride exercise device.
Figure 1B:
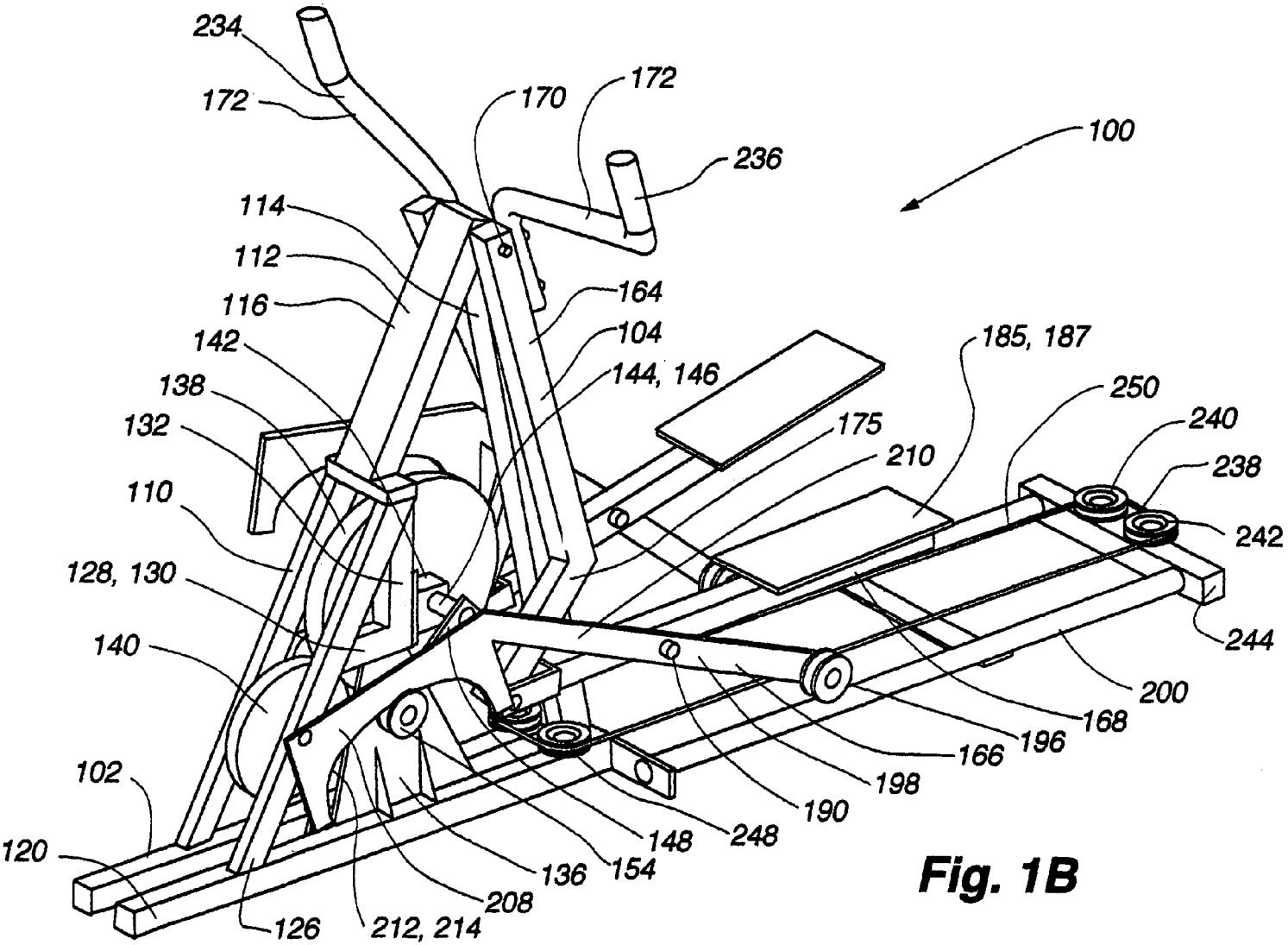
FIG. 1B is a left side isometric view of the first embodiment of the variable stride exercise device.
Figure 2:
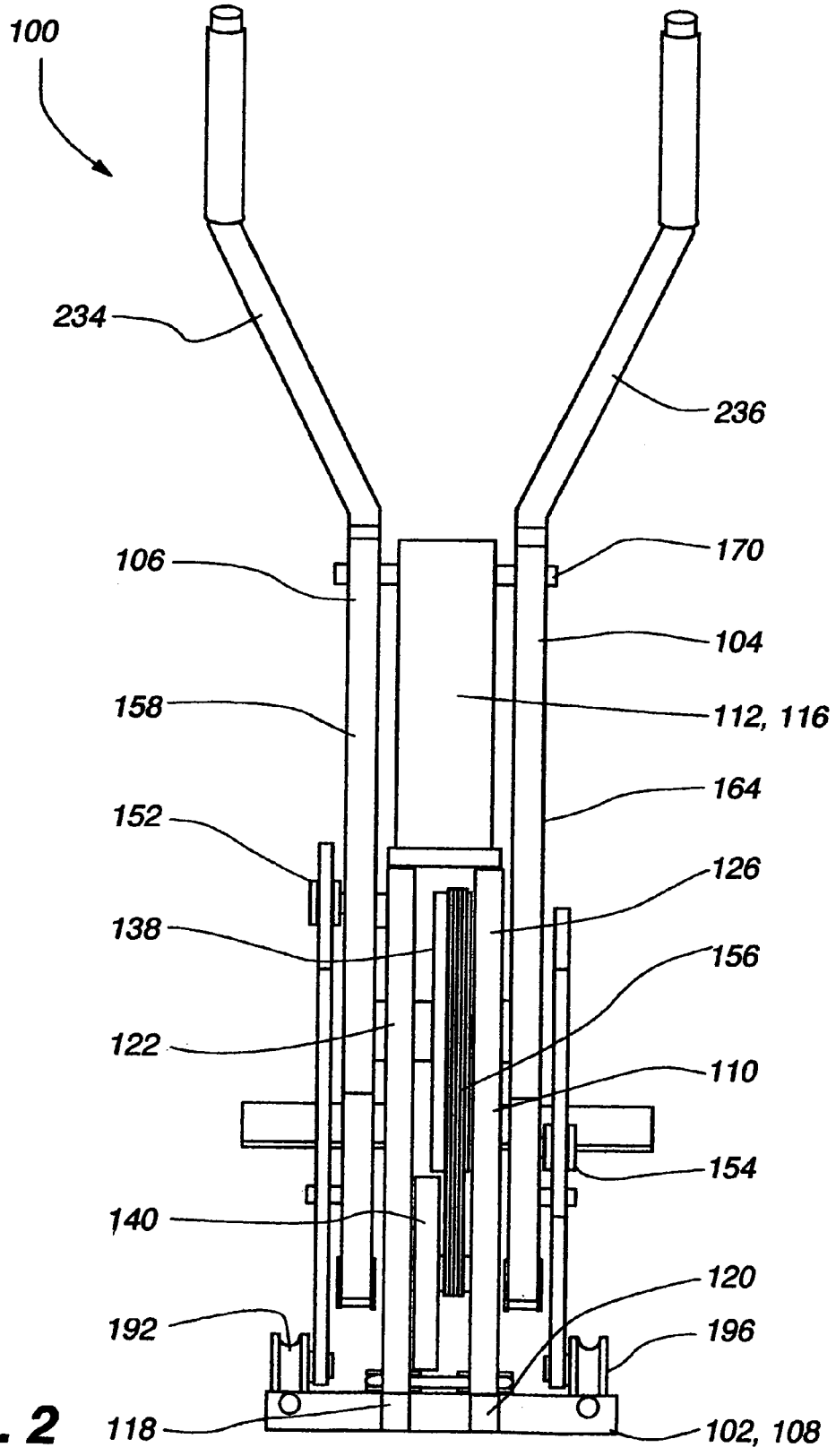
FIG. 2 is a front view of the exercise device depicted in FIGS. 1A-1B.

A first embodiment of an exercise device 100 conforming to aspects of the present invention is shown in FIGS. 1A-2. The exercise device 100 includes a frame 102 having a left linkage assembly 104 and a right linkage assembly 106 connected therewith. The left linkage assembly 104 is substantially a mirror image of the right linkage assembly. The frame includes a base portion 108, a fork assembly 110, a front post 112, and a rear post 114. The combination of the fork assembly, the front post, and the rear post pivotally supports the linkage assemblies as well as supports the components that variably support the linkage assemblies.

The fork assembly 110, the front post 112, and the rear post 114 define an A-frame like support structure 116. More particularly, the fork assembly 110 and the rear post 114 are connected with the base portion 108. At the front of the device, the fork assembly 110 extends upwardly and rearwardly from the base portion 108. The front post 112 extends upwardly from the fork assembly 110 in the same direction as the fork assembly relative to the base portion. Rearward of the fork assembly 110, the rear post 114 extends upwardly and forwardly from the base portion 108 and intersects with the top area of the front post 112. It is to be appreciated that various frame configurations and orientations can be utilized with the present invention other than what is depicted and described herein.

The A-frame support assembly 116 is secured to a right base member 118 and a left base member 120. The fork assembly 110 includes a right fork member 122 supporting a right crank suspension bracket 124, and a left fork member 126 supporting a left crank suspension bracket 128. The right fork member 122 and the left fork member 126 extend upwardly and rearwardly from the right base member 118 and the left base member 120, respectively. The right crank suspension bracket 124 is L-shaped and has a horizontal portion 130 extending rearwardly from the right fork member and a vertical portion 132 extending downwardly from the right fork member to intersect the horizontal portion at substantially a right angle. The left crank suspension bracket 128 is connected with the left fork member 126 and is substantially a mirror image of the right crank suspension member 124. The front post 112 is attached to the fork assembly 110 at the connection of the vertical portion 132 of the right crank suspension bracket 124 with the right fork member 122 and the connection of the vertical portion 132 of the left crank suspension bracket 128 with the left fork member 126. A right brace member 134 and a left brace member 136 extend upward from the right base member 118 and the left base member 120, respectively, to connect with right and left crank suspension brackets, respectively.

Still referring to FIGS. 1A-2, the A-frame 116 rotatably supports a pulley 138 and a flywheel 140. More particularly, the pulley 138 is rotatably supported between bearing brackets 142 extending rearwardly from the right and left crank suspension brackets 124 and 128, respectively. The pulley includes a crank axle 144, which defines a crank axis 146. Left and right crank arms 148 and 150 are connected with the crank axle 144 to rotate about the crank axis 146 along repeating circular paths. In addition, the right and left crank arms are configured to travel 180 degrees out of phase with each other. Distal the crank axle, a right cam roller 152 and a left cam roller 154 are rotatably connected with the right crank arm 150 and the left crank arm 148, respectively. As discussed in more detail below, the right and left cam rollers variably support the front portion of the linkage assemblies.

The flywheel 140 is rotatably supported between the left and right fork members 126 and 122. A belt 156 couples the pulley 138 with the flywheel 140. As such, via the pulley, the flywheel is indirectly coupled to the right and left crank arms 150 and 148 so that rotation of the crank arms is coupled with the flywheel. The flywheel provides a large angular momentum to give the overall movement of the linkages and crank arms a smooth feel during use. For example, the flywheel configured with a sufficiently heavy perimeter weight helps turn the crank arms smoothly even when the user is not supplying a turning force and promotes a smooth movement of the of linkage assemblies as the crank arms move through the 6 o'clock and 12 o'clock positions where the user imparts little force on the cranks.

As shown in FIGS. 1A-2, the right linkage assembly 106 includes a right swing link 158, a right cam link 160, and a right foot link 162 operably connected with the right crank arm 150 and the frame 102 to provide a variable stride path. Although the following description refers mainly to the components of the right linkage assembly, it is to be appreciated that the left linkage assembly is substantially a mirror image of the right linkage assembly, and as such, includes the same components as the right linkage assembly, which operate in relation with each other and with the frame as the right linkage assembly. For example, the left linkage assembly includes a left swing link 164, a left cam link 166, and a left foot link 168 operably connected with the left crank arm 148 and the frame 102 to provide a variable stride path. The right swing link 158 is pivotally supported near the apex of the A-frame support 116. More particularly, the top portion of the front post 112 defines an upper pivot 170 above the intersection of the front post 112 and the rear post 114. The right 158 (and left 164) swing link is pivotally supported at the upper pivot 170. In one particular implementation, the swing link defines an arm exercise portion 172 extending upwardly from the upper pivotal connection 170. Without an arm exercise, the swing arm is shorter and pivotally supported near its top portion.

A lower portion 174 of the right swing link 158 is pivotally connected with a forward portion 176 of the right foot link 162 at a right lower pivot 178. The swing link 158 of FIG. 1A defines a forwardly extending bottom portion 180 angularly oriented with respect to a top portion 182. Although the right and left swing links depicted in FIGS. 1A and 1B are shown as bent (so as to define an angle between straight end portions), it is to be appreciated other embodiments of the present invention can utilize swing links defining other shapes, such as straight or arcuate.

Although various embodiments of the invention described herein include pivotally connected or supported links, it is to be appreciated that the pivotal connections may be provided with various possible configurations of ring bearings, collars, posts, pivots, and other pivotal or rotatable arrangements. Moreover, the pivotal connections may be direct, such as in a pivotal connection between a first link and a second link where one link has a pin or rod pivotally supported by one or more ring bearings housed in a circular aperture of the second link, or may be indirect, such as when a third link is interposed between the first and second link.

As introduced above, the forward portion 176 of the right foot link 162 is pivotally coupled with the lower portion 174 of the right swing link 158. The right foot link 162 is also pivotally coupled with the right cam link 160 rearward of the right swing link. The rearward portion of the right foot link supports a right foot engaging portion 184. The foot engaging portion 184, in one example, includes a rectangular foot pad 186 meant to support a user's foot. The foot engaging portions may be directly connected with the top of the foot links or may be pivotally supported so that they articulate during use or their angular relations with the foot links vary.

The right foot link 162, between the forward and rearward ends thereof, is pivotally connected with the right cam link 160, between the forward and rearward ends thereof, at a right cam link pivot 188. Similarly, in a mirror image of the right linkage assembly, the left foot link 164, between the forward and rearward ends thereof, is pivotally connected with the left cam link 166, between the forward and rearward ends thereof, at a left cam link pivot 190. It is to be appreciated that the locations of the pivotal connections between the foot links and the cam links are not limited to the locations shown in the figures, but may be otherwise located between the ends of the links. As discussed in more detail below, when using the exercise device, the user mounts the exercise device by placing his feet on the right and left foot engaging portions 184, 185 provided toward the rear portions of the right and left foot links. Movement imparted to the right and left foot links 162 and 168 by the user causes the right and left swing links 158 and 164 to swing back and forth about the upper pivot. The travel paths in which the foot engaging portions move is dictated in part by the movement of the right and left cam links and the stride length of the user.

Still referring to FIGS. 1A-2, a right guide roller 192 is rotatably connected with a rear portion 194 of the right cam link 160, and a left guide roller 196 is rotatably connected with a rear portion 198 of the left cam link 166. The frame includes a left 200 and a right rail 202. The right and left guide rollers 196 and 198 are adapted to roll back and forth along the right rail and the left rail, respectively. The guide rollers may also be adapted to roll along other surfaces, such as the floor. Although the right and left rails are flat (i.e., level) the rails may also be inclined or declined, and may be arcuately-shaped with a fixed or varying radius.

As shown in FIGS. 1A-2, a right cam member 204 is connected with a forward portion 206 of the right cam link 160, and a left cam member 208 is connected with a forward portion 210 of the left cam link 166. Each cam member includes a downwardly concave section 212 defining a generally arcuate surface 214. The arcuate surface 214 is adapted to rest on the cam roller (152, 154) on the end of the crank arm (150, 148). As such, the forward portion 206 of the right cam link 160 is supported by the right cam roller 152 and the forward portion 210 of the left cam link 166 is supported by the left cam roller 154. The crank arm is thus not coupled with the cam link in a fixed relation. Rather, via the roller/cam interface, the cam link may move relative to the crank arm. As such, as discussed in more detail below, the cam links (160, 166) act as variable stride links that allow a user to move the foot links (162, 168) by varying his stride length. During use, the crank arms (148, 150) rotate about the crank axis 146. The cam rollers (152, 154) also rotate about the crank axis 146, moving through an arcuate path having vertical and horizontal components. During use, the cam members ride on the rollers as the crank arms rotate about the crank axis. Depending on the horizontal forces applied to the cam links, the cam rollers are adapted to roll back and forth along the arcuate cam surfaces of the right and left cam members in relation to forward and rearward movement of the right and left cam links when the exercise device is in use.

The arcuate surfaces 214 of the cam members (204, 200) shown in FIGS. 1A-1B and others define a variable radius, with the radius being longer in the middle and shorter toward the ends. As the radius decreases, the force required to move the roller along the cam surface increases, thus, as a user's stride increases, it takes a greater force to move the cams (204, 208) relative to the crank arms (150, 148). The arcuate surfaces 214 may also define a fixed radius. At either end of the cam surfaces, the generally concave sections define downwardly extending nearly vertical, portions. The downwardly extending portions of the arcuate cam surfaces of the right and left cam members act to keep the cam members and the cam links from disengaging from the crank arms. It is also possible to utilize hard stops or some other mechanism that prohibits the roller from disengaging the crank.

To operate the exercise machine 100 shown in FIGS. 1A-2, a user first places his feet in operative contact with the right and left foot engagement portions 184. To begin operation of the machine in a forward stride exercise, the user places his weight predominantly on the foot pad 186 located upwardly and/or forwardly relative to the other foot pad along with some forward force imparted by the user's foot. As a result, the crank arms (148, 150) will begin rotation in a clockwise direction (as viewed from the right side of the exercise device). The user then proceeds to exercise by continuing to stride forwardly toward the front post. Forces imparted to the foot engaging portions 184 by the user cause the foot links (162, 168) to move back and forth, which in turn cause the swing links (158, 164) to pivot back and forth around the upper pivot 170. At the same time, the crank arms (148, 150) rotate around the crank axis 146. Because the foot links (162, 168) and the cam links (160, 166) are rollingly supported by the rails (202, 200) and the crank arms (150, 148) through rollers (152, 154, 192, 196), the paths in which the cam links and foot links move are variable and can be affected by the stride length of the user. As such, the foot paths are not solely dictated by the geometric constraints of the intercoupling of the foot links, cam links, swing links, crank arms, and the frame. Therefore, the user can dynamically adjust the travel path of the of the foot engaging portions while using the exercise device based on the user's natural stride length, stride power, and stride rate.

A comparison of FIGS. 3A-3D illustrates the relative movement of the various components of the linkage assemblies as the right crank arm 150 moves through one full rotation from a the rearward orientation (FIG. 3A), to an upward orientation (FIG. 3B), to a forward orientation (FIG. 3C), and to a downward orientation (FIG. 3D), and back to the rearward orientation for a given user stride length. In FIGS. 3A-3D, the cam members (204, 208) are shown in fixed relation to the cam rollers (152, 154) at a midpoint or apex 232 of the cam surfaces. The cam rollers will stay near the midpoint of the cam surfaces when little or no forward or rearward force component is placed on the foot engaging portions 184 by a user. As discussed in more detail below, the right and left linkage assemblies 106 and 104 can be interconnected so that forward movement of one causes rearward movement of the other, and vice versa. Therefore, it is to be appreciated that the components of the left linkage assembly may move relative to each other in the same way as the right linkage assembly components, but in an opposite direction relative to the right linkage assembly components when an interconnection assembly is utilized.

Figure 3A:
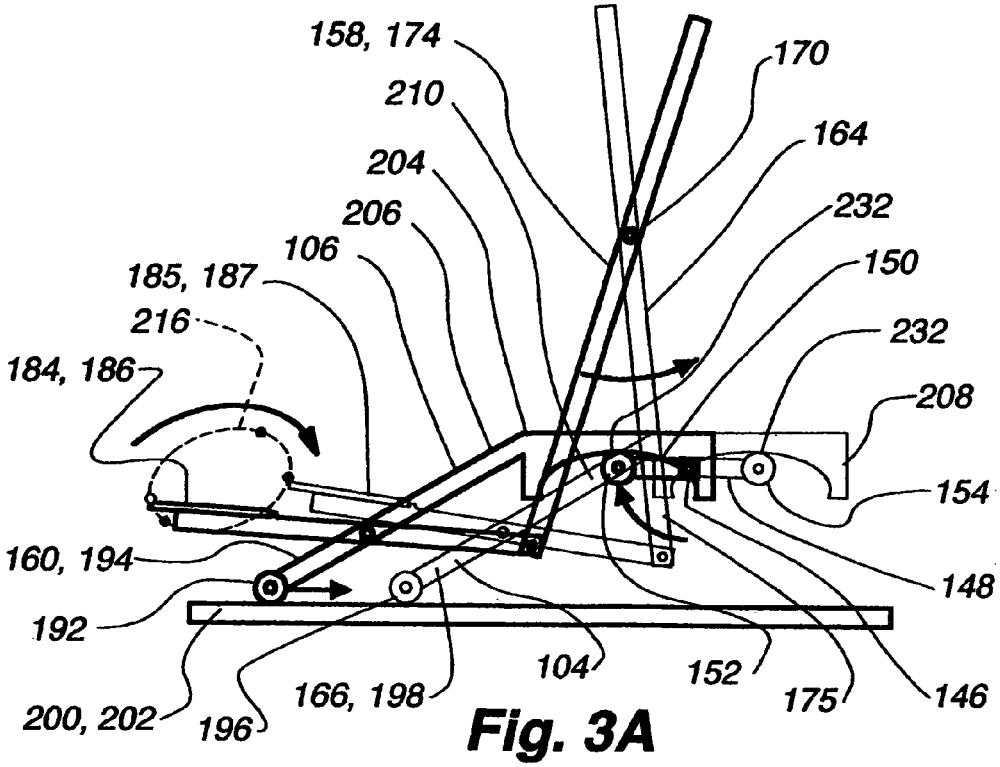
FIG. 3A is a right side schematic view of the exercise device depicted in FIGS. 1A-1B showing the right crank arm in about a 9 o'clock or rearward orientation and a right cam roller located at about the mid-point of the cam member.

Referring first to FIG. 3A, the right and left foot pads 186 and 187 are oriented such that the user's right foot is placed rearwardly of his left foot. In addition, the user's right foot is positioned such that the user's right heel is slightly raised relative to the user's right toes, and the user's left foot is positioned such that the user's left heel is slightly higher relative to the user's left toes. As the user strides forward with his right leg toward the front post 112, the right crank arm 150 rotates in a clockwise direction (as viewed from the right side of the exercise device) around the crank axis 146 from the rearward orientation (FIG. 3A) to the upward orientation (FIG. 3B), which causes the lower portion 174 of the right swing link 158 to pivot counterclockwise from a rearward position shown in FIG. 3A around the upper pivot 170 to the position shown in FIG. 3B. At the same time, the right guide roller 192 rolls forwardly along the right rail 202. The rearward portion 194 of the right cam link 160 moves forwardly in conjunction with the movement of the right guide roller 192, and the forward portion 206 of the right cam link 160 moves upwardly and forwardly in conjunction with the movement of the right cam roller 152 connected with the right crank arm 150. In the particular stride path shown in FIGS. 3A and 3B, the right cam roller does not move along the length of the right cam surface.

A right forward step is accompanied by rearward movement of the left leg. The left crank 148 rotates in coordination with the right crank 150. Thus, the left crank arm 148 rotates in a clockwise direction (as viewed from the right side of the exercise device) around the crank axis 146 from the forward orientation to the downward orientation, which causes a lower portion 175 of the left swing link 164 to pivot clockwise from a forward position shown in FIG. 3A around the upper pivot 170 to the position shown in FIG. 3B. At the same time, the left guide roller 196 rolls rearwardly along left rail 200. The rearward portion 198 of the left cam link 166 moves rearwardly in conjunction with the movement of the left guide roller 196, and the forward portion 210 of the left cam link 166 moves downwardly and rearwardly in conjunction with the movement of the left cam roller 154 connected with the left crank arm 148. In the particular stride path shown in FIGS. 3A and 3B, the left cam roller 154 does not move along the length of the left cam surface. The beginning movement of the left linkage assembly 104 is similar to the movement of the right linkage 106 assembly shown and discussed below with reference to FIGS. 3C and 3D.

Figure 3B:
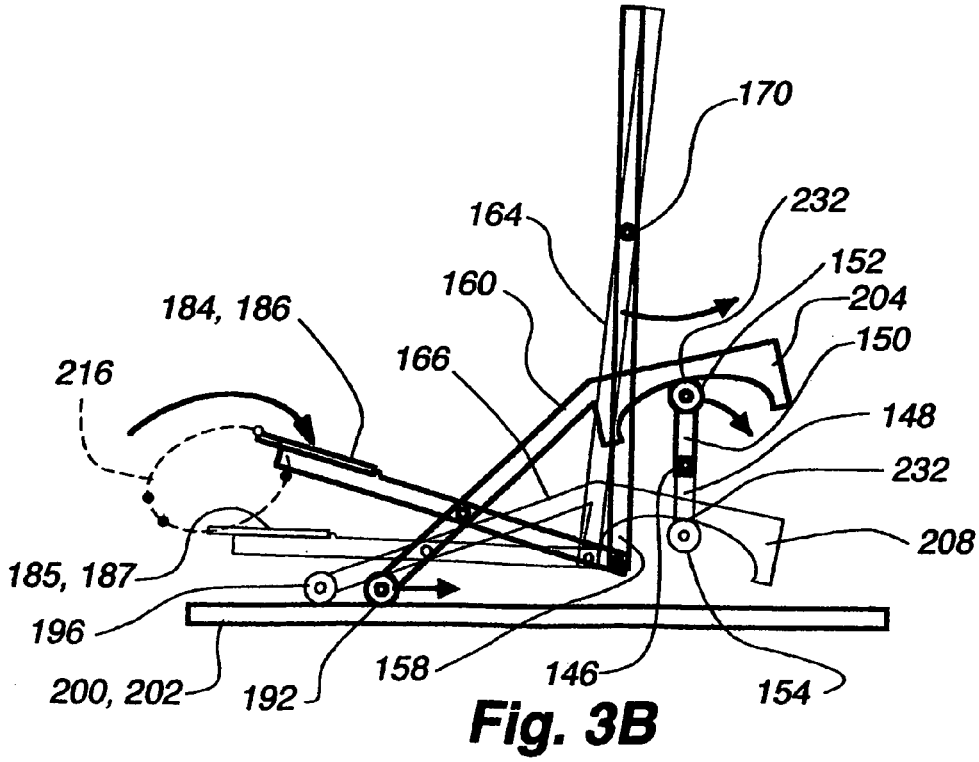
FIG. 3B is a right side schematic view of the exercise device depicted in FIGS. 1A-1B showing a right crank arm in about a 12 o'clock or upper orientation and the right cam roller located at about the mid-point of a cam member.

As shown in FIG. 3B, the right foot pad 186 has moved upward and forward from the position shown in FIG. 3A, and the left foot pad 187 has moved downward and rearward from the position shown in FIG. 3A. As such, in FIG. 3B, the right and left pads are oriented such that the user's right foot is placed upward relative to his left foot. In addition, the user's right foot is positioned such that the user's right heel is raised relative to the user's right toes, and the user's left foot is positioned such that the user's left heel is almost level with the user's left toes.

Figure 3C:
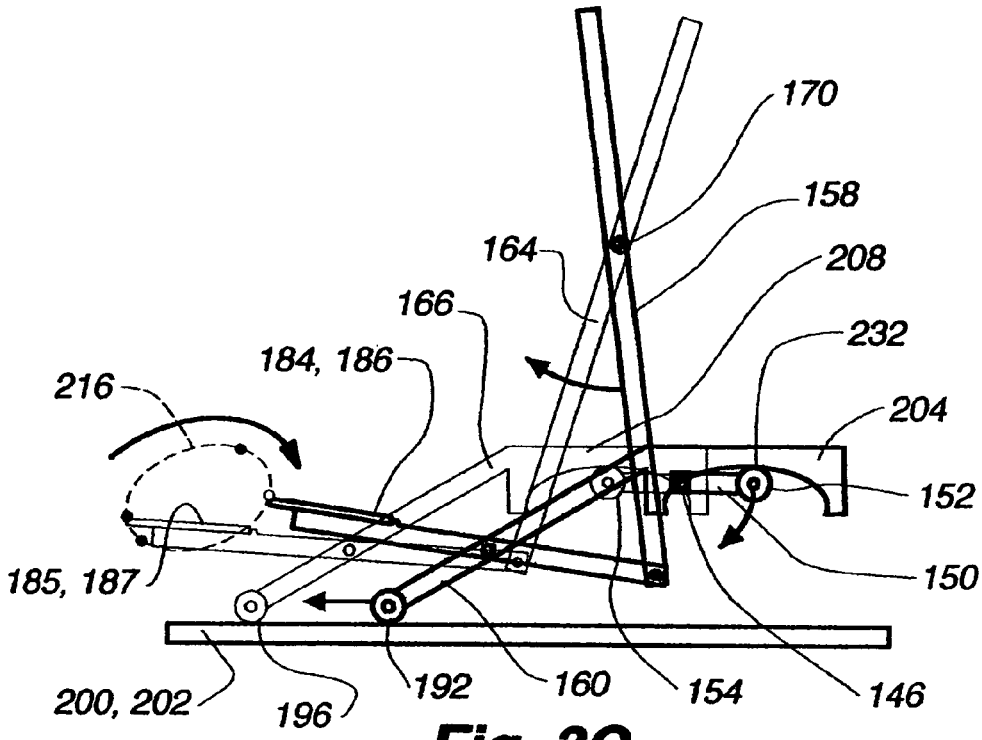
FIG. 3C is a right side schematic view of the exercise device depicted in FIGS. 1A-1B showing the right crank arm in about a 3 o'clock or forward orientation and the right cam roller located at about the mid-point of the cam member.

As the user continues to stride forward toward the front post 112, the right crank arm 150 rotates in a clockwise direction (as viewed from the right side of the exercise device) around the crank axis 146 from the upward orientation (FIG. 3B) to the forward orientation (FIG. 3C). At the same time, the lower portion 174 of the right swing link 158 pivots counterclockwise from the position shown in FIG. 3B around the upper pivot 170 to a forward position shown in FIG. 3C. In coordination, the right guide roller 192 continues to roll forwardly along the right rail 202. The rearward portion 194 of the right cam link 160 moves forwardly in conjunction with the movement of the right guide roller 202, and the forward portion 206 of the right cam link 160 moves downwardly and forwardly in conjunction with the movement of the right cam roller 152 connected with the right crank arm 150. In the particular stride path shown in FIGS. 3B and 3C, the right cam roller 152 does not move along the length of the right cam surface.

With reference to the left linkage assembly 104, the left crank arm 148 rotates in a clockwise direction (as viewed from the right side of the exercise device) around the crank axis from the downward orientation (FIG. 3B) to a rearward orientation (FIG. 3C), which causes the lower portion 175 of the left swing link 164 to pivot clockwise from the position shown in FIG. 3B around the upper pivot 170 to a rearward position shown in FIG. 3C. At the same time, the left guide roller 196 continues to roll rearwardly along the left rail 200. The rearward portion 198 of the left cam link 166 moves rearwardly in conjunction with the movement of the left guide roller 196, and the forward portion 210 of the left cam link 166 moves upwardly and rearwardly in conjunction with the movement of the left cam roller 154 connected with the left crank arm 148. In the particular stride path shown in FIGS. 3B and 3C, the left cam roller does not move along the length of the left cam surface.

As shown in FIG. 3C, the right foot pad 186 has moved downward and forward from the position shown in FIG. 3B, and the left foot pad 187 has moved upward and rearward from the position shown in FIG. 3B. As such, in FIG. 3C, the right and left pads are oriented such that the user's right foot is placed forward relative to his left foot. In addition, the user's right foot is positioned such that the user's right heel is slightly raised relative to the user's right toes, and the user's left foot is positioned such that the user's left heel is slightly raised relative to the user's left toes.

Figure 3D:
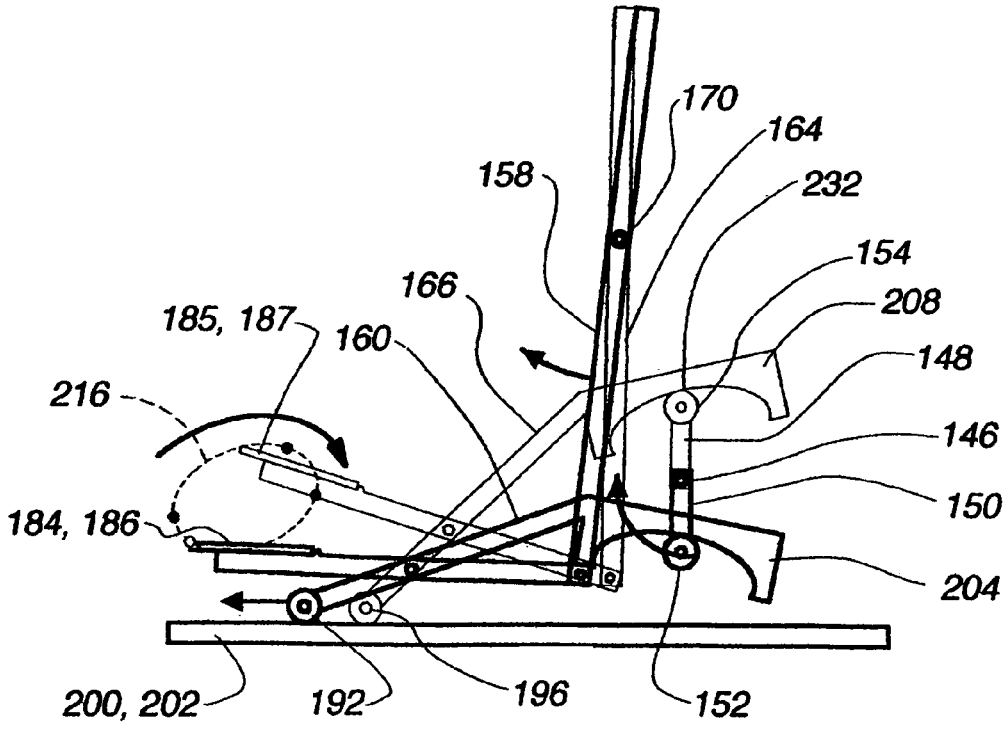
FIG. 3D is a right side schematic view of the exercise device depicted in FIGS. 1A-1B showing the right crank arm in about a 6 o'clock or lower orientation and the right cam roller located at about the mid-point of the cam member.

From the linkage orientation of FIG. 3C to FIG. 3D, the user's right leg transitions from a forward movement to a rearward movement. As such, the user begins the rearward portion or second half of a full stride. As the user begins, the right crank arm 150 rotates in a clockwise direction (as viewed from the right side of the exercise device) around the crank axis 146 from the forward orientation rearwardly to the downward orientation (FIG. 3D). At the same time, the lower portion 174 of the right swing link 158 pivots clockwise from the forward position shown in FIG. 3C around the upper pivot 170 back to the position shown in FIG. 3D. In coordination, the right guide roller 192 begins rolling rearwardly along the right rail 202. The rearward portion 194 of the right cam link 160 moves rearwardly in conjunction with the movement of the right guide roller 192, and the forward portion 206 of the right cam link 160 moves downwardly and rearwardly in conjunction with the movement of the right cam roller 152 connected with the right crank arm 150. In the particular stride path shown in FIGS. 3C and 3D, the right cam roller does not move along the length of the right cam surface.

At the same time, the left linkage 104 transitions from rearward movement to forward movement. The left crank arm 148 rotates in a clockwise direction (as viewed from the right side of the exercise device) around the crank axis 146 from the rearward orientation (FIG. 3C) to the upward orientation (FIG. 3D). At the same time, the lower portion 175 of the left swing link 164 pivots counterclockwise from the rearward position shown in FIG. 3C around the upper pivot 170 back to the position shown in FIG. 3D. In coordination, the left guide roller 196 begins to roll forwardly along left rail 200. The rearward portion 198 of the left cam link 166 moves forwardly in conjunction with the movement of the left guide roller 196, and the forward portion 210 of the left cam link 166 moves upwardly and forwardly in conjunction with the movement of the left cam roller 154 connected with the left crank arm 148. In the particular stride path shown in FIGS. 3C and 3D, the left cam roller does not move along the length of the left cam surface.

As shown in FIG. 3D, the right foot pad 186 has moved rearward and downward from the position shown in FIG. 3C, and the left foot pad 187 has moved upward and forward from the position shown in FIG. 3C. As such, in FIG. 3D, the right and left pads are oriented such that the user's right foot is placed downward relative to his left foot. In addition, the user's right foot is positioned such that the user's right heel is almost level with the user's right toes, and the user's left foot is positioned such that the user's left heel is raised relative to the user's left toes.

As the user continues the rearward portion of the stride away from the front post 112, the right crank arm 150 rotates in a clockwise direction (as viewed from the right side of the exercise device) around the crank axis 146 from the downward orientation (see FIG. 3D) back to the rearward orientation (see FIG. 3A) to complete one full stride. At the same time, the lower portion 174 of the right swing link 150 pivots clockwise from the position shown in FIG. 3D around the upper pivot 170 back to the rearward position shown in FIG. 3A. In coordination, the right guide roller 192 continues to roll rearwardly along right rail 202. The rearward portion 194 of the right cam link 160 moves rearwardly in conjunction with the movement of the right guide roller 192, and the forward portion 206 of the right cam link 160 moves upwardly and rearwardly in conjunction with the movement of the right cam roller connected with the right crank arm. In the particular stride path shown in FIGS. 3D and 3A, the right cam roller does not move along the length of the right cam surface. Referring to the left linkage assembly 104, the left crank arm 148 rotates in a clockwise direction (as viewed from the right side of the exercise device) around the crank axis 146 from the upward orientation (see FIG. 3D) to the forward orientation (see FIG. 3A). At the same time, the lower portion 175 of the left swing link 164 pivots counterclockwise from the position shown in FIG. 3D around the upper pivot 170 back to forward position shown in FIG. 3A. In conclusion, the left guide roller 196 continues to roll forwardly along the left rail 200. The rearward portion 198 of the left cam link 166 moves forwardly in conjunction with the movement of the left guide roller, and the forward portion 210 of the left cam link 166 moves downwardly and forwardly in conjunction with the movement of the left cam roller connected with the left crank arm. In the particular stride path shown in FIGS. 3D and 3A, the left cam roller does not move along the length of the left cam surface.

As previously mentioned, a user can vary his stride length while using the exercise device. More particularly, a user of the exercise device during more rigorous exercise can lengthen his stride by applying additional force to the foot pads, because the cam links are connected with the crank arms through cam rollers in rolling engagement with cam surfaces of the cam links, i.e., the cam links are not pivotally connected in fixed relation to the crank arms. Forces applied to the foot pads are translated from the foot links to the cam links through the cam link pivots, which can cause the cam links to move relative to the crank arms by causing the cam rollers to roll along the length of the cam surface.

In one example, a comparison of FIGS. 3A-3D with FIGS. 4A-4D illustrates orientations of the linkages associated with a user dynamically changing the movement of linkage assemblies to accommodate a lengthened stride, such as during more vigorous exercise. As described above, FIGS. 3A-3D illustrate the relative movements of the linkage components for the exercise device as the crank arms (150, 148) complete one full rotation while cam rollers (152, 154) stay near the midpoint of the cam surfaces. An ellipse 216 shown in dash in FIGS. 3A-3D represents the foot path of the right foot pad 186 as the crank arms complete one full rotation. FIGS. 4A-4D illustrate the relative movements of the linkage components for the exercise device as the crank arms complete one full rotation while the user extends his stride length when the crank arms are in the forward and rearward orientations. An ellipse 218 shown in dash in FIGS. 4A-4D represents the foot path of the right foot pad 186 as the crank arms complete one full rotation. A longer user stride in FIGS. 4A-4D is illustrated by comparing the foot path 218 shown in FIGS. 4A-4D with the foot path 216 shown in FIGS. 3A-3D. The oblong shape of the foot path 218 is accentuated in FIGS. 4A-4D as it stretches further in both forward and rearward horizontal directions than the foot path 216 shown in FIGS. 3A-3D.

Figure 4A:
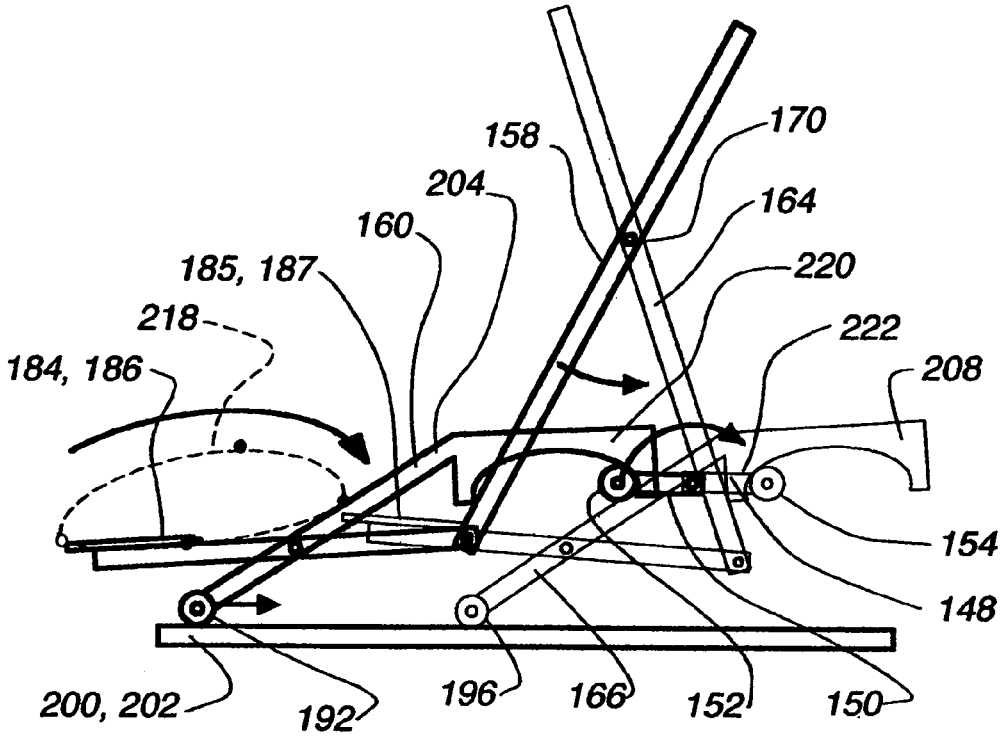
FIG. 4A is a right side schematic view of the exercise device depicted in FIGS. 1A-1B showing a right crank arm in about a 9 o'clock or rearward orientation and the right cam roller located at a forward position on the right cam member.
Figure 4B:
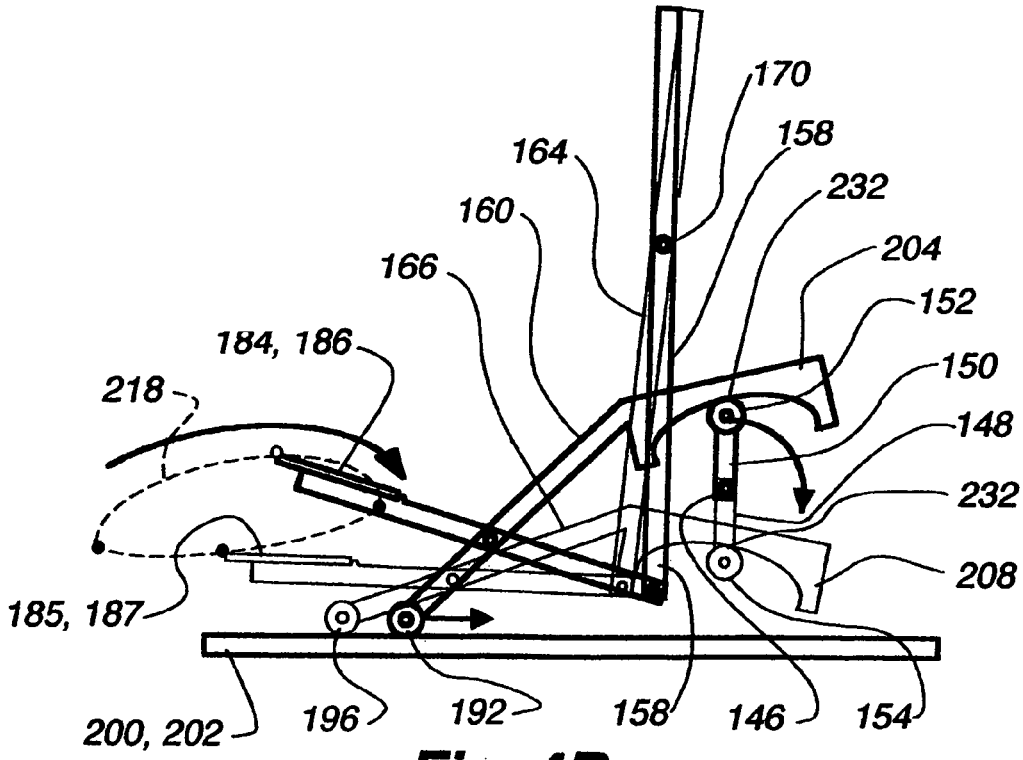
FIG. 4B is a right side schematic view of the exercise device depicted in FIGS. 1A-1B showing the right crank arm in about a 12 o'clock or upper orientation and the right cam roller located at about the mid-point of a cam member.

As shown in FIGS. 3A and 4A, the right crank arm 150 is in a rearward orientation. As discussed above, in FIG. 3A, the right and left cam rollers (152, 154) are located near or at the midpoint or apex 232 of cam surfaces of the right and left cam members (204, 208), respectively, such as when a user is exercising at a low exertion level. In contrast, in FIG. 4A, the right cam roller 152 is engaged with the downwardly extending portion of the cam surface located near a forward end 220 of the right cam member 204, such as during vigorous exercise. As such, the right cam link 160, the right cam link pivot 188, and the right foot link 162 in FIG. 4A are located in positions rearward of that which is illustrated in FIG. 3A. In FIG. 4A, the left cam roller 154 is engaged with the downwardly extending portion of the cam surface located near a rearward end 222 of the left cam member 208. As such, the left cam link 166, the left cam link pivot 190, and the left foot link 168 in FIG. 4A are located in positions forward of that which is illustrated in FIG. 3A. Therefore, the foot pads (186, 187) illustrated in FIG. 4A are separated by a greater distance than the foot pads illustrated in FIG. 3A, which equates to a longer user stride length in illustrated in FIG. 4A than in FIG. 3A for the same crank arm orientation.

Figure 4C:
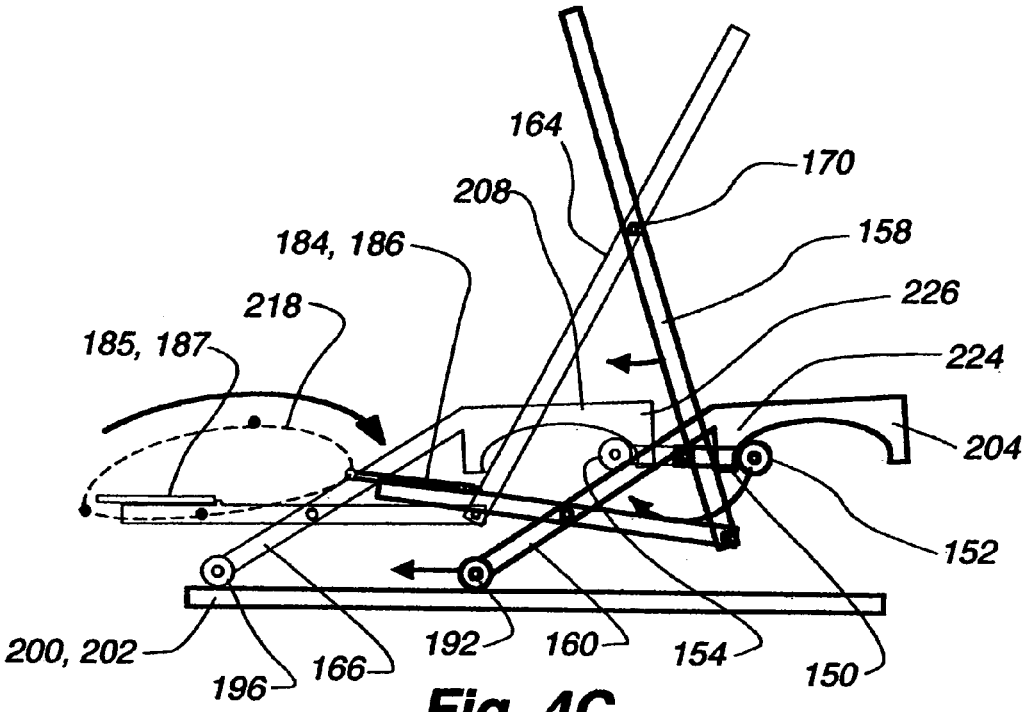
FIG. 4C is a right side schematic view of the exercise device depicted in FIGS. 1A-1B showing the right crank arm in about a 3 o'clock or forward orientation and the right cam roller located at a rearward position on the right cam member.
Figure 4D:
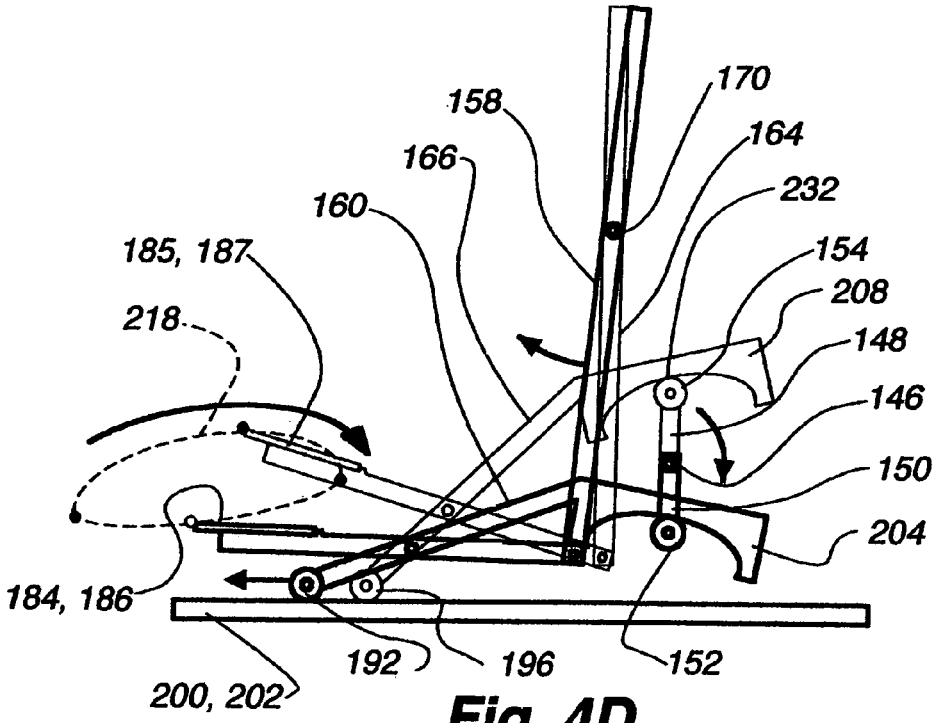
FIG. 4D is a right side schematic view of the exercise device depicted in FIGS. 1A-1B showing the right crank arm in about a 6 o'clock or lower orientation and the right cam roller located at about the mid-point of the cam member.

Similarly, as shown in FIGS. 3C and 4C, the right crank arm 150 is in a forward orientation. In FIG. 3C, the right and left cam rollers (152, 154) are located near or at the midpoint or apex 232 of cam surfaces of the right and left cam members (204, 208), respectively, such as when a user is exercising at a low exertion level. In contrast, in FIG. 4C, the right cam roller 152 is engaged with the downwardly extending portion of the cam surface located near a rearward end 224 of the right cam member 204, such as during vigorous exercise. As such, the right cam link 160, the right cam link pivot 188, and the right foot link 162 in FIG. 4C are located in positions forward of that which is illustrated in FIG. 3C. In FIG. 4C, the left cam roller 154 is engaged with the downwardly extending portion of the cam surface located near a forward end 226 of the left cam member 208. As such, the left cam link 166, the left cam link pivot 190, and the left foot link 168 in FIG. 4C are located in positions rearward of that which is illustrated in FIG. 3C. Therefore, the foot pads (186, 187) illustrated in FIG. 4C are separated by a greater distance than the foot pads illustrated in FIG. 3C, which equates to a longer user stride length in FIG. 4C than in FIG. 3C for the same crank arm orientation.

It is to be appreciated that the user may vary is stride length by varying amounts at any crank arm orientation. For example, a comparison of FIGS. 3A-3D with FIGS. 5A-5D illustrates orientations of the linkages associated with a user dynamically lengthening his stride in a rearward direction. A longer user stride in the rearward direction shown in FIGS. 5A-5D is illustrated by comparison to a foot path 228 shown in dash in FIGS. 5A-5D with the foot path 216 shown in FIGS. 3A-3D. The oblong shape of the foot path 228 is accentuated in FIGS. 5A-5D as it stretches further in the rearward horizontal direction than the foot path 216 shown in FIGS. 3A-3D.

Figure 5A:
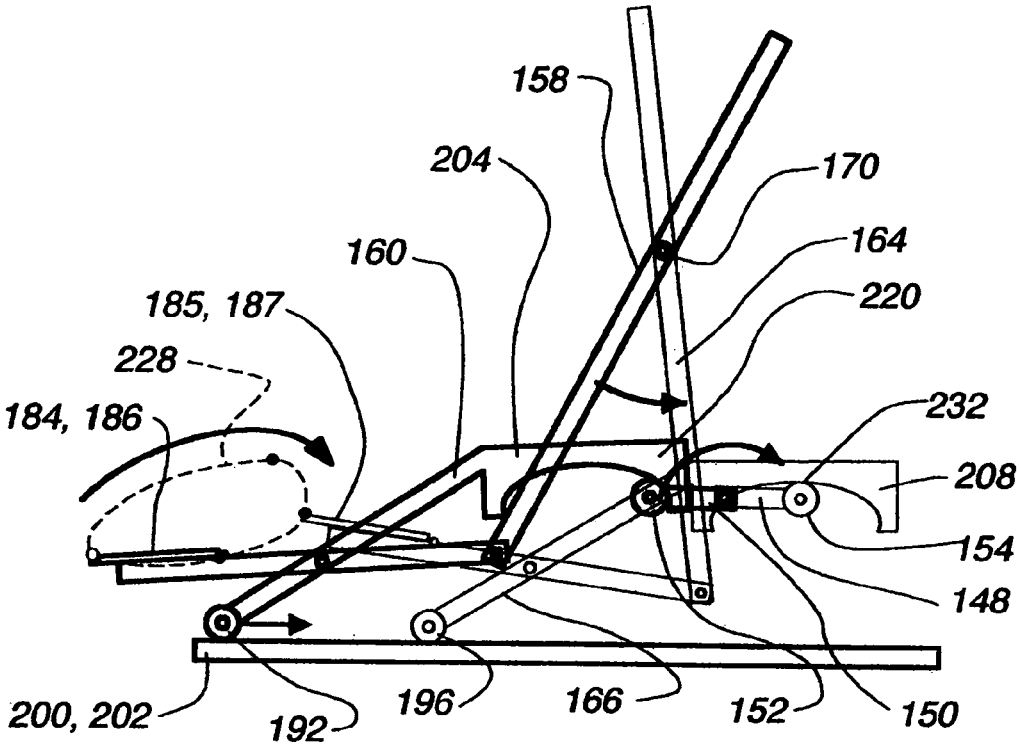
FIG. 5A is a right side schematic view of the exercise device depicted in FIGS. 1A-1B showing the right crank arm in about a 9 o'clock or rearward orientation and the right cam roller located at a forward position on the right cam member.
Figure 5B:
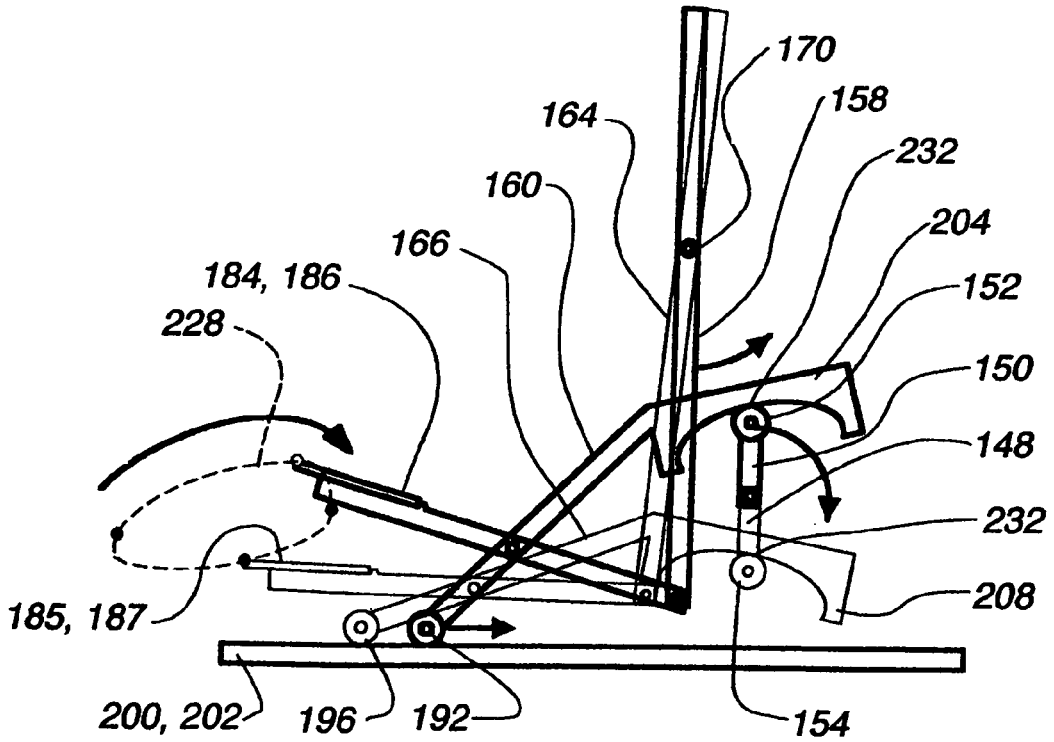
FIG. 5B is a right side schematic view of the exercise device depicted in FIGS. 1A-1B showing the right crank arm in about a 12 o'clock or upper orientation and the right cam roller located at about the mid-point of a cam member.

As shown in FIGS. 3A and 5A, the right crank arm 150 is in a rearward orientation. As discussed above, in FIG. 3A, the right and left cam rollers (152, 154) are located near or at the midpoint or apex of cam surfaces of the right and left cam members (204, 208), respectively. In contrast, in FIG. 5A, the right cam roller 152 is engaged with the downwardly extending portion of the cam surface located near the forward end 220 of the right cam member 204. As such, the right cam link 160, the right cam link pivot 188, and the right foot link 162 in FIG. 5A are located in positions rearward of that which is illustrated in FIG. 3A. As shown in FIG. 5A, the left cam roller 154 is similarly engaged the cam surface of the left cam member 208 as depicted in FIG. 3A. Therefore, the foot pads (186, 187) illustrated in FIG. 5A are separated by a greater distance than the foot pads illustrated in FIG. 3A, due to the rearward positioning of the right foot pad 187 in FIG. 5A.

Figure 5C:
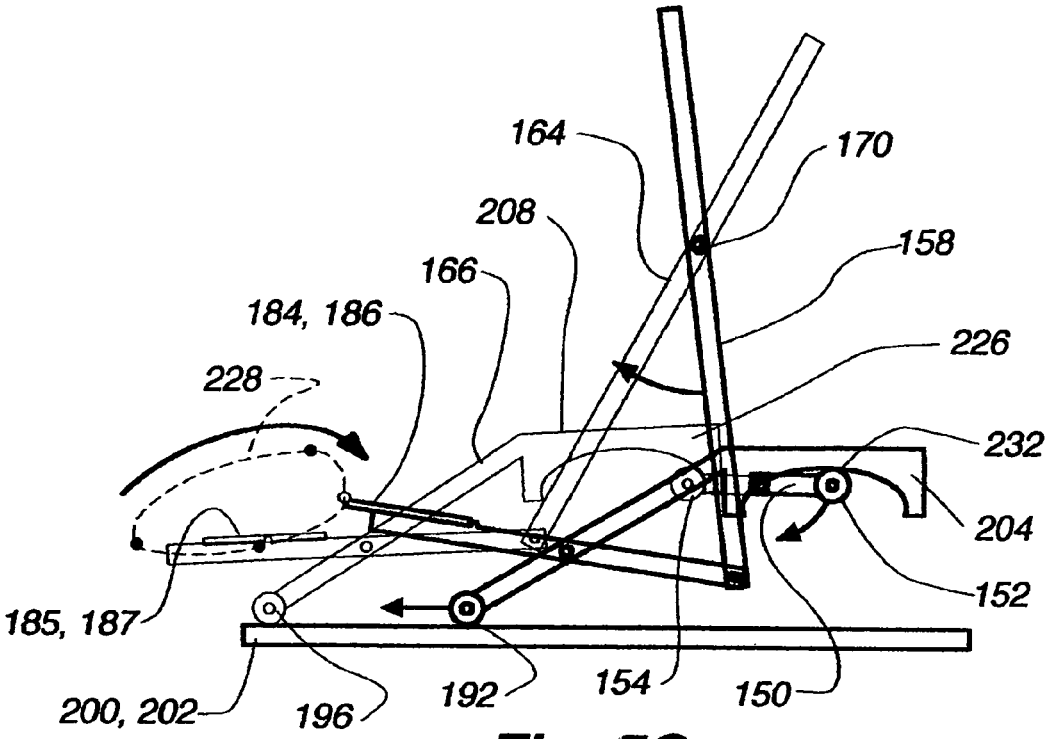
FIG. 5C is a right side schematic view of the exercise device depicted in FIGS. 1A-1B showing the right crank arm in about a 3 o'clock or forward orientation and the right cam roller located at about the mid-point of the cam member.
Figure 5D:
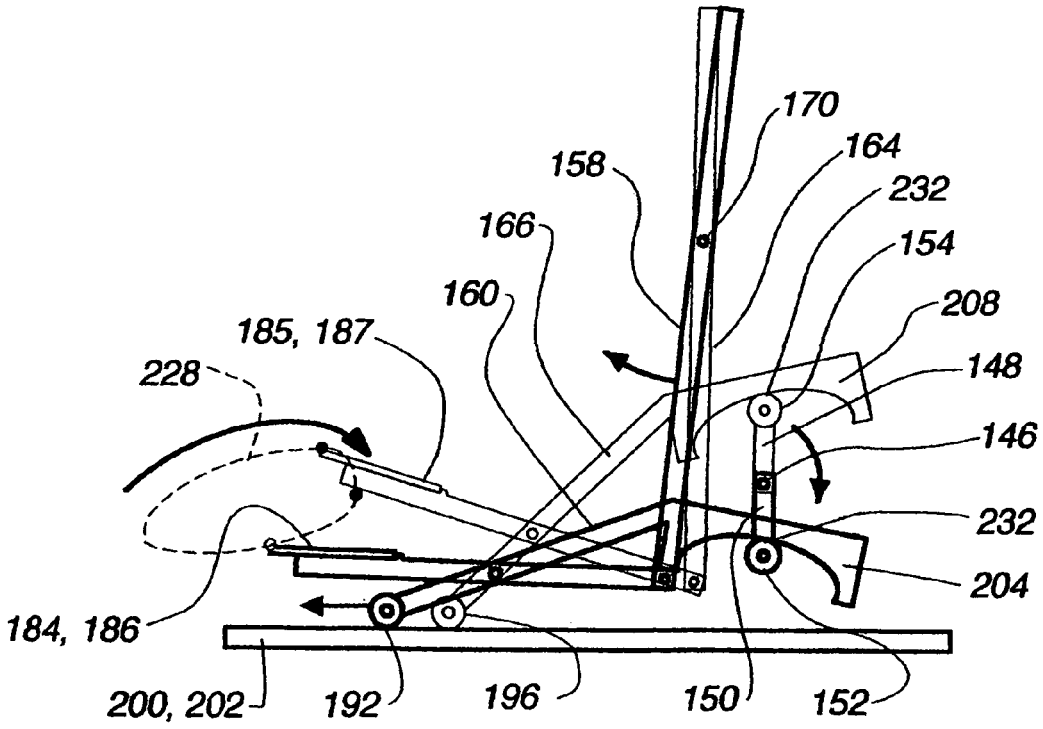
FIG. 5D is a right side schematic view of the exercise device depicted in FIGS. 1A-1B showing the right crank arm in about a 6 o'clock or lower orientation and the right cam roller located at about the mid-point of the cam member.

Similarly, as shown in FIGS. 3C and 5C, the right crank arm 150 is in a forward orientation. In FIG. 3C, the right and left cam rollers (152, 154) are located near or at the midpoint or apex 232 of cam surfaces of the right and left cam members (204, 208), respectively. In contrast, in FIG. 5C, the left cam roller 154 is engaged with the downwardly extending portion of the cam surface located near the forward end 226 of the left cam member 208. As such, the left cam link 166, the left cam link pivot 190, and the left foot link 168 in FIG. 5C are located in positions rearward of that which is illustrated in FIG. 3C. As shown in FIG. 5C, the right cam roller 152 is similarly engaged with the cam surface of the right cam member 204 as depicted in FIG. 3C. Therefore, the foot pads (186, 187) illustrated in FIG. 5C are separated by a greater distance than the foot pads illustrated in FIG. 3C, due to the rearward positioning of the left foot pad 187 in FIG. 5C.

In yet another example, a comparison of FIGS. 3A-3D with FIGS. 6A-6D illustrates orientations of the linkages associated with a user dynamically lengthening his stride in a forward direction. A longer user stride in the rearward direction shown in FIGS. 6A-6D is illustrated by comparison to a foot path 230 shown in dash in FIGS. 6A-6D with the foot path shown in FIGS. 3A-3D. The oblong shape of the foot path 230 is accentuated in FIGS. 6A-6D as it stretches further in the forward horizontal direction than the foot path 216 shown in FIGS. 3A-3D.

Figure 6A:
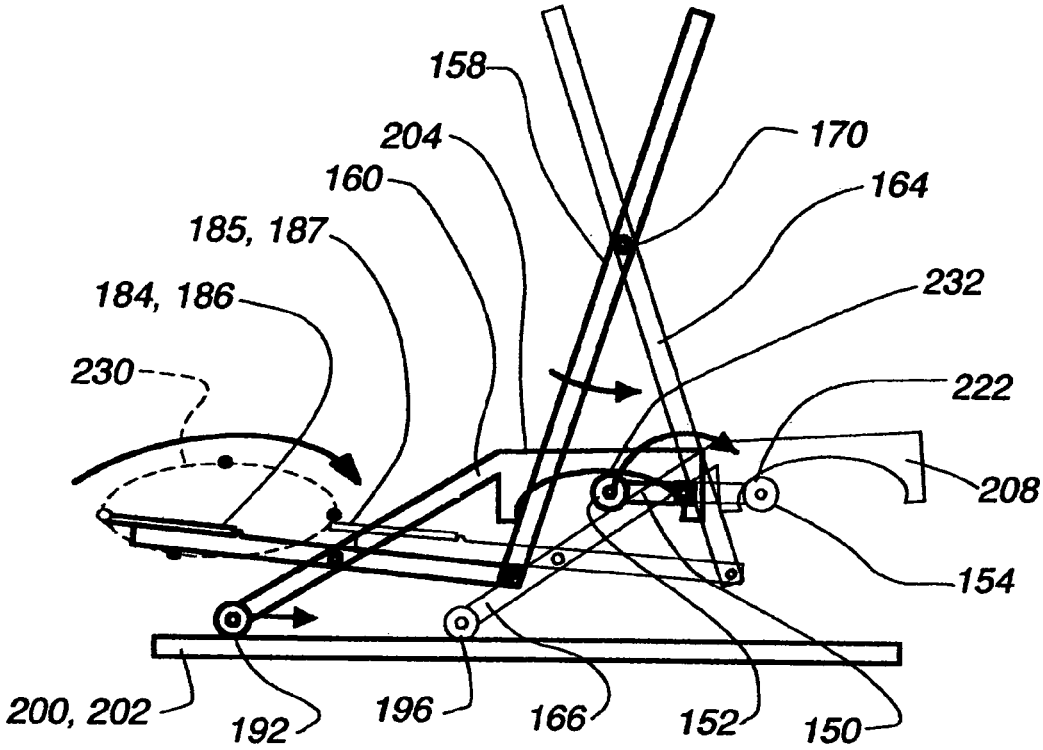
FIG. 6A is a right side schematic view of the exercise device depicted in FIGS. 1A-1B showing the right crank arm in about a 9 o'clock or rearward orientation and the right cam roller located at about the mid-point of the cam member.
Figure 6B:
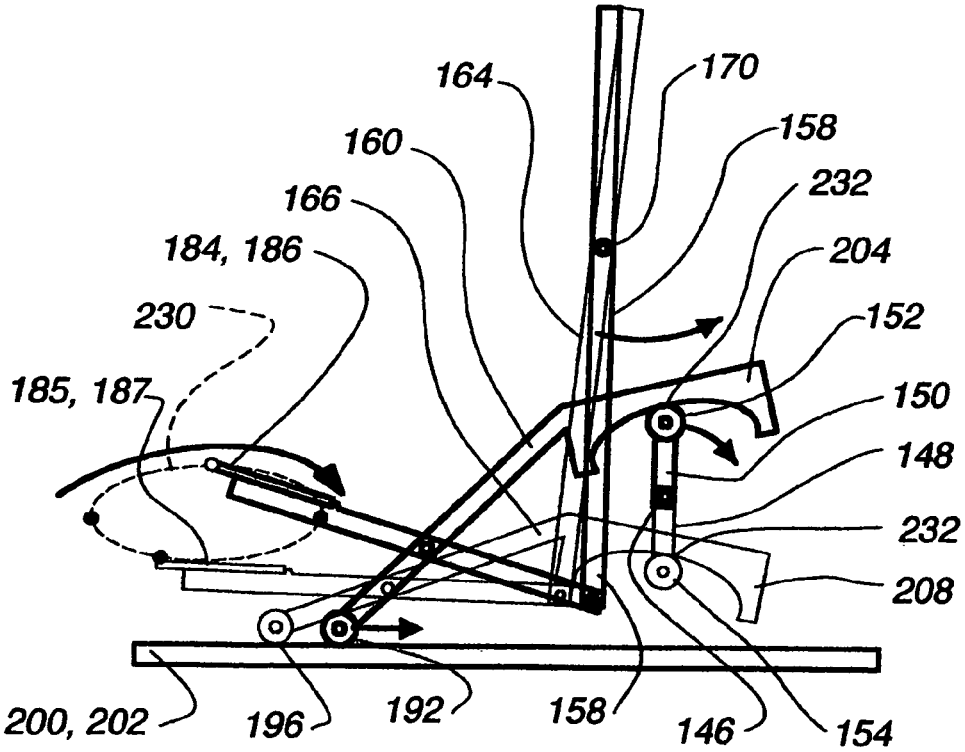
FIG. 6B is a right side schematic view of the exercise device depicted in FIGS. 1A-1B showing the right crank arm in about a 12 o'clock or upper orientation and the right cam roller located at about the mid-point of a cam member.

As shown in FIGS. 3A and 6A, the right crank arm 150 is in a rearward orientation. As discussed above, in FIG. 3A, the right and left cam rollers (152, 154) are located near or at the midpoint or apex 232 of cam surfaces of the right and left cam members (204, 208), respectively. In contrast, in FIG. 6A, the left cam roller 154 is engaged with the downwardly extending portion of the cam surface located near the rearward end 222 of the left cam member 208. As such, the left cam link 166, the left cam link pivot 190, and the left foot link 168 in FIG. 6A are located in positions forward of that which is illustrated in FIG. 3A. As shown in FIG. 6A, the right cam roller 152 is similarly engaged with the cam surface of the right cam member 204 as depicted in FIG. 3A. Therefore, the foot pads (186, 187) illustrated in FIG. 6A are separated by a greater distance than the foot pads illustrated in FIG. 3A, due to the forward positioning of the left foot pad 187 in FIG. 6A.

Figure 6C:
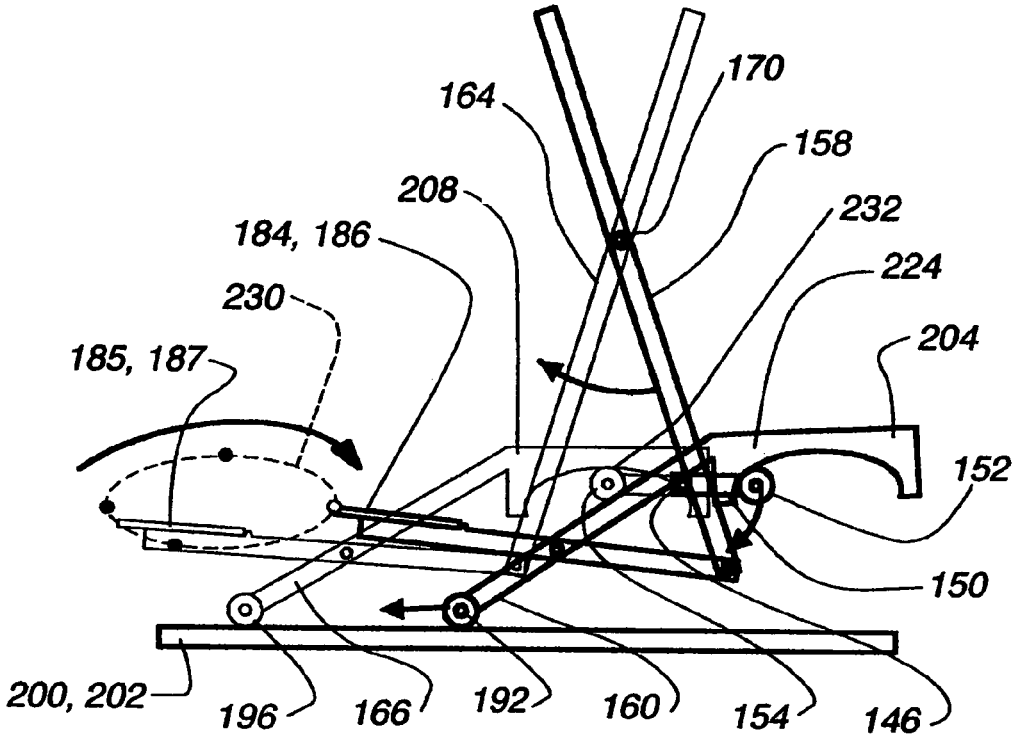
FIG. 6C is a right side schematic view of the exercise device depicted in FIGS. 1A-1B showing the right crank arm in about a 3 o'clock or forward orientation and the right cam roller located at a rearward position on the right cam member.
Figure 6D:
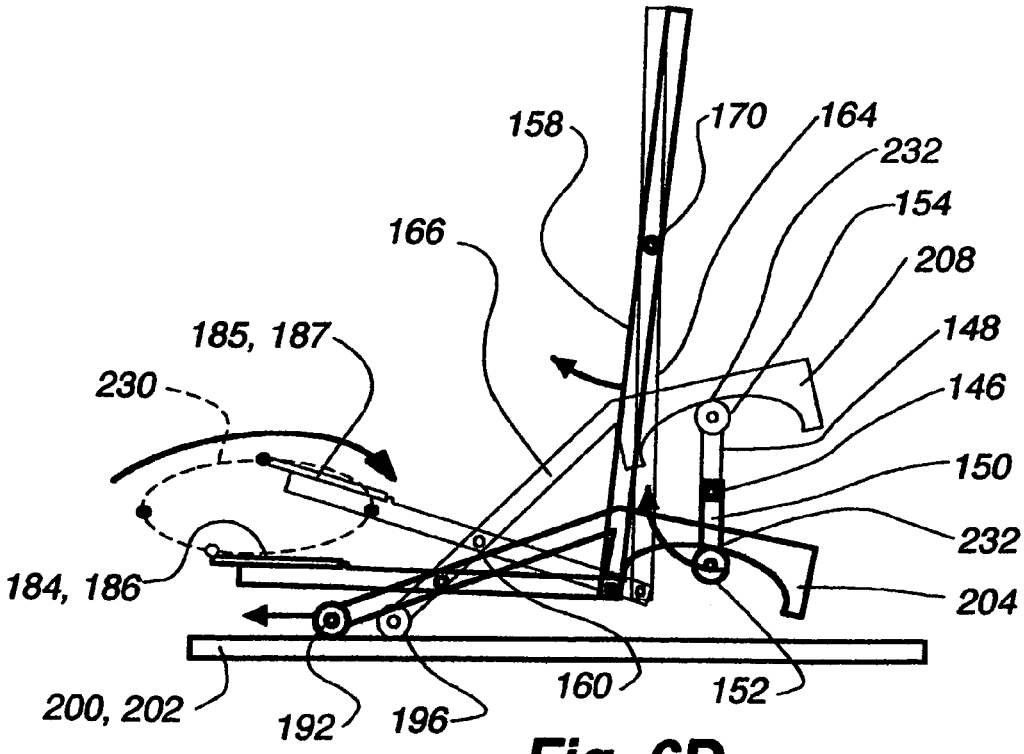
FIG. 6D is a right side schematic view of the exercise device depicted in FIGS. 1A-1B showing the right crank arm in about a 6 o'clock or lower orientation and the right cam roller located at about the mid-point of the cam member.
Figure 7A:
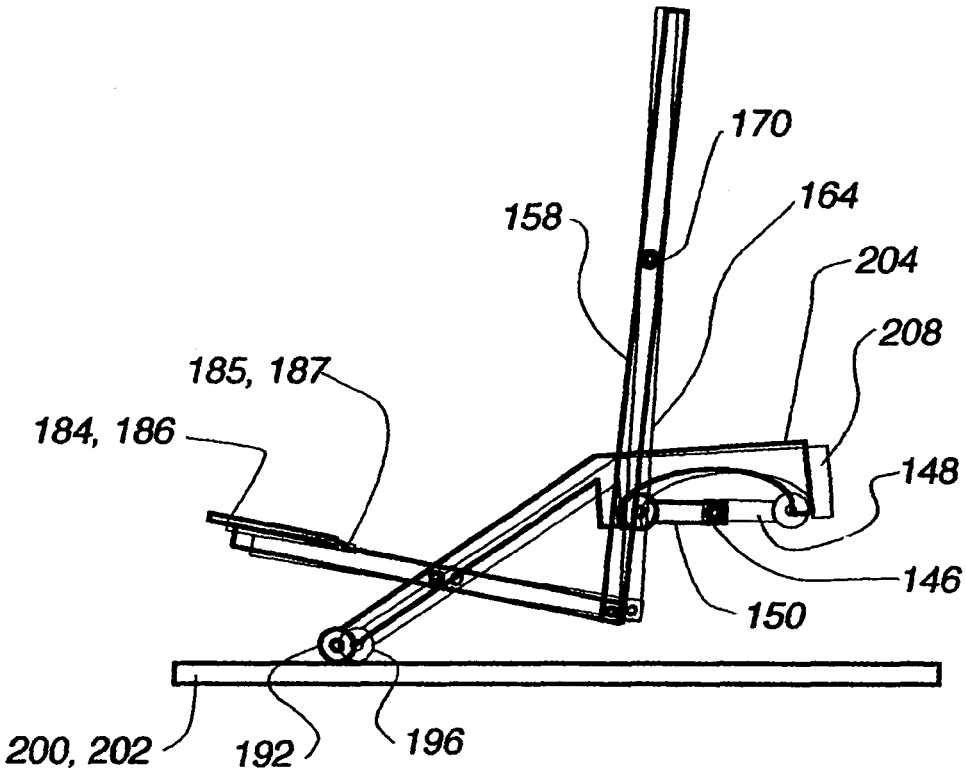
FIG. 7A is a right side schematic view of the exercise device depicted in FIGS. 1A-1B showing the right crank arm in about a 9 o'clock orientation with the right cam roller located at a rearward position on the right cam member and a left cam roller located at a forward position on a left cam member.
Figure 7B:
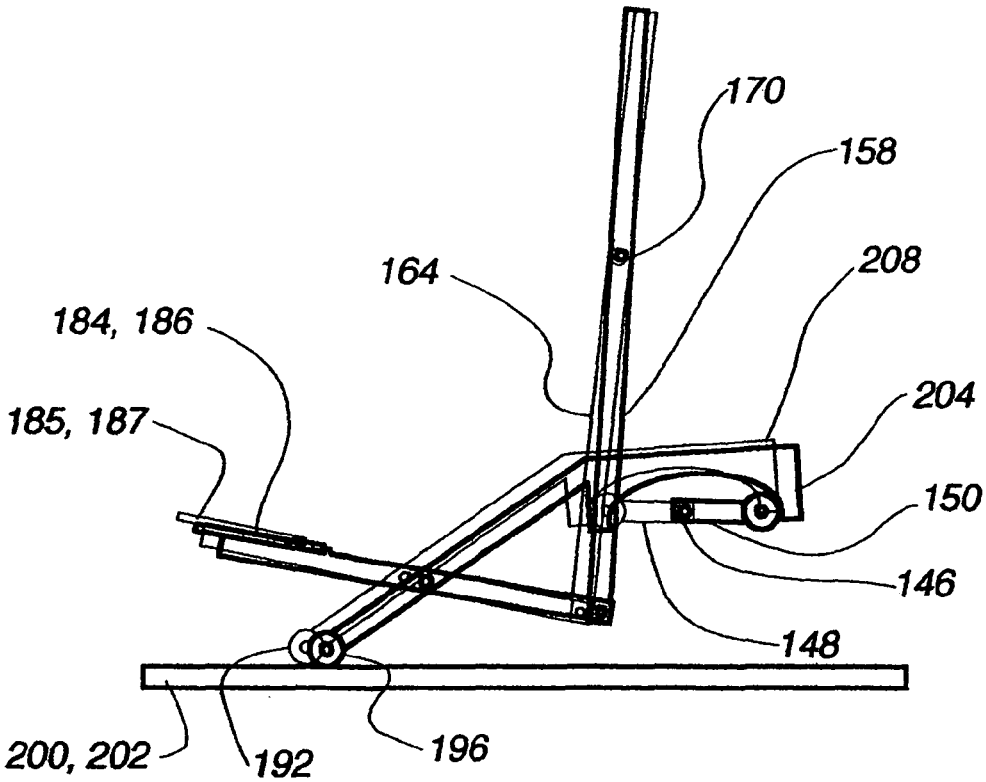
FIG. 7B is a right side schematic view of the exercise device depicted in FIGS. 1A-1B showing the right crank arm in about a 3 o'clock orientation with the right cam roller located at a forward position on the right cam member and the left cam roller located at a rearward position on the left cam member.
Figure 7C:
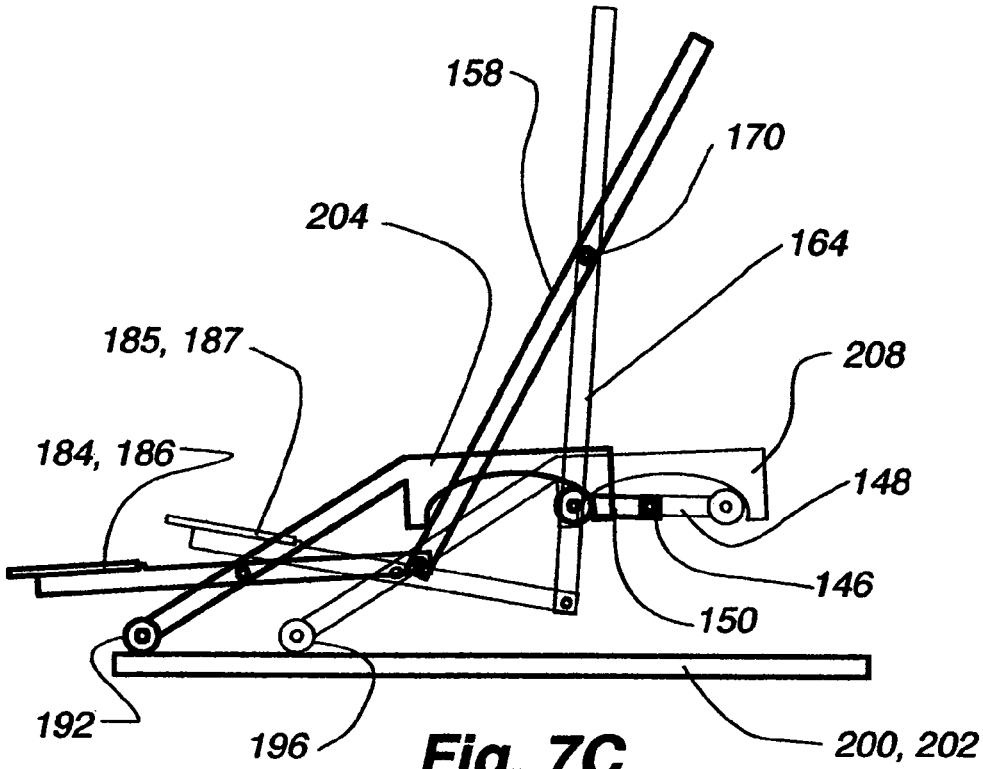
FIG. 7C is a right side schematic view of the exercise device depicted in FIGS. 1A-1B showing the right crank arm in about a 9 o'clock orientation with the right cam roller located at a forward position on the right cam member and the left cam roller located at a forward position on the left cam member.
Figure 7D:
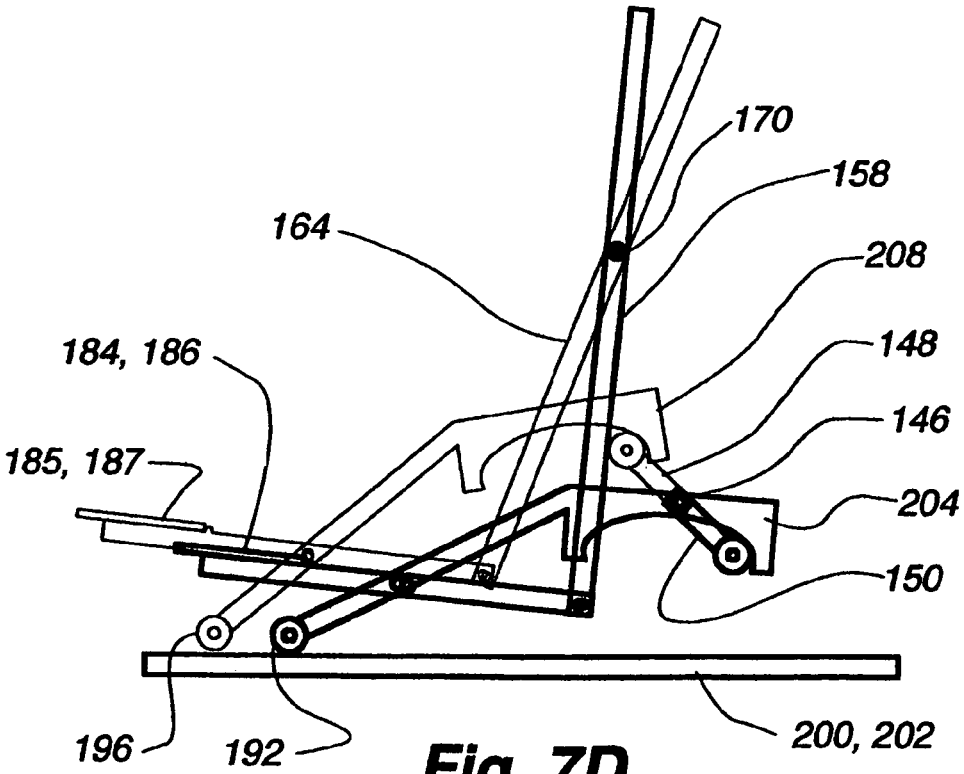
FIG. 7D is a right side schematic view of the exercise device depicted in FIGS. 1A-1B showing the right crank arm in about a 4 o'clock orientation with the right cam roller located at a forward position on the right cam member and the left cam roller located at a forward position on the left cam member.
Figure 7E:
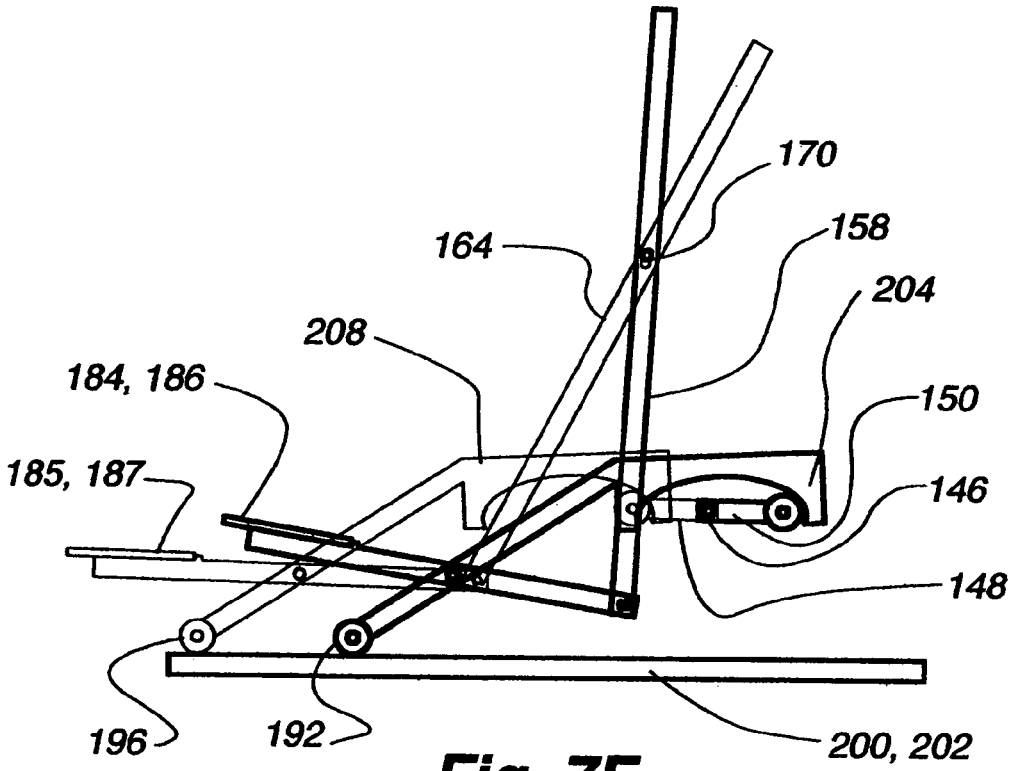
FIG. 7E is a right side schematic view of the exercise device depicted in FIGS. 1A-1B showing the right crank arm in about a 3 o'clock orientation with the right cam roller located at a forward position on the right cam member and the left cam roller located at a forward position on the left cam member.
Figure 7F:
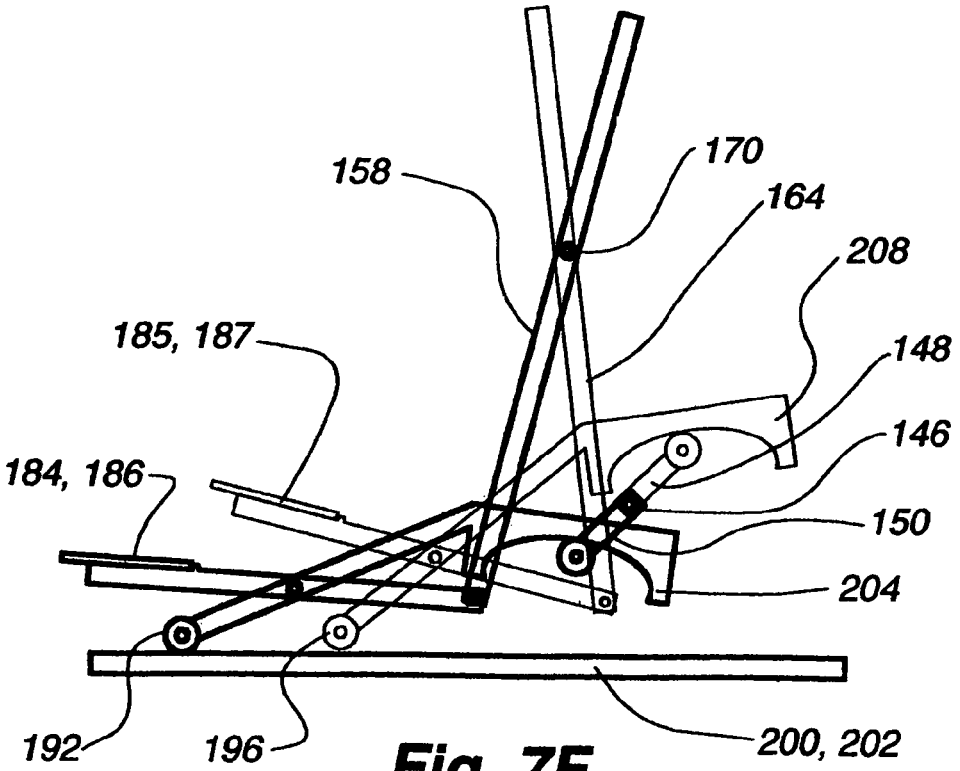
FIG. 7F is a right side schematic view of the exercise device depicted in FIGS. 1A-1B showing the right crank arm in about a 7 o'clock orientation with the right cam roller located at a mid-position on the right cam member and the left cam roller located at a mid-position on the left cam member.
Figure 7G:
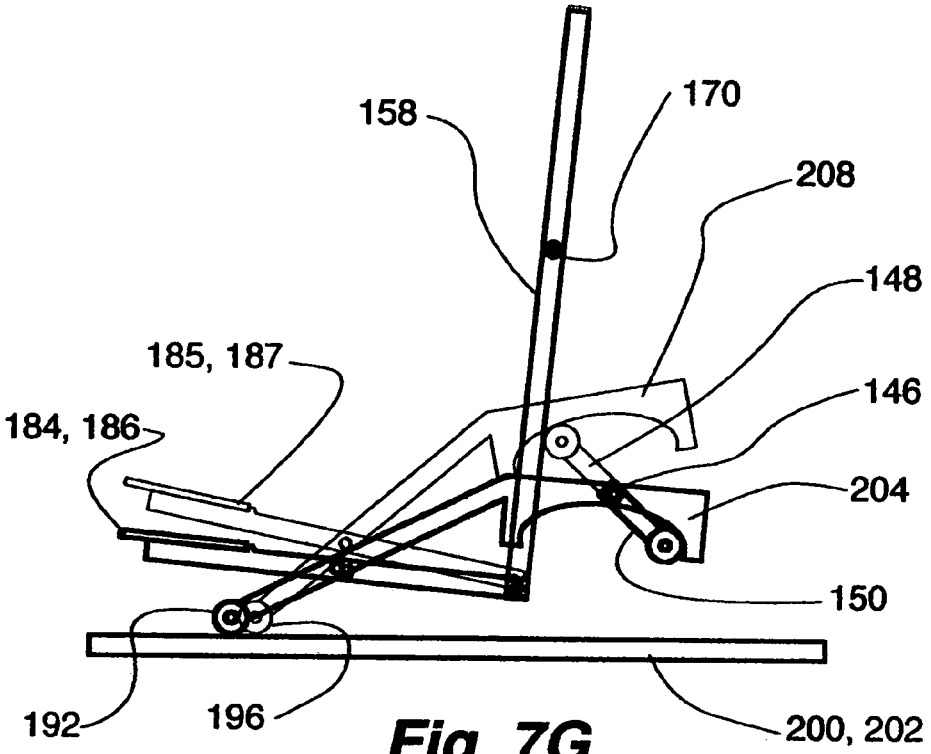
FIG. 7G is a right side schematic view of the exercise device depicted in FIGS. 1A-1B showing the right crank arm in about a 4 o'clock orientation with the right cam roller located at a forward position on the right cam member and the left cam roller located at a mid-rearward position on the left cam member.
Figure 7H:
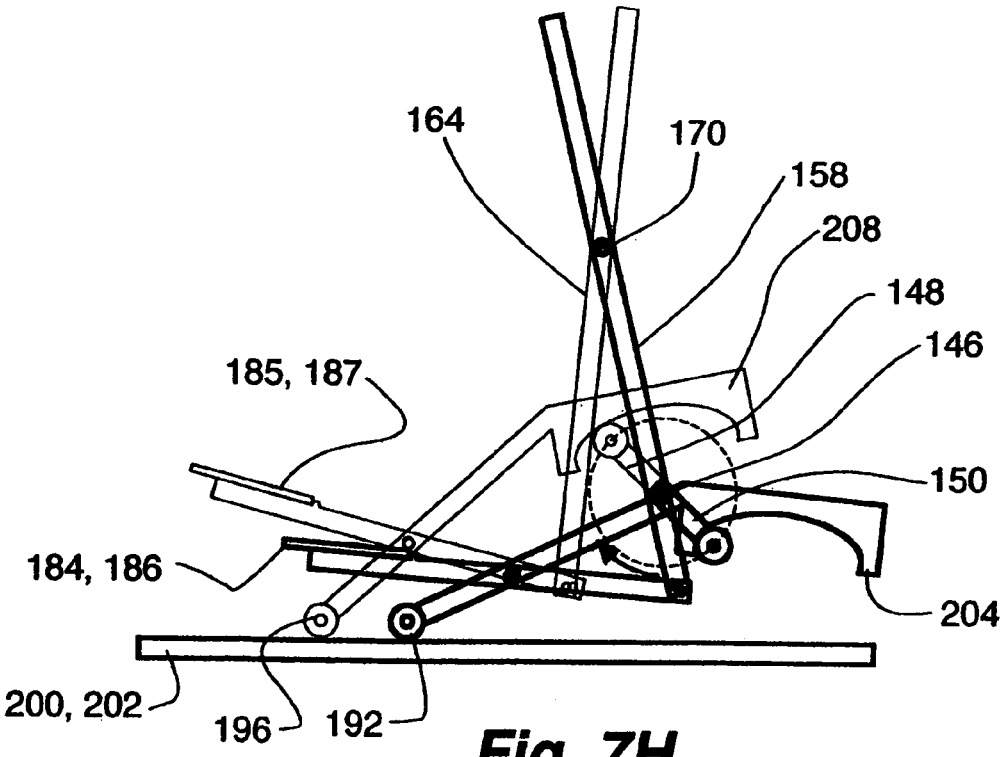
FIG. 7H is a right side schematic view of the exercise device depicted in FIGS. 1A-1B showing the right crank arm in about a 4 o'clock orientation with the right cam roller located at a rearward position on the right cam member and the left cam roller located at a mid-rearward position on the left cam member.
Figure 7I:
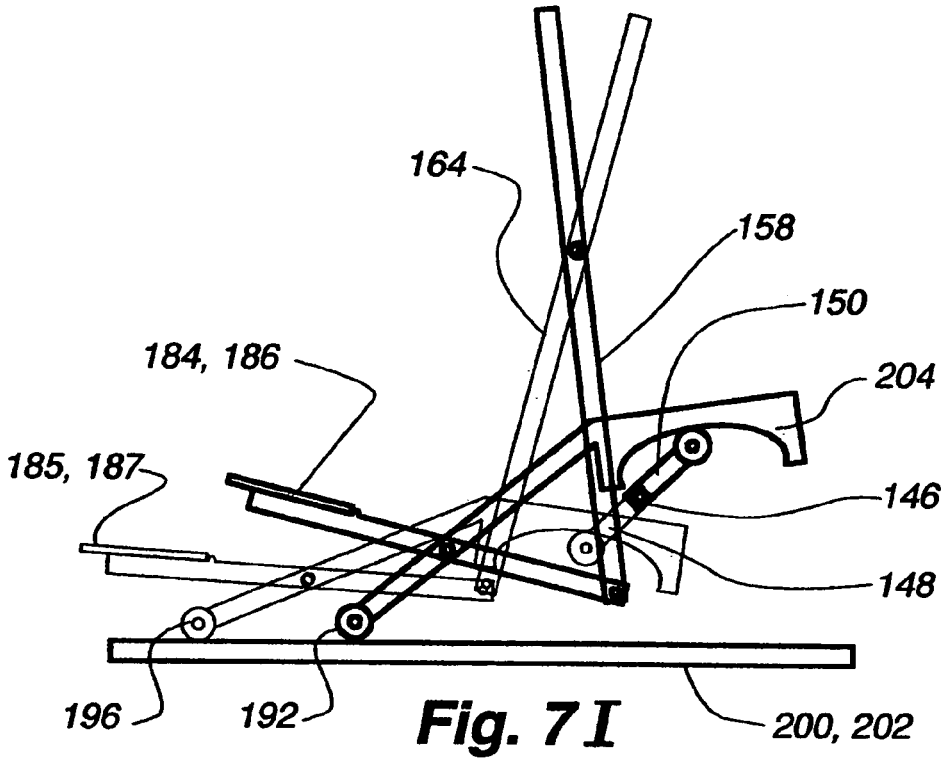
FIG. 7I is a right side schematic view of the exercise device depicted in FIGS. 1A-1B showing the right crank arm in about a 2 o'clock orientation with the right cam roller located at a mid-position on the right cam member and the left cam roller located at a mid-position on the left cam member.
Figure 7J:
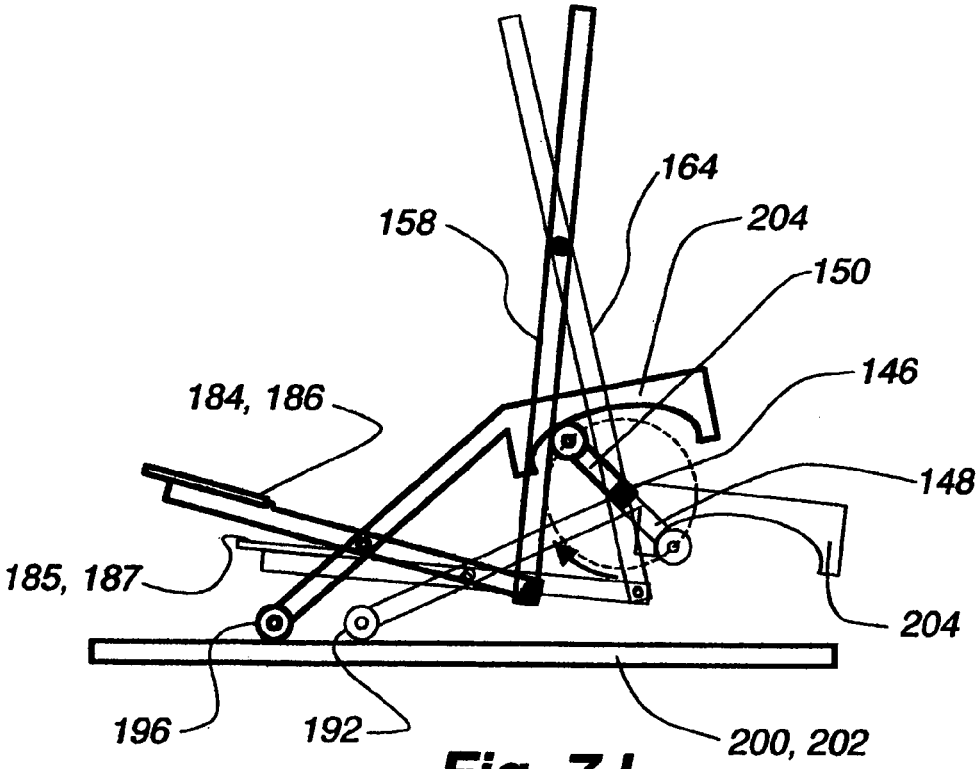
FIG. 7J is a right side schematic view of the exercise device depicted in FIGS. 1A-1B showing the right crank arm in about a 10 o'clock orientation with the right cam roller located at a mid-rearward position on the right cam member and the left cam roller located at a rearward position on the left cam member.

Similarly, as shown in FIGS. 3C and 6C, the right crank arm 150 is in a forward orientation. In FIG. 3C, the right and left cam rollers (152, 154) are located near or at the midpoint or apex 232 of cam surfaces 152 of the right and left cam members (204, 208), respectively. In contrast, in FIG. 6C, the right cam roller 152 is engaged with the downwardly extending portion of the cam surface located near the rearward end 224 of the right cam member 204. As such, the right cam link 160, the right cam link pivot 188, and the right foot link 162 in FIG. 6C are located in positions forward of that which is illustrated in FIG. 3C. As shown in FIG. 6C, the left cam roller is similarly engaged the cam surface of the left cam member as depicted in FIG. 3C. Therefore, the foot pads illustrated in FIG. 6C are separated by a greater distance than the foot pads illustrated in FIG. 3C, due to the forward positioning of the right foot pad in FIG. 6C.

FIGS. 7A-7J further illustrate various examples of linkage component orientations that may occur during use of the exercise device 100. These various component orientations may result in differently shaped foot paths for a particular user. As such, it is to be appreciated that use of the exercise device is not limited to various foot paths illustrated in the accompanied figures. As previously mentioned, the user can dynamically adjust the travel path of the of the foot engaging portions while using the exercise device based on the user's natural stride length, stride power, and stride rate, which can result in numerous and varying types of foot paths for a particular user.

People naturally vary their stride during exercise. An exercise device conforming to the present invention accommodates these natural stride variations without forcing a user into a fixed stride length and shape. As discussed above, when a user varies his stride length while using the exercise device, the distance in which the cam members (204, 206) move along the cam rollers (152, 154) also varies along with the distance the guide rollers (192, 196) move along the rails (202, 200). For example, as the user increases his stride length, the distance that the cam members pass over the cam rollers increases. Moreover, the distance that the guide rollers move along the rails also increases.

The contour shapes, lengths, and orientations of the cam surfaces 214 and rails (202, 200) can affect the forces required to provide a variable stride as well as the forces required to move the cam links (160, 166) with respect to the cam rollers (152, 154). For example, if the radii defining the cam surfaces 214 are increased, it will require less force to move the cam link relative to the crank arm, and thus, less force to vary user stride. In contrast, if the radii defining the cam surfaces are decreased, it will require greater force to move the cam links relative to the crank arms, and thus, greater force to vary user stride. If the radii defining the cam surfaces are decreased at the forward and rearward ends of the cam surfaces with a greater radii between the ends, for example, then the amount of force required to move the cam link at the ends of the cam surface will be greater than moving it along the greater radii areas. In addition, longer cam surfaces will allow a user to dynamically increase his stride length over greater distances.

As shown in FIGS. 1A-2, the exercise device 100 may also include lever arms (234, 236) connected with or integral to the swing links (158, 164). The lever arms provide an extra gripping surface for the user as well as allowing the user to complement his use of the exercise device with an upper body workout. The lever arms (234, 236) extend from the respective swing links (158, 164) at the location of the upper pivot 170 to provide hand grips for a user of the exercise device. The lever arms form rigid mechanical extensions of the swing links, and rotate about the upper pivot. In operation, the user of the exercise machine grips one of lever arms in each of his left and right hands, and pulls or pushes on the lever arms in coordination with the rearwardly and forwardly movement of the foot links (162, 168). Thus, forward movement of the lever arms above the upper pivot is accompanied by rearward movement of the swing arm below the upper pivot. Moreover, as the lever arms impact a force on the foot links, the forces from the lever arms may also act to cause a variation in the stride path.

As previously mentioned, an exercise device conforming to the present invention may include an interconnection assembly that causes the components of the right and left linkage assemblies to move in opposite directions relative to each other. Such an interconnection assembly is not necessary. The interconnection assemblies disclosed herein and variations thereof can be used with any embodiments of the exercise device disclosed herein. It is to be appreciated that these interconnection assemblies may be configured differently, and should not be limited to the configurations discussed and depicted herein.

Referring back to FIGS. 1A-1B, an interconnection assembly 238 involving a cable and pulleys is shown. The interconnection assembly 238 includes a right rear pulley 240 and a left rear pulley 242 pivotally supported on a cross member 244 connected with the right rail 202 and left rail 200, and a right front pulley 246 and a left front pulley 248 pivotally supported on the right base member 118 and the left base member 120, respectively. The pulleys are generally located rearward of the rearward most position of the guide rollers (192, 196) and forward of the forward most position of the guide rollers.

A cable 250 (which may be connected sections of cable) is routed around each of the pulleys. The cable is also connected with each cam link (160, 166) near the guide rollers (192, 196). As such, forward motion of the right cam link 160 (and corresponding right linkage assembly 106) imparts a forward motion to the section of cable 250 between the right rear pulley 240 and the right front pulley 246. This in turn translates to a rearward motion to the section of cable 250 between the left rear pulley 242 and the left front pulley 248, which imparts a rearward force on the left cam link 166 (and corresponding left linkage assembly 104). Conversely, rearward motion of the right cam link 160 (and corresponding right linkage assembly) imparts a rearward motion to the section of cable between the right rear pulley 240 and the right front pulley 246. This in turn translates to a forward motion to the section of cable between the left rear pulley 242 and the left front pulley 248, which imparts a forward force on the left cam link 166 (and corresponding left linkage assembly).

Figure 8:
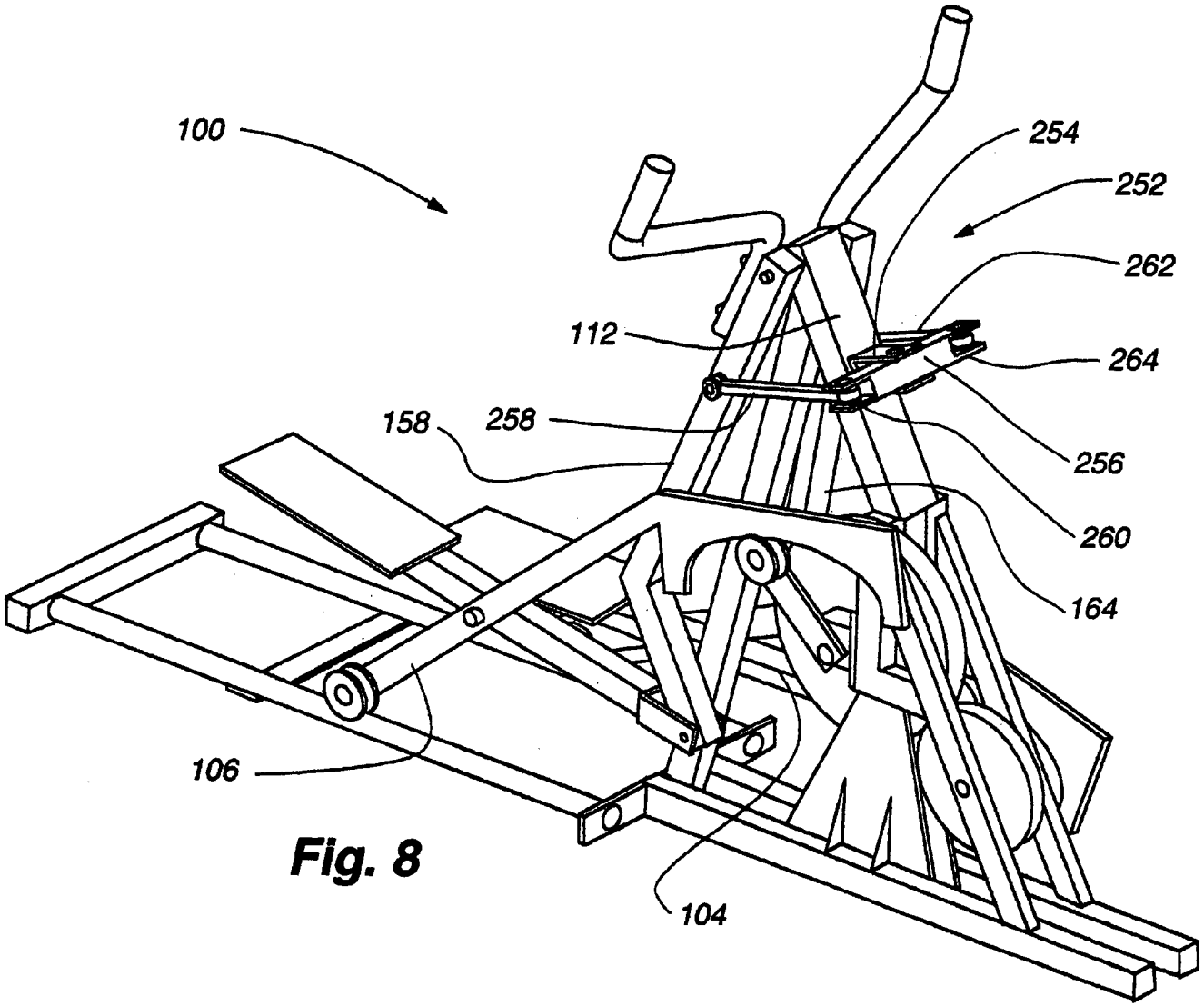
FIG. 8 is an isometric view of the variable stride exercise device depicted in FIGS. 1A-1B including a first alternative interconnection assembly.

An alternative interconnection assembly 252 is shown in FIG. 8, which includes a forward extending U-bracket 254 pivotally connected with the front post 112. A teeter member 256 is pivotally supported in the U-bracket 254 such that it extends outwardly in left and right directions from each side of the U-bracket. A right interconnecting link 256 is pivotally connected with a right side 260 of the teeter member 256 and extends from the teeter member to pivotally connect with the right swing link 158. A left interconnecting link 262 is pivotally connected with a left side 264 of the teeter member 256 and extends from the teeter member to pivotally connect with the left swing link 164. It is to be appreciated that the various pivots may be straight pin type pivots, universal joints, ball joints, and the like. Moreover, the pivots may be adapted to move laterally with respect to whatever member with which they are connected. In addition, some of the pivotal connections may be eliminated depending on the particular joint configuration used. With the interconnection assembly 252 shown in FIG. 8, forward motion of the right swing link 158 (and corresponding right linkage assembly 106) imparts a forward motion to the right interconnection link 258, which causes the teeter member 256 to pivot about the U-bracket 254. This in turn imparts a rearward motion on the left interconnection link 262, which imparts a rearward force on the left swing link 164 (and corresponding left linkage assembly 104). Conversely, rearward motion of the right swing link 158 (and corresponding right linkage assembly) imparts a rearward motion to the right interconnection link 258, which causes the teeter member 256 to pivot about the U-bracket 254. This in turn imparts a forward motion on the left interconnection link 262, which imparts a forward force on the left swing link 164 (and corresponding left linkage assembly).

Figure 9:
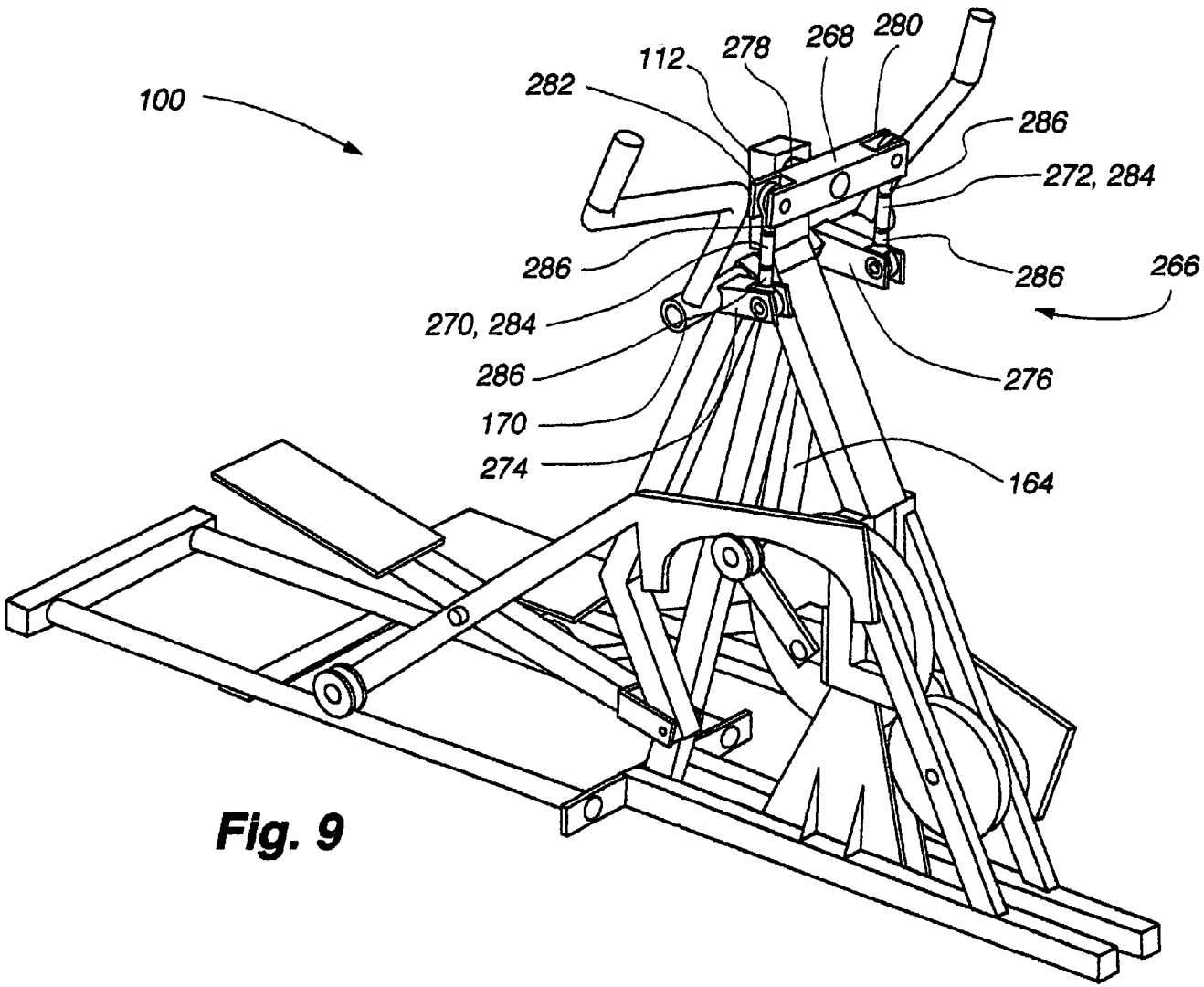
FIG. 9 is an isometric view of the variable stride exercise device depicted in FIGS. 1A-1B including a second alternative interconnection assembly.

A second alternative embodiment 266 of an interconnection assembly is illustrated in FIG. 9 and includes a teeter member 268, a right interconnection link 270, a left interconnection link 272, a right U-bracket 274, and a left U-bracket 276. A teeter axle 278 extends forwardly from the front post 112 and is adapted to pivotally support the teeter member 268. The left interconnection link 272 is pivotally connected with a left portion 280 of the teeter member 268 and extends downwardly therefrom to pivotally connect with the left U-bracket 276, which is rigidly connected with the left swing link 164 near the upper pivot 170. The right interconnecting link 272 is pivotally connected with a right portion 282 of the teeter member 268 and extends downwardly therefrom to pivotally connect with the right U-bracket 274, which is rigidly connected with the right swing link 158 near the upper pivot 170. When either of the swing links swing rearward, the associated U-bracket pivots downwardly. The downward pivot of the U-bracket causes the teeter portion connected therewith (via the interconnection link) to pivot downwardly about the teeter axle. In coordination, the other portion of the teeter pulls upwardly on the other U-bracket. The upward force on the opposite U-bracket acts to swing the opposing swing link forwardly. In this way, the motion of the swing link and other links connected thereto, is coordinated via the interconnection assembly.

As shown in FIG. 9, the right and left interconnection links (270, 272) may include a threaded member 284 adapted to receive threaded eye-bolts 286 in opposing ends. Thus, in one implementation, the interconnecting links may be considered turnbuckles, through which rotation of the threaded member may be shortened or lengthened. The eye-bolts are adapted to rotatably receive interconnection link axles. The pivotal connections between the teeter, turnbuckles, and the U-brackets may be a ball joint or a universal joint configuration, in one implementation. Although the teeter axle is connected with the front post a location above the upper pivot, it is to be appreciated that in other embodiments of the interconnection assembly, the teeter axle may be connected with the front post a location below the upper pivot, as discussed below with reference to FIG. 15.

Figure 10:
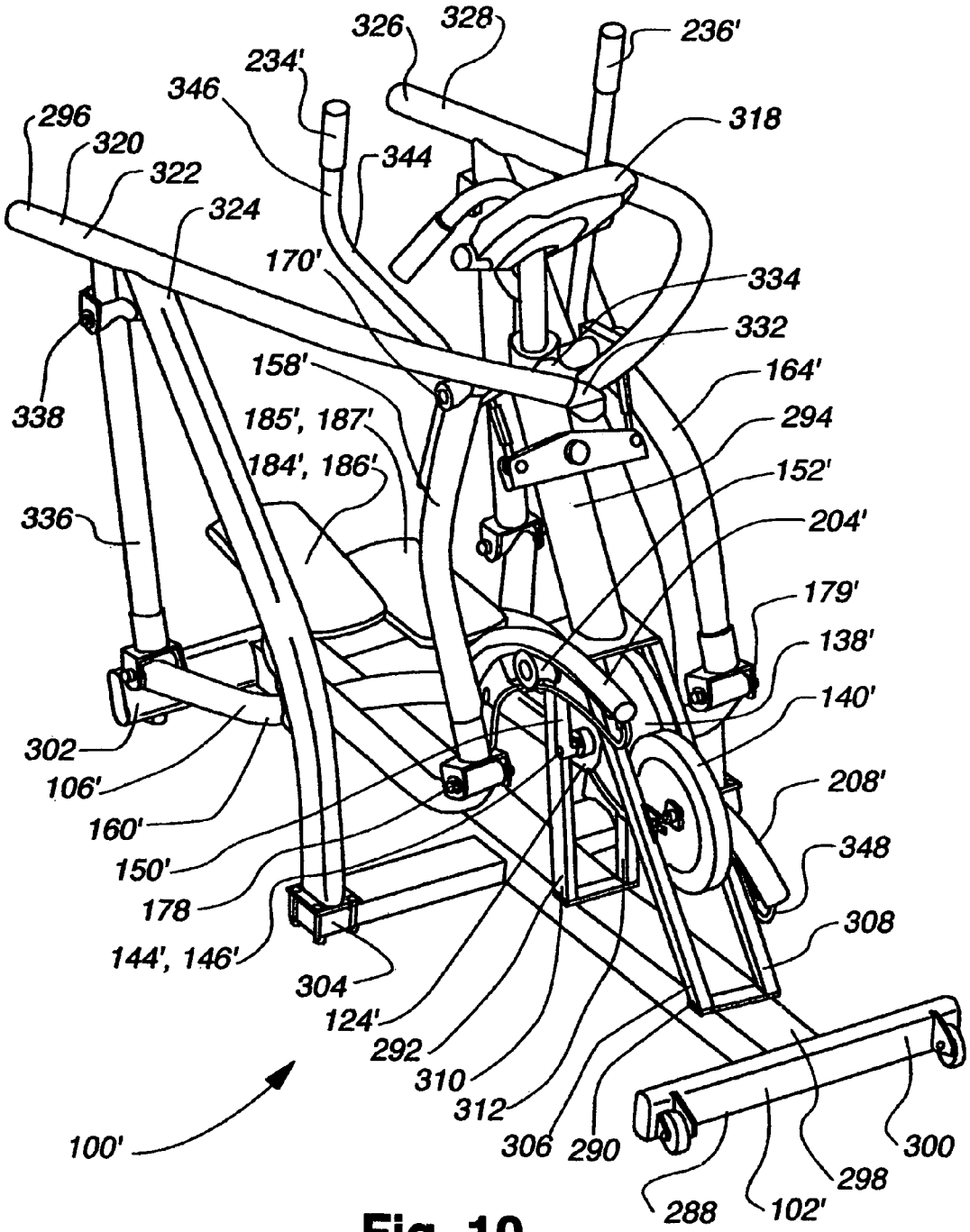
FIG. 10 is an isometric view of a second embodiment of a variable stride exercise device.
Figure 11:
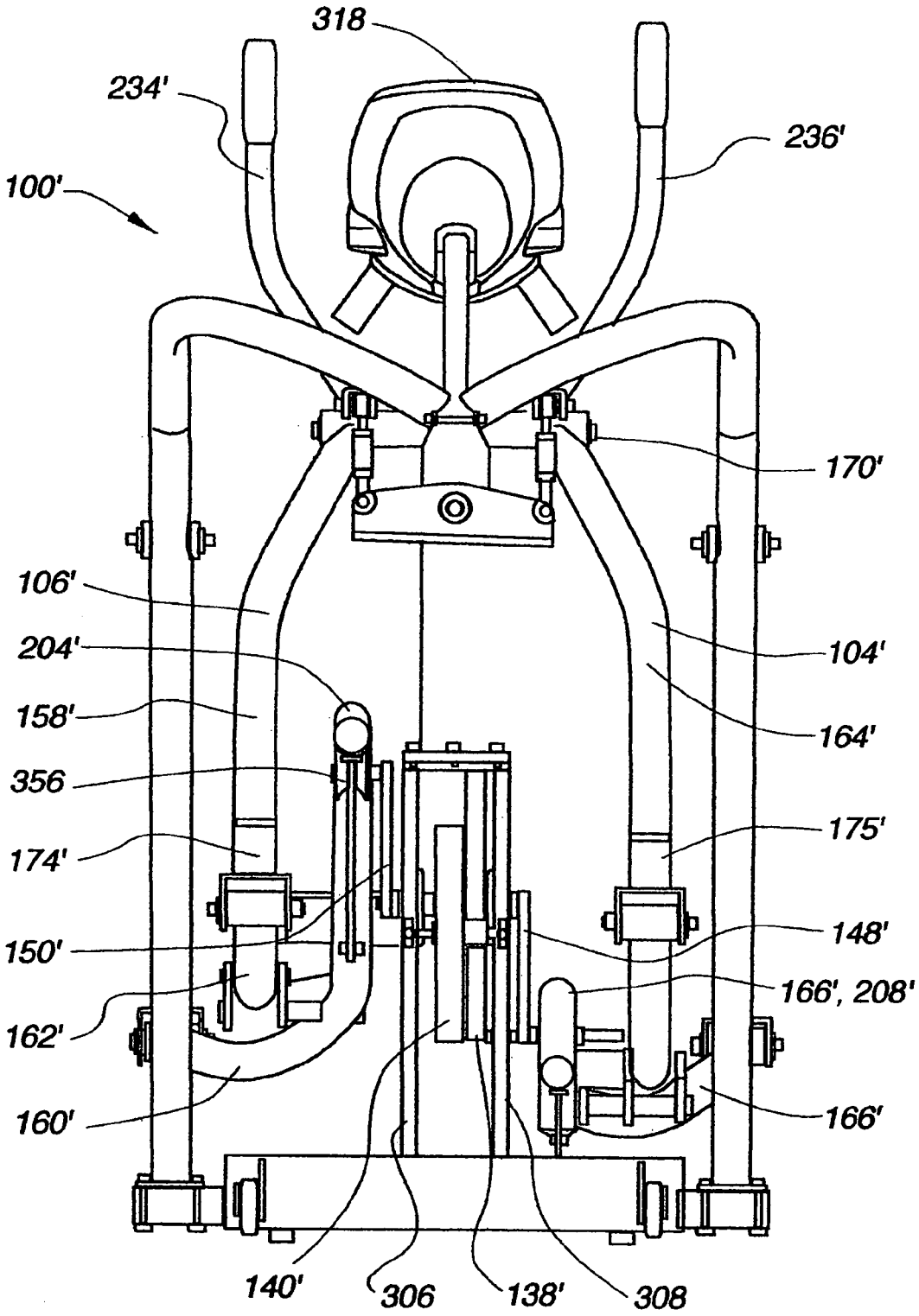
FIG. 11 is a front view of the exercise device depicted in FIG. 10.
Figure 12A:
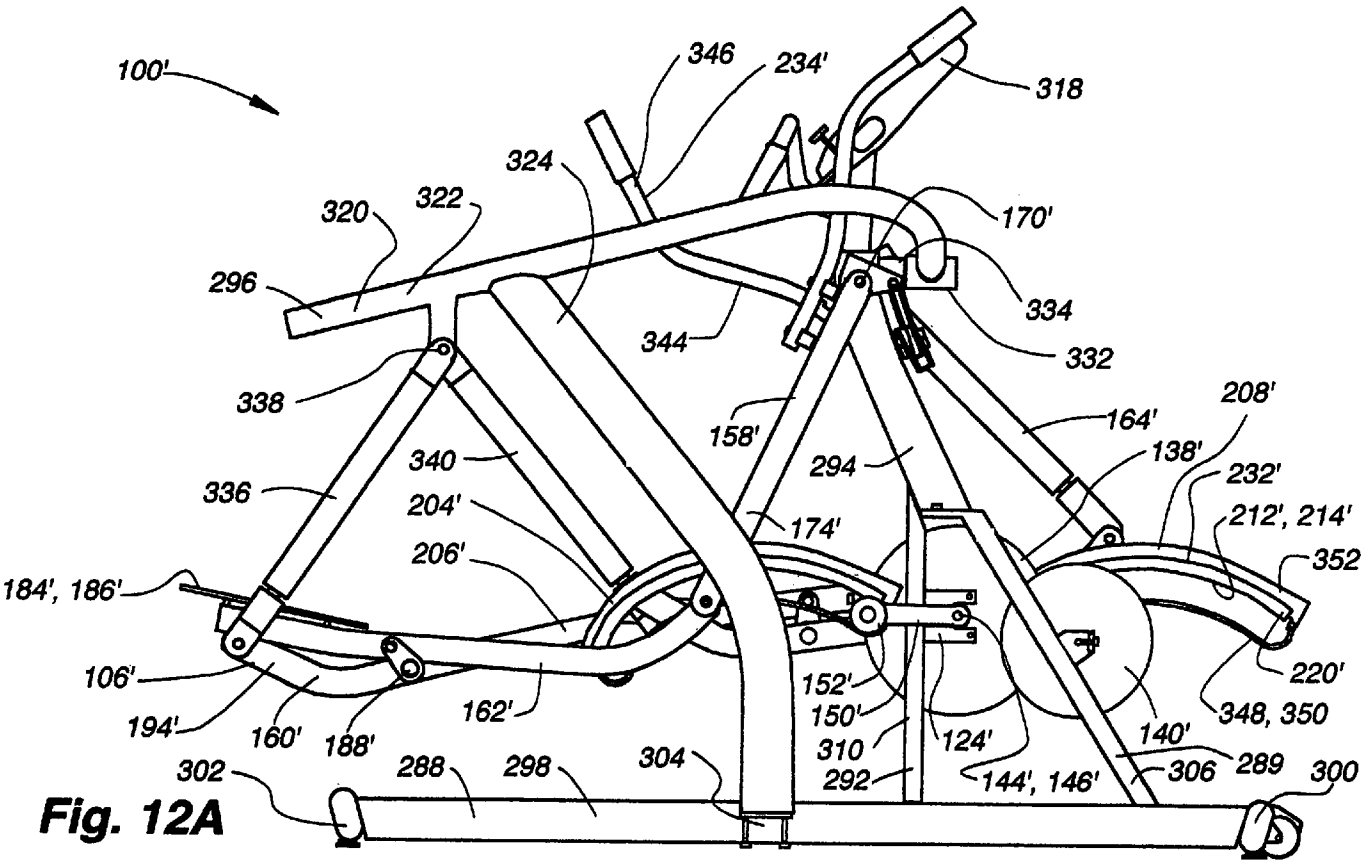
FIGS. 12A and 12B are right side and left side views, respectively, of the exercise device depicted in FIG. 10 showing the right crank arm in the 9 o'clock or rearward position and the foot links in an expanded stride configuration.
Figure 12B:
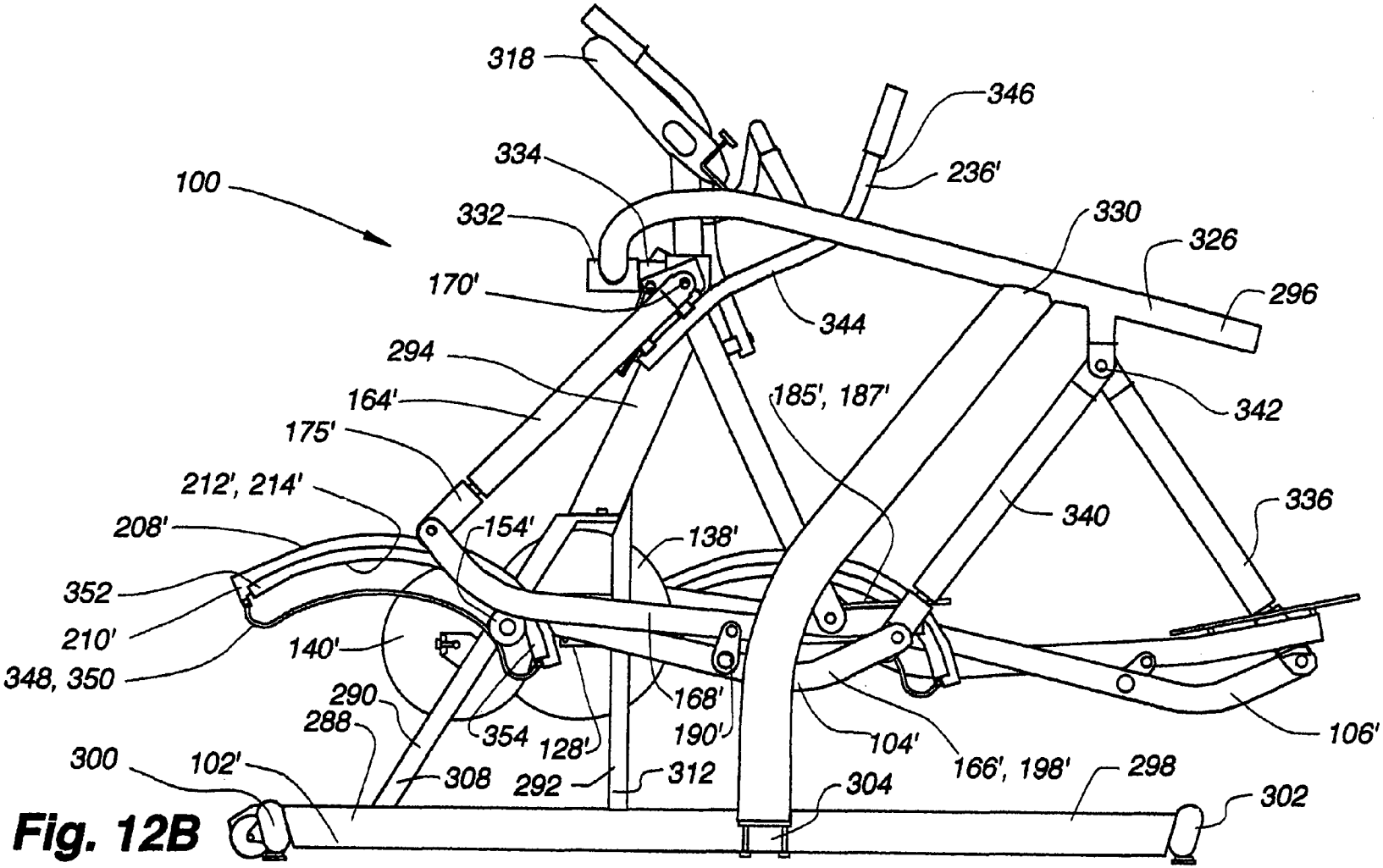

FIG. 10 is an isometric view of a second exercise device 100' conforming to the aspects of the present invention. FIG. 11 is a front view of the second exercise device 100', and FIGS. 12A and 12B are right and left side views of the exercise device 100', respectively. The second exercise device, like the first embodiment, provides a user with a variable stride. Structurally, the second exercise device varies from the first in several ways. For example, in the second exercise device 100', the rear portions of the cam links are pivotally connected with the frame through guide links, as opposed to being supported by guide rollers engaged with rails, as discussed with reference to the first embodiment. In addition, the frame of the second embodiment is configured differently than the frame of the first embodiment.

As shown in FIGS. 10-12B, the frame 102' includes a base portion 288, a front fork assembly 290, a rear fork assembly 292, a front post 294, and a handle bar assembly 296. The base portion 288 includes a base member 298 having a forward cross-member 300, a rearward cross-member 302, and a middle cross-member 304 connected therewith. The middle cross-member 304 may be connected with the base member at any location between the forward cross-member 300 and the rearward cross-member 302. The front fork assembly 290 and the rear fork assembly 292 connect with a portion of the base member 298 between the forward cross-member and the middle cross-member. The front fork assembly 290 is defined by a right front fork member 306 and a left front fork member 308. The rear fork assembly 292 is defined by a right rear fork member 310 connected with a right crank suspension bracket 124', and a left rear fork member 312 connected with a left crank suspension bracket 128'.

As shown in FIGS. 10-12B, a pulley 138' is rotatably connected with and between the right and left crank suspension brackets (124', 128') for rotation about the crank axle 144', which defines the crank axis 146'. Left and right crank arms (148', 150') are connected with the pulley 138' to rotate about the crank axis 146' along repeating circular paths 180 degrees out of phase with each other. The exercise device shown in FIGS. 10-12B also includes a flywheel 140' rotatably connected with and between the right front fork member 306 and the left front fork member 308. The flywheel 140' is connected through a belt 156' with the pulley 138', although the pulley and flywheel may be connected through other means, such as a chain, a gear arrangement, direct interference drive, or the like.

The front fork assembly 290 extends upwardly and rearwardly from the base member 298 and connects with the rear fork assembly 292, which extends upwardly from the base member. The front post 294 extends upwardly and rearwardly from the intersection of the front and rear fork assemblies. The exercise device may also include a display panel 318 supported on the upper end portion of the front post.

Still referring to FIGS. 10-12B, the handle bar assembly 296 includes a right handle bar 320 supported at a rearward portion 322 by a right upright member 324 extending upward from the middle cross-member 304, and a left handle bar 326 supported at a rearward portion 328 by a left upright member 330 extending upward from the middle cross-member 304. The right and left handle bars extend forward from the right and left upright members, curving downward and inward toward each other and intersecting at a forward handle bar point 332 located in front of the front post 294. A front support member 334 extends forwardly from the front post to connect with the front handle bar point. As previously mentioned, it is to be appreciated that various frame configurations and orientations can be utilized with the present invention other than what is depicted and described herein.

Similar to the first embodiment, and as shown in FIG. 12A, the right linkage assembly 106' includes a right swing link 158', a right cam link 160', and a right foot link 162' operatively connected with the right crank arm 150' and the frame 102' to provide a variable stride path. The left linkage assembly 104' is substantially a mirror image of the right linkage assembly 106', and as shown in FIG. 12B, includes a left swing link 164', a left cam link 166', and a left foot link 168' operatively connected with the left crank arm 148' and the frame 102' to provide a variable stride path. The components of the linkage assemblies are connected with each other and interact with the right and left crank arms in a manner similar to that described above with reference to FIGS. 1-9.

In contrast to the first embodiment, the rear portions (194', 198') of the cam links (160', 166') shown in FIGS. 12A-12B are not coupled with the frame through guide rollers. Instead, the right cam link 160' is pivotally connected with a right guide link 336, which is pivotally connected with the right handle bar 320 at a right rear pivot 338. Similarly, the left cam link 166' is pivotally connected with a left guide link 340, which is pivotally connected with the left handle bar 326 at a left rear pivot 342. As such, the guide links pivot back and forth around the rear pivots when the exercise device is in use. Therefore, the pivotal connections between the cam links and the guide links move through arcs having radii defined by the lengths of the guide links. The guide rollers of the first embodiment roll along a flat, straight path; thus, the foot path shape will differ between the first embodiment and the second embodiment. Because alternative rail shapes are possible, the first embodiment may be configured to provide a foot path very similar to the second exercise device. Although the guide links depicted in FIGS. 12A and 12B define substantially straight lengths, it is to be appreciated that other embodiments of the present invention can utilize guide links defining other shapes, such as arcuate or bent (so as to define an angle between straight end portions).

As shown in FIGS. 10-12B, and as discussed above with reference to FIGS. 1A-2, the exercise device 100' may also include lever arms (234', 236') connected with the swing links (158', 164'), which provide an extra gripping surface for the user as well as allowing the user to complement his use of the exercise device with an upper body workout. The lever arms are connected with upper portions of the swing links and extend upwardly to provide hand grips for a user. The lever arms shown in FIGS. 10-12B are curved with a section 344 extending rearward and a section 346 extending upward. The rearward section orients the grip proximate a user standing on the foot pads (186', 187').

Similar to the first embodiment shown in FIGS. 1A-2, the right and left foot links (162', 168') in the second embodiment in FIGS. 10-12B include foot engaging portions (184', 185') located on the rearward portions of the foot links. The right and left foot engaging portions (184', 185') may also include rectangular right and left foot pads (186', 187') meant to support a user's foot. As previously mentioned, the foot engaging portions may be directly connected with the top of the foot links or may be pivotally supported so that they articulate during use or their angular relations with the foot links vary. Additionally, the foot pads may be parallel with the links or any angle therebetween.

Portions of the foot links (162', 168'), between the forward and rearward ends thereof, are pivotally connected with portions of the cam links (160', 166') at cam link pivots (188', 190'). The cam members (204', 208') are connected with forward portions (206', 210') of the cam link, and each cam member includes a downwardly concave section 212' defining a generally arcuate surface 214'. The cam members (204', 208') are supported on cam rollers (152', 154') at the end of the crank arms (150', 148'). The cam rollers are adapted to rollingly support the arcuate cam surface of the cam members.

Because the cam member (204', 208') is not in fixed engagement with the crank arm (150', 148'), the exercise device includes features to keep the cam member from disengaging from the crank arm. One such feature is a bottom guide 348 connected with the cam links (160', 166'). The bottom guide, in one example, includes a tubular member 350 extending in an arc from a front 352 of the cam surface 214 to a rear 354 of the cam surface 214. The arc is generally parallel with the arc defined by the cam member. Additionally, the tubular member is below the arcuate surface slightly more than the diameter of the cam roller (152', 154'). As such, the roller is free to roll back-and-forth along the cam surface, but should the cam link lift up, the roller will bump against the bottom guide prohibiting it from disengaging. It is to be appreciated that other configurations may also be used to constrain the cam rollers. For example, the cam member is tubular defining a lower radius. The outer rolling surface 256 of the cam rollers defines a concave cross section adapted to engage the tubular-shaped cam member to help keep the cam rollers aligned with the cam members, and help prevent lateral disengagement as well as smooth back-and-forth rolling.

As with the first embodiment, the cam links (160', 166') are not constrained in fixed relation to the crank arms (150', 148'), but instead may move relative to the crank arms as the cam members (204', 208') move back and forth on the cam rollers (152', 154'). Thus, the paths in which the cam links and foot links move are variable and can be affected by the stride length of the user. Moreover, similar to the first embodiment, the paths in which the foot links (162', 168') and cam links (160', 166') move are not solely dictated by the geometric constraints of the swing links (158', 164'), the crank arms (150', 148'), and the frame 102'. Therefore, the user can dynamically adjust the travel path of the of the foot engaging portion while using the exercise device based on the user's stride length and variable forces imparted on the linkages. As described with the first embodiment, the cam links (160', 166') in the second embodiment act as variable stride links that allow a user to move the foot links by varying his stride length, stride power, stride frequency, or combinations thereof. Additionally, because all users naturally have different strides due to size, fitness, or desired exercise exertion, the exercise device conforms to all of these differences.

The user operates the exercise machine shown in FIG. 10 in the same manner as described above with reference to FIGS. 1A-2. As such, a user first places his feet in operative contact with the right and left foot engagement portions (184', 186'). The user then exercises by striding forwardly toward the front post 294 with one leg and away with the other leg. Forces imparted to the foot engaging portion as well as the lever arms (234', 236') by the user cause the foot links (162', 168') to move back and forth, which in turn cause the swing links (158', 164') to pivot back and forth around the upper pivot 170'. At the same time, the crank arms (150', 148') rotate around the crank axis 146'. Because the foot links and the cam links are operatively connected with the frame 102' and the crank arms through the guide links (336, 340) and cam rollers in a partially unconstrained manner, the paths in which the cam links and foot links move are variable and can be affected by the stride of the user. As such, the paths in which the foot links and cam links move are not solely dictated by the geometric constraints of the swing links, the crank arms, and the frame. Therefore, the user can dynamically adjust the travel path of the of the foot engaging portions while using the exercise device. Thus, the exercise device provides a foot path that conforms to any particular user stride.

As the exercise device is in use, the relative motions of the members of the linkage assemblies (106', 104') and the crank arms (150', 148') of the second embodiment 100' of the second exercise device are similar to the first embodiment. However, the rear portions (194', 198') of the cam links (160', 166') shown in FIGS. 10-12B do not travel back and forth along rails, but instead pivot about the rear pivots in an arc defined by the location of the connection between the guide links (336, 340) and the cam links (160', 166') from the rear pivots, and the lengths of the guide links. For further illustration, FIGS. 12A-15B show the relative movement of the various components of the linkage assemblies of the second embodiment of the exercise device as the right crank arm moves from a rearward position to an upward position.

As shown in FIGS. 12A and 12B, the right and left foot pads (186', 187') are oriented such that the user's right foot is placed rearwardly of his left foot. In addition, the user's right foot is positioned such that the user's right heel is raised relative to the user's right toes, and the user's left foot is positioned such that the user's left heel is lower relative to the user's left toes. The linkage assemblies (104', 106') illustrated in FIGS. 12A and 12B also depict an orientation associated with a lengthened stride, such as may occur during more vigorous exercise. Thus, the right cam link 160' is in its rearward-most position and the left cam link 166' is its forward-most position. To orient the right cam link 160' in its rearward-most position, the right cam roller 152' is engaged with the downwardly extending portion of the cam surface at the forward end 200' of the right cam member 204'. To orient the left cam link 166' in its rearward-most position, the left cam roller 154' is engaged with the downwardly extending portion of the cam surface located at the rearward end 222' of the left cam member 208'. Therefore, the foot pads (186', 187') illustrated in FIGS. 12A and 12B are separated by a greater distance than the foot pads would be if the cam rollers were located on the apex 232' of each cam surface for the same crank arm orientation.

Figure 13A:
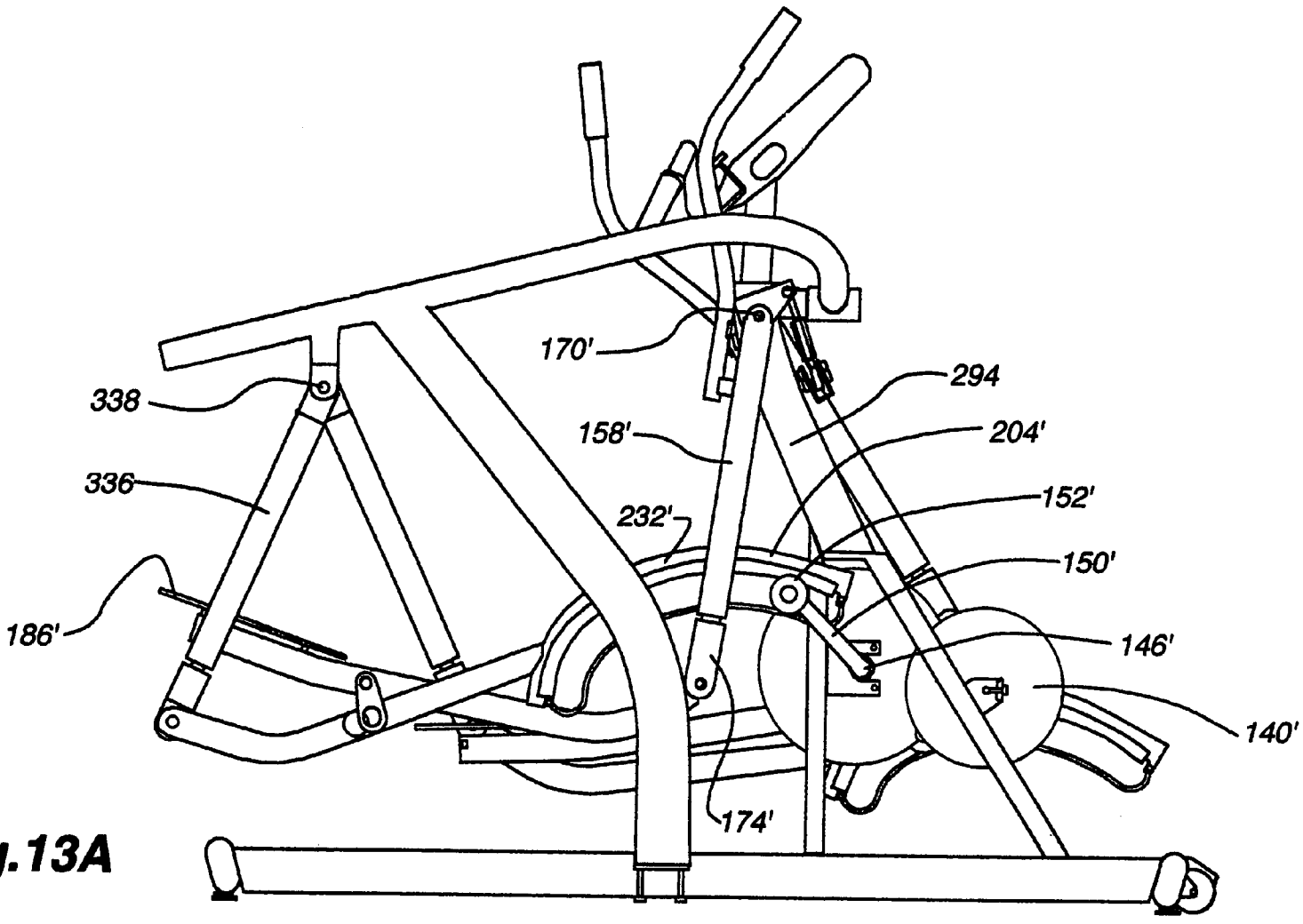
FIGS. 13A and 13B are right side and left side views, respectively, of the exercise device depicted in FIG. 10 showing the right crank arm transitioning to the 12 o'clock or upward position from the position shown in FIGS. 12A and 12B.
Figure 13B:
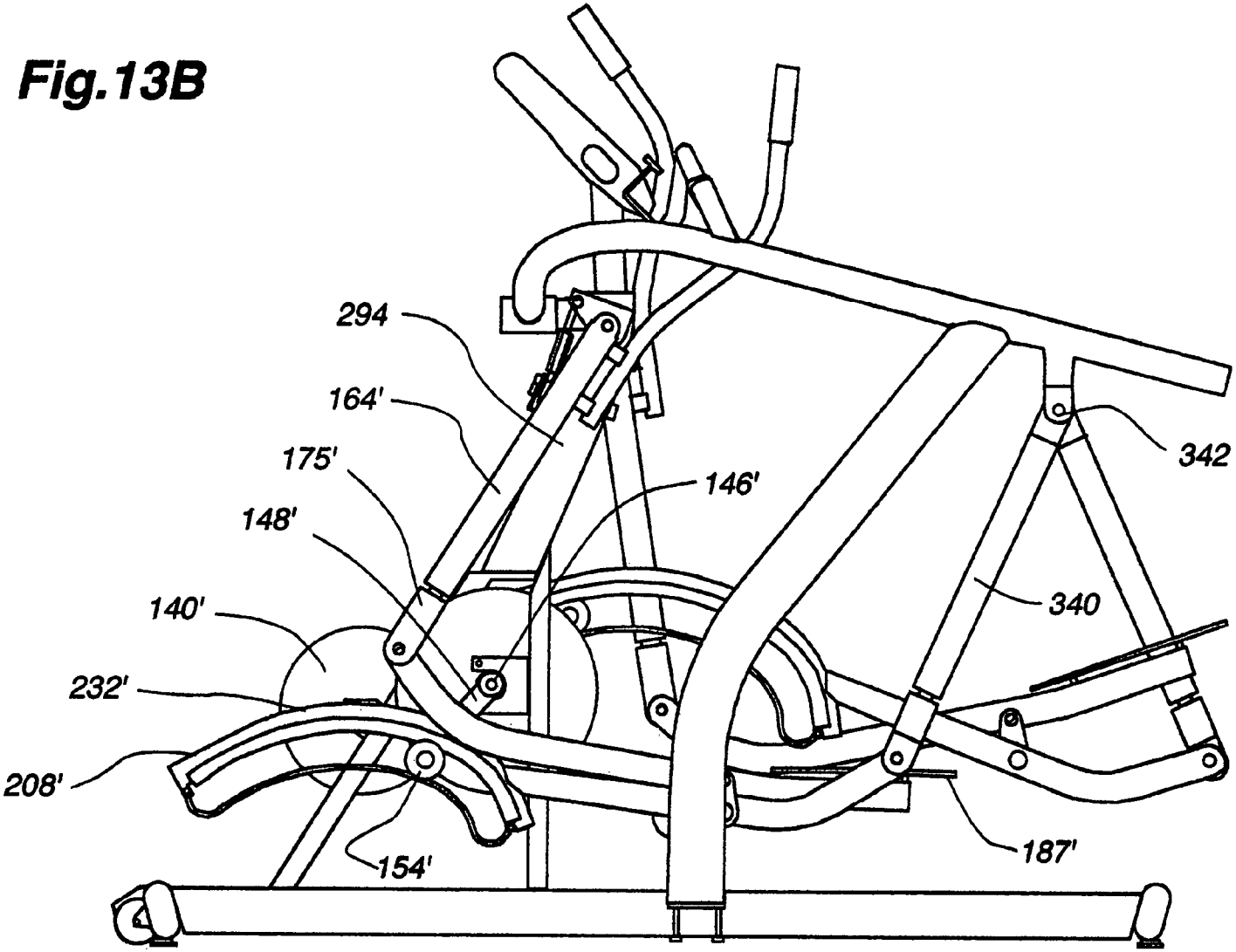

As the user strides forward toward the front post 294, the right crank arm 150' rotates in a clockwise direction (as viewed from the right side of the exercise device) around the crank axis 146' from the rearward orientation shown in FIGS. 12A and 12B toward an orientation shown in FIGS. 13A and 13B, which causes the lower portion 174' of the right swing link 158' to pivot counterclockwise from a rearward position shown in FIG. 12A around the upper pivot 170' to a position shown in FIG. 13A. At the same time, the right guide link 336 pivots counterclockwise about the right rear pivot 338. In addition, the left crank arm 148' rotates in a clockwise direction (as viewed from the right side of the exercise device) around the crank axis 146' from the forward orientation shown in FIG. 12B toward the orientation shown in FIG. 13B, which causes the lower portion 175' of the left swing link 164' to pivot clockwise from a rearward position shown in FIG. 12B around the position shown in FIG. 13B. At the same time, the left guide link 340 pivots clockwise about the left rear pivot 342. The flywheel 140' helps rotate the crank arms smoothly, which is important because the crank arms are not directly connected with the linkage assemblies.

As shown in FIGS. 13A and 13B, the right foot pad 186' has moved upward and forward from the position shown in FIG. 12A, and the left foot pad 187' has moved downward and rearward from the position shown in FIG. 12B. Thus, the foot pads (186', 187') are closer together in FIGS. 13A and 13B. Additionally, in FIGS. 13A and 13B, the right and left pads are oriented such that the user's right foot is placed upward and rearward relative to his left foot. The right cam roller 152' has also moved rearward relative to the right cam member 204' toward the apex 232' of the right cam surface, and the left cam roller 154' has moved forward relative to the left cam member 208' toward the apex 232' of the left cam surface. In addition, the user's right foot is positioned such that the user's right heel is raised relative to the user's right toes, and the user's left foot is positioned such that the user's left heel is also lower relative to the user's left toes. As the user continues to stride forward toward the front post 294, the right crank arm 150' rotates in a clockwise direction (as viewed from the right side of the exercise device) around the crank axis 146' from the orientation of FIG. 13A to the orientation of FIG. 14A, which is accompanied by the lower portion of the right swing link 158' pivoting counterclockwise from the position shown in FIG. 13A around the upper pivot 170' to a position shown in FIG. 14A. At the same time, the right guide link 336 continues to pivot counterclockwise about the right rear pivot 338. In addition, the left crank arm 148' rotates in a clockwise direction (as viewed from the right side of the exercise device) around the crank axis 146' from the orientation of FIG. 13B downward to the orientation of FIG. 14B, which is accompanied by the lower portion 175' of the left swing link 164' pivoting clockwise from the position shown in FIG. 13B around the upper pivot 170' to the position shown in FIG. 14B. At the same time, the left guide link 340 continues pivot clockwise about the left rear pivot 342.

Figure 14A:
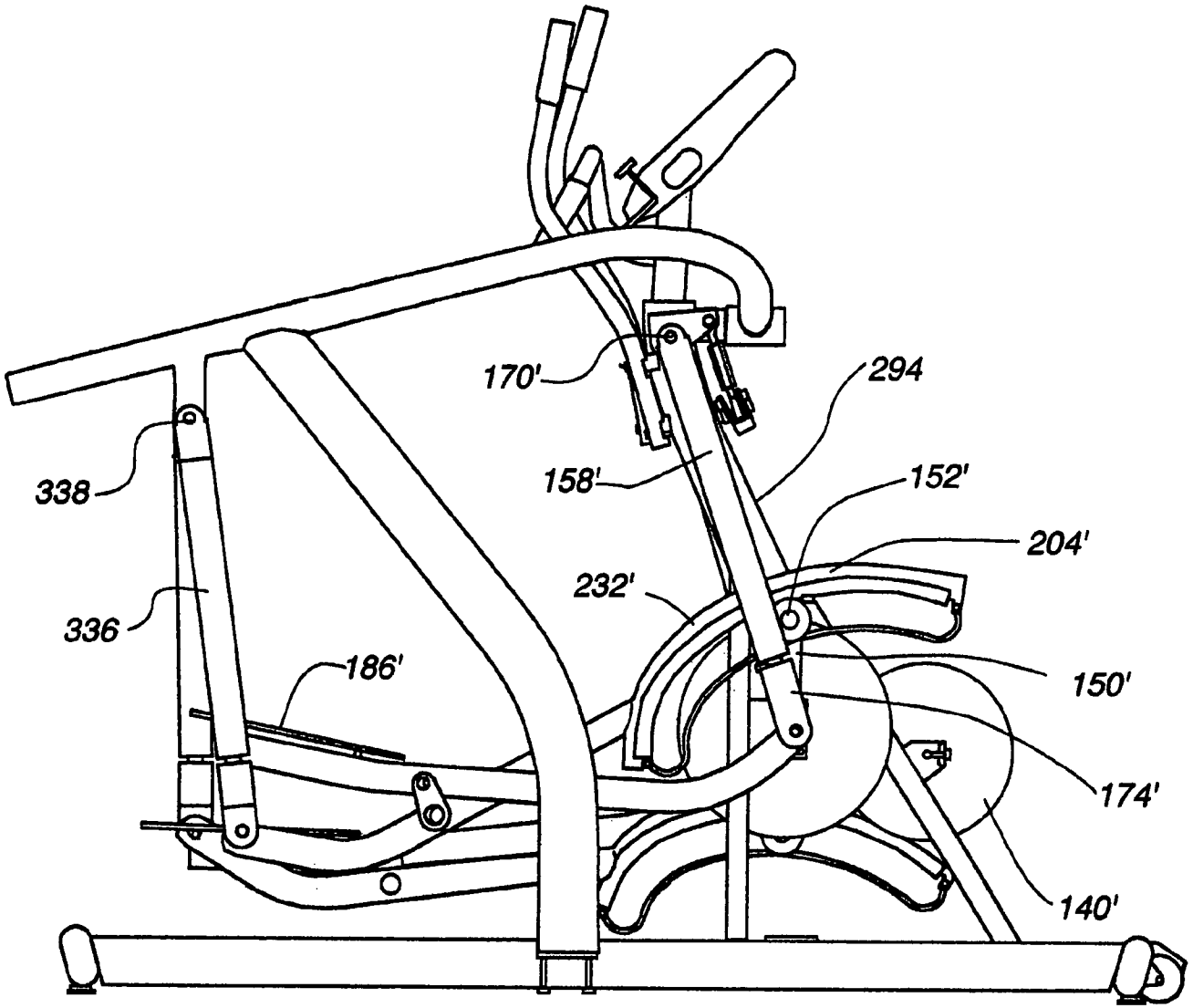
FIGS. 14A and 14B are right side and left side views, respectively, of the exercise device depicted in FIG. 10 showing the right crank arm in the 12 o'clock or upward position.
Figure 14B:
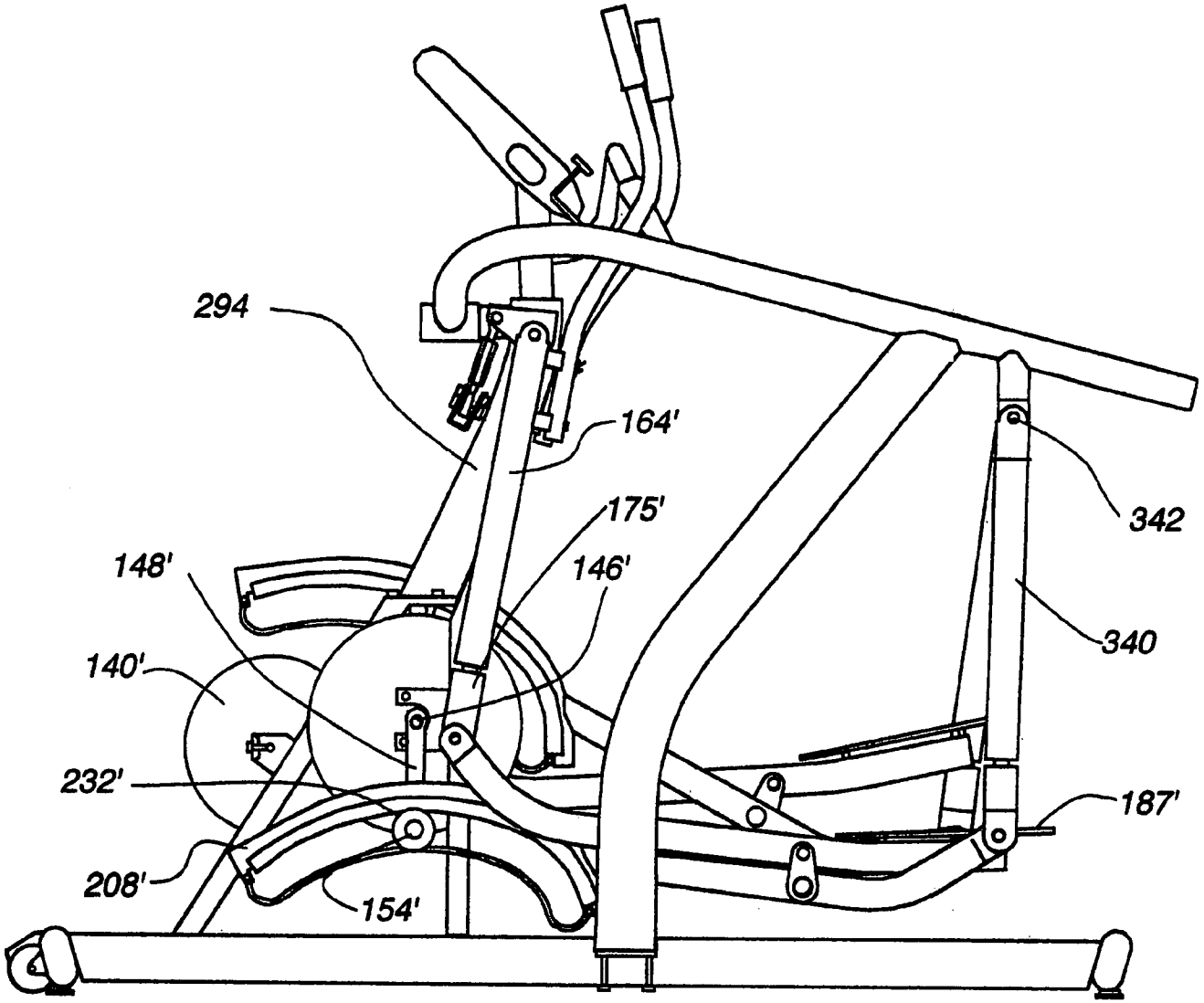

As shown in FIGS. 14A and 14B, the right foot pad 186' has moved upward and forward from the position shown in FIG. 13A, and the left foot pad 187' has moved downward and rearward from the position shown in FIG. 13B. Thus, the foot pads are closer together in FIGS. 14A and 14B. Additionally, in FIGS. 14A and 14B, the right and left pads are oriented such that the user's right foot is placed upward relative to his left foot. The right cam roller 152' has also moved rearward relative to the right cam member 204' near the apex 232' of the right cam surface, and the left cam roller 154' has moved forward relative to the left cam member 208' near the apex 232' of the left cam surface. In addition, the user's right foot is positioned such that the user's right heel is raised relative to the user's right toes, and the user's left foot is positioned such that the user's left heel is almost level with the user's left toes.

It is to be appreciated that varying the length and/or shape of the guide links (336, 340), foot links (162', 168'), swing links (158', 164'), cam links (160', 166'), and the contours of the cam surfaces may affect how the foot engaging pads (186', 187') move for varying stride lengths. For example, the pivoting motion of the guide link alone or in combination with the swing path of the cam link may cause the foot pad to move in a manner similar to a user's ankle articulation at the rear of a user's natural stride, wherein the user's heel is raised relative to the user's toes. Similarly, the pivoting motion of the guide link alone or in combination with the swing path of the cam link may cause the foot pad to transition to and move in a manner similar to a user's ankle articulation at the front of a user's natural stride, wherein the user's heel is lower relative to the user's toes. Further, guide links and cam surfaces may be configured to imitate a user's ankle articulation for longer and shorter strides. For example, a user's heel may be raised to a higher elevation relative to his toes at the rear of the user's longer stride as compared to the user's shorter stride. Similarly, a user's heel may be lowered to a lower elevation relative to his toes at the front of the user's longer stride as compared to the user's shorter stride. In most instances, providing a foot pad that articulates in a manner similar to a user's ankle keeps the user's foot substantially in contact with the foot pad to reduce jarring impacts associated when a user's foot loses then gains contact with the foot engaging portion. In addition, other embodiments of the exercise device can utilize various lengths and shapes of guide links and cam surfaces so as to alter how the user's foot will move throughout a given stride length.

Figure 15:
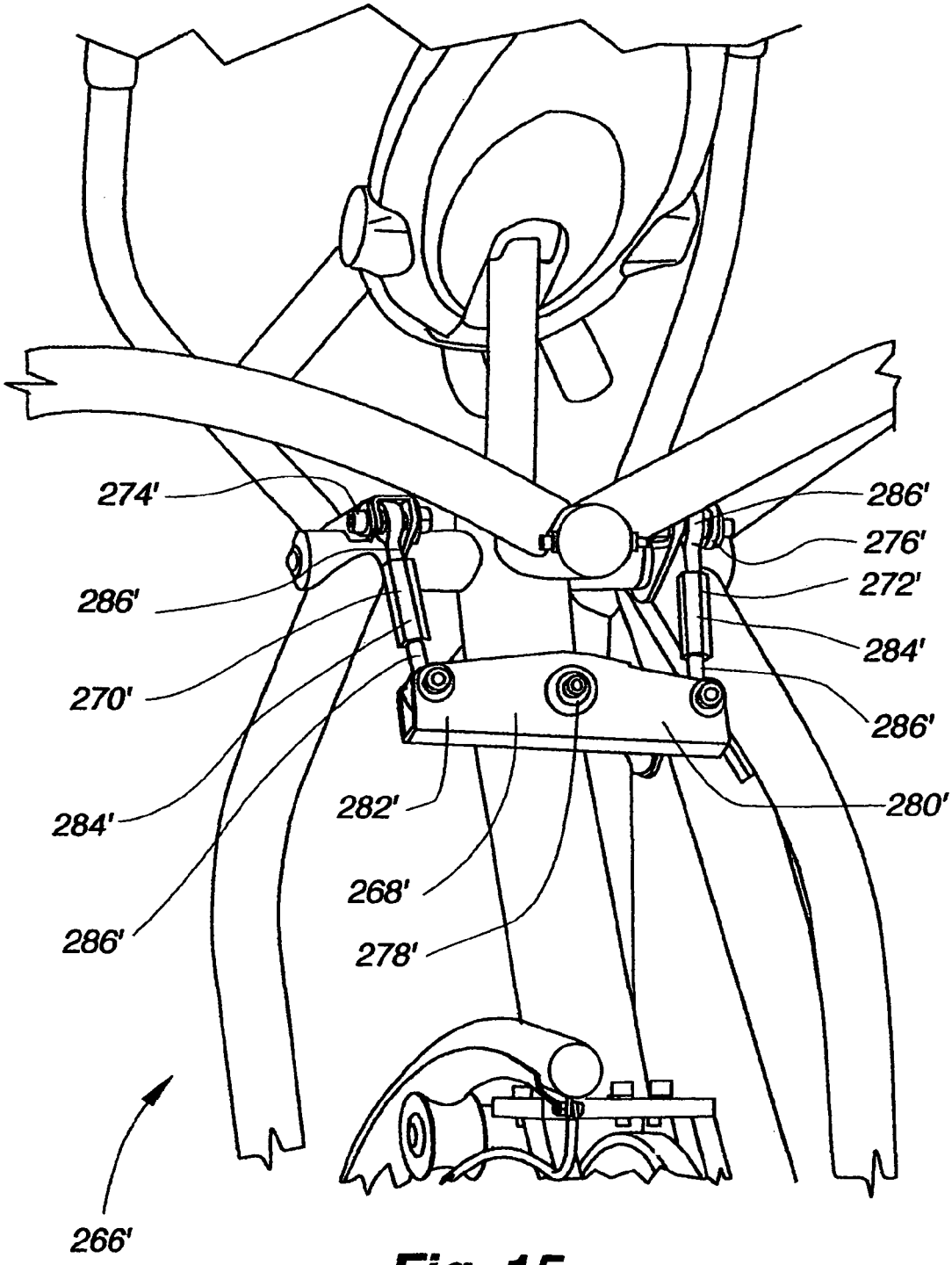
FIG. 15 is a detailed view of an interconnection assembly illustrated on the exercise device of FIG. 10.

The second embodiment of the exercise device 100' shown in FIG. 10 also includes an interconnection assembly 266' that acts to move the linkage assemblies in opposite directions. A detailed view of the interconnection assembly 266' is shown in FIG. 15 and is structurally similar to the interconnection described above with reference to FIG. 9, except the teeter member is located below the upper pivot 170'. As such, the interconnection assembly 266' includes a teeter member 268', a right interconnection link 270', a left interconnection link 272', a right U-bracket 274', and a left U-bracket 276'. A teeter axle 278' extends forwardly from the front post 294 and is adapted to pivotally support the teeter member. The left interconnection link 272' is pivotally connected with the left portion 280' of the teeter member 268' and extends upwardly therefrom to pivotally connect with the left U-bracket 276', which is rigidly connected with the left swing link 164' near the upper pivot 170'. The right interconnecting link 270' is pivotally connected with the right portion 282' of the teeter member 268' and extends upwardly therefrom to pivotally connect with the right U-bracket 274', which is rigidly connected with the right swing link 158' near the upper pivot 170'.

When either of the swing links (158', 164') swing rearward, the associated U-bracket (274', 276') of the interconnection assembly 266' shown in FIG. 15 pivots upwardly. More particularly, when the right swing link 158' rotates about the upper pivot 170' in a counterclockwise direction (as viewed from the right side of the exercise device), the right U-bracket 274' pulls (through the right interconnection link 270') the right portion 282' of the teeter member 268' upwardly and causes the teeter to rotate clockwise around the teeter axle 278' (as viewed from the front of the exercise device). As the teeter member rotates clockwise (as viewed from the front of the exercise device), the left portion 280' of the teeter member pulls downwardly on the left U-bracket 276' (through the left interconnection link 272'), which in turn, causes the left swing link 164' to rotate about the about the upper pivot in a clockwise direction (as viewed from the right side of the exercise device).

Some embodiments of the present invention may include a motion limiter that acts to limit the movement of the cam members when a user begins exercising. More particularly, the motion limiter impedes excessive upward movement of the cams. For example, when a user begins exercise by imparting an initial movement to the foot links, which is translated to the cam members, depending on the relative positions of the various links, the cam members may move relative to the cam rollers in an upward and/or downward direction before the crank arms begin turning. Unless the initial upward movement of the cam members is limited to some degree, a user's initial stride movements may be awkward. In addition, the motion limiter prevents the cam from striking the inside of the shroud in embodiments of the exercise device that include a shroud enclosing the cam members, crank arms, pulley, and flywheel.

Figure 16:
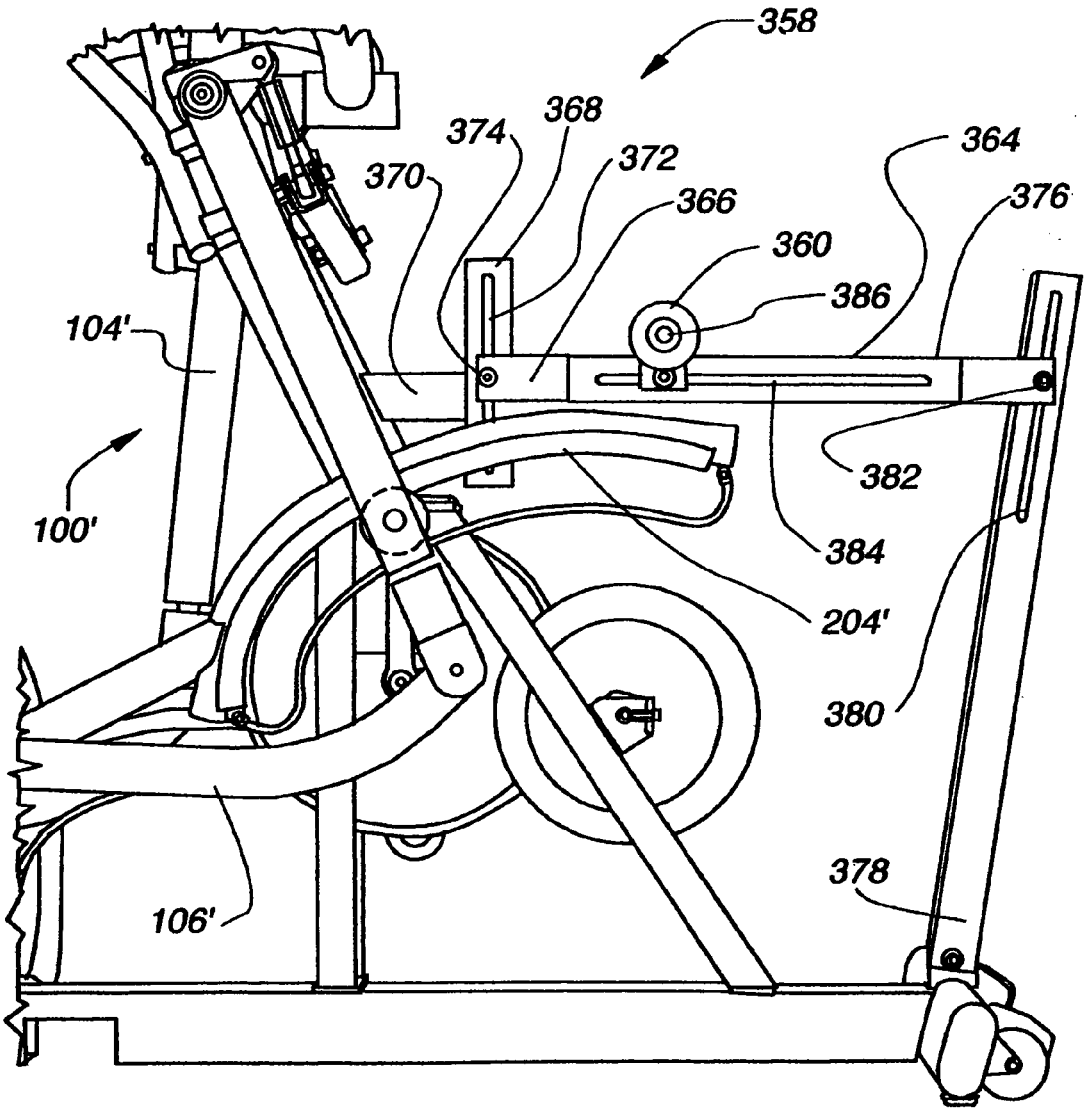
FIG. 16 is an isometric view of an exercise device including a roller stop assembly.
Figure 17:
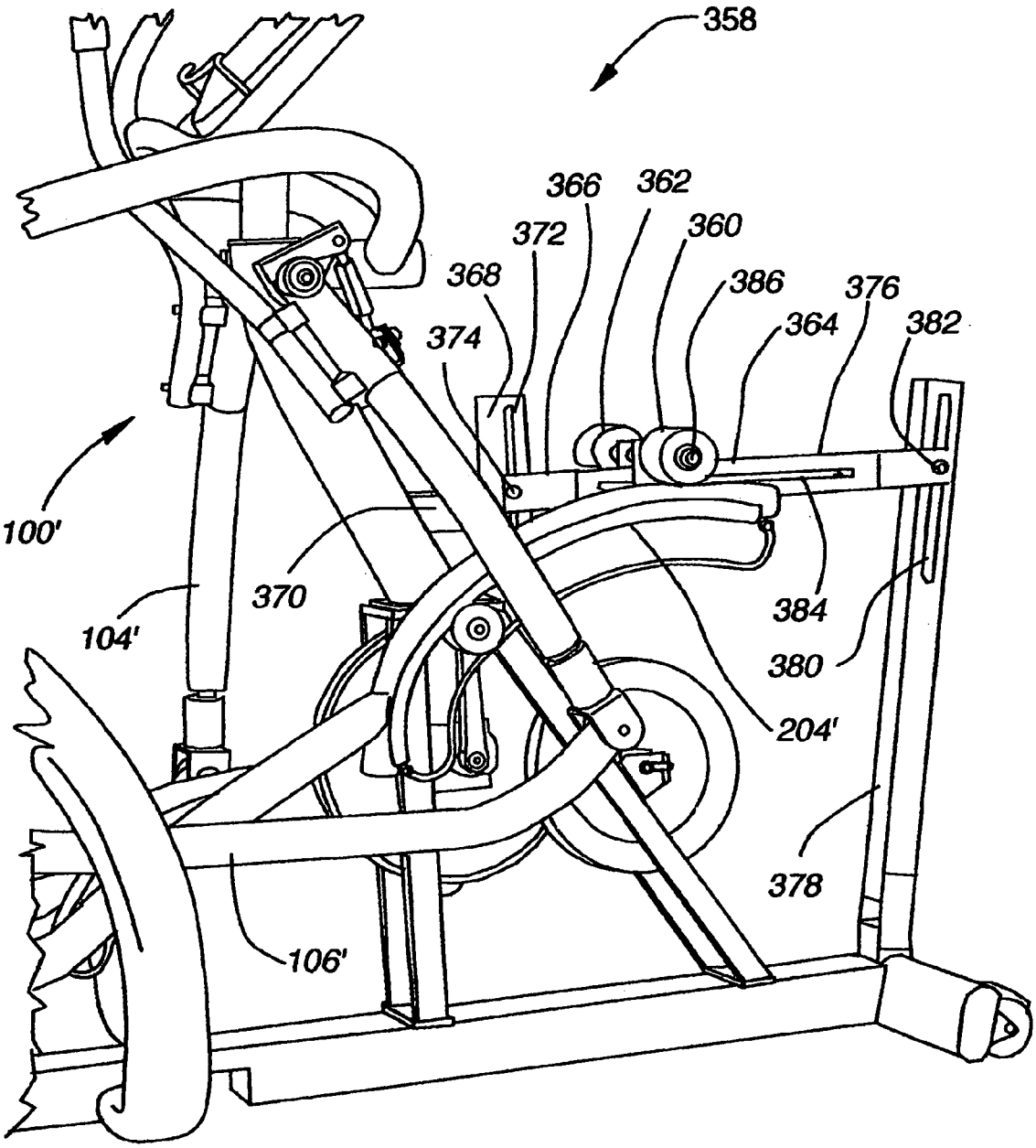
FIG. 17 is an isometric view of the roller stop assembly of FIG. 16 showing the right cam link in contact with a roller.

One example of a motion limiter 358 is shown in FIGS. 16 and 17. The motion limiter includes a right limiter roller 360 and a left limiter roller 362 adjustably supported by a roller support member 364. The roller support member 364 is positioned above and forward the pulley 138'. The right and left limiter rollers (360, 362) are aligned in the same plane as the left and right cam rollers (152', 154'), respectively. A rear portion 366 of the roller support member 364 is adjustably connected with a rearward upright member 368. The rearward upright member is transversely connected with a forward extension member 370 extending from the front post 294. The rearward upright member 368 defines a slot 372 adapted to receive a rearward bolt and nut 374 connected with the roller support member 364. The rearward bolt and nut 374 allow the rear portion 366 of the roller support member 364 to be connected at any location along the length of the slot 372.

As shown in FIGS. 16 and 17, a forward portion 376 of the roller support member 364 is adjustably connected with a forward upright member 378. The forward upright member 378 is pivotally connected with the forward cross member 300 of the base portion 288 of the frame 102'. The forward upright member 378 defines a slot 380 adapted to receive a forward bolt and nut 382 connected with the roller support member 364. The forward bolt and nut allow the forward portion 376 of the roller support member 364 to be connected at any location along the length of the slot 380.

Still referring to FIGS. 16 and 17, the roller support member 364 also defines a slot 384 adapted to receive a roller bolt and nut 386 that allows the right and left limit rollers (360, 362) to be connected at any location along the length the slot 384. The slotted connections between the various members and rollers of the motion limiter allow a user to optimally position the limit rollers to accommodate initial cam member movements and/or prevent the cam members from contacting the shroud (if used). It is to be appreciated that the motion limiter may include other hardware configurations, such as a pop-pin or spring loaded pin arrangement to allow for adjustment of the roller positions. Although the motion limiter shown in FIGS. 16 and 17 is configured to allow for adjustment of the roller position, other embodiments of the present invention may include fixed position rollers.

FIG. 16 shows the exercise device 100' with the linkage assemblies (106', 104') in an initial position before a user imparts any motion to either foot link (162', 168'). If the user were to stride forward very quickly before the crank arms (150', 148') began to turn, the cams (204', 208') may hit the rollers (360, 362) and be forced to move forward with the cranks rather than continue moving upward. For example, as shown in FIG. 17, the right cam member 204' is shown in a forward and upward position relative to the position shown in FIG. 16 and is in contact with the right roller 360. Because the right roller 360 of the motion limiter 358 will prevent the right cam member 204' from continuing to travel upward, the right cam member shown in FIG. 17 will move forward with the right crank arm and right cam roller.

Other embodiments of the exercise device include a lockout device that allows a user to lock the swing links in position so as to prevent the swing links from pivoting about the upper pivot while exercising. The lockout device can be configured in various ways in order to lock the swing links in position. For example, in an exercise machine having any of the interconnection assemblies shown in FIG. 8, 9, or 15, preventing the teeter member from pivoting about the teeter axle would effectively lock the swing links in position. Pivotal movement of the teeter member could be prevented in a number of ways, such as by clamping the teeter member to the front post or inserting a pin through the teeter member and into the front post.

Figure 18:
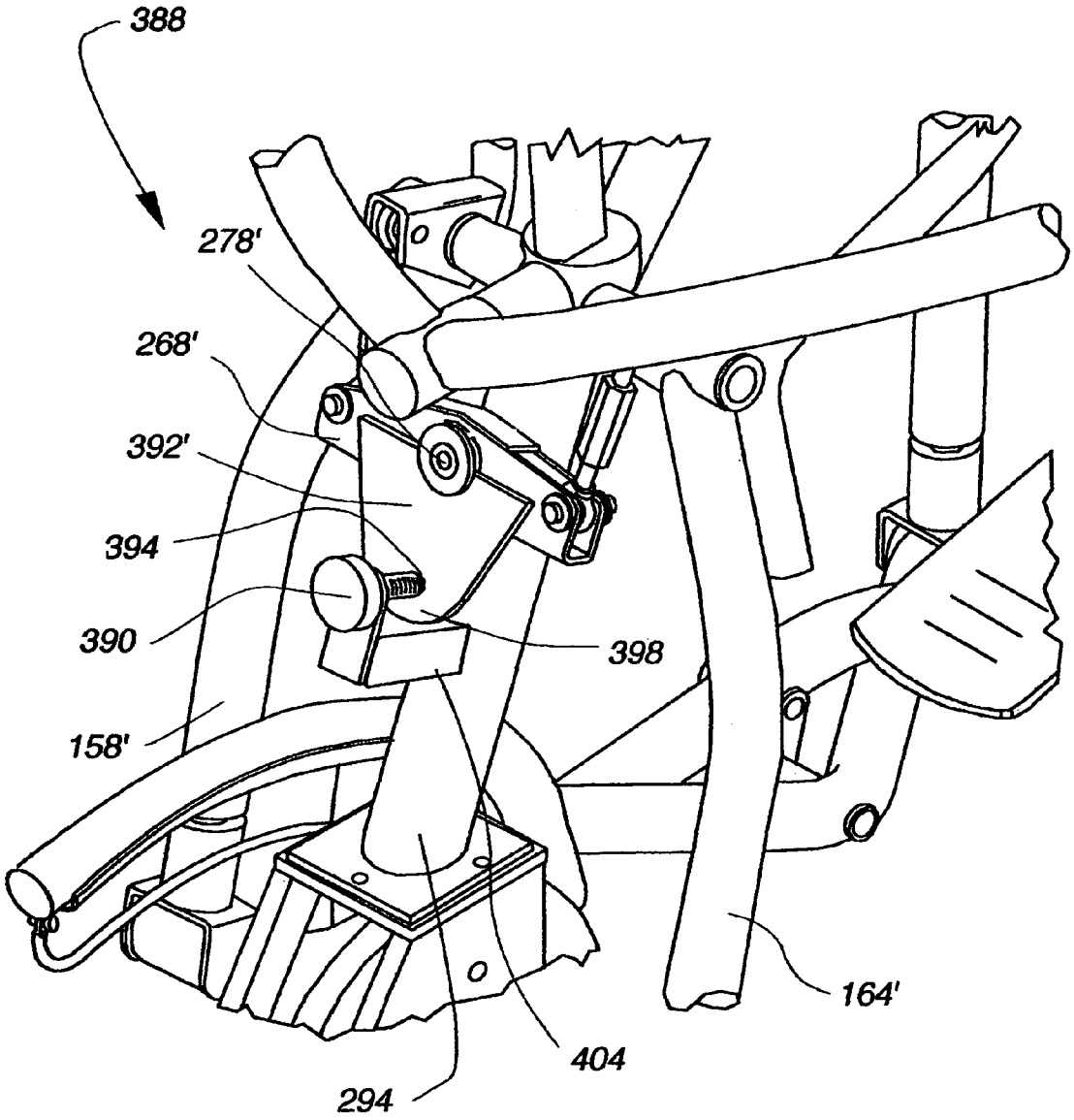
FIG. 18 is an isometric view of an exercise device including a lockout device.
Figure 19:
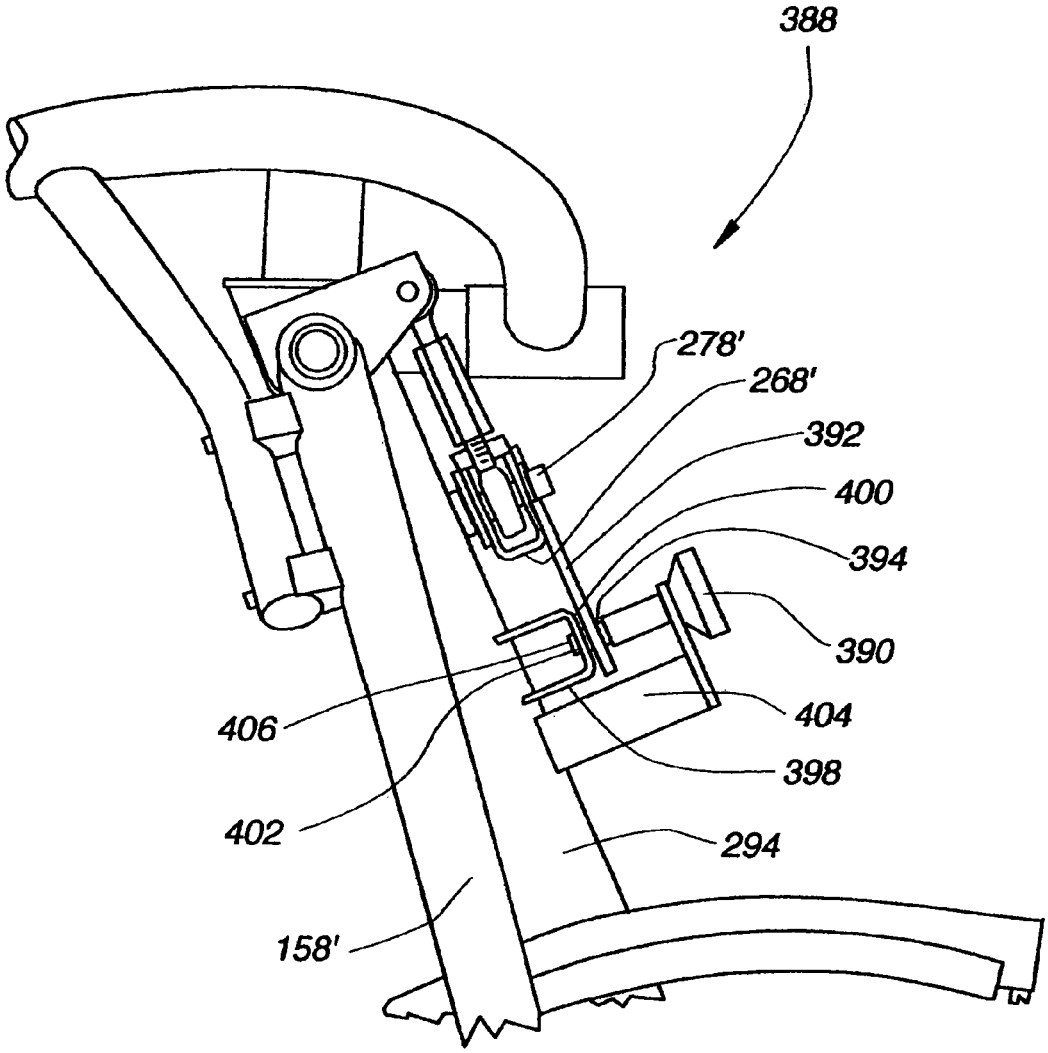
FIG. 19 is a right side view of the lockout device of FIG. 18.

FIGS. 18 and 19 depict one example of a lockout mechanism 388 used in conjunction with the interconnection assembly 266' described above with reference to FIG. 15. The lockout mechanism 388 shown in FIGS. 18 and 19 utilizes a pop-pin mechanism 390 to prevent the teeter member 268' from rotating about the teeter axle 278' on the front post 294. The lockout mechanism includes a locking plate 392 connected with and extending downward from the teeter member 268'. A first aperture 394 is located in a lower portion 396 of the locking plate 392. A U-bracket 398 is connected with and extends forward from the front post 294 far enough to place a top surface 400 of the U-bracket 398 in close proximity to the locking plate 392 while allowing the locking plate to pass unimpeded over the top of the U-bracket while the exercise device is in use. A second aperture 402 is located in the top surface 400 of the locking plate 392. The pop-pin mechanism 390 is connected with a pop-pin support structure 404 extending forward from the front post 294, which places a pin 406 extending from the pop-pin mechanism in alignment with the second aperture in the U-bracket.

The lockout mechanism 388 shown in FIGS. 18 and 19 can be engaged to prevent the teeter member 268' from pivoting about the teeter axle 278' by first aligning the first aperture 394 above the second aperture 402, which are both adapted to receive the pin 406 from the pop-pin mechanism 390. Alignment of the apertures may be accomplished by manipulating the linkages of the exercise device. Next, the pin 406 is inserted through the first and second apertures (394, 402), as shown in FIG. 19, which prevents the locking plate 392 and the teeter member 268' from pivoting about the teeter axle 278'. Because the teeter member cannot pivot, the right and left swing links (158', 164') are prevented from pivoting about the upper pivot 170'. The lockout device 388 is disengaged from the interconnection assembly by removing the pin from the first and second apertures.

Using a lockout device to prevent the swing links from pivoting about the upper pivot alters the foot paths of the foot engaging portions of the foot links as the crank arms rotate in such a way as to resemble a stepping motion. To operate the exercise machine with the swing links locked in position, a user first places his feet in operative contact with the right and left foot engagement portions. The user then exercises by exerting a downward force on either the left or right foot engagement portions. Interaction of the reciprocating crank arms and the cam links cause the foot links to pivot up and down opposite from each other about the lower pivots.

In one example where a lockout device is used to prevent the swing links from pivoting about the upper pivot 170 (referring the exercise device in either FIGS. 1A-2 or FIGS. 10-12B), a downward force imparted to the right foot engaging portion 184 of the right foot link 162 is transferred to the right cam link 160 through the right cam link pivot 188, which in turn, transfers forces to the right cam roller 152 and the right guide roller 192 (or right guide link). The downward force exerted on the right cam roller causes the right crank arm to rotate toward the 6 o'clock or downward position. As the right crank arm and right cam roller move toward the downward position, the right cam link pivots downward or clockwise (as viewed from the right side of the exercise device) about the right guide roller (or right rear pivot 336). Therefore, the right cam link pivot 188 moves downwardly with the right cam link 160, which in turn allows the right foot link 162 to move downward. Because the right swing link 158 is held in a fixed position relative to the upper pivot 170, the range of motion of the right foot link 162 is limited to pivoting about the right lower pivot 178. As such, the right foot engaging portion 184 and the right cam link pivot 188 both pivot clockwise about the right lower pivot 178.

At the same time the right crank arm 150 rotates toward the downward position, the left crank arm 148 rotates toward the 12 o'clock or upward position. As the left crank arm and left cam roller 154 move toward the upward position, the left cam link 166 pivots upward or counterclockwise (as viewed from the right side of the exercise device) about the left guide roller 196 (or left rear pivot 342). Therefore, the left cam link pivot 190 moves upwardly with the left cam link 166, which in turn pushes the left foot link upward 168. Because the left swing link 164 is held in a fixed position relative to the upper pivot 170, the range of motion of the left foot link 168 is limited to pivoting about the left lower pivot 179. As such, the left foot engaging portion 185 and the left cam link pivot 190 both pivot counterclockwise (as viewed from the right side of the exercise device) about the left lower pivot 179. The above described motions of the right and left foot links can be repeated to perform a stepping-type exercise.

It is to be appreciated that varying the contours and orientations of guide rails, links, and cam surfaces can affect how the foot engaging portions on the foot links move for varying stride lengths. As such, embodiments of the exercise device can utilize various lengths, shapes, and orientations of rails, linkage components, and cam surfaces so as to alter how the user's foot will move throughout a given stride length. For example, FIGS. 20A-20B and 21A-21B are schematic representations of third 100" and fourth exercise devices 100'" that generally correspond with the two exercise devices 100", 100'" shown in FIGS. 1A-2 and 10-11, respectively. However, the third and fourth exercise devices have differently shaped linkage assembly components. It should be noted that the frames 102", 102'" shown in FIGS. 20A-20B and 21A-21B are simplified schematic representations. As such, it is to be appreciated that various frame configurations and orientations can be utilized with the present invention other than what is depicted and described herein. For example, the third and fourth exercise devices can be configured with variations of the frames 102, 102' described with reference to FIGS. 1A-2 and 10-11, respectively.

Figure 20A:
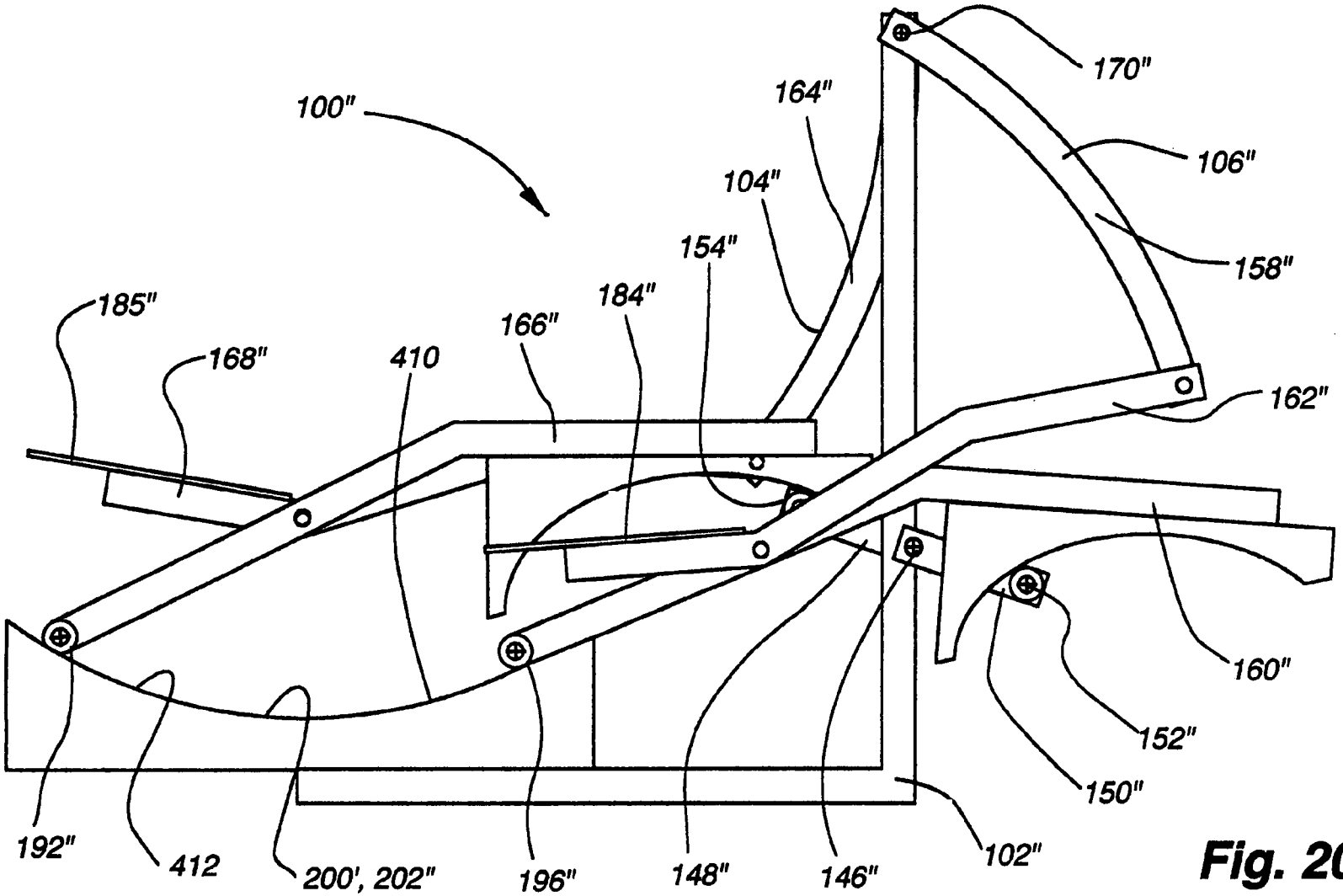
FIG. 20A is a right side view of a third embodiment of a variable stride exercise device, showing the right crank arm in a forward position and the foot links in an expanded stride configuration.
Figure 20B:
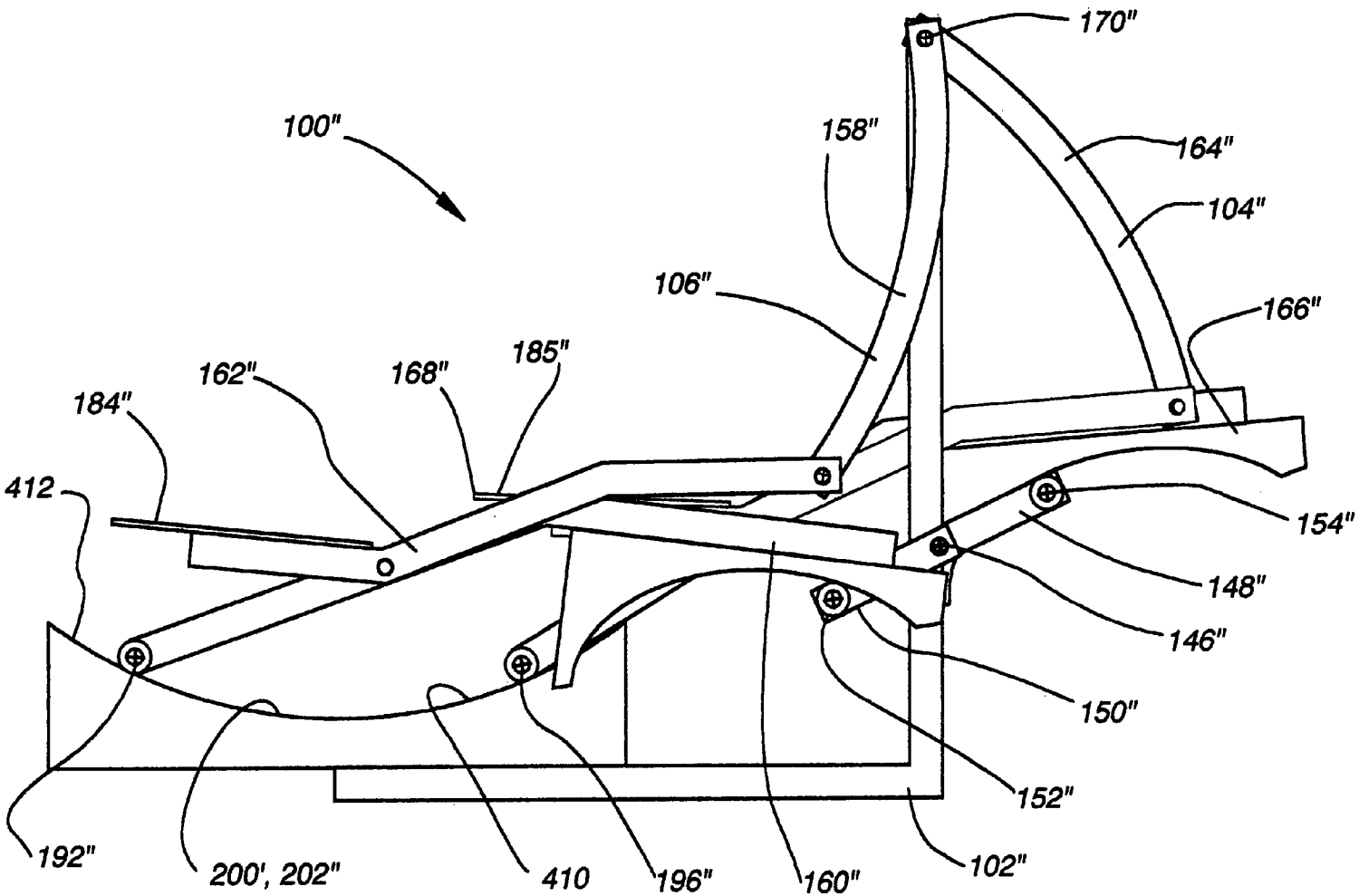
FIG. 20B is a right side view of the third embodiment of a variable stride exercise device, showing the right crank arm in a rearward position and the foot links in an expanded stride configuration.

As shown in FIGS. 20A-20B, the third exercise device 100" includes linkage assemblies 104", 106" having the same components as described above with reference to the exercise device of FIGS. 1A-2. As such, the exercise device 100" is operated in the substantially the same manner as described above with reference to the first exercise device 100. However, the third exercise device 100" structurally differs from the first exercise device 100 in various ways. For example, the third exercise device includes right and left swing links 158", 164" depicted as being curved and relatively shorter than the swing links 158, 164 shown in FIGS. 1A-1B. In addition, the third exercise device includes a crank axis 146" that is located substantially directly below an upper pivot 170". Further, right and left rails 202", 200" of the third exercise device are arcuately-shaped, as opposed to being flat. The arcuate rails may also be defined by a fixed or varying radius.

Due to the aforementioned structural differences, the exercise device 100" shown in FIGS. 20A-20B can provide a user with a foot path that may be different from that which is described above with reference to the first exercise device 100. For example, during exercise, right and left guide rollers 192", 196" rotatably connected with rear portions of the left and right cam links 166", 160" will follow an arcuate path defined by the shape of the arcuate guide rails 200", 202". For example, a rear portion of the right cam link 160" tracks the contour of the arcuate right rail 202" as the right guide roller 192" rolls from a forward upwardly extending portion 410 (see FIG. 20A) to a rearward upwardly extending portion 412 (see FIG. 20B) of the right rail. In addition, a rear portion of the left cam link 166" tracks the contour of the arcuate left rail 200" as the left guide roller 196" rolls from the rearward upwardly extending portion 412 (see FIG. 20A) to the forward upwardly extending portion 410 (see FIG. 20B) of the left rail. As such, the path of movement of the guide rollers along the rails includes a horizontal component and a vertical component. As the guide rollers 192", 196" travel toward the forward and rearward portions 410, 412 of the arcuate rails 202", 200", the vertical component of guide roller movement increases.

As previously described above with reference to the first exercise device 100, varying the user's stride length varies the distance in which the guide roller moves along the rail along with the distance in which the cam member moves along the cam roller. For example, as the user increases his stride length, the distance in which the guide rollers move along the rails increases, as does the distance in which the cam members pass over the cam rollers. As such, it is to also be appreciated that as the guide rollers 192", 196" move toward the forward and rearward portions 410, 412 of the arcuate rails 202", 200", the user will encounter a greater resistance to motion. When the guide rollers 192", 196" move toward the forward portions 410 of the arcuate guide rails 202", 200" the increased resistance is caused by forces exerted rearwardly in a horizontal direction on the guide rollers by the arcuate rails as the guide rollers engage the forward upwardly extending portion of the rails. Similarly, when the guide rollers move toward the rearward portions 412 of the arcuate guide rails the increased resistance is caused by forces exerted forwardly in a horizontal direction on the guide rollers by the arcuate rails as the guide rollers engage the rearward upwardly extending portion of the rails.

As previously mentioned, varying the contours of the rails and cam surfaces affect how the foot engaging portions move for varying stride lengths. For example, as shown in FIG. 20A, when the right foot link 162" is in a forward position, the shape of the right rail 202" in conjunction with the shape of the right cam surface act to position to the right foot engaging portion 184" on the right foot link such that a user's foot is positioned with the user's toes slightly raised relative to the user's heel. In another example, as shown in FIG. 20B, when the right foot link 162" is in a rearward position, the shape of the right rail 202" in conjunction with the shape of the right cam surface act to position to the foot engaging portion such that a user's foot will be positioned with the user's heel slightly raised relative to the user's toes. As such, other embodiments of the exercise device can utilize various lengths and shapes of the rails and cam surface so as to alter how the user's foot will move throughout a given stride length.

Figure 21A:
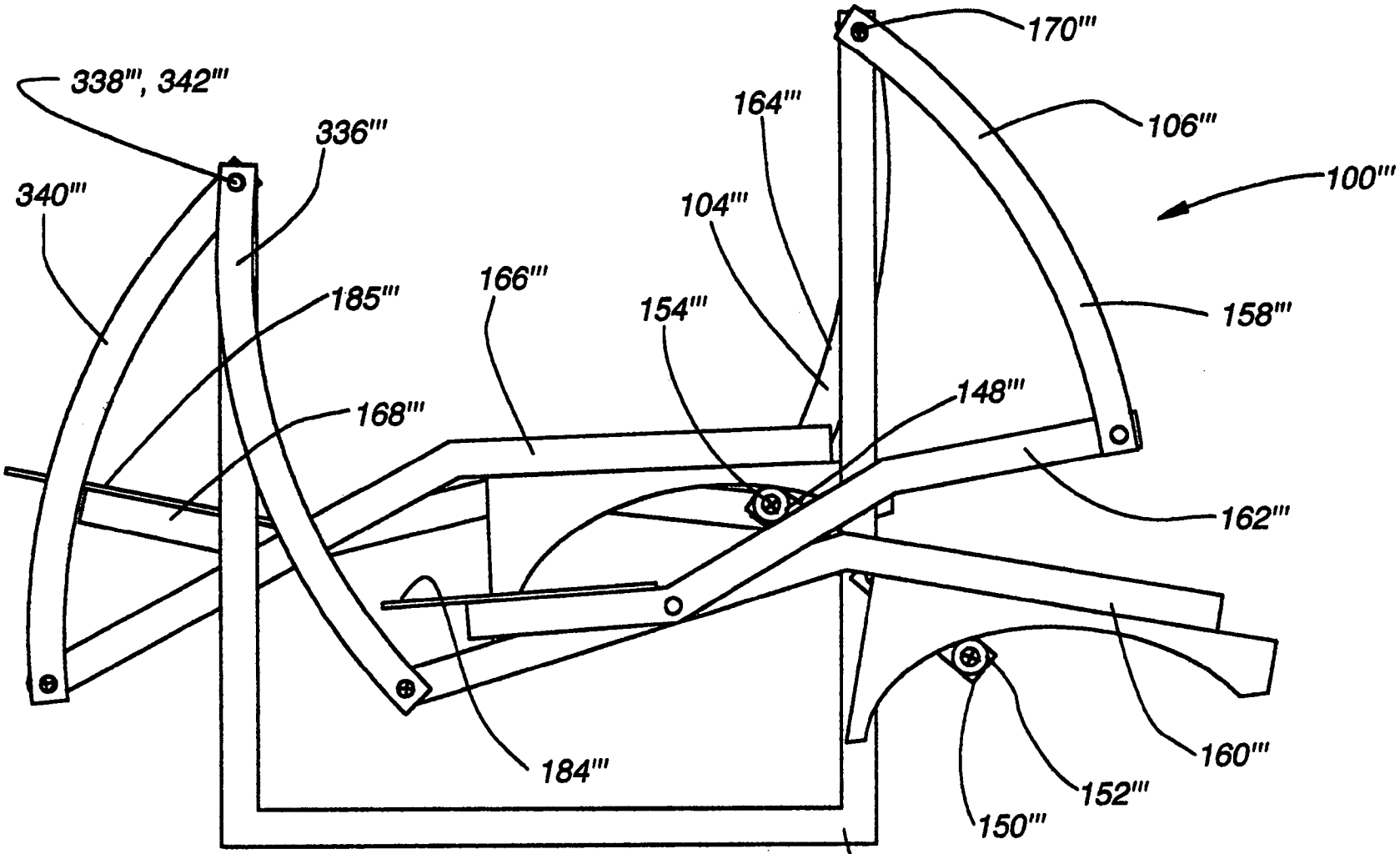
FIG. 21A is a right side view of a fourth embodiment a variable stride exercise device, showing the right crank arm in a forward position.
Figure 21B:
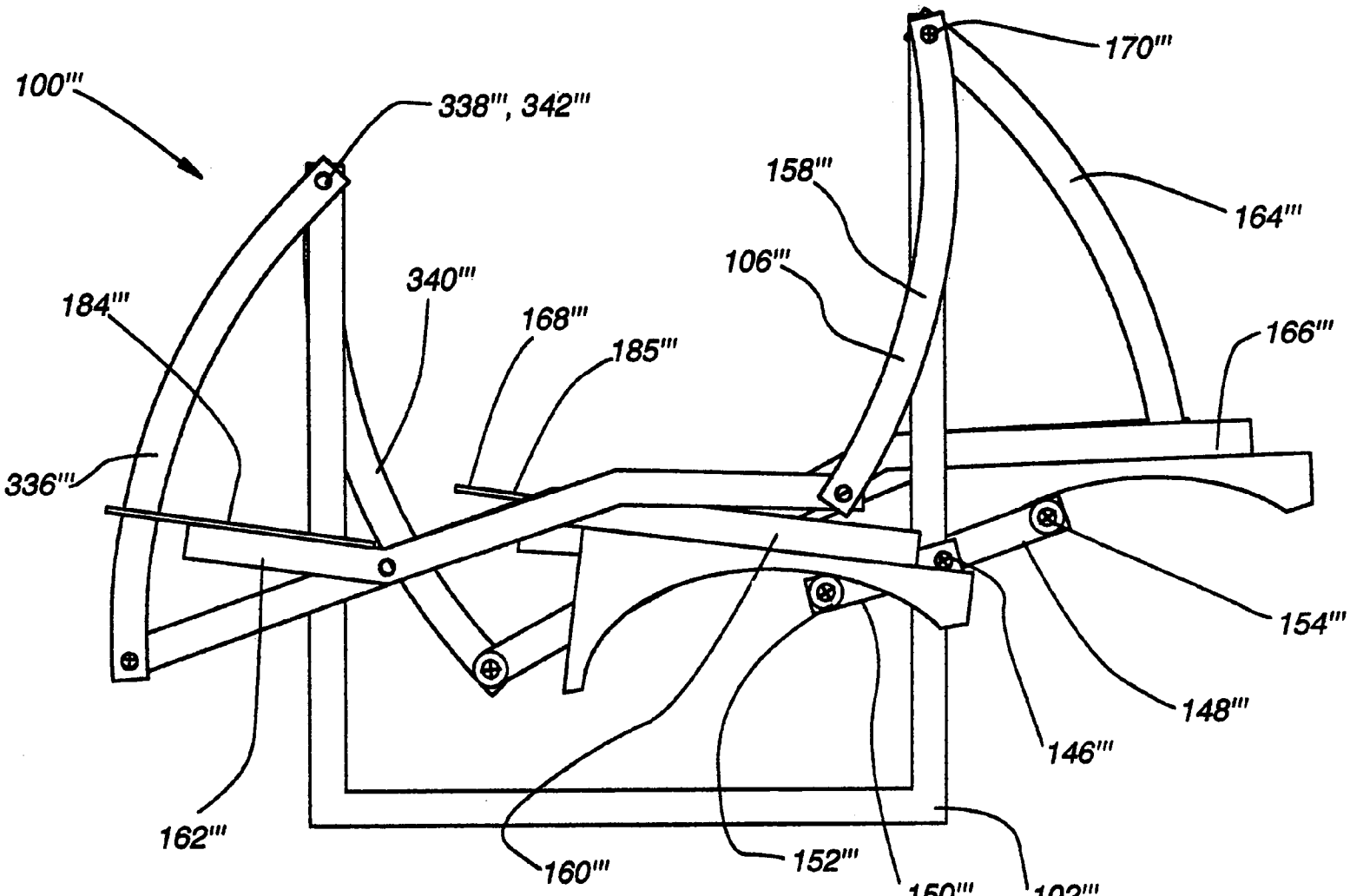
FIG. 21B is a right side view of the fourth embodiment a variable stride exercise device, showing the right crank arm in a rearward position.

A fourth embodiment of the exercise device 100'" is shown in FIGS. 21A and 21B, which provides another illustration of how various alterations of to the lengths, shapes, and orientations of the linkage components can alter how the user's foot will move throughout a given stride length. As previously mentioned, the fourth exercise device 100''' generally corresponds with the second exercise device 100' described above with reference to FIGS. 10-11. As shown in FIGS. 21A-21B, the fourth exercise device 100''' includes right and left linkage assemblies 106''', 104''' having the same components as described above with reference to the exercise device 100' of FIGS. 10-11. As such, the exercise device 100''' is operated in the substantially the same manner as described above with reference to the second exercise device 100'. However, the fourth exercise device 100''' structurally differs from the second exercise device 100' in various ways. For example, the fourth exercise device includes right and left swing links 158''', 164''' depicted as being curved and relatively shorter than the swing links 158', 164' shown in FIG. 10. In addition, the fourth exercise device includes a crank axis 146''' that is located substantially directly below an upper pivot 170'''. Further, right and left guide links 336''', 338''' of the fourth exercise device are arcuately-shaped.

Due to the aforementioned structural differences, the exercise device 100''' shown in FIGS. 21A-21B can provide a user with a foot path that may be different from that which is described above with reference to the second exercise device 100'. For example, during exercise, as shown in FIG. 21A, when the right foot link 162''' is in a forward position, the lengths and shapes of the linkage components in conjunction with the relative locations of the various pivots act to position to the right foot engaging portion 184''' such that a user's foot is positioned with the user's toes slightly raised relative to the user's heel. In another example, as shown in FIG. 21B, when the right foot link 162''' is in a rearward position, the right foot engaging portion 184''' is positioned such that a user's foot will be positioned with the user's heel slightly raised relative to the user's toes.

Additional embodiments of the variable stride exercise device conforming to aspects of the present invention are described below with reference to FIGS. 22A-28D. As described below, these additional embodiments include linkage assemblies that structurally differ from the exercise devices described above, but still allow a user to dynamically vary his stride path during exercise. It is to be appreciated that the features described in connection with each arrangement and embodiment of the invention are interchangeable to some degree so that many variations beyond those specifically depicted in the referenced figures are possible. For example, the frame structures are schematically represented in FIGS. 22A-28D as simple structures used to support linkage assemblies and other components. As such, it is to be appreciated that the exercise devices shown in FIGS. 22A-28D can utilize various types of frames having different components, including variations of the frames described above with reference to the first and second exercise devices. In addition, the crank arms of the exercise devices shown in FIGS. 22A-28D may be operatively connected with a motor, a flywheel, an electromagnetic resistance device, performance feedback electronics and other features or combination thereof. Further, the exercise devices shown in FIGS. 22A-28F can also include a flywheel and pulley arrangement and/or interconnection assemblies as described above.

As shown in FIGS. 22A-22D, a fifth embodiment of the exercise device 414 includes a right linkage assembly 416 and a left linkage assembly 418 operatively connected with a frame 420. As previously mentioned, the frame 420 shown in FIGS. 22A-22D is a schematic representation and is defined by base portion 422 and a front post 424 extending upwardly therefrom. The frame 420 also includes a cross member 426 extending rearwardly from an upper end portion of the front post 424. The right linkage assembly 416 includes a right swing link 428, a right roller guide link 430, a right foot link 432, and a right variable stride link 434 operatively connected with a right crank arm 436 and the frame to provide a variable stride path. Although the following description refers mainly to the components of the right linkage assembly, it is to be appreciated that the left linkage assembly is substantially a mirror image of the right linkage assembly, and as such, includes the same components as the right linkage assembly, which operate in relation with each other and with the frame as the right linkage assembly. For example, the left linkage assembly 418 includes a left swing link 438, a left roller guide link 440, a left foot link 442, and a left variable stride link 444 operatively connected with a left crank arm 446 and the frame.

Figure 22A:
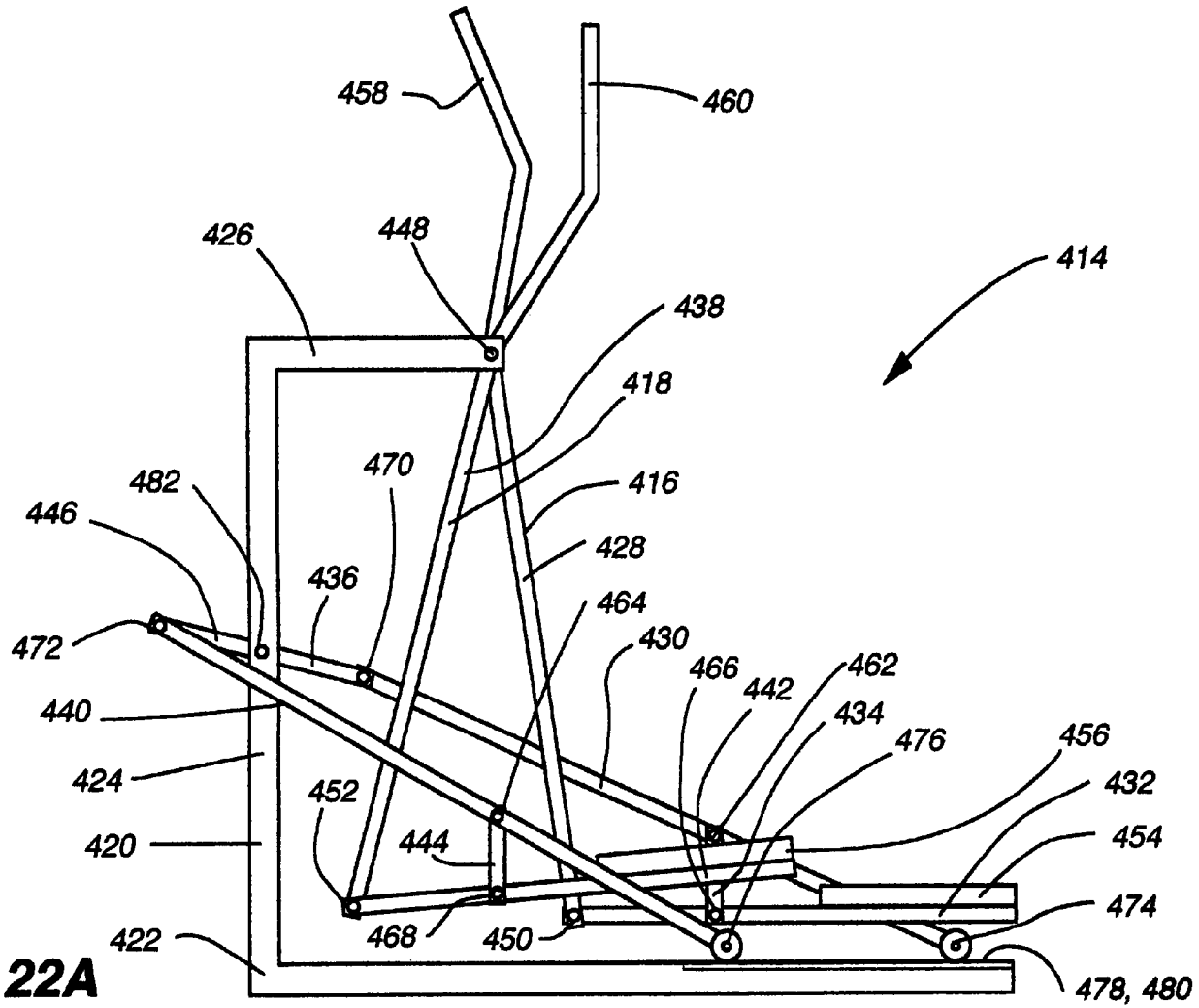
FIG. 22A is a left side view of a fifth embodiment of a variable stride exercise device utilizing variable stride links connected with roller guide links and foot links.
Figure 22B:
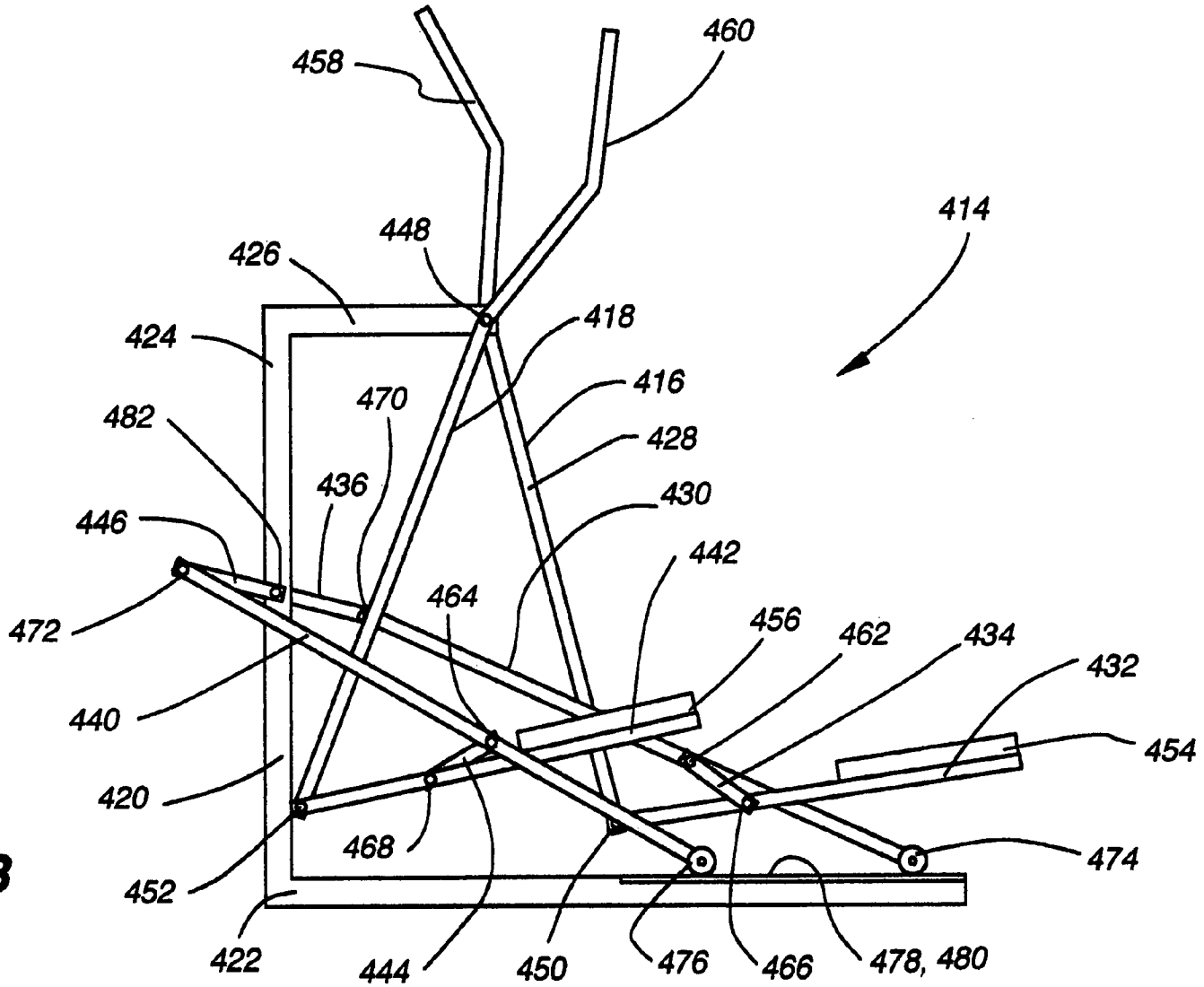
FIG. 22B is a left side view of the exercise device depicted in FIG. 22A showing the left foot link in a forward position and the right foot link a rearward position.

As shown in FIGS. 22A and 22B, upper portions of the swing links 428, 438 are pivotally connected with the cross-member 426 at an upper pivot 448. Lower portions of the swing links 428, 438 are pivotally connected with forward end portions of the foot links 432, 442 at lower pivots 450, 452. A rearward portion of the right foot link 432 supports a right foot engaging portion 454, and the rearward portion of the left foot link 442 supports a left foot engaging portion 456. As described above with reference to other embodiments, the foot engaging portion can include a rectangular foot pad meant to support a user's foot. The foot engaging portions may also be directly connected with the top of the foot links or may be pivotally supported so that they articulate during use or their angular relations with the foot links vary.

As shown in FIGS. 22A and 22B, the fifth exercise device 414 also includes right and left lever arms 458, 460 connected with the corresponding right and left swing links 428, 438. The lever arms extend from the respective swing links upwardly from the upper pivot to provide hand grips or a user of the exercise device. As previously described with reference to other embodiments, the lever arms form rigid mechanical extensions of the swing links, and rotate about the upper pivot during exercise. In operation, the user of the exercise machine grips one of lever arms in each of his left and right hands, and pulls or pushes on the lever arms in coordination with the rearwardly and forwardly movement of the foot links. As the lever arms impact a force on the foot links, the forces from the lever arms may also act to cause a variation in the stride path.

As previously mentioned, the exercise device 414 includes variable stride links 434, 444 to provide the variable stride feature of the fifth embodiment. As shown in FIGS. 22A and 22B, first end portions of the variable stride links 434, 444 are pivotally connected with the roller guide links 430, 440 at first stride pivots 462, 464, and second end portions of the variable stride links are pivotally connected with foot links 432, 442 at second stride pivots 466, 468. The variable stride link helps to support the foot link under the roller guide link so that the foot link may swing back and forth, with respect to the roller guide link, during use. As shown in FIGS. 22A-22B, forward portions of the roller guide links 430, 440 are pivotally connected with the crank arms 436, 446 at guide pivots 470, 472, and rearward portions of the roller guide links are supported by right and left guide rollers 474, 476. More particularly, the guide rollers are rotatably connected with the rear portions of the roller guide links and are adapted to roll back and forth along rails 478, 480 connected with the base portion 422 of the frame 420. Although the right and left rails shown in FIGS. 22A and 22B are flat (i.e., level), the rails may also be inclined or declined, and may be arcuately-shaped with a fixed or varying radius.

As shown in FIGS. 22A and 22B, the crank arms 436, 446 are pivotally connected with the front post 424 at a crank axis 482. As previously described with respect to the other embodiments, the left and right crank arms are rotatably connected at the crank axis to travel along a circular path. The right and left crank arms can also be configured to travel 180 degrees out of phase with each other. Although crank arms are shown in the various devices described herein, it is to be appreciated that other assemblies providing a closed curve path or the like may also be utilized.

To operate the exercise machine shown in FIGS. 22A and 22B, a user places his feet in operative contact with the right and left foot engaging portions 454, 456 on the foot links 432, 442. The user then exercises by striding forwardly toward the front post 424. Forces imparted to the foot engaging portions by the user cause the foot links to move back and forth, which in turn cause the swing links 428, 438 to pivot back and forth around the upper pivot 448. At the same time, the crank arms 436, 446 rotate around the crank axis 482. Rotation of the crank arms in conjunction with the movement of the foot links, cause the rear portions of the roller guide links 430, 440 to roll back and forth along the rails. Because the foot links are pivotally supported by the roller guide links through the variable stride links 434, 444, the paths in which the foot links move are variable and can be affected by the stride length and power of the user as the crank arms rotate. As such, the paths in which the foot links move are not solely dictated by the geometric constraints of the swing links, the crank arms, the roller guide links, and the frame. Therefore, the user can dynamically adjust the travel path of the of the foot engaging portion while using the exercise device based on the user's stride length. Generally, the amount of forward force on the foot link impacts the variable amount of the forward stride and the amount of rearward force on the foot link impacts the variable amount of rearward stride.

A comparison of FIGS. 22A and 22B illustrates how movement of the variable stride links 434, 444 can affect the position of the foot engaging portions 454, 456 for given crank arm positions, which in turn, provides for a variable stride path. The crank arms 436, 446 are illustrated in the substantially the same positions in FIGS. 22A and 22B. More particularly, the left crank arm 446 is positioned forwardly, just above the nine o'clock position, and the right crank arm 436 is positioned rearwardly, just below the three o'clock position. As shown in FIG. 22A, the left foot link 442 is in a position forward of the right foot link 432, and the variable stride links 434, 444 are substantially vertically oriented.

As shown in FIG. 22B, the left foot link 442 is moved in a more forward position than that which is depicted in FIG. 22A, and the right foot link 432 is moved in a more rearwardly position than that which is depicted in FIG. 22A. The change in foot link positions between FIGS. 22A and 22B is accomplished through rotation of the variable stride links 434, 444 relative to the roller guide links 430, 440 and the foot links 432, 442. For example, movement of the left foot link 442 in a forward direction rotates the left variable stride link 444 in a clockwise direction about the first stride pivot 464 (as viewed from the left side of the exercise device) relative to the left roller guide link 440 from FIG. 22A to FIG. 22B. At the same time, the left swing link 438 and the left lever arm 460 rotate clockwise (as viewed from the left side of the exercise device) about the upper pivot 448. The left foot engaging portion 456 also moves forwardly and slightly upward between the arrangements of FIG. 22A and FIG. 22B. Also, as the left foot link 442 swings forward with respect to the left roller guide link 440, the left stride links also pivots to cause the left foot link to rise. Additionally, the left foot link 442 articulates as it swings forward causing the rear of the left foot link (associated with a user's heel) to move upward a relatively greater distance than the portion of the left foot link (at the front of the foot engaging portion) associated with a user's toe area.

As further illustrated in FIGS. 22A and 22B, movement of the right foot link 432 in a rearward direction rotates the right variable stride link 434 in a counterclockwise direction (as viewed from the left side of the exercise device) relative to the right guide link 430 from FIG. 22A to FIG. 22B. In addition, the right swing link 428 and the right lever arm 458 rotate counterclockwise (as viewed from the left side of the exercise device) about the upper pivot 448. The right foot engaging portion 454 also moves rearwardly and slightly upward such that a user's foot will be positioned with the user's heel slightly raised relative to the user's toes. In FIG. 22A, the right foot engaging portion 454 is nearly flat, with just a slight difference between the heel (higher) and the toe (lower). As such, from the position in FIG. 22A, a user's heel would rise with respect to the toe to the position shown in FIG. 22B. It is to be appreciated that varying the lengths and connection points of the variable stride links can affect how the foot engaging portions move for varying stride lengths, which in turn alter how the user's foot moves throughout a given stride.

As previously described with reference to other embodiments, a user of the exercise device 414 shown FIGS. 22A and 22B can dynamically adjust the travel path of the of the foot engaging portions while using the exercise device based on the user's natural stride length, stride power, and stride rate, which can result in numerous and varying types of foot paths for a particular user. More particularly, a user of the exercise device during more rigorous exercise can lengthen his stride by applying additional force to the foot engaging portions 454, 456, because the foot links 432, 442 are coupled with the roller guide links 430, 440 through variable stride links 434, 444, i.e., the foot links are not pivotally connected in fixed relation to the roller guide links. As such, forces applied to the foot engaging portions are translated from the foot links to the variable stride links, which allow the foot links to move relative to the roller guide links.

Figure 22D:
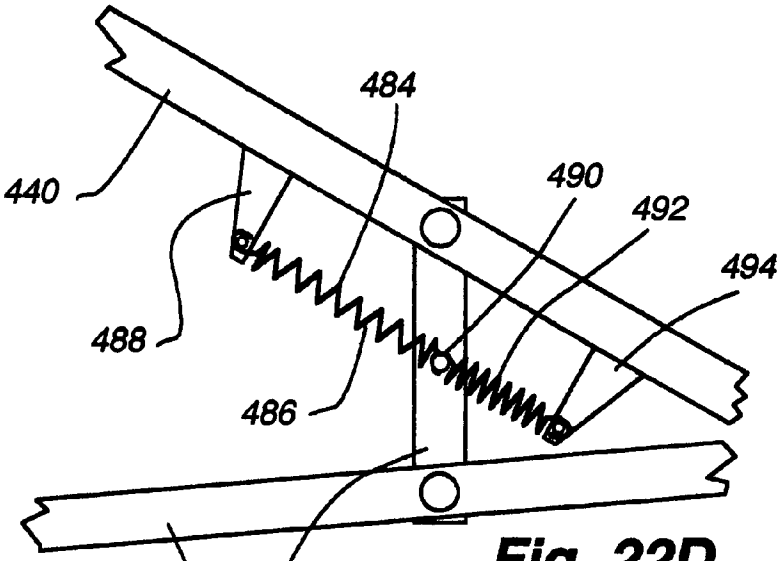
FIG. 22D is a detailed view of the spring connected with a left variable stride link shown in FIG. 22C.
Figure 22C:
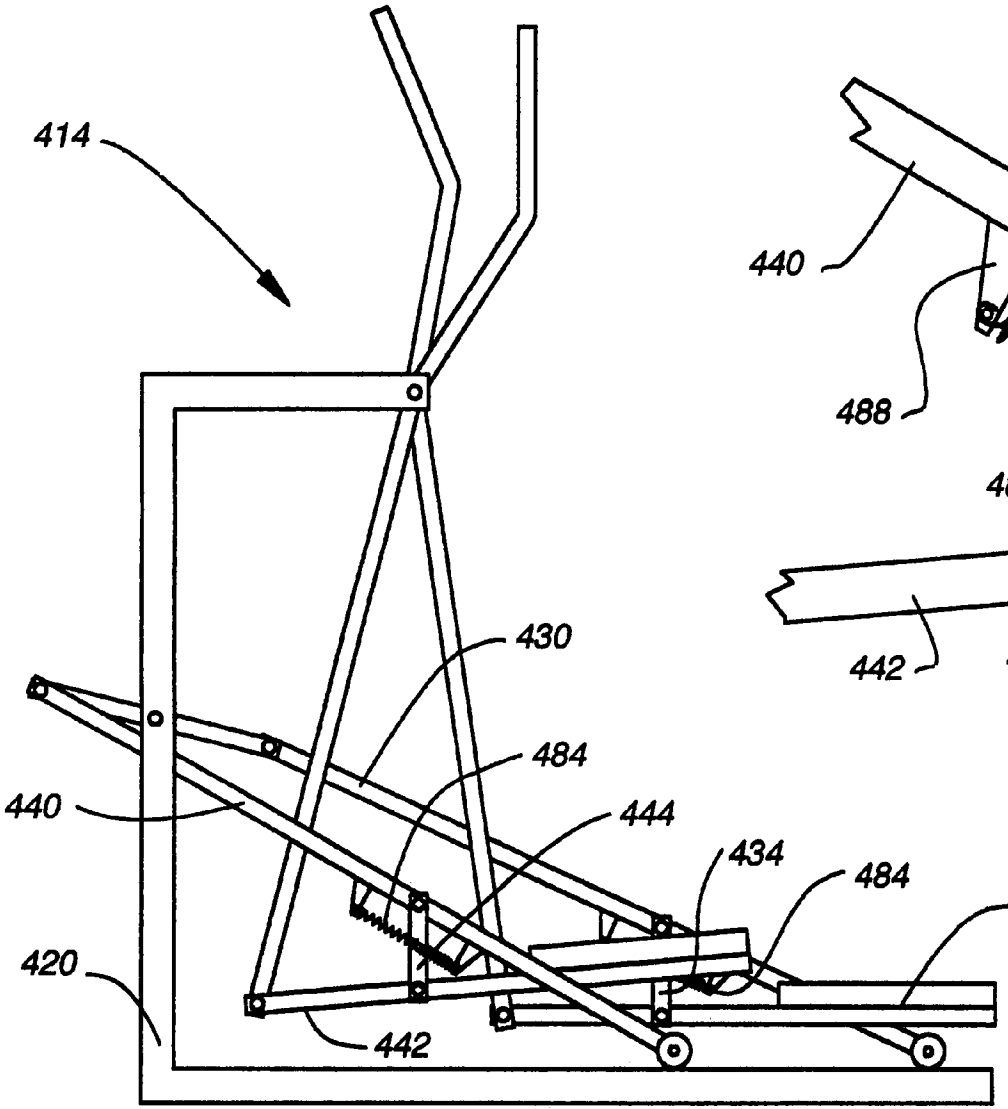
FIG. 22C is a left side view of the exercise device depicted in FIG. 22A utilizing springs connected with the variable stride links.

As shown in FIGS. 22C and 22D, the fifth embodiment of the exercise device 414 can also include spring assemblies 484 operatively connected with the variable stride links 434, 444 that are biased to maintain the variable stride links in a null position with respect to the foot links 432, 442. FIG. 22D shows a detailed view of the spring assembly 484 connected with the left variable stride link 444. As depicted, the spring assembly includes a first spring 486 connected between a first spring bracket 488 extending downward from the roller guide link 440 and a post 490 connected with the variable stride link 444. A second spring 492 is connected between the between a second spring bracket 494 extending downward from the roller guide link 440 and the post 490 connected with the variable stride link. The spring assemblies tend to limit the rearward-forward displacement of foot links relative to the roller guide links, while at the same time cushioning any shocks that might otherwise occur just prior to reversal of the direction of foot link movement. Each of the spring assemblies can utilize rearward and forward compression springs arranged to resist rearward and forward motion. The two springs in each spring assembly can also be configured to sufficiently compress and/or stretch during operation of the exercise machine so as to not unduly limit the largest length of stride permitted for the users when using naturally long strides.

Figure 23A:
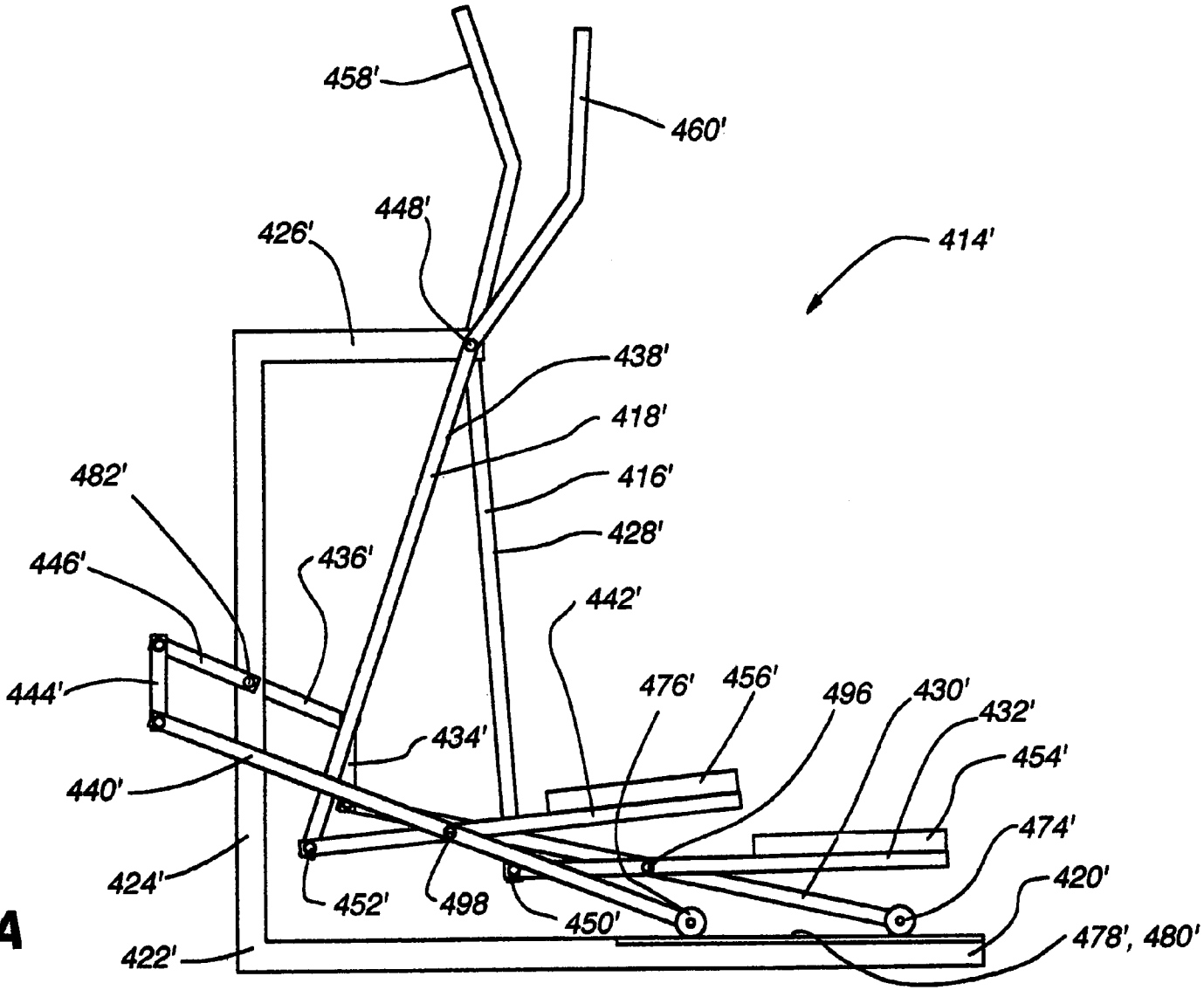
FIG. 23A is a left side view of a sixth embodiment of a variable stride exercise device utilizing variable stride links connected with roller guide links and crank arms.
Figure 23B:
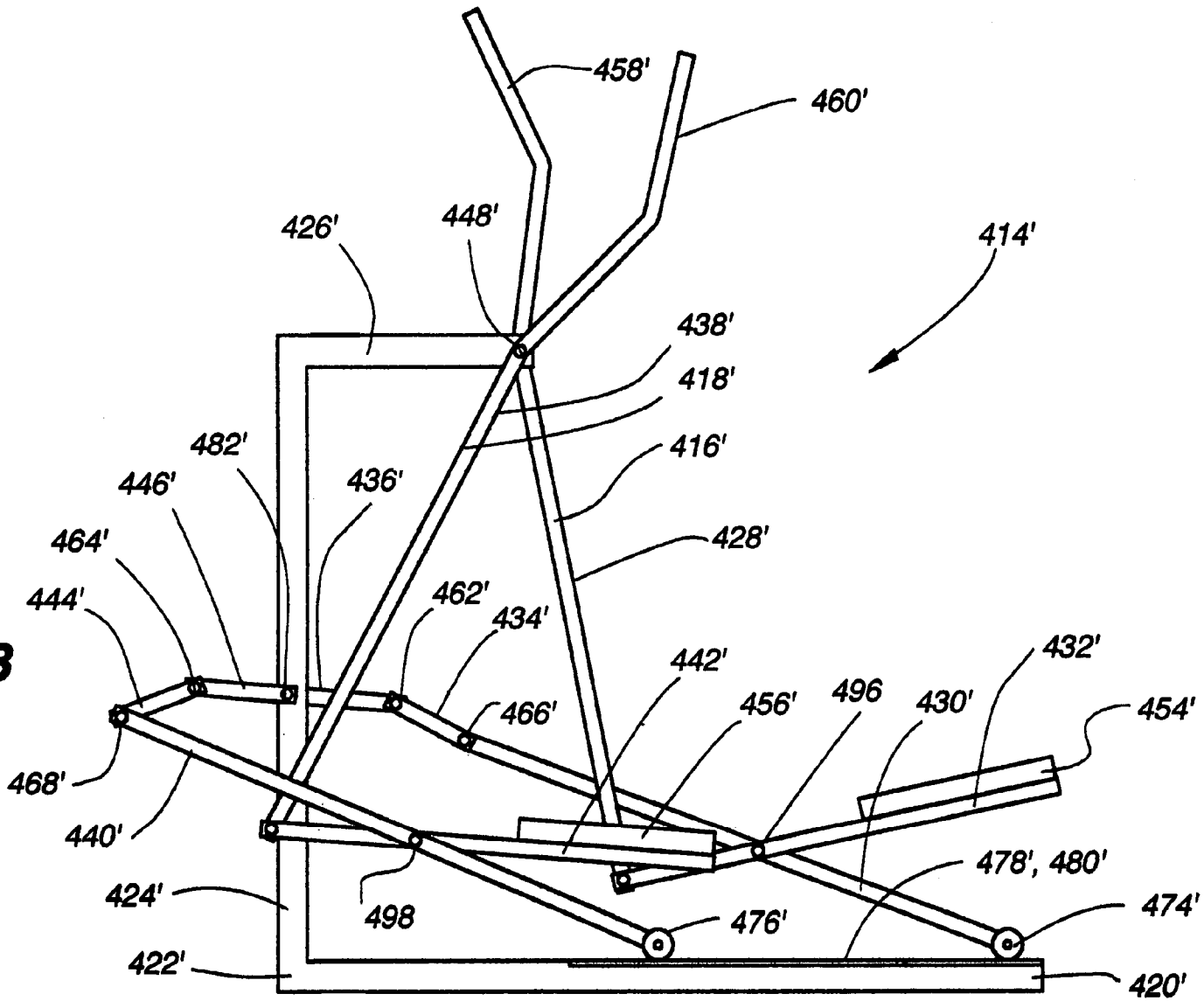
FIG. 23B is a left side view of the exercise device depicted in FIG. 23A showing left foot link in a forward position and the right foot link a rearward position.

A sixth embodiment of the exercise device 414' is illustrated in FIGS. 23A and 23B. The sixth embodiment 414' is similar to the fifth embodiment 414 depicted in FIGS. 22A and 22B. As such, the sixth embodiment 414' includes a right linkage assembly 416' and a left linkage assembly 418' operatively connected with a frame 420'. The right linkage assembly 416' includes a right swing link 428', a right roller guide link 430', a right foot link 432', and a right variable stride link 434' operatively connected with a right crank arm 436' and the frame to provide a variable stride path. In addition, the left linkage assembly 418' includes a left swing link 438', a left roller guide link 440', a left foot link 442', and a left variable stride link 444' operatively connected with a left crank arm 446' and the frame. Similar to the fifth embodiment, right and left foot engaging portions 454', 456' are supported on rearward portions of the foot links 432', 343'. However, in the sixth embodiment 414', the variable stride links 434', 444' are connected with different components of the left and right linkage assemblies than in the third embodiment 414. More particularly, the variable stride links 434', 444' are pivotally connected between the roller guide links 430', 440' and the crank arms 436', 446'. In addition, the forward end portions of the roller guide links 430', 440' are pivotally connected with the foot links 432', 442'.

As shown in FIGS. 23A and 23B, upper portions of the swing links 428', 438' are pivotally connected with the cross-member 426' at an upper pivot 448'. Lower portions of the swing links are pivotally connected with forward portions of the foot links 432', 442' at lower pivots 450', 452'. As described above with reference to the fifth embodiment, the sixth embodiment 414' also includes right and left lever arms 458', 460' connected with the corresponding right and left swing links 428', 438'. As shown in FIGS. 23A and 23B, the foot links 432', 442' are pivotally connected with the roller guide links 430', 440' at middle pivots 496, 498. As previously mentioned, the sixth exercise device also includes variable stride links 434', 444' to provide the variable stride feature of the sixth embodiment. As shown in FIGS. 23A and 23B, first end portions of the variable stride links 434', 444' are pivotally connected with the crank arms 436', 446' at first stride pivots 462', 464', and second end portions of the variable stride links are pivotally connected with forward end portions of the roller guide links 430', 440' at second stride pivots 466', 468'. The variable stride links pivotally support the forward end portions of the roller guide links from the crank arms so that the roller guide links may swing back and forth with respect to the crank arms during use. As discussed above with reference to the fifth embodiment, the rearward portions of the roller guide links 430', 440' are supported by right and left guide rollers 474', 476'. As such, the guide rollers are rotatably connected with the rear portions of the roller guide links and are adapted to roll back and forth along rails 478', 480' connected with the base portion 422' of the frame 420'.

As shown in FIGS. 23A and 23B, the crank arms 436', 446' are pivotally connected with the front post 424' at a crank axis 482'. As previously described with respect to the other embodiments, the left and right crank arms are rotatably connected at the crank axis to travel along a circular path. The right and left crank arms can also be configured to travel 180 degrees out of phase with each other. Although crank arms are shown in the various devices described herein, it is to be appreciated that other assemblies providing a closed curve path or the like may also be utilized.

To operate the exercise machine shown in FIGS. 23A and 23B, a user places his feet in operative contact with right and left foot engaging portions 454', 456' on the foot links 432', 442'. The user then exercises by striding forwardly toward the front post 424'. Forces imparted to the foot engaging portions by the user cause the foot links to move back and forth, which in turn cause the swing links 428', 438' to pivot back and forth around the upper pivot 448'. At the same time, the crank arms 436', 446' rotate around the crank axis 482'. Rotation of the crank arms in conjunction with the movement of the foot links cause the rear portions of the roller guide links 430', 440' to roll back and forth along the rails 478', 480'. Because the foot links 432', 442' are pivotally supported by the roller guide links 430', 440', which in turn, are pivotally supported by the crank arms 436', 446' through the variable stride links 434', 444', the paths in which the foot links move are variable and can be affected by the stride length of the user as the crank arms rotate. As such, the paths in which the foot links and roller guide links move are not solely dictated by the geometric constraints of the swing links, the crank arms, the roller guide links, and the frame. Therefore, the user can dynamically adjust the travel path of the of the foot engaging portion while using the exercise device based on the user's stride length.

A comparison of FIGS. 23A and 23B illustrates how the variable stride links 434', 444' can affect the position of the foot engagement sections along with a slight change in crank arm positions. The left crank arm 446' is shown in FIG. 23A in about the 10 o'clock position, and the left crank arm is shown in FIG. 23B in about the 9 o'clock position. As shown in FIG. 23A, the left foot link 442' is in a position that is forward of the right foot link 432', and the variable stride links 434', 444' are substantially vertically oriented. As shown in FIG. 23B, the left foot link is located in a more forwardly position than that which is depicted in FIG. 23A, and the right foot link is located in a more rearwardly position than that which is depicted in FIG. 23B.

The change in foot link positions between FIGS. 23A and 23B is accomplished mainly through rotation of the variable stride links 434', 444' relative to the roller guide links 430', 440'. For example, movement of the left foot link 442' in a forward direction relative to the left crank arm 446' rotates the left variable stride link in a clockwise direction about the first stride pivot 464' (as viewed from the left side of the exercise device) relative to the left crank arm from FIG. 23A to FIG. 23B. In addition, the left swing link 438' and the left lever arm 460' rotate clockwise (as viewed from the left side of the exercise device) about the upper pivot 448'. The left foot engaging portion 456' also moves forwardly and downward such that a user's foot will move from an orientation where the user's heel is slightly raised relative to the user's toes to a position where the user's heel is lowered with respect to the toe area.

As further illustrated in FIGS. 23A and 23B, movement of the right foot link 432' in a rearward direction rotates the right variable stride link 434' in a counterclockwise direction (as viewed from the left side of the exercise device) about the first stride pivot 462'. In addition, the right swing link 428' and the right lever arm 458' rotate counterclockwise about the upper pivot 448'. The right foot engaging portion 454' also moves rearwardly and slightly upward such that a user's foot will articulate from a fairly flat orientation in FIG. 23A to an orientation with the user's heel raised relative to the user's toes shown in FIG. 23B. It is to be appreciated that varying the lengths and connection points of the variable stride links can also affect how the foot engaging portions move for varying stride lengths, which in turn alter how the user's foot moves throughout a give stride length.

The exercise devices previously described and illustrated may be considered "front drive" devices, wherein the crank arms are located toward the front of the exercise device. In contrast, the exercise devices depicted and discussed below with respect to FIGS. 24A-25 may be considered "rear drive" exercise devices, wherein the crank arm are located toward the rear of the exercise device.

Figure 24A:
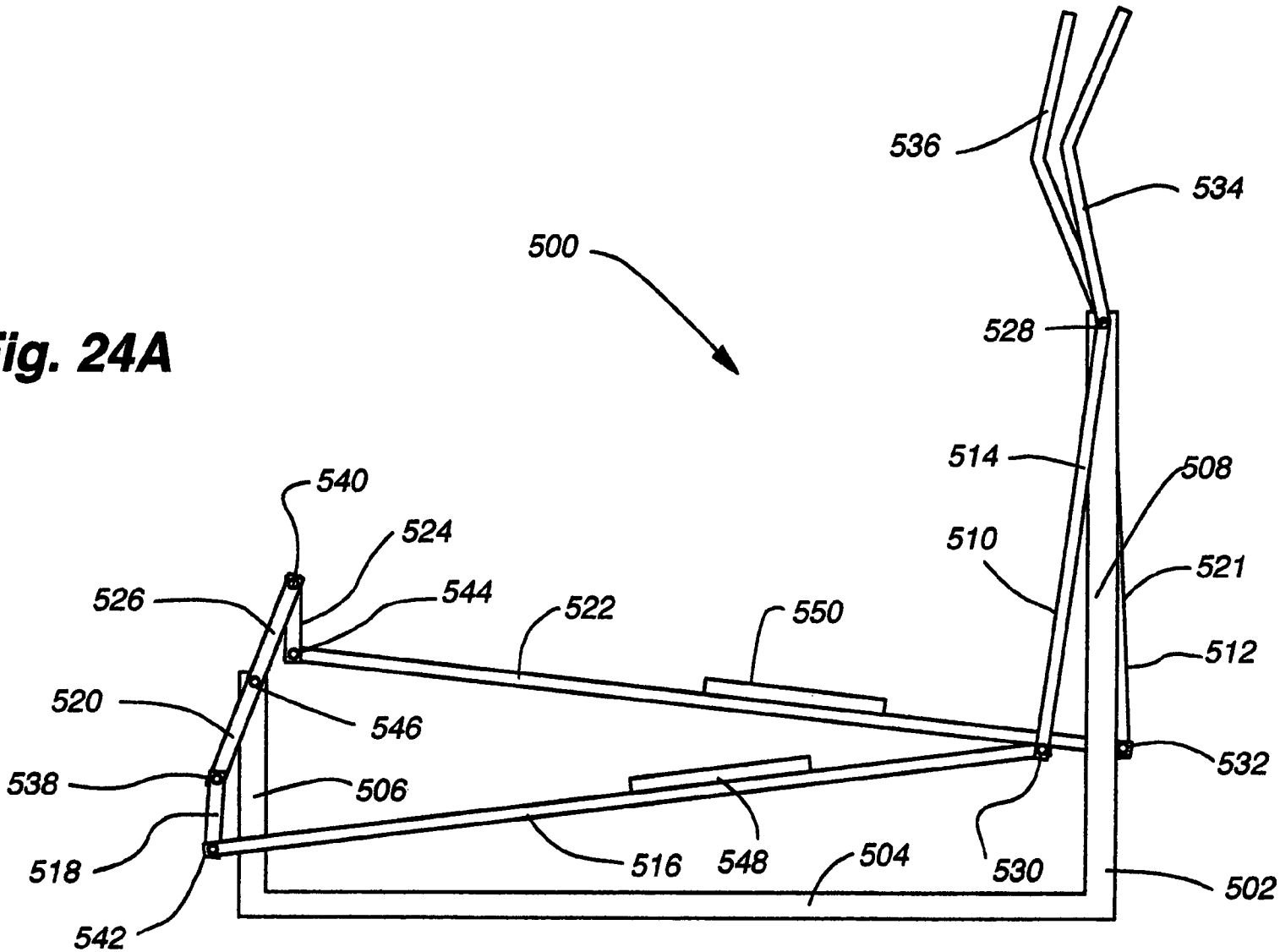
FIG. 24A is a right side view of a seventh embodiment of a variable stride exercise device utilizing variable stride links connected with foot links and crank arms.
Figure 24B:
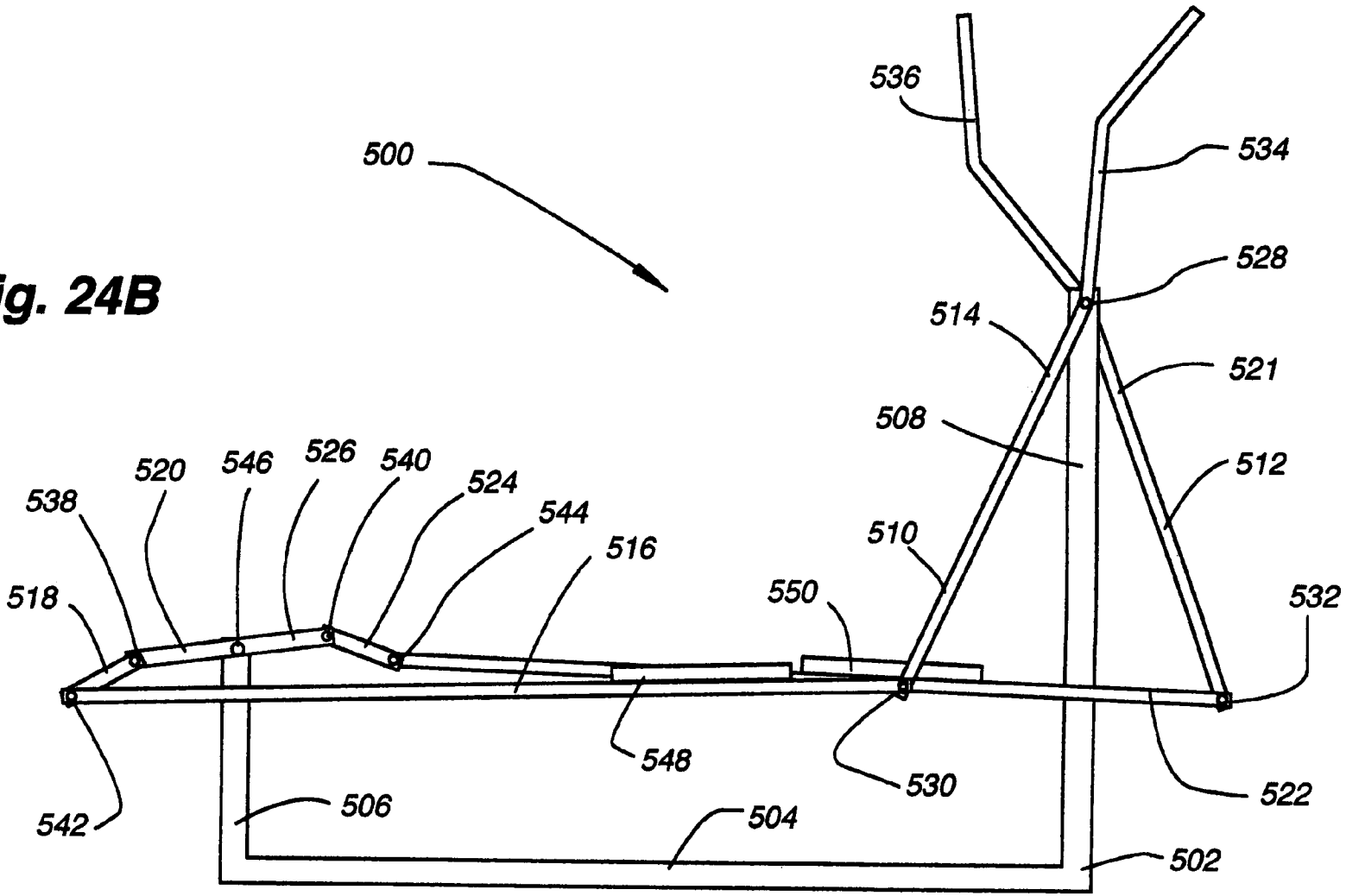
FIG. 24B is a right side view of the exercise device depicted in FIG. 24A with the left foot link in a forward position and the right foot link in a rearward position.

A seventh embodiment of the exercise device 500 shown in FIGS. 24A and 24B in includes schematic representation of a frame 502 including a base portion 504. A rear post 506 and a front post 508 extend upwardly from opposing end portions of the base portion. The seventh embodiment 500 also includes a right linkage assembly 510 and a left linkage assembly 512 operatively connected with the frame. The right linkage assembly 510 includes a right swing link 514, a right foot link 516, and a right variable stride link 518 operatively connected with a right crank arm 520 and the frame to provide a variable stride path. In addition, the left linkage assembly includes a left swing link 520, a left foot link 522, and a left variable stride link 524 operatively connected with a left crank arm 526 and the frame. The variable stride links 518, 524 are connected with different components of the left and right linkage assemblies than in the previously described embodiments. More particularly, the variable stride links are pivotally connected between the foot links and the crank arms.

As shown in FIGS. 24A and 24B, upper portions of the swing links 514, 521 are pivotally connected with the front post 508 at an upper pivot 528. Lower portions of the swing links are pivotally connected with forward portions of the foot links 516, 522 at lower pivots 530, 532. Similar to the previously described embodiments, the seventh embodiment 500 shown in FIGS. 24A and 24B also includes right and left lever arms 534, 536 connected with the corresponding right and left swing links 514, 521. As previously mentioned, the variable stride links are pivotally connected with the foot links and the crank arms. More particularly, first end portions of the variable stride links 518, 524 are pivotally connected with the crank arms 520, 526 at first stride pivots 538, 540, and second end portions of the variable stride links are pivotally connected with rear end portions of the foot links 516, 522 at second stride pivots 542, 544. The crank arms 520, 526 are pivotally connected with the rear post 506 at a crank axis 548. As previously described with respect to other embodiments, the left and right crank arms are rotatably connected at the crank axis to travel along repeating circular paths and can also be configured to travel 180 degrees out of phase with each other.

As shown in FIGS. 24A and 24B, the right foot link 516 supports a right foot engaging portion 548, and the left foot link 522 supports a left foot engaging portion 550. As described above with reference to other embodiments, the foot engaging portions can include a rectangular foot pad meant to support a user's foot. The foot engaging portions may also be directly connected with the top of the foot links or may be pivotally supported so that they articulate during use or their angular relations with the foot links vary.

To operate the exercise machine shown in FIGS. 24A and 24B, a user places his feet in operative contact with the right and left foot engagement portions 548, 550 on the foot links 516, 522. The user then exercises by striding forwardly toward the front post 508. Forces imparted to the foot engaging portions by the user cause the foot links to move back and forth, which in turn cause the swing links 514, 521 to pivot back and forth around the upper pivot 528. At the same time, the crank arms 520, 526 rotate around the crank axis 546. Because the rear end portions of the foot links 516, 522 are pivotally supported by the crank arms 520, 526 through the variable stride links 518, 524, the paths in which the foot links move are variable and can be affected by the stride of the user. As such, the paths in which the foot links move are not solely dictated by the geometric constraints of the swing links, the crank arms, and the frame. Therefore, the user can dynamically adjust the travel path of the of the foot engaging portion while using the exercise device based on the user's stride length.

A comparison of FIGS. 24A and 24B illustrates how the variable stride links 518, 524 can affect the position of the foot links 516, 522 along with a change in crank arm position 520, 526, which in turn, provides for a variable stride path as the crank arms rotate. The left crank arm 526 is shown in FIG. 24A in about the 1 o'clock position, and the variable stride links are substantially vertically oriented. The left crank arm is shown in FIG. 24B in about the 3 o'clock position. In addition, as shown in FIG. 24B, the left foot link 522 is moved in a more forwardly position than that which is depicted in FIG. 24A, and the right foot link 516 is moved in a more rearwardly position than that which is depicted in FIG. 24A.

The change in foot link positions between FIGS. 24A and 24B is accomplished partially as a result of the rotation of the crank arms 518, 526, and partially as result of the rotations of the variable stride links 518, 524 relative to the crank arms. For example, movement of the left foot link 522 in a forward direction relative to the left crank arm 526 rotates the left variable stride link 524 in a counterclockwise direction (as viewed from the right side of the exercise device) about the first stride pivot 540 from FIG. 24A to FIG. 24B. In addition, the left swing link 521 and the left lever arm 536 rotate counterclockwise (as viewed from the right side of the exercise device) about the upper pivot 528. The left foot engaging portion 550 also moves forward and slightly downward such that a user's foot will be positioned almost parallel with the base portion 504 of the frame 502.

As further illustrated in FIGS. 24A and 24B, movement of the right foot link 516 in a rearward direction relative to the right crank arm 520 rotates the right variable stride link 518 in a clockwise direction (as viewed from the right side of the exercise device) about the first stride pivot 538 from FIG. 24A to FIG. 24B. In addition, the right swing link 510 and the right lever arm 534 rotate clockwise (as viewed from the right side of the exercise device) about the upper pivot 528. The right foot engaging portion 548 also moves rearwardly and slightly upward such that a user's foot will be positioned almost parallel with the base portion of the frame. It is to be appreciated that varying the lengths and connection points of the variable stride links can also affect how the foot engaging portions move for varying stride lengths, which in turn, alter how the user's foot moves throughout a give stride length.

Figures 25, 25A:
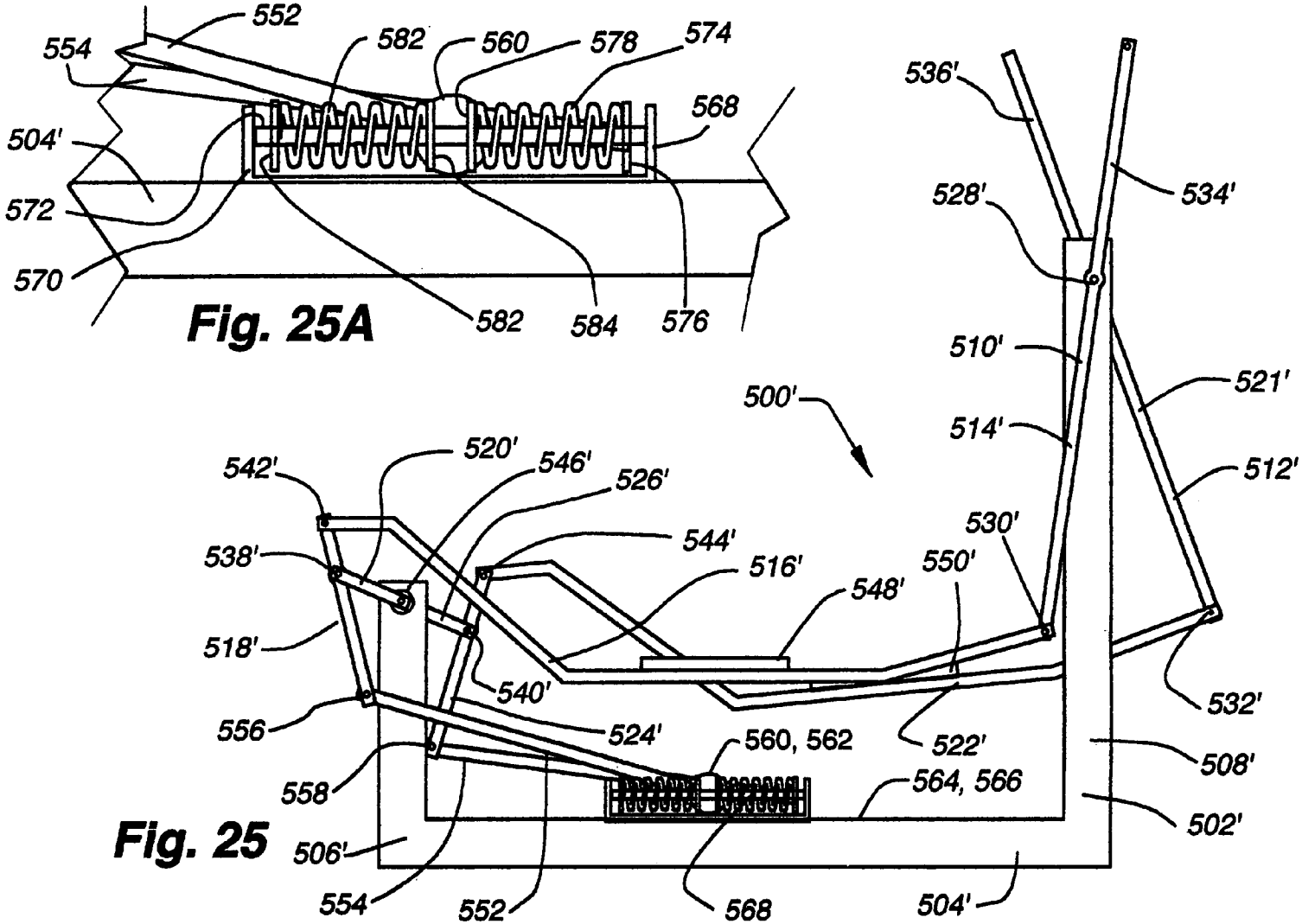
FIG. 25 is a right side view of an eighth embodiment of a variable stride exercise device utilizing variable stride links connected with roller guide links, crank arms, and foot links.
FIG. 25A is a detailed view of a spring assembly shown in FIG. 25.

An eighth embodiment of the exercise device 500' is shown in FIG. 25, which generally resembles a hybrid of the sixth embodiment 414' depicted in FIGS. 23A and 23B and the seventh embodiment 500 depicted in FIGS. 24A and 24B. As such, the eighth embodiment includes a frame 502' including a base portion 504' with a rear post 506' and a front post 508' extending upwardly therefrom. The eighth embodiment 500' also includes a right linkage assembly 510' and a left linkage assembly 512' operatively connected with the frame 502'. The right linkage assembly includes a right swing link 514', a right foot link 516', a right roller guide link 552, and a right variable stride link 518' operatively connected with a right crank arm 520' and the frame to provide a variable stride path. In addition, the left linkage assembly includes a left swing link 521', a left foot link 522', a left roller guide link 554, and a left variable stride link 524' operatively connected with a left crank arm 526' and the frame. The variable stride links 518', 524' are connected with different components of the left and right linkage assemblies than in the previously described embodiments. More particularly, the variable stride links are pivotally connected with the foot links 516', 522', the roller guide links 552, 554, and the crank arms 520', 526'.

Similar to the seventh embodiment, upper portions of the swing links 514', 521' of the eighth embodiment are pivotally connected with the front post 508' at an upper pivot 528'. Lower portions of the swing links are pivotally connected with forward portions of the foot links 516', 522' at lower pivots 530', 532'. Similar to the sixth and seventh embodiments described above, the eighth embodiment shown in FIG. 25 also includes lever arms 534', 536' connected with corresponding swing links. The foot links shown in FIG. 25 also support foot engaging portions 548', 550'.

As previously mentioned, the variable stride links are connected with the foot links, cranks arms, and roller guide links. More particularly, as shown in FIG. 25, mid portions of the variable stride links 518', 524' are pivotally connected with the crank arms at first stride pivots 538', 540'. The crank arms are pivotally connected with the rear post 506' at the crank axis 546'. As previously described with respect to other embodiments, the left and right crank arms are rotatably connected at the crank axis to travel along repeating circular paths and can also be configured to travel 180 degrees out of phase with each other. Still referring to FIG. 25, first end portions of the variable stride links are pivotally connected with rear end portions of the foot links 516', 522' at second stride pivots 542', 544'. The variable stride links are also pivotally connected with rear end portions of the roller guide links 552, 544 at third stride pivots 556, 558.

As shown in FIG. 25, forward end portions of the roller guide links are supported by right and left guide rollers 560, 562. More particularly, the guide rollers 560, 562 are rotatably connected with the forward portions of the roller guide links and are adapted to roll back and forth along right and left rails 564, 566 connected with the base portion 504' of frame 502' when the exercise device is in use. Each guide rollers is also operatively connected with a spring assembly 568. FIG. 25A shows a detailed view of the spring assembly operatively connected with the right guide roller 560. As depicted, the spring assembly includes a spring base 570 supporting a center bar 572.

A first linear spring 574 is supported on the center bar 572 between a forward stop 576 and a forward compression member 578 connected with the guide roller 560. As second linear spring 582 is supported on the center bar 572 between a rearward stop 582 and a rearward compression member 584 connected with guide roller 560. As the roller guide links move back and forth, the guide rollers roll forward and rearward along the rails. In turn, as the guide roller moves forward, the forward compression member acts to compress the first linear spring, and as the guide roller moves rearward, the rearward compression member acts to compress the second linear spring. Similar to the spring assemblies described above with reference to the fifth embodiment shown in FIGS. 22C and 22D, the spring assemblies 568 in FIG. 25 tend to provide resistance to rearward-forward displacement of the foot links relative to the crank arms.

To operate the exercise machine shown in FIG. 25, a user places his feet in operative contact with foot engaging portions 548', 550' on the foot links 516', 522'. The user then exercises by striding forwardly toward the front post 508'. Forces imparted to the foot engaging portions by the user cause the foot links to move back and forth, which in turn cause the swing links 514', 521' to pivot back and forth around the upper pivot 528'. At the same time, the crank arms 520', 526' rotate around the crank axis 546'. As the crank arms rotate, the roller guide links 552, 554 move back and forth, causing the guide rollers 560, 562 to roll rearward and forward along the rails 564, 566. Movement of the guide rollers also causes compression of the first and second linear springs 574, 582 described above. Because rear end portions of the foot links are pivotally supported by the crank arms through the variable stride links, the paths in which the foot links move are variable and can be affected by the stride length of the user as the crank arms rotate. As such, the paths in which the foot links move are not solely dictated by the geometric constraints of the swing links, the crank arms, and the frame. Therefore, the user can dynamically adjust the travel path of the of the foot engaging portion while using the exercise device based on the user's stride length.

Figure 26A:
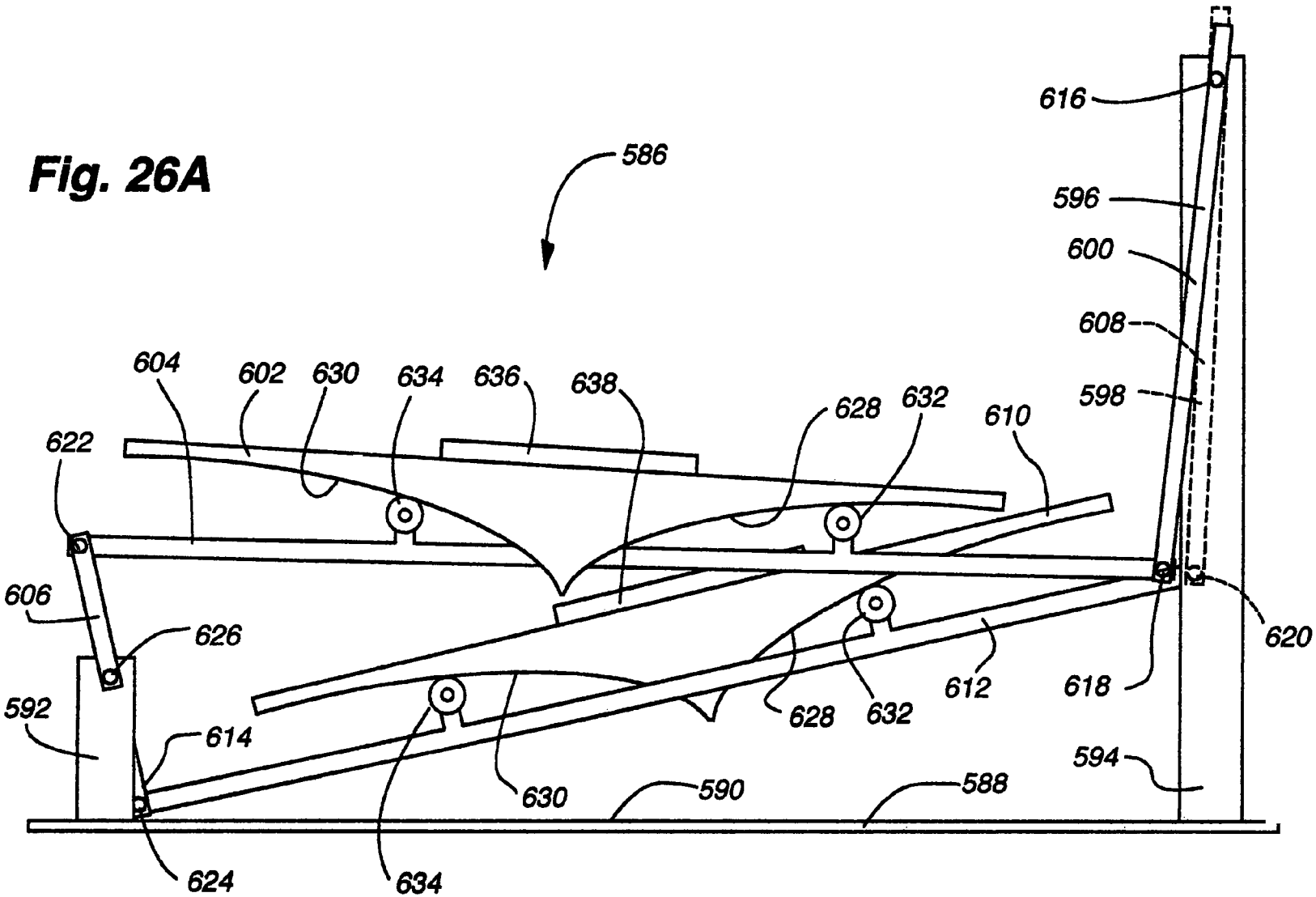
FIG. 26A is a right side view of a ninth embodiment of a variable stride exercise device utilizing foot links having forward and rearward cam surfaces.
Figure 26B:
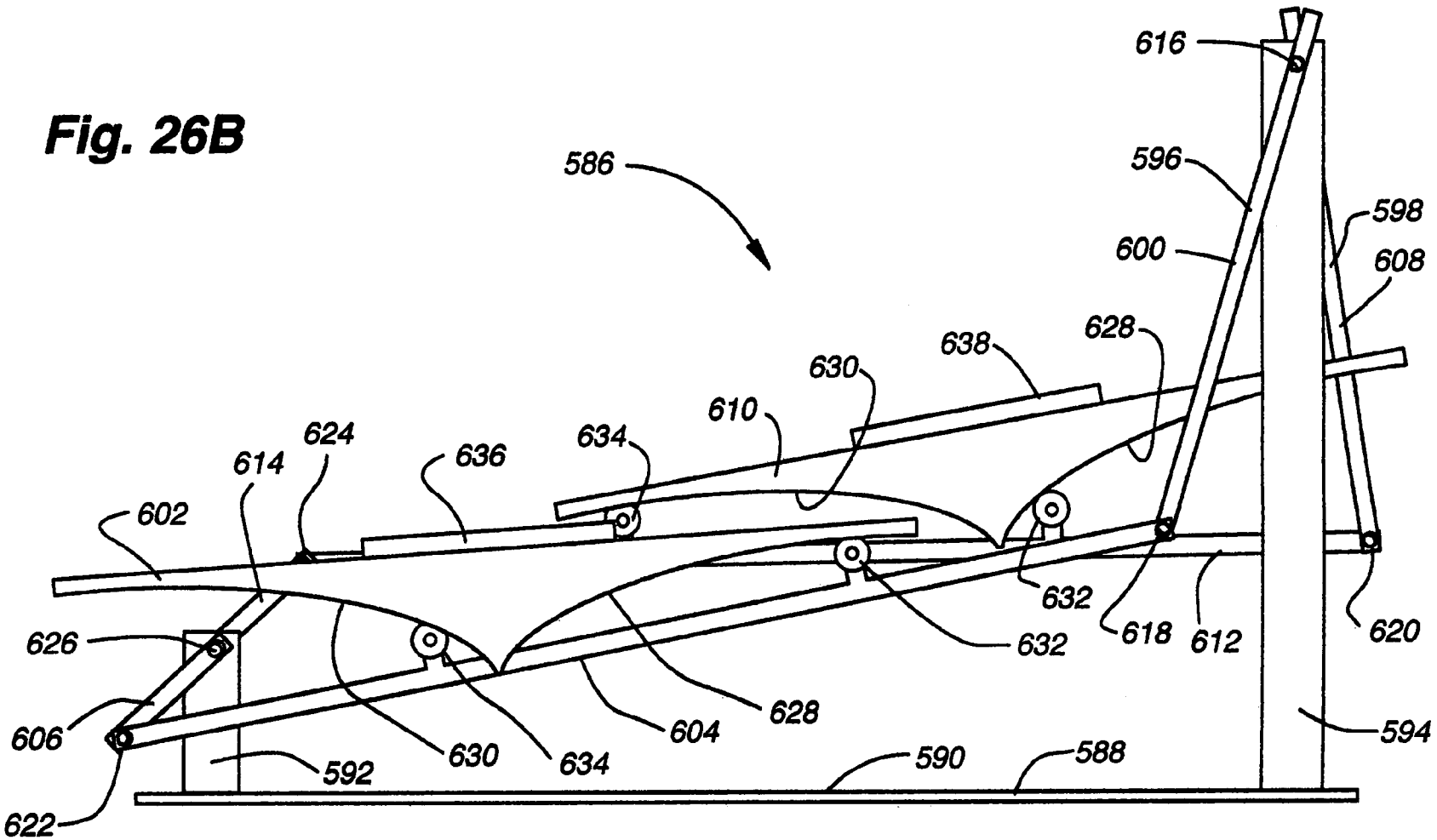
FIG. 26B is a right side view of the exercise device depicted in FIG. 26A showing the left foot links in a forward position and the right foot links in a rearward position.

A ninth embodiment of the exercise device 586 is shown in FIGS. 26A-26B. The ninth embodiment includes a frame 588 having a base portion 590 with a rear post 592 and a front post 594 extending upwardly therefrom. The ninth embodiment 586 also includes a right linkage assembly 596 and a left linkage assembly 598 operatively connected with the frame 588. The right linkage assembly includes a right swing link 600, a right foot link 602, and a right roller guide link 604 operatively connected with a right crank arm 606 and the frame to provide a variable stride path. In addition, the left linkage assembly includes a left swing link 608, a left foot link 610, and a left roller guide link 612 operatively connected with a left crank arm 614 and the frame.

As shown in FIGS. 26A and 26B, upper portions of the swing links 600, 608 are pivotally connected with the front post 594 at an upper pivot 616. Lower portions of the swing links 600, 608 are pivotally connected with forward portions of the roller guide links 604, 612 at lower pivots 618, 620. As discussed below, the ninth embodiment shown in FIGS. 26A and 26B can also include lever arms connected with corresponding swing links similar to those described above with reference to other embodiments. Rear end portions of the roller guide links 604, 612 are pivotally connected with the crank arms 606, 614 at guide pivots 622, 624. The crank arms are pivotally connected with the rear post 592 at a crank axis 626. As previously described with respect to other embodiments, the left and right crank arms are rotatably connected at the crank axis to travel along repeating circular paths and can also be configured to travel 180 degrees out of phase with each other.

As shown in FIGS. 26A and 26B, the foot links 602, 610 each include a downwardly facing arcuate forward cam surface 628 and a downwardly facing arcuate rearward cam surface 630. Each forward cam surface 628 is adapted to rollingly engage a forward cam roller 632 rotatably connected with each of the roller guide links 604, 612, and each rearward cam surface 630 is adapted to rollingly engage a rear cam roller 634 rotatably connected with each of the roller guide links. As such, the foot links 602, 610 can roll in forward and rearward directions relative to the roller guide links 604, 612, which provides the user the ability vary his stride while using the exercise device. As shown in FIGS. 26A and 26B, the right foot link supports a right foot engaging portion 636, and the left foot link supports a left foot engaging portion 638. As described above with reference to other embodiments, the foot engaging portion can include a rectangular foot pad meant to support a user's foot. The foot engaging portions may also be directly connected with the top of the foot links or may be pivotally supported so that they articulate during use or their angular relations with the foot links vary.

As described in more detail below, as the foot links 602, 610 move relative to the roller guide links 604, 612, the shape of the cam surfaces 628, 630 on the foot links affect the orientation of foot engaging portions 636, 638 and the user's feet engaged therewith. For example, as either foot link moves forward relative to the roller guide link, engagement of the forward cam roller on the forward cam surface will cause the forward portion of the foot link to move upwardly. As such, a user's foot placed on the foot engaging portion will be positioned with the user's toes raised relative to the user's heel. Alternatively, as either foot link moves rearwardly relative to the roller guide link, engagement of the rearward cam roller on the rearward cam surface will cause the rearward portion of the foot link to move upwardly. As such, a user's foot placed on the foot engaging portion section will be positioned with the user's heel raised relative to the user's toes. As such, the shape of the forward and rearward cam surfaces can affect how much user foot ankle will move for a given stride length.

To operate the exercise device 586 shown in FIGS. 26A and 26B, a user places his feet in operative contact with the right and left foot engaging portions 636, 638. The user then exercises by striding forwardly toward the front post 594. Forces imparted to the foot engaging portions 636, 638 by the user cause the foot links 602, 610 to move back and forth, which in turn cause the roller guide links 64, 612 to move back and forth. In turn, the swing links 600, 608 pivot back and forth around the upper pivot 616. At the same time, the crank arms 606, 614 rotate around the crank axis 626. Because the foot links are supported by the roller guide links through the cam rollers and can move relative to the roller guide links, the paths in which the foot links move are variable and can be affected by the stride length of the user as the crank arms rotate. As such, the paths in which the foot links move are not solely dictated by the geometric constraints of the swing links, the crank arms, the roller guide links, and the frame. Therefore, the user can dynamically adjust the travel path of the of the foot engaging portion while using the exercise device based on the user's stride.

A comparison of FIGS. 26A and 26B illustrates one example of how the positions of the foot engaging portions 636, 638 can be changed to provide for a variable stride path as the crank arms 606, 614 rotate. The left crank arm 614 is shown in FIG. 26A in about the 5 o'clock position, and the left foot link 610 is positioned slightly forward of the right foot link 602. The left crank arm is shown in FIG. 26B in about the 2 o'clock position, the left foot link is in a position that is significantly more forward than the right foot link. The change in foot link positions between FIGS. 26A and 26B is accomplished partially as a result of the rotation of the crank arms, and partially as result of the movements of the foot links relative to roller guide links. As shown in FIG. 26A, both foot links 602, 610 are generally centered on the respective roller guide links 604, 612. In FIG. 26B, however, the left foot link 610 is moved forward relative to the left roller guide link 612, and the right foot link 602 is moved rearwardly relative to the right roller guide link 604.

In addition to a user's stride, gravity may also effect the position of the foot link relative to the guide link. For example, referring to FIG. 26A, when the left crank arm 614 is in a lower position, the left guide link 612 is arranged in a decline between the left lower pivot 620 and left guide pivot 624. With such a decline, the left foot link will tend to roll backwards as the cam rollers and the crank arm move toward a lower orientation. Rolling backwards in this manner will cause the foot engaging portion to articulate so that the heel rises relative to the toe. Conversely, as the crank arm moves upward toward the position of the right crank arm 606 shown in FIG. 26A, the foot link 602 will tend to roll forward, albeit more gradually with the configuration as illustrated in FIG. 26A. It is to be appreciated that the incline or decline of the foot links in any given orientation may be adjusted by lengthening/shortening the rear post, the cranks arms, the front post, and/or the swing links.

Figure 26C:
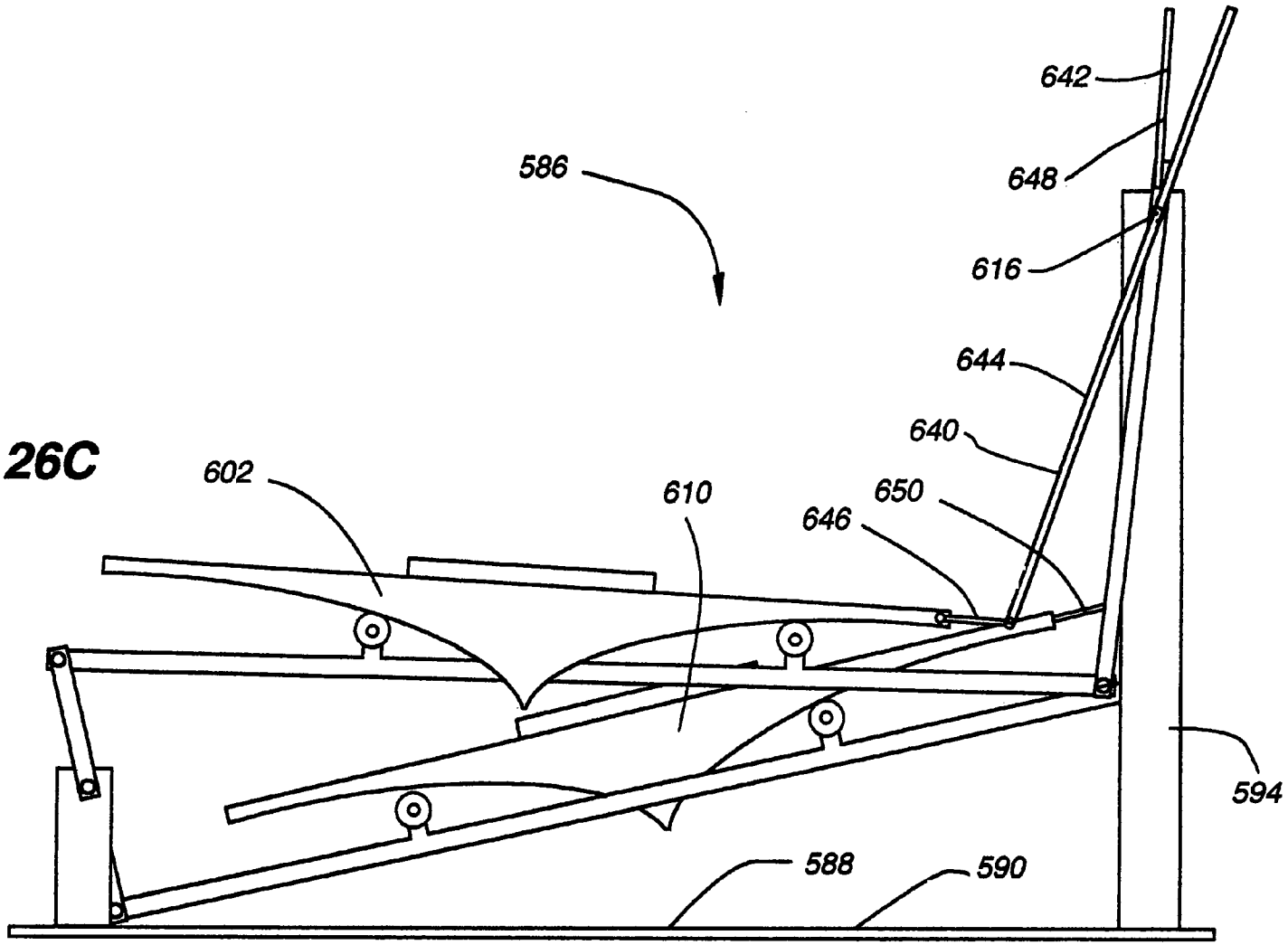
FIG. 26C is a right side view of the exercise device depicted in FIG. 26A, including arm linkage arrangements connected with the foot links.
Figure 26D:
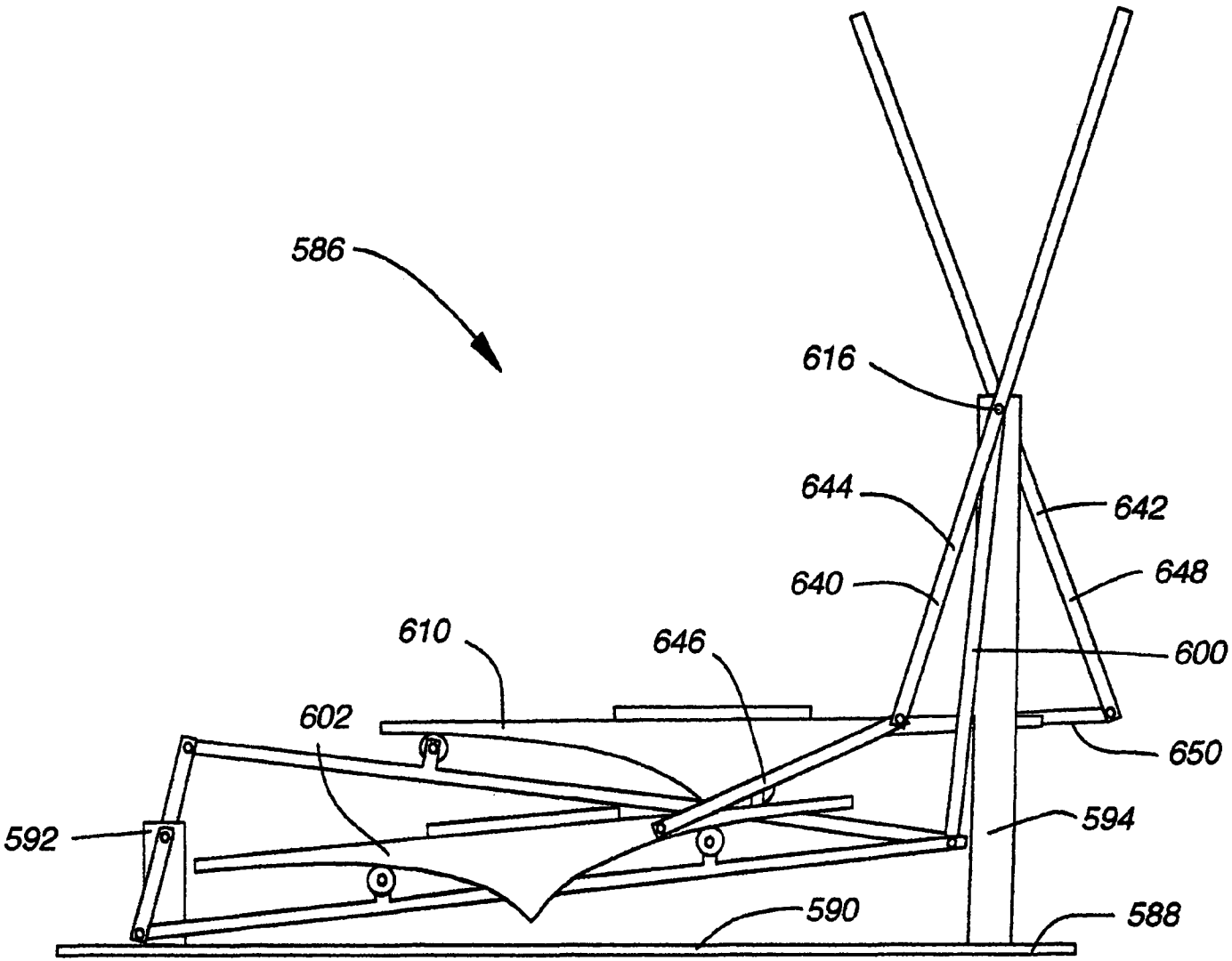
FIG. 26D is a right side view of the exercise device depicted in FIG. 26A, including foot link extension links
Figure 26E:
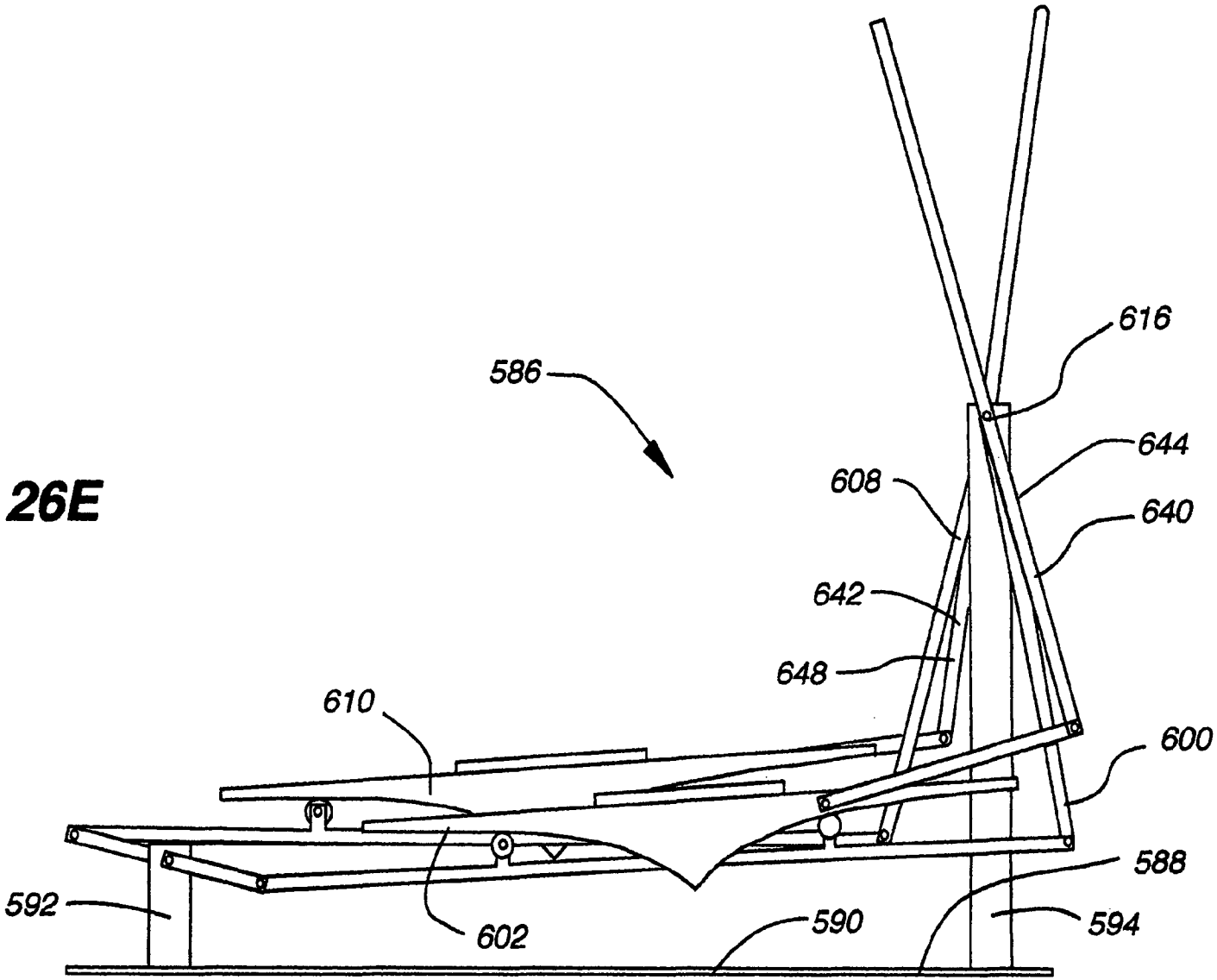
FIG. 26E is a right side view of the exercise device depicted in FIG. 26A, including foot link extension links

As shown in FIGS. 26C-26E, the ninth embodiment of the exercise device 586 can also include right and left arm linkages 640, 642 connected with the foot links 602, 610 and the upper pivot 616. As shown in FIG. 26C, the right arm linkage includes a right lever arm 644 pivotally connected with the front post 594 at the upper pivot 616. The right lever arm 644 is coupled with the right foot link 602 though a right extension link 646. More particularly, a rear end portion of the right extension link 646 is pivotally connected with a forward end portion of the right foot link, and a forward end portion of the right extension link is pivotally connected with a lower end portion of the right lever arm 644. Similar to the right arm linkage, the left arm linkage includes a left lever arm 648 pivotally connected with the front post 594 at the upper pivot 616. The left lever arm 648 is coupled with the left foot link 610 though a left extension link 650. More particularly, a rear end portion of the left extension link 650 is pivotally connected with a forward end portion of the left foot link, and a forward end portion of the left extension link is pivotally connected with a lower end portion of the left lever arm 648. As such, the arm linkages can be connected with the foot swing links to allow a user to effect movement of the foot links relative to the roller guide links by pulling and pushing on the lever arms. It is to be appreciated arm linkages shown in FIG. 26C can be connected with the ninth embodiment of the exercise device in different ways and include in various numbers of links. For example, FIGS. 26D and 26E show the rear end portions of the extension links 646, 650 pivotally connected with forward mid portion of foot links 602, 610. In other configurations, the arm linkages do not include extension links, and as such, are pivotally connected directly with the foot links.

Figure 27A:
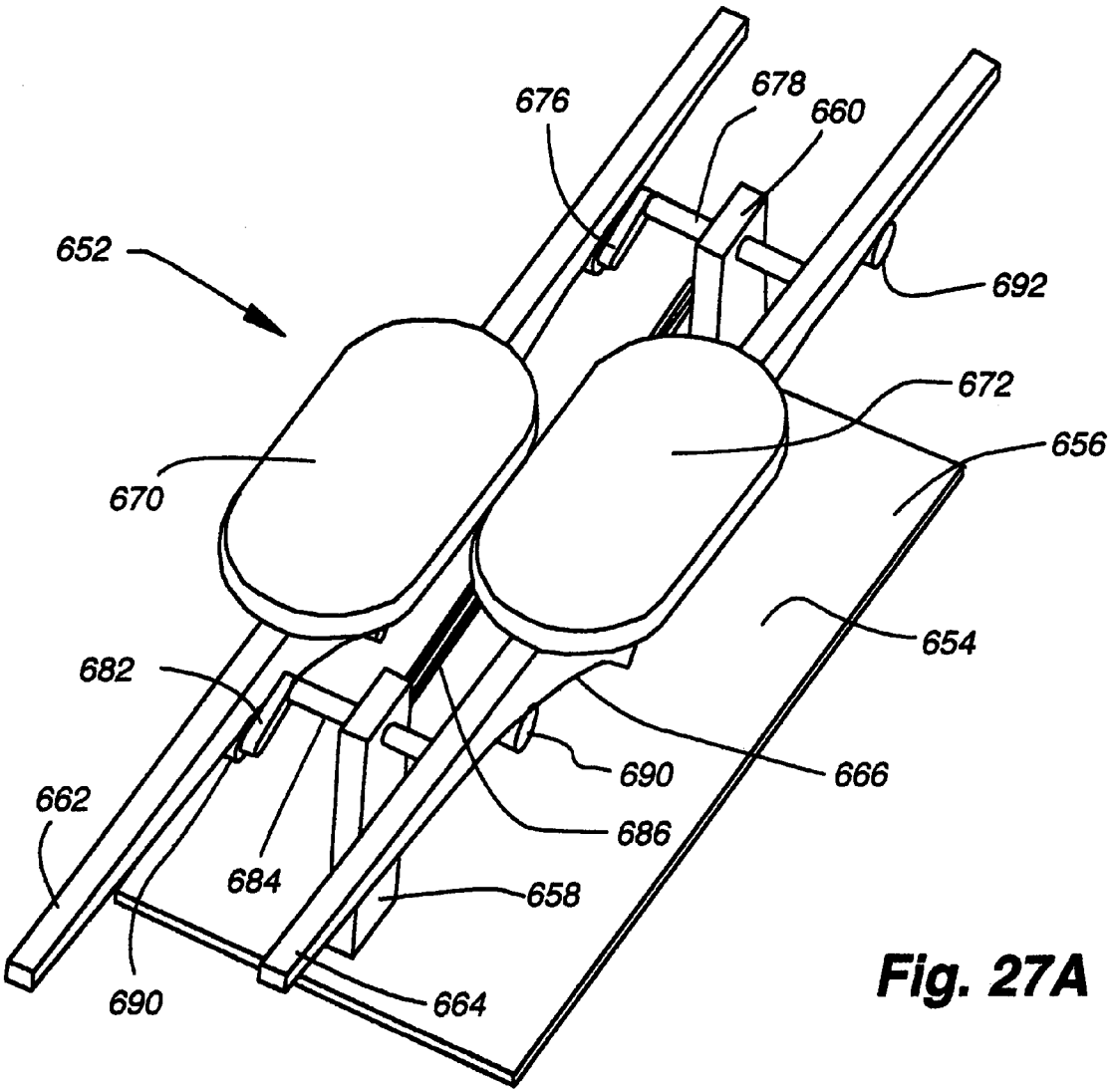
FIG. 27A is an isometric view of a tenth embodiment of a variable stride exercise device utilizing foot links having forward and rearward cam surfaces with forward and rearward crank arms.
Figure 27B:
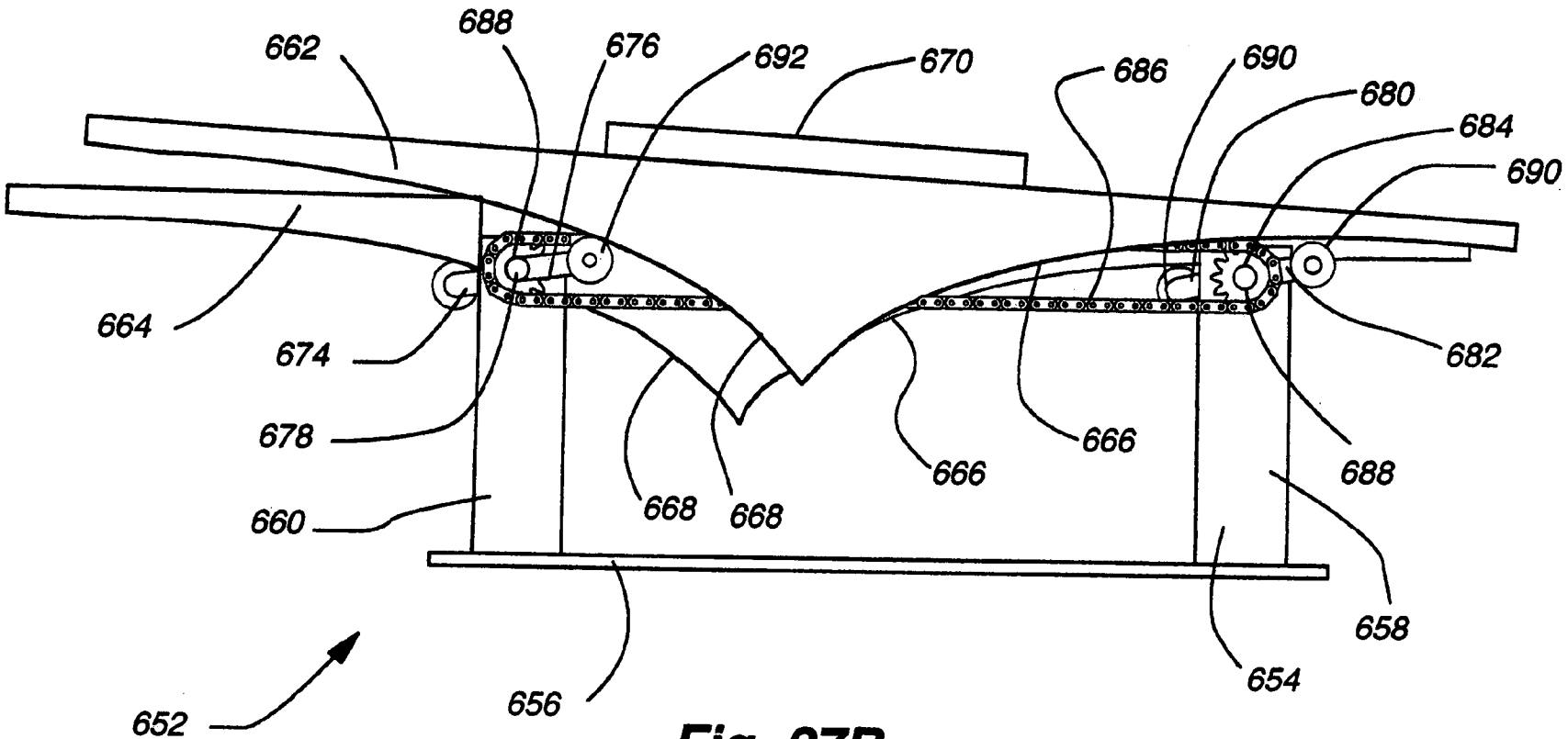
FIG. 27B is a right side view of the exercise device depicted in FIG. 27A.

A tenth embodiment of the exercise device 652 is shown in FIGS. 27A and 27B, which includes a frame 654 having a base portion 656 with a front post 658 and a rear post 660 extending upwardly therefrom. The tenth embodiment also includes right and left foot links 662, 664 that are similar to the those described above with reference to the ninth embodiment. As such, each foot link 662, 664 includes a downwardly facing arcuate forward cam surface 666 and a downwardly facing arcuate rearward cam surface 668. As discussed in more detail below, the cam surfaces on the foot links are rollingly engaged with front and rear crank arms rotatably connected with the frame to provide a variable stride path. As described above with reference to the ninth embodiment, the foot links shown in FIGS. 27A and 27B also support foot engaging portions 670, 672.

As shown in FIGS. 27A and 27B, left and right rear crank arms 674, 676 are rotatably connected with the rear post 660 of the frame 654 at a rear crank axis 678, and left and right forward crank arms 680, 682 are rotatably connected with the front post 658 of the frame at a forward crank axis 684. As described above with reference other embodiments, the crank arms are also configured to travel 180 degrees out of phase with each other. The exercise device 652 also includes a chain 686 connected with sprockets 688 at each crank axis 678, 684 to coordinate rotation of the forward and rear crank arms. Forward and rearward cam rollers 690, 692 are rotatably connected with the forward and rear crank arms. As shown in FIGS. 27A and 27B, the cam surfaces 666, 668 on the foot links 662, 664 are rollingly supported on cam rollers 690, 692. As such, the foot links can roll in forward and rearward directions relative to the crank arms, which provides the user the ability vary his stride while using the exercise device.

Although a chain and sprocket arrangement is used to couple the forward and rear crank arms, it is to be appreciated that crank arms may be coupled together through other arrangements, such a belt and pulley, a gear arrangement, direct interference drive, or the like.

As the foot links 662, 664 of the tenth embodiment 652 move relative to the crank arms, the shape of the cam surfaces affect the orientation of the foot engaging portions 670, 672 along with the user's feet engaged therewith. For example, as either foot link moves forwardly relative to the crank arms, engagement of the forward cam roller on the forward cam surface will cause the forward portion of the foot link to move upwardly. As such, a user's foot placed on a foot engagement section of the foot link will be positioned with the user's toes raised relative to the user's heel. Alternatively, as either foot link moves rearwardly relative to the crank arms, engagement of the rearward cam roller on the rearward cam surface will cause the rearward portion of the foot link to move upwardly. As such, a user's foot placed on the foot engagement section will be positioned with the user's heel raised relative to the user's toes. As such, the shape of the forward and rearward cam surface affect how much user foot ankle movement will be required for a given stride length.

To operate the exercise device 652 shown in FIGS. 27A and 27B, a user places his feet in operative contact with the right and left foot engaging portions 670, 672. The user then exercises by striding forwardly toward the front post 658. Forces imparted to the foot engaging portions by the user cause the foot links 662, 664 to move back and forth. At the same time, the rear crank arms 674, 676 rotate around the rear crank axis 678, and the forward crank arms 680, 682 rotate around the forward crank axis 684. Because the foot links 662, 664 are rollingly supported by the cam rollers 690, 692 on the crank arms, the paths in which the foot links move are variable and can be affected by the stride length of the user as the crank arms rotate. As such, the paths in which the foot links move are not solely dictated by the geometric constraints of the crank arms and the frame. Therefore, the user can dynamically adjust the travel path of the of the foot engaging portion while using the exercise device based on the user's stride.

Figure 27C:
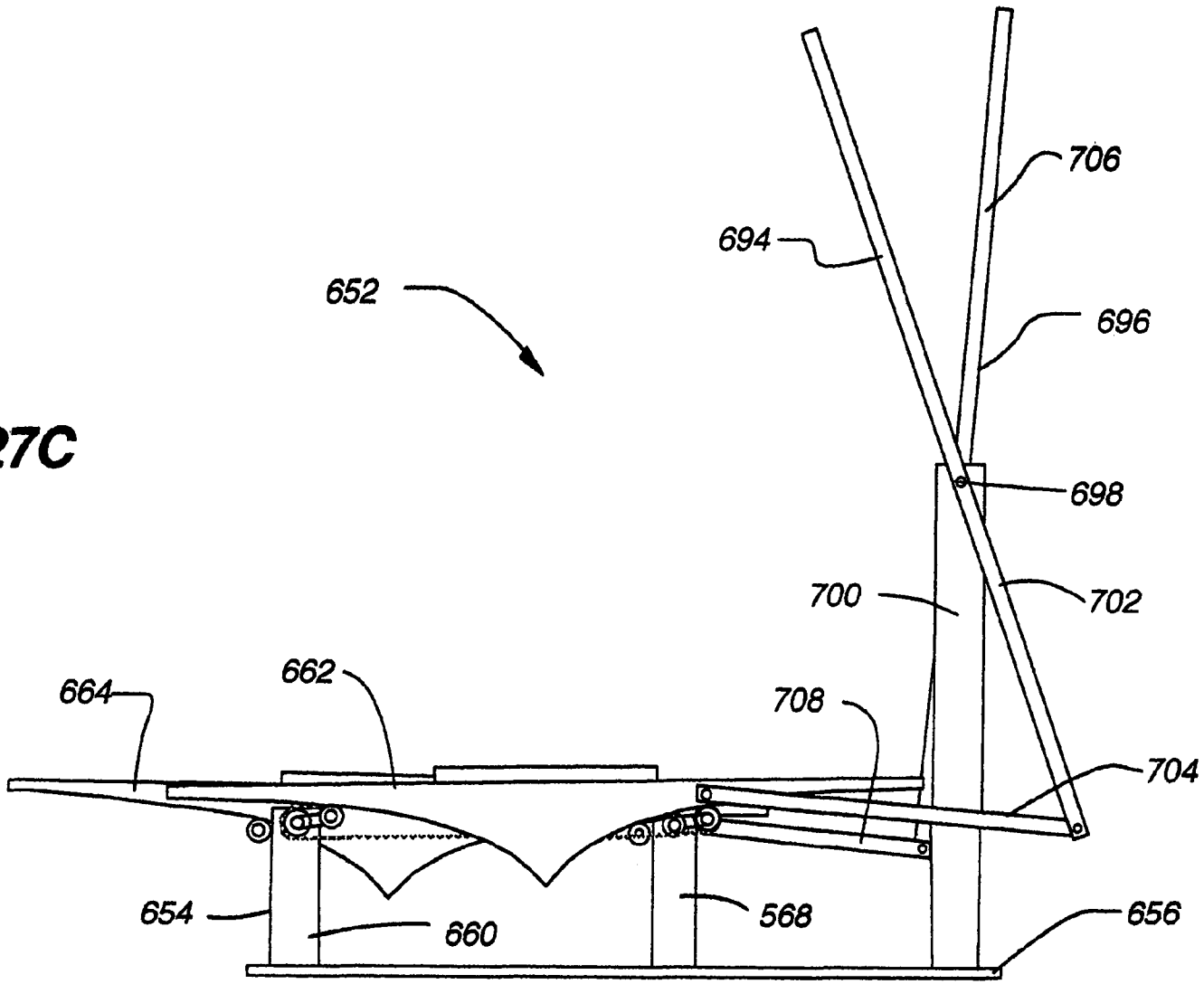
FIG. 27C is a right side view of the exercise device depicted in FIG. 27A utilizing lever arms.

As shown in FIG. 27C, the tenth embodiment of the exercise device 652 can also include right and left arm linkages 694, 696 similar to those described above with reference to the ninth embodiment. As depicted, the right and left arm linkages are connected with the foot links 662, 664 and an upper pivot 698 on an arm support post 700 extending upwardly from the base portion 656 of the frame. As shown in FIG. 27C, the right arm linkage includes a right lever arm 702 pivotally connected with the arm support post 700 at the upper pivot 698. The right lever arm 702 is coupled with the right foot link 662 though a right extension link 704. More particularly, a rear end portion of the right extension link 704 is pivotally connected with a forward end portion of the right foot link, and a forward end portion of the right extension link is pivotally connected with a lower end portion of the right lever arm 702. Similar to the right arm linkage, the left arm linkage includes a left lever arm 706 pivotally connected with the arm support post 700 at the upper pivot 698. The left lever arm 706 is coupled with the left foot link 664 though a left extension link 708. More particularly, a rear end portion of the left extension link 708 is pivotally connected with a forward end portion of the left foot link, and a forward end portion of the left extension link is pivotally connected with a lower end portion of the left lever arm 706. As such, the arm linkages can be connected with the foot links to allow a user to effect movement of the foot links relative to the crank arms by pulling and pushing on the lever arms.

An eleventh embodiment of the exercise device 710 is shown in FIGS. 28A-28D. The eleventh embodiment includes a right linkage assembly 712 and a left linkage assembly 714 operatively connected with a frame 716. The frame 716 includes a forward platform 718 and a roller platform 720 connected with opposing end portion s of a base member 722. The frame also includes a front post 724 extends upward from the forward platform. As discussed below, the right linkage assembly 712 includes a right foot link 726 rollingly supported on a right roller guide link 728 to provide a variable stride path. Similar to the right linkage assembly, the left linkage assembly 714 includes a left foot link 730 rollingly supported on a left roller guide link 732. As described above with reference to other embodiments, the foot links support right and left foot engaging portions 734, 736.

Figure 28A:
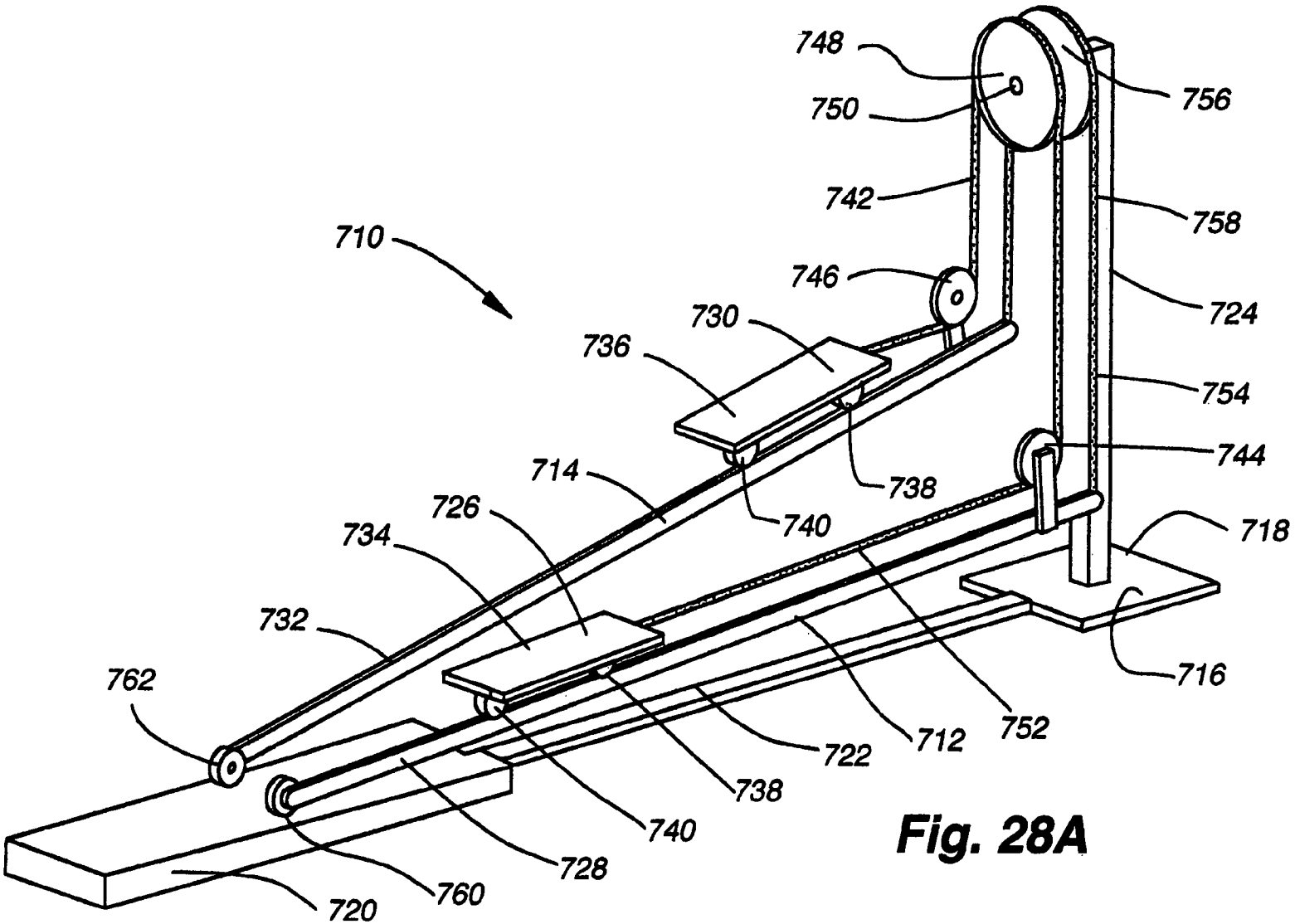
FIG. 28A is an isometric view of an eleventh embodiment of a variable stride exercise device utilizing foot links with rollers.
Figure 28B:
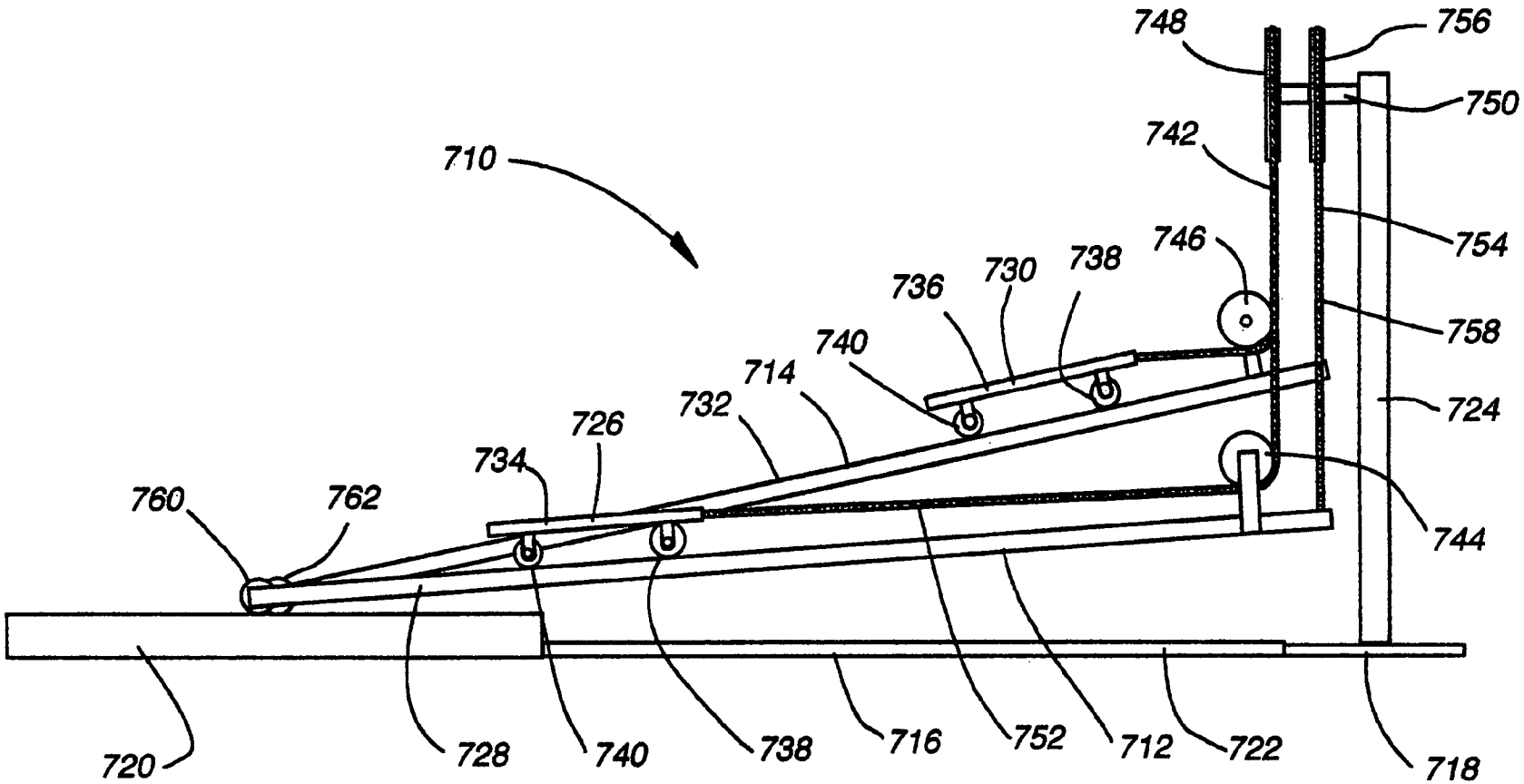
FIG. 28B is a right side view of the exercise device depicted in FIG. 28A.

As shown in FIGS. 28A and 28B, forward and rear foot link rollers 738, 740 are rotatably connected with bottom sides of the right and left foot links 726, 730. The foot link rollers are adapted to engage the roller guide links 728, 732 to allow the foot links 726, 730 to roll forward and rearward along the length of the roller guide links. The right and left foot links are also operatively connected with each other through a first cable-pulley assembly 742. As discussed below, the first cable-pulley assembly operatively connects the right and left foot links together such that when one foot link moves rearwardly, the other foot link moves forward.

As shown in FIG. 28A, the first cable-pulley assembly 742 includes a right pulley 744 rotatably connected with a forward portion of the right roller guide link 728, and a left pulley 746 rotatably connected with a forward portion of the left roller guide link 732. A first center pulley 748 is rotatably connected with a center pulley axle 750 extending rearwardly from the front post 724. A first cable 752 is routed through the right, left, and first center pulleys to connect the left foot link 730 with the right foot link 726. More particularly, the first cable 752 is connected with left foot link 730 and extends forward therefrom to partially wrap around the left pulley 746. From the left pulley, the first cable extends upward and partially wraps around the first center pulley 748. From the first center pulley, the first cable extends downward and partially wraps around the right pulley 744. From the right pulley, the first cable extends rearwardly and connects with the right foot link 726. As previously mentioned, the foot links are operatively connected with each other through first cable-pulley assembly to provide opposing foot link motions along the roller guide links. For example, when the left foot link moves rearwardly along the left roller guide link, the first cable 752 is pulled rearwardly from the left pulley 746, causing the left pulley to rotate clockwise (as viewed from the right side of the exercise device). In turn, the first center pulley 748 rotates counterclockwise (as viewed from the rear of the exercise device), which in turn, causes the right pulley 744 to rotate counterclockwise (as viewed from the right side of the exercise device). In turn, the first cable pulls the right foot link 726 in a forward direction along the right roller guide link 728.

As shown in FIG. 28A, a second cable-pulley assembly 754 operatively connects forward end portions of the right roller guide link 728 with the left roller guide link 732 to provide opposing up and down motion the forward end portions of the roller guide links. The second cable-pulley assembly 754 includes a second center pulley 756 rotatably connected with the center pulley axle 750. Although the first center pulley 748 and the second center pulley 756 are both rotatably supported by the center pulley axle, the first and second center pulleys rotate independently of one another. A second cable 758 is connected with a forward portion of the left roller guide link 732 and extends upwardly therefrom to partially wrap around the second center pulley 756. From the second center pulley, the second cable extends downward and connects with a forward portion of the right roller guide link 728. As shown in FIG. 28A, rear end portions of the right and left roller guide links 728, 732 are rotatably supported on the roller platform 720. More particularly, right and left guide rollers 760, 762 are rotatably connected with the right and left roller guide links, respectively, and are adapted roll back and forth along the roller platform. The second cable-pulley assembly operatively connects the right and left roller guide links together such that when one roller guide link moves downward, the other roller guide link moves upward. For example, when the forward portion of the left roller guide link moves downward, the second cable is pulled downward, which in turn, causes the second center pulley to rotate counterclockwise (as viewed from the rear of the exercise device). From the second center pulley, the second cable acts to pull the forward portion of the right roller guide link upward. As the forward portions of the roller guide links move up and down in opposite directions, the guide rollers move back and forth along the roller platform in order to help maintain a generally vertical alignment of the second cable between the right and left roller guide links and the second center pulley.

Figure 28C:
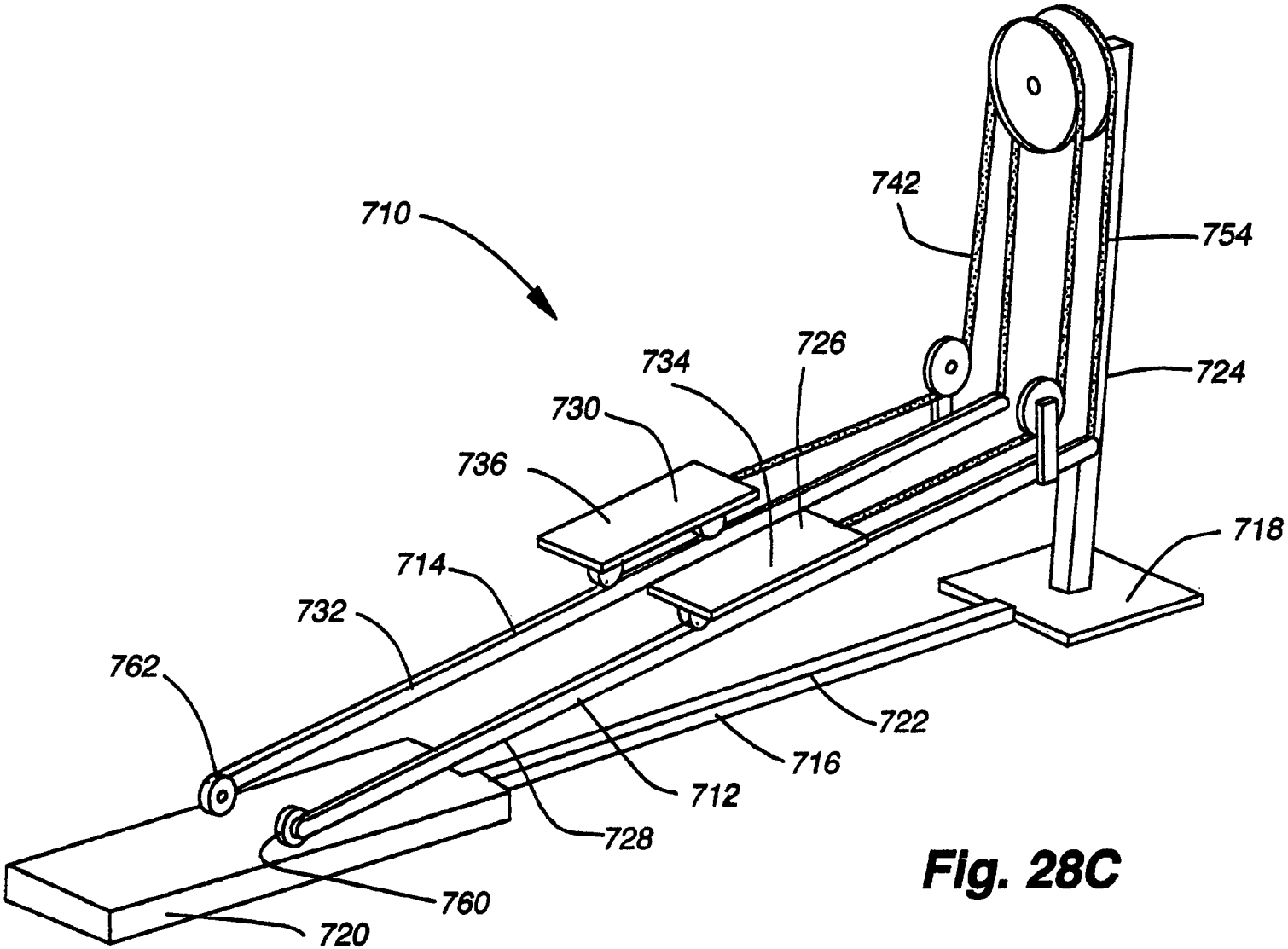
FIG. 28C is an isometric view of the exercise device depicted in FIG. 28A showing the foot links in a middle stride position.

To operate the exercise device 710 shown in FIGS. 28A-28C, a user places his feet in operative contact with the right and left foot engaging portions 734, 736 located on the top surfaces of the right and left foot links 726, 730. The user then exercises by striding forwardly toward the front post 724. Forward and rearward forces imparted to the foot engaging portions by the user in conjunction with the first cable-pulley assembly cause the foot links to move back and forth along the roller guide links in opposite directions relative to each other. The user can also move with a stepping motion to impart vertical forces on the foot engagement sections of the foot links. Downward forces imparted to the foot engaging portions by the user in conjunction with the second cable-pulley assembly cause the roller guide links to pivot up and down about the guide rollers, which in turn, moves the foot links up and down in opposite directions relative to each other. Because the first and second cable-pulley assemblies operate independently from each other, the user can dynamically adjust the travel path of the of the foot engagement sections along the roller guide links while at the same time dynamically adjusting up and down motion of the foot engagement sections.

A comparison of FIGS. 28A and 28C illustrates how the movement of the foot links 726, 730 and the roller guide links 728, 732 can affect the position of the foot engaging portions 734, 736 and the user's foot engaged therewith. As shown in FIG. 28A, the forward portion of the left roller guide link 732 is in an upward position relative to the forward portion of right roller guide link 728, and the left foot link 730 is in a forward position relative to the right foot link 726. As shown in FIG. 28C, the forward portions of the roller guide links are generally at the same elevation with respect to each other, and foot links are in similar positions relative to each with respect to the roller guide links. The change in foot link positions between FIGS. 28A and 28C is accomplished partially as a result of the rotation of the roller guide links about the guide rollers 760, 762, and partially as a result of the movement of the foot links along the lengths roller guide links. More particularly, movement of the left foot link 730 in a rearward direction from FIG. 28A to FIG. 28C pulls the right foot link 726 (through the first cable-pulley assembly) in a forward direction, and movement of the left foot link in a downward direction from FIG. 28A to FIG. 28C causes the right foot link (through the second cable-pulley assembly) to move in an upward direction. Because the roller guide links slope upwardly from the guide rollers toward the front post, the user's feet will always be positioned such that the user's toes will be at a higher elevation than the user's heels. It is to be appreciated that other embodiments of the exercise device can be configured to allow movement of the roller guide links so as to slope in a downward direction from the guide rollers toward the front post.

Figure 28D:
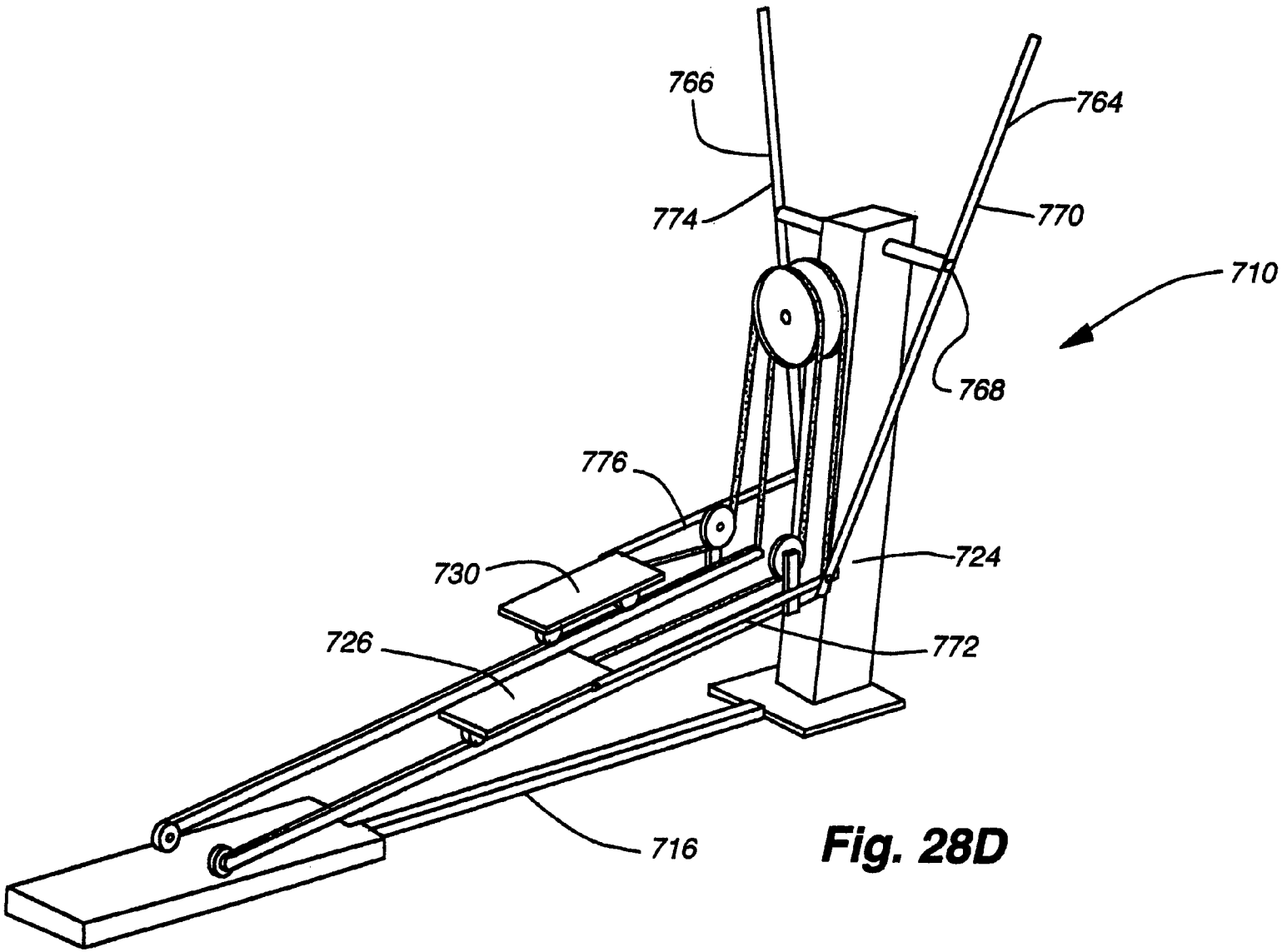
FIG. 28D is an isometric view of the exercise device depicted in FIG. 28A utilizing lever arms coupled with the foot links.

As shown in FIG. 28D, the eleventh embodiment of the exercise device 710 can also include right and left arm linkages 764, 766 similar to those described above with reference to the ninth embodiment. As depicted, the right and left arm linkages are connected with the foot links 726, 730 and an upper pivot 768 on the front post 724. As shown in FIG. 28D, the right arm linkage includes a right lever arm 770 pivotally connected with the front post at the upper pivot. The right lever arm 770 is also coupled with the right foot link 726 though a right extension link 772. More particularly, a rear end portion of the right extension link 772 is pivotally connected with a forward end portion of the right foot link, and a forward end portion of the right extension link is pivotally connected with a lower end portion of the right lever arm 770. Similar to the right arm linkage, the left arm linkage includes a left lever arm 774 pivotally connected with the front post 724 at the upper pivot 768. The left lever arm is also coupled with the left foot link 730 though a left extension link 776. More particularly, a rear end portion of the left extension link 776 is pivotally connected with a forward end portion of the left foot link, and a forward end portion of the left extension link is pivotally connected with a lower end portion of the left lever arm 774. As such, the arm linkages can be connected with the foot links to allow a user to effect movement of the foot links relative to the roller guide links by pulling and pushing on the lever arms.

It will be appreciated from the above noted description of various arrangements and embodiments of the present invention that a variable stride exercise device has been described which includes first and second linkage assemblies, first and second crank arms, and a frame. The exercise device can be formed in various ways and operated in various manners depending upon on how the linkage assemblies are constructed and coupled with the frame. It will be appreciated that the features described in connection with each arrangement and embodiment of the invention are interchangeable to some degree so that many variations beyond those specifically described are possible. For example, in any of the embodiments described herein, the crank arms may be operatively connected with a motor, a flywheel, an electromagnetic resistance device, performance feedback electronics and other features or combination thereof.

As mentioned above, additional aspects of the present invention involve a releasable connection mechanism for variable stride exercise devices. The releasable connection mechanism provides for selective and/or automated coupling of various elements of the linkage assemblies, which selectively eliminates or limits the user's ability to dynamically vary his stride path while using the exercise device. As described in more detail below, some embodiments of the releasable connection mechanism selectively and/or automatically engage the cam roller to prevent the cam roller from moving along the length of the cam member of the exercise device. More particularly, embodiments of the releasable connection mechanism operate to connect and disconnect a cam member with a corresponding cam roller. When the cam roller is prevented from rolling along the length of the cam member, the cam roller is not prevented from rotating relative to the corresponding crank arm. As such, the releasable connection mechanism can selectively configure the exercise device with a fixed stride path. It should also be appreciated that some embodiments of the releasable connection mechanism can also be configured to selectively and/or automatically engage the cam roller to limit movement of the cam roller along the length of the cam member, as opposed to preventing rolling movement of the cam roller relative to the cam member.

As described in more detail below, the releasable connection mechanism can include a locking member to selectively couple various elements of the linkage assemblies on variable exercise devices to selectively eliminate or limit the variable stride path feature of the exercise device. In some embodiments, the releasable connection mechanism includes an actuation device that selectively moves the locking member to couple elements of the linkage assembly. Various types of actuation devices can be used with the releasable connection mechanism, such as a solenoid, a manually operated switch or latch, a DC motor, or an AC motor. It should also be appreciated that other forms of actuation devices may utilize various forms of energy, such as air or various types of hydraulic fluids acting under pressure. Embodiments of the releasable connection mechanism can also include one or more spring members to move the locking member to decouple elements of the linkage assembly, restoring the variable stride path feature to the exercise device. It should be appreciated that various types of spring members can be used with the releasable connection mechanism, such as linear or torsional springs, leaf springs, or elastic bands. Although embodiments of the releasable connection mechanism described below include an actuation device and a spring member, it is to be appreciated that other embodiments need not include a spring member. For example, some embodiments include two actuation devices, such as solenoids or manually operated switches, to move the locking member to couple and decouple elements of the linkage assembly. Further, embodiments of the releasable connection mechanism can include a spring member to move the locking member to couple elements of the linkage assembly and an actuation device to decouple elements of the linkage assembly.

In some embodiments, the releasable connection mechanism can be configured to allow a user to selectively engage or disengage the cam roller with the cam member to eliminate and restore the variable stride feature of an exercise device. It should also be appreciated that the releasable connection mechanism is not limited to use with variable stride exercise devices having cam members and cam rollers. As such, other embodiments of the releasable connection mechanism can be configured to selectively connect various other linkage configurations together to eliminate and restore the variable stride feature of an exercise device. The releasable connection mechanism may also be configured to automatically engage and disengage during start-up of the exercise device. Automatic engagement and disengagement of the releasable connection mechanism may also be tied to various types of trigger signals, such as rotational speed of the pulley or a timer. Still, other embodiments may provide for a combination of manual and automatic engagement and disengagement of the releasable connection mechanism.

Figures 29A, 29B:
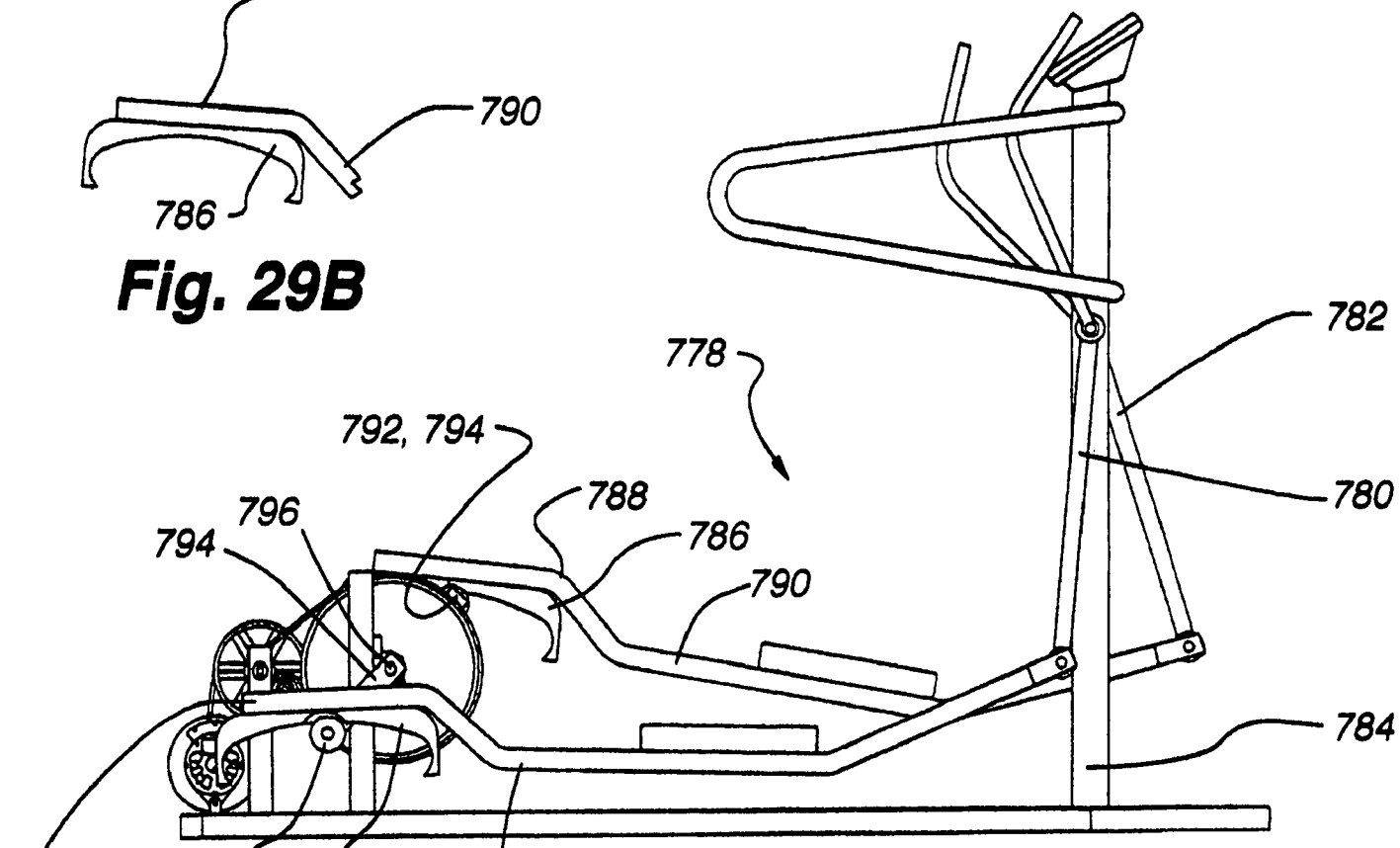
FIG. 29A is a right side view of a prior art variable stride exercise device.
FIG. 29B is a detailed view of a cam member of the variable stride exercise device of FIG. 29A.

As previously mentioned, embodiments of the releasable connection mechanism can be configured to selectively connect the cam member with the cam roller. As such, embodiments of the releasable connection mechanism can be configured to operate with many of the exercise devices described and depicted herein having a cam member rollingly supported by a cam roller. It should also be appreciated that variable stride exercises other than what are described and depicted herein can also utilize the releasable connection mechanism, such as the exercise devices disclosed U.S. patent application Ser. No. 10/789,182, filed on Feb. 26, 2004; and U.S. patent application Ser. No. 09/823,362, filed on Mar. 30, 2001, now U.S. Pat. No. 6,689,019, both of which are hereby incorporated by reference herein. For example, FIGS. 29A and 29B illustrate one embodiment of a variable stride exercise device 778 described U.S. Pat. No. 6,689,019, which can utilize the releasable connection mechanism. As shown in FIGS. 29A and 29B, the exercise device includes a right linkage assembly 780 and a left linkage assembly 782 operatively connected with a frame 784 to provide a variable stride path. The linkage assemblies of the exercise device shown in FIGS. 29A and 29B each include a cam member 786 connected with a rear end portion 788 of a foot link 790. The cam members are each rolling supported by corresponding cam rollers 792, which are rotatably connected with corresponding crank arms 794 configured to rotate about a crank axis 796. As described in more detail below, the releasable connection mechanism can be used with a variable stride exercise device of the type shown in FIGS. 29A and 29B to selectively and/or automatically connect the cam members with the cam rollers to eliminate the user's ability to dynamically vary his stride path while using the exercise device.

FIGS. 30A-30E show a first embodiment of a releasable connection mechanism 798 which can be used with various embodiments of variable stride exercise devices. FIGS. 30A-30E also illustrates detailed view of a cam member 800 having a cam surface 802 rollingly supported on a cam roller 804. As described above with reference to various embodiment of the variable stride exercise device, the cam roller 804, in turn, is rotatably connected with a crank arm 806 through a cam roller axle 808. Although the cam member and cam roller shown in FIGS. 30A-30E are similar to that which is described above with the reference to the exercise device shown in FIGS. 10 and 11, it is to be appreciated that the embodiments of the releasable connection mechanism disclosed herein may be used with either the right or left cam member of other variable stride exercise devices discussed herein. As shown in FIGS. 30A-30E, the releasable connection mechanism 798 includes a locking member 810 in the form of a locking plate 812 pivotally coupled with the cam member 800. As discussed in more detail below, the locking plate 812 can be automatically and/or selectively moved into engagement with the cam roller so as to hold the cam roller in a fixed position along the length of the cam member. Although the locking plate engages the cam roller to limit or prevent movement along the length of the cam surface, the locking plate does not prevent the cam roller from rotating about the cam roller axle.

Figure 30A:
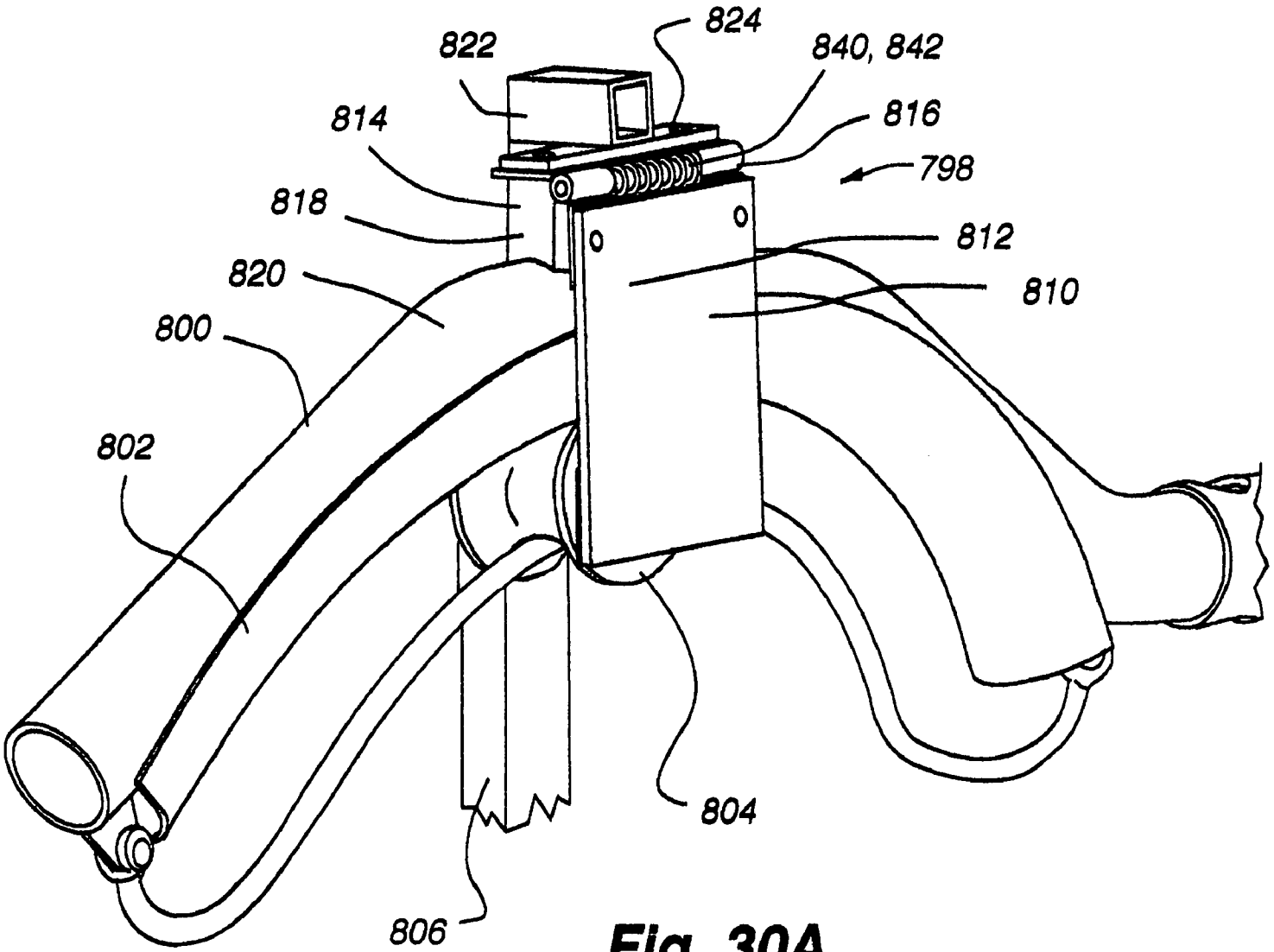
FIG. 30A is an isometric view of a first embodiment of a releasable connection mechanism connected with a cam member.
Figure 30B:
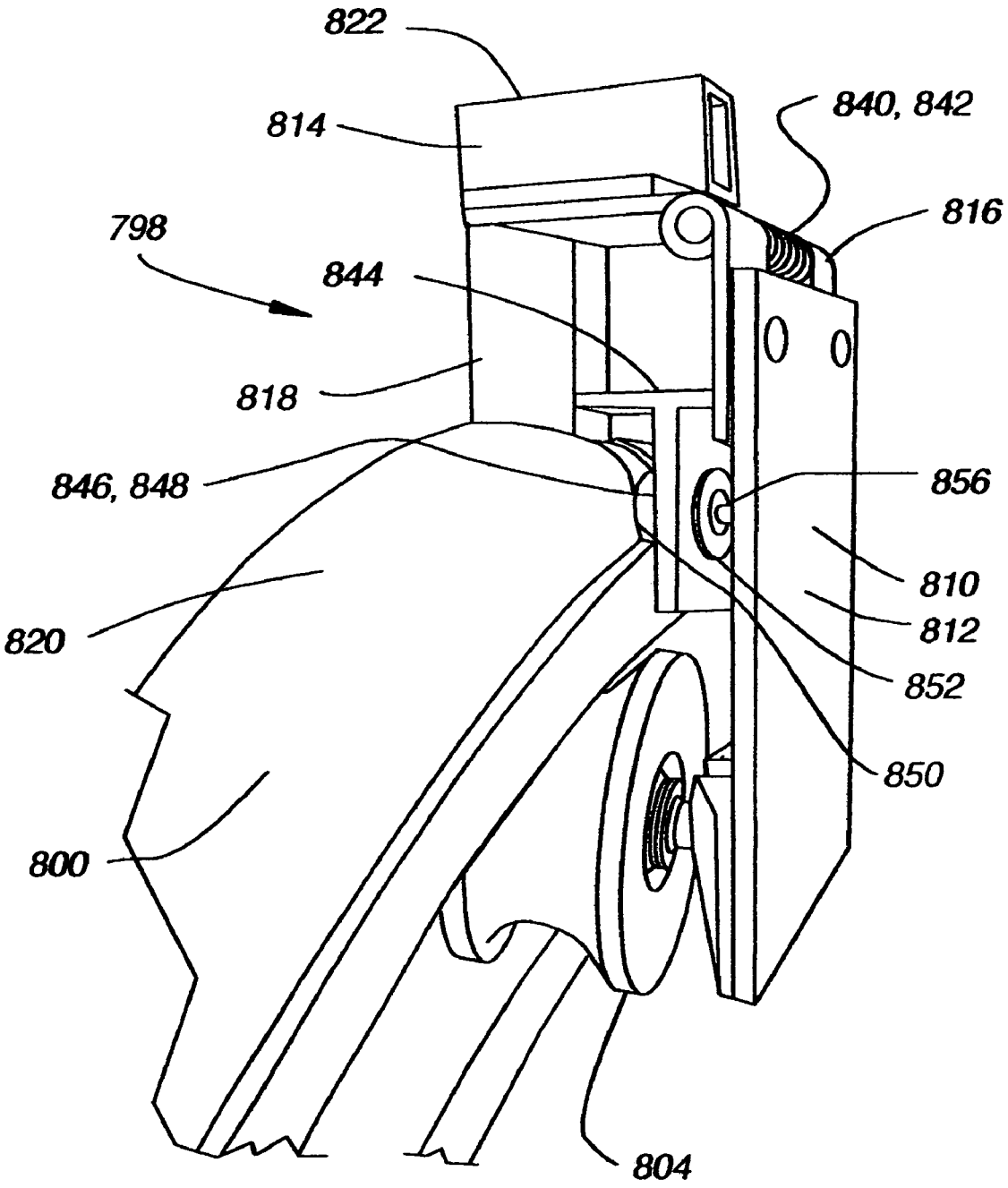
FIG. 30B is a detailed view of the releasable connection mechanism of FIG. 30A shown with a locking member engaged with a cam roller.
Figure 30C:
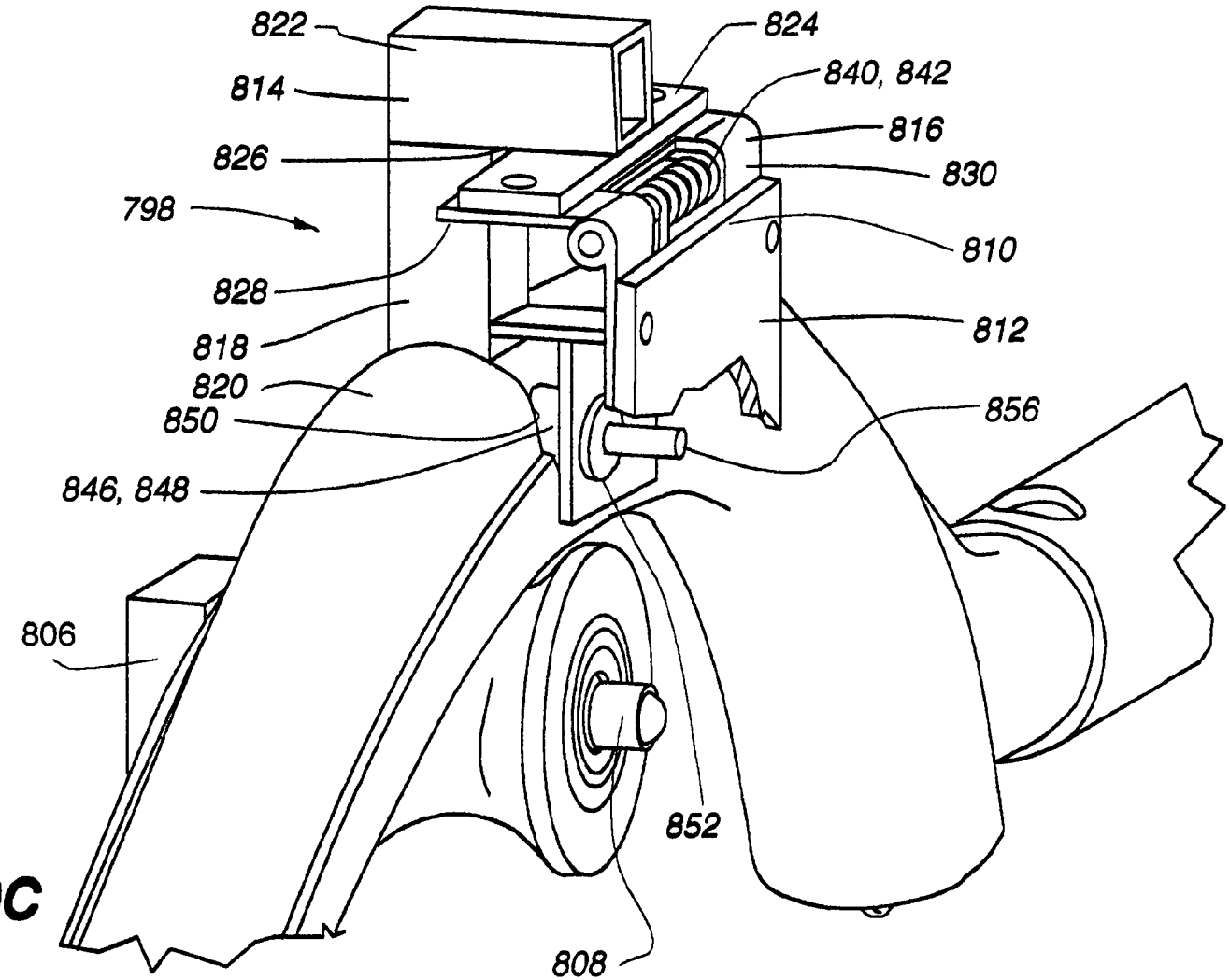
FIG. 30C is a view of the releasable connection mechanism shown in FIG. 30B with the locking member partially cut away.

As shown in FIGS. 30A-30E, the locking plate 812 is pivotally connected with a support structure 814 through a hinge 816. The support structure includes a first support member 818 extending upwardly from a top surface 820 of the cam member 800. Although the first support member 818 is connected with the cam member at a location near the apex of the cam, it is to be appreciated that the first support member can be connected with the cam member either forward or rearward and/or right or left of the location depicted in FIG. 30A. As shown in FIG. 30C, a second support member 822 extends outwardly from the first support member 818, and a hinge support member 824 is connected with a bottom side 826 of the second support member 822. The hinge 816 includes a first hinge plate 828 connected with the hinge support member 824 and second hinge plate 830 connected with the locking plate 812. Although the figures illustrate the hinge as being bolted to the hinge support member and the locking plate, it is to be appreciated that the hinge may be connected with other suitable means, such as welding.

Figure 30D:
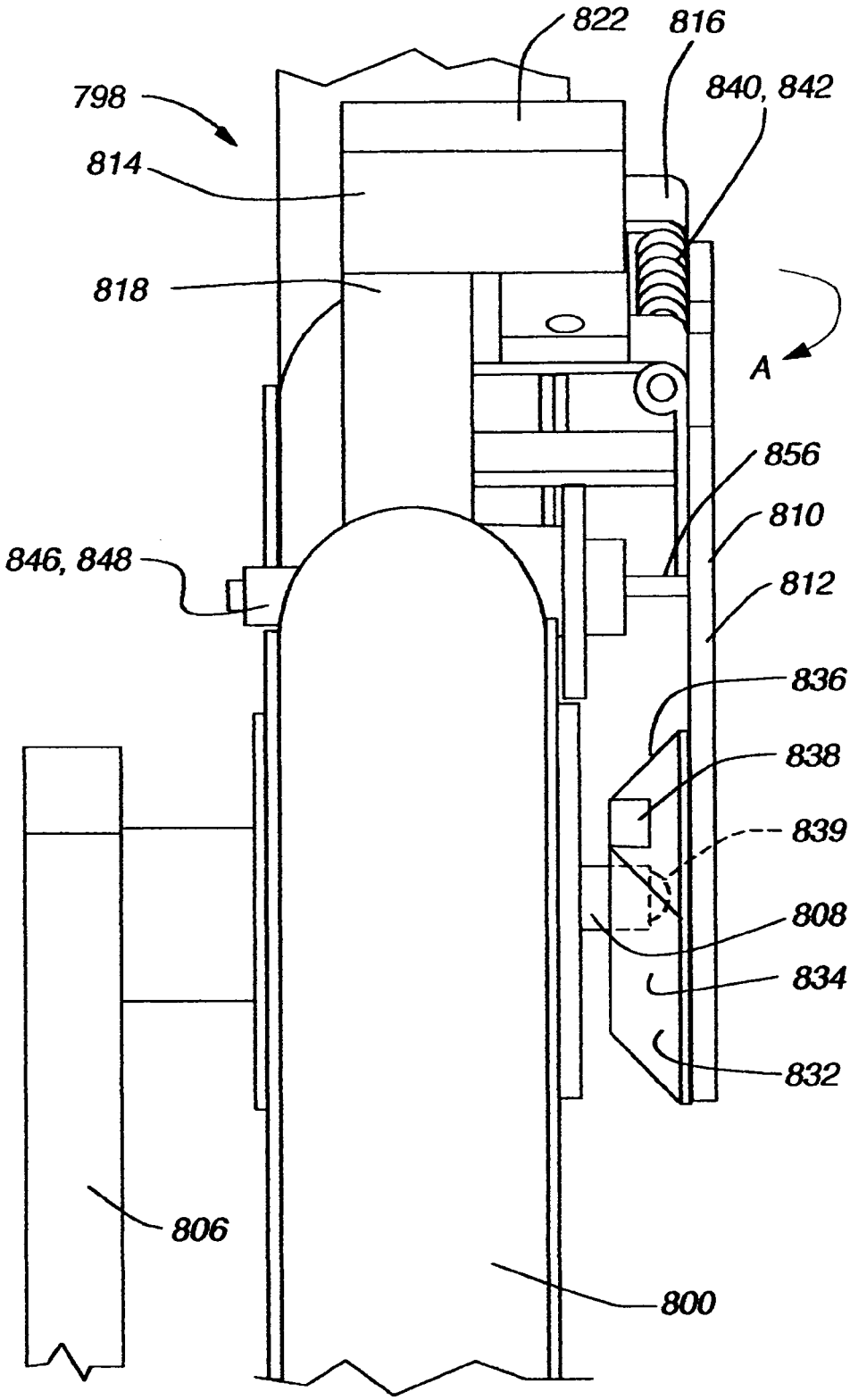
FIG. 30D is a side view of the releasable connection mechanism shown in FIG. 30B showing the locking member engaged with the cam roller.
Figure 30E:
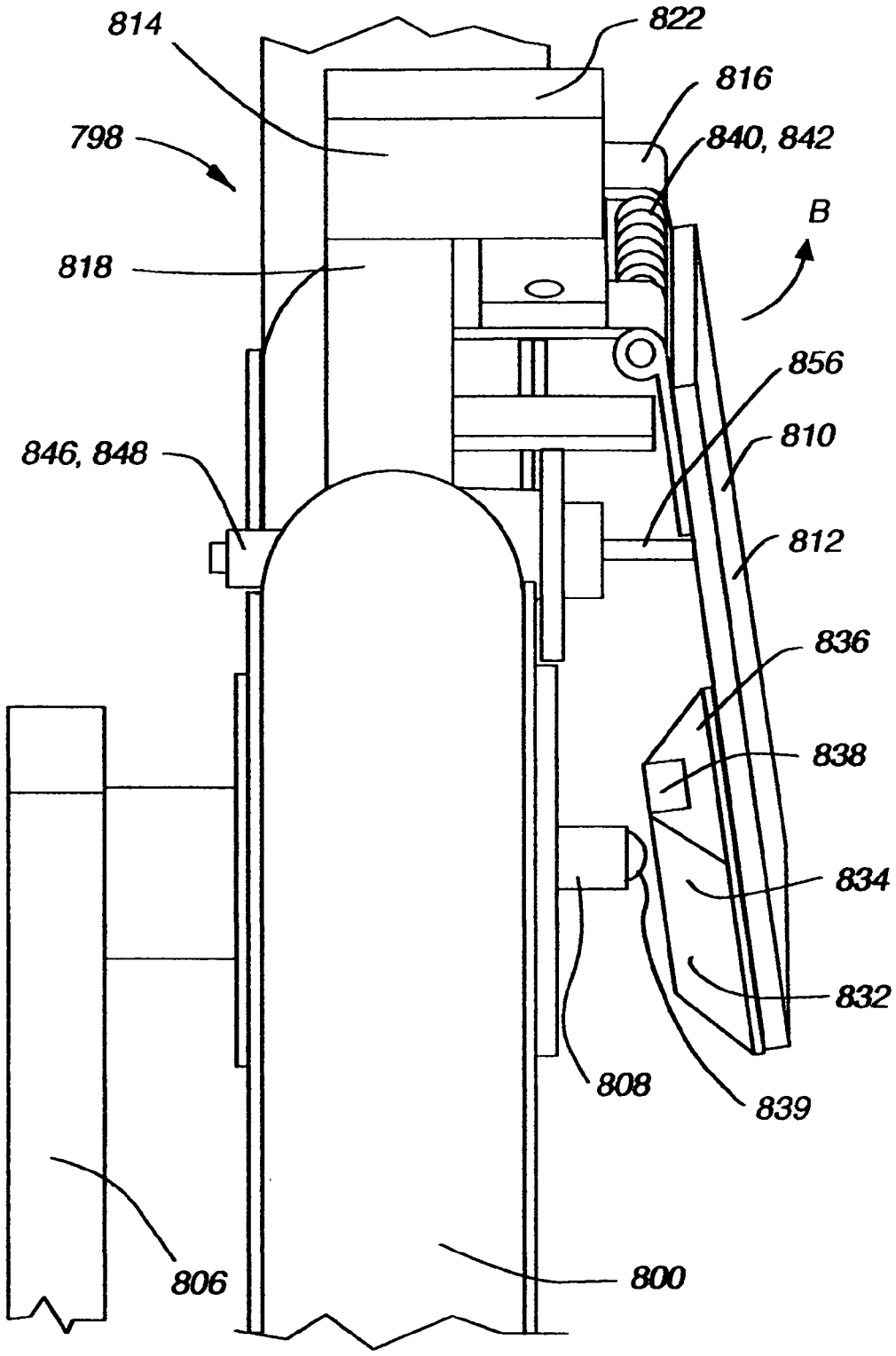
FIG. 30E is a side view of the releasable connection mechanism shown in FIG. 30B showing the locking member disengaged from the cam roller.

As previously mentioned, the locking plate 812 selectively engages the cam roller axle 808 so as to hold the cam roller in a fixed position along the length of the cam surface 802, while at the same time allowing the cam roller 804 to rotate about the cam roller axle 808. As illustrated in FIGS. 30D and 30E, the locking plate includes a cam roller engagement portion 832. The cam roller engagement portion 832 is defined by a first wedge portion 834 and a second wedge portion 836 arranged such that the thickness of the locking plate 812 progressively increases from either edge of the locking plate toward the center of the locking plate. A cam roller slot 838 is defined between the first wedge portion 834 and the second wedge portion 836. The cam roller slot 838 is adapted to receive an end portion 839 of the cam roller axle 808 extending outwardly from the cam roller 804 toward the locking plate 812. As discussed in more detail below, when the end portion of the cam roller axle is received within the cam roller slot, the cam roller is held in a fixed position along the length of the cam surface.

As shown in FIGS. 30A-30E, the releasable connection mechanism 798 includes a spring member 840 in the form of a torsional spring 842 coupled with the hinge 816 to impart a biasing force on the locking plate 812. The biasing force from the spring member 840 acts to pivot the locking plate downward (direction A in FIG. 30D) into engagement with the cam roller axle 808. It is to be appreciated that other embodiments of the present invention may be arranged in other ways to provide the biasing force, such as with a coil spring or elastic band connected between the locking plate and the support structure. As shown in FIG. 30B, a blocking member 844 extending outwardly from the first support member 818 below the second support member 822 toward the locking plate 812 and limits the pivotal movement of the locking plate toward the cam member 800. FIG. 30D shows the locking plate engaged with the cam roller axle, wherein the end portion 839 of the cam roller axle 808 is received within the cam roller slot 838.

As shown in FIGS. 30B-30E, the releasable connection mechanism 798 includes an actuation device 846 in the form of a linear solenoid 848 to selectively pivot the locking plate 812 outwardly (direction B in FIG. 30E) to disengage the locking plate from the cam roller axle 808, which allows the cam roller 804 to move along the length of the cam surface. As shown in FIGS. 30B-30E, the solenoid 848 extends through a first aperture 850 in the cam member 800 and is connected with the support structure 814 through a second aperture 852 in a solenoid support member 854 extending downward from the blocking member 810. As shown in FIG. 30E, when the solenoid is energized, a plunger 856 extends outward from the solenoid support member and imparts an outward force on the locking plate 812. The locking plate may also include a cushion to help absorb the impact from the solenoid plunger and help prevent damage to the plunger and/or the locking plate. The outward force imparted by the plunger 856 is greater than the biasing force of the spring member 840, and as such, the locking plate pivots about the hinge 816 outwardly away from the cam member (direction B in FIG. 30E). As shown in FIG. 30E, the plunger 856 extends a sufficient distance from the solenoid to cause the locking plate 812 to move far enough away from the cam member such that the engagement portion 832 of the locking plate is removed from the travel path of the cam roller axle 808. As such, the cam roller can roll along the length of the cam surface unimpeded by the locking plate.

As shown in FIG. 30D, when the solenoid 848 is de-energized, the biasing force from the spring member 840 causes the locking plate 812 to pivot about the hinge 816 inwardly toward the cam member 800 (direction A in FIG. 30D), pushing the plunger 856 back into the solenoid until the locking plate 812 abuts the blocking member 844. More particularly, the biasing force acts to position the engagement portion 832 of the locking plate within the travel path of the cam roller axle 808. If the cam roller axle is properly aligned with the engagement portion of the locking plate, the end portion 839 of the cam roller axle 808 will be received within the cam roller slot 838, which in turn, limits or prevents the cam roller 804 from rolling along the length of the cam surface 802. If the cam roller 804 is positioned along the cam surface 802 in a location such that the cam roller axle 808 is not aligned to be received within the cam roller slot 838, the cam roller may be rolled along the cam surface so the cam roller axle contacts either the first wedge portion 834 or the second wedge portion 836 on the locking plate 812. As the cam roller axle moves along either wedge portion of the locking plate toward the cam roller slot, the cam roller axle 808 forces the locking plate to pivot outwardly away from cam member. Once the cam roller axle is aligned with the cam roller slot, the biasing force from the spring member 840 causes the locking plate to pivot toward the cam member such that the end portion 839 of the cam roller axle 808 is received within the cam roller slot, which in turn, limits or prevents the cam roller from rolling along the length of the cam surface.

FIGS. 31A-31D show a second embodiment of a releasable connection mechanism 798'. Similar to the releasable connection mechanism 798 described above with reference to FIGS. 30A-30E, the second embodiment includes a locking member 810' configured to selectively engage the cam roller 804 to limit or prevent movement along the length of the cam member 800 while at the same time allowing the cam roller to rotate about the cam roller axle 808. However, instead of utilizing the locking plate 812 described above, the locking member 810' of the second embodiment is in the form of a bottom guide 858. As such, the releasable connection mechanism shown in FIGS. 31A-31D includes an actuation device 846' and a spring member 840' arranged to automatically and/or selectively move the bottom guide 858 in and out of engagement with the cam roller. More particularly, the bottom guide engages an outer rolling surface 860 of the cam roller 804, which creates a friction force between the cam roller 804, the cam member 800, and the bottom guide 858. The friction forces limit the rotational movement of the cam roller along the cam member. It is also to be appreciated that the friction forces can be sufficient enough to prevent the cam roller from rolling along the cam member. As discussed in more detail below, the bottom guide 858 is pivotally connected with the cam member 800. The spring member 840', which includes a coil spring 862, is biased to pivot the bottom guide 858 into engagement with the cam roller 804. Conversely, the actuation device 846', which includes a DC motor 864, is configured to selectively pivot the bottom guide to disengage the bottom guide from the cam roller.

Figure 31A:
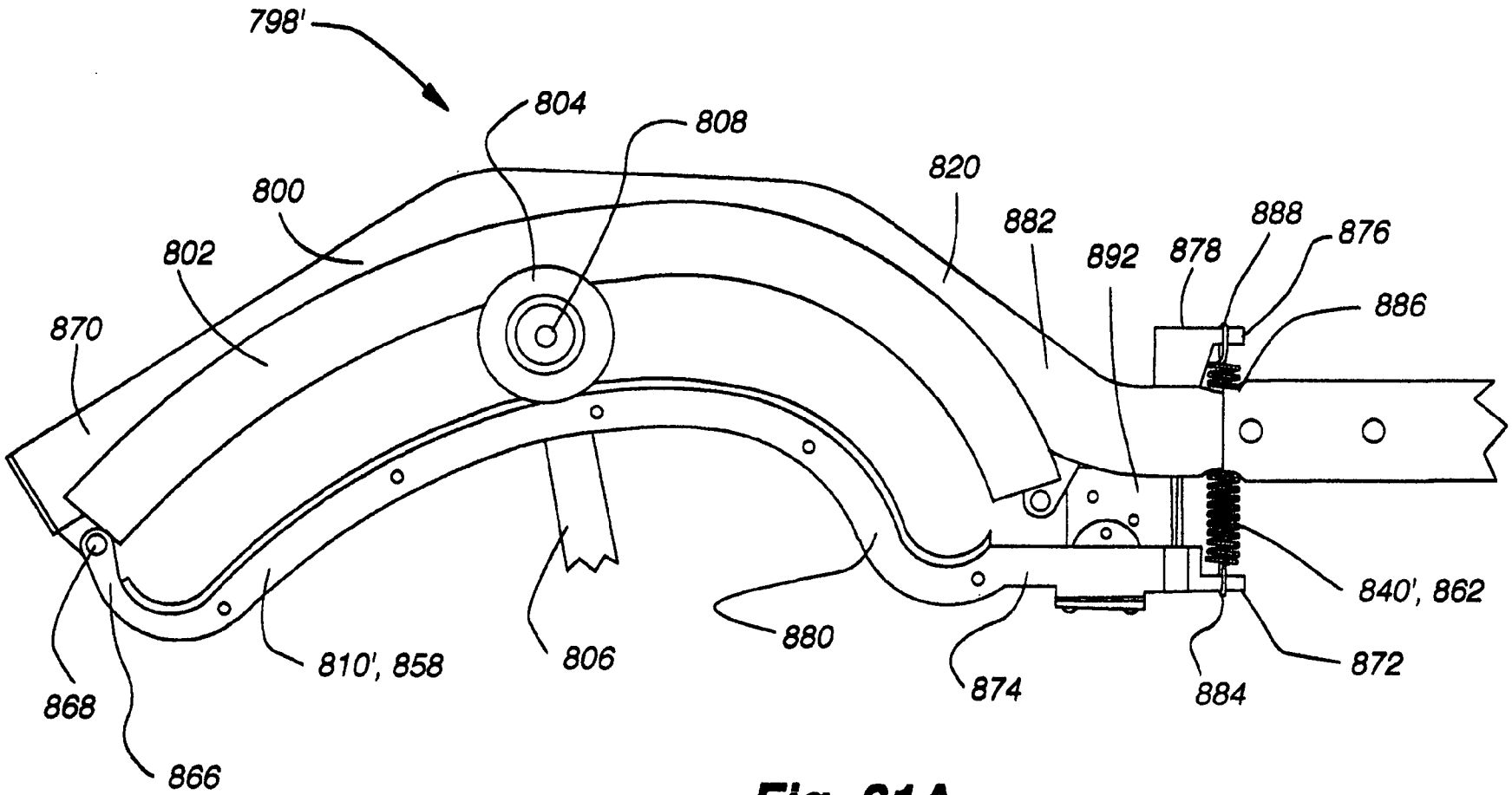
FIG. 31A shows a second embodiment of a releasable connection mechanism.

As previously mentioned, the bottom guide 858 is pivotally connected with the cam member 800. As shown in FIG. 31A, the bottom guide 858 extends in an arc along the length of the cam member 800. The arc is generally parallel with the arc defined by the cam member. A first end portion 866 of the bottom guide 858 is pivotally connected through a hinge 868 near a first end portion 870 of the cam member 800. It is to be appreciated that the bottom guide need not be connected with the cam member through a hinge. For example, the first end portion of the bottom guide may be integrally connected with the cam member and made from a resilient material that allows the bottom guide to resiliently bend up and down relative to the cam member. As discussed in more detail below, the spring member 840' pulls upward on the bottom guide 858 to pivot the bottom guide about the hinge (direction A in FIG. 31D) to engage the bottom guide with the cam roller. Conversely, the DC motor 864, when energized, pushes downward on the bottom guide 858 to pivot the bottom guide about the hinge (direction B in FIG. 31C) to disengage the bottom guide from the cam roller.

Figure 31B:
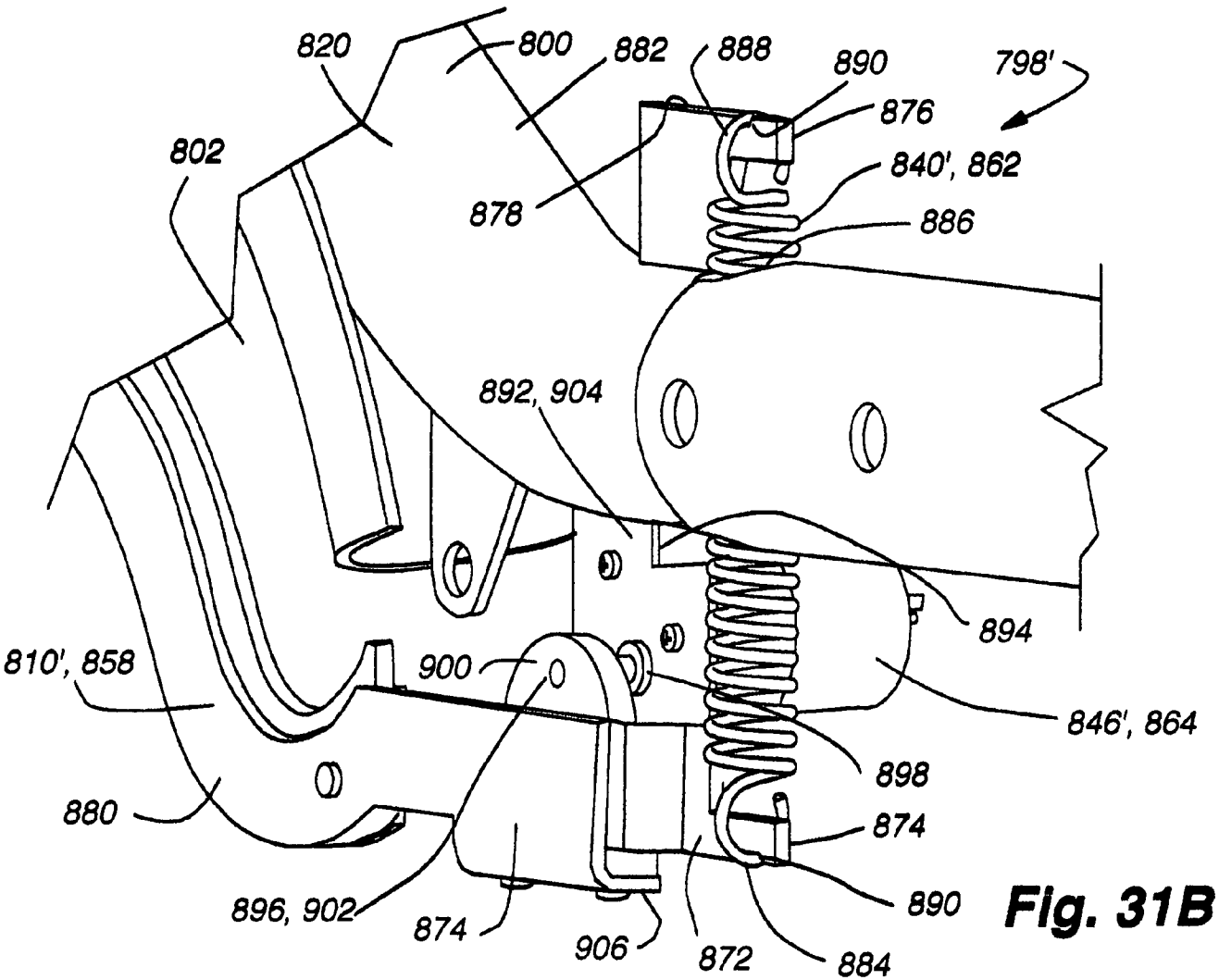
FIG. 31B is a detailed view of an actuation device, spring member, and bottom guide extension shown in FIG. 31A.

As shown in FIGS. 31A and 31B, the spring member 840' is connected with the cam member 800 and the bottom guide 858. More particularly, opposing end portions of the spring are connected with a first spring connection tab 872 on a bottom guide extension 874 and a second spring connection tab 876 on a spring connector plate 878. As shown in FIGS. 31A and 31B, the bottom guide extension 874 extends from a second end portion 880 of the bottom guide 858 under a second end portion 882 of the cam member 800. The spring connector plate 878 extends upward from the top surface 820 of the cam member 800. The spring member 840' extends from a first loop 884 connected with the first spring connection tab 872, downward through a spring aperture 886 defined within the cam member 800, to a second loop 888 connected with the second spring connection tab 876. As best shown in FIG. 31B, the first and second spring connection tabs may also include notches 890 adapted to receive portions of the first and second loops to help prevent the first and second loops from sliding along the lengths of and disengaging from the first and second spring connection tabs. The spring member 840' can be connected between the bottom guide extension 874 and the spring connector plate 878 such that it is stretched beyond its zero deflection length. As such, the spring provides a biasing force that causes the bottom guide 858 to pivot about the hinge 868 upwardly (direction A in FIG. 31D) toward the cam member 800 to press against the outer rolling surface 860 of the cam roller 804. It is to be appreciated that other embodiments of the present invention may be configured in other ways to provide the biasing force, such as with an elastic band or a spring loaded hinge.

As previously mentioned, when the DC motor 864 is energized, the bottom guide 858 is pushed downward about the hinge (direction B in FIG. 31C) to disengage the bottom guide 858 from the cam roller 804, which allows the cam roller to move along the length of the cam member. As shown in FIG. 31B, the DC motor 864 is mounted on an L-shaped plate 892 connected with and extending downward from the second end portion 882 of the cam member 804. It is to be appreciated that the L-shaped plate may be connected with the cam member through any suitable means, such as welding or with fasteners. The DC motor 864 is connected with a first side 894 of the L-shaped plate 892 and includes a shaft 896 extending through an aperture 898 in the L-shaped plate. An actuation disk 900 is eccentrically connected with an end portion 902 of the shaft 896 adjacent a second side 904 of the L-shaped plate 892. As discussed in more detail below, when the DC motor 864 is energized, the shaft 896 and the actuation disk 900 rotate together, which in turn, pivots the bottom guide downward (direction B in FIG. 31C).

Figure 31C:
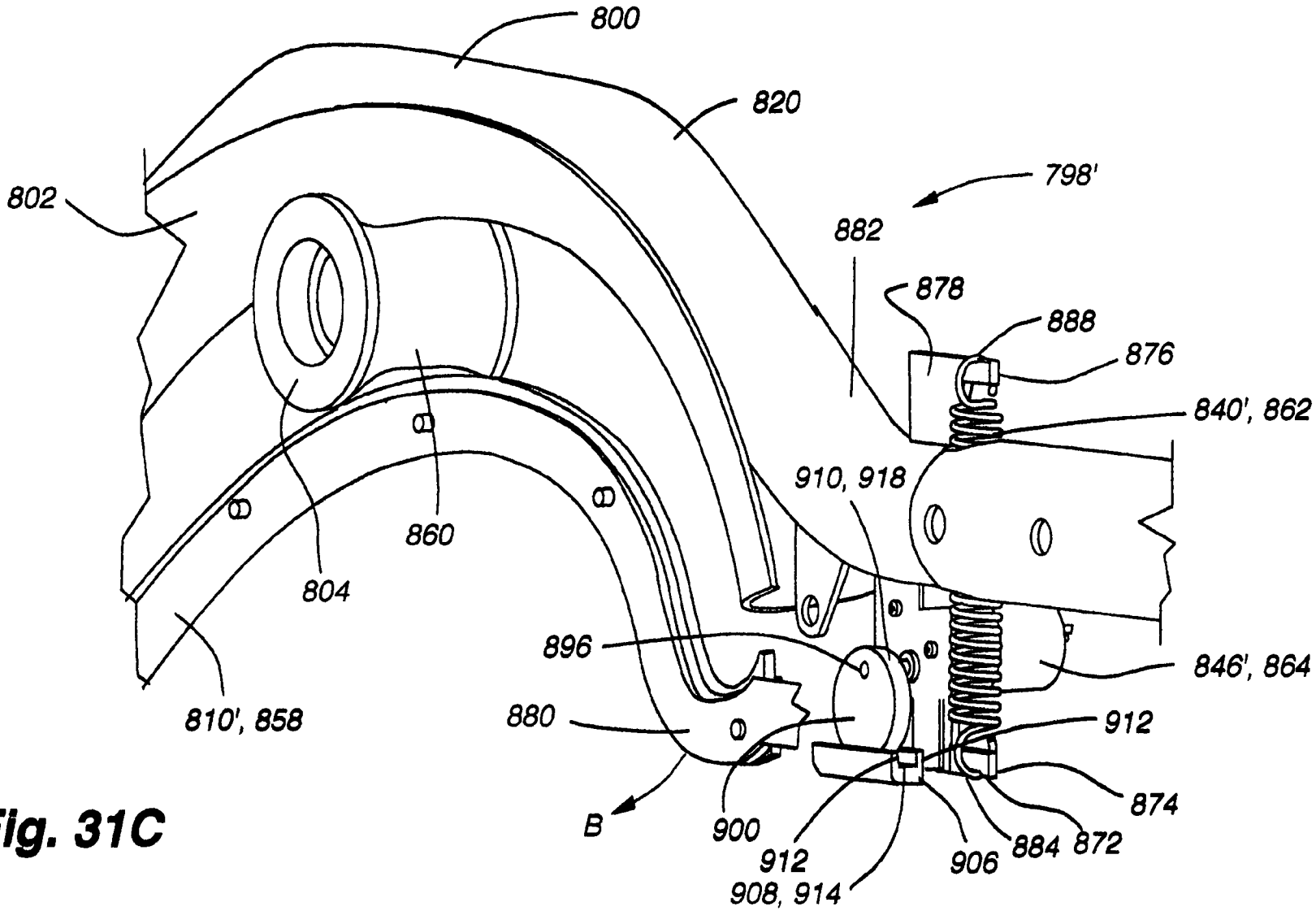
FIG. 31C shows the releasable connection mechanism of FIG. 31A with a portion of a bottom guide extension cut away showing the locking member disengaged from the cam roller.
Figure 31D:
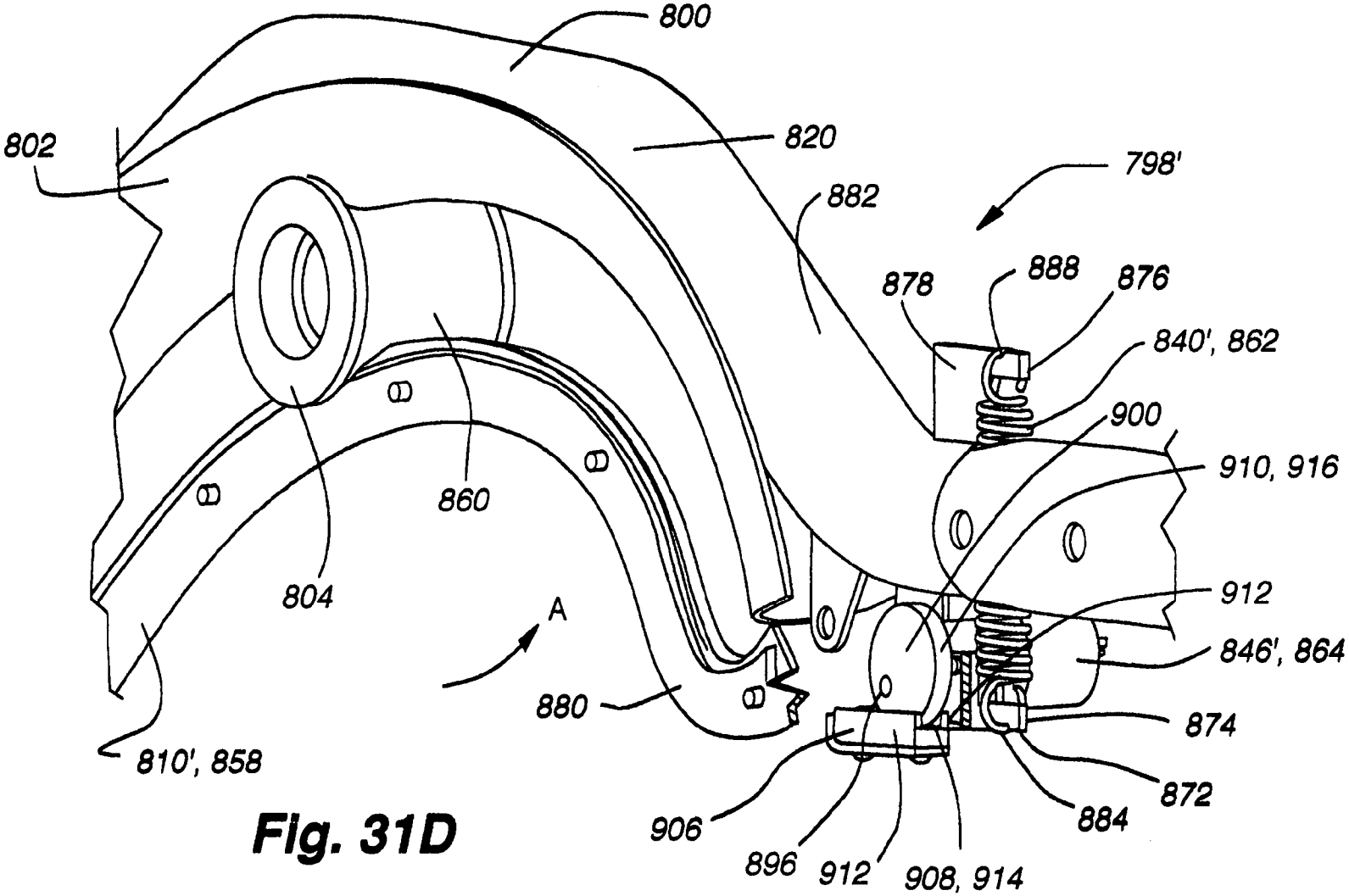
FIG. 31D shows the releasable connection mechanism of FIG. 31A with a portion of a bottom guide extension cut away showing the locking member engaged with the cam roller.

When the DC motor 864 is energized, the eccentrically mounted actuation disk 900 rotates and exerts a force against a channel member 906 connected with the bottom guide extension 874, which pivots the bottom guide 858 downward. FIGS. 31C and 31D show a view of the releasable connection mechanism with a portion of the bottom guide extension cut away to better illustrated the channel member 906, which defines a U-shaped channel 908. The channel member 906 is connected with the bottom guide extension 874 so as to place the U-shaped channel 908 in alignment with an outer perimeter surface 910 of the actuation disk 900. In addition, the U-shaped channel is adapted to received a portion of the actuation disk. More particularly, the U-shaped channel is slightly wider than the thickness of the actuation disk so that a portion of the actuation disk may be received between opposing sides 912 of the U-shaped channel.

As shown in FIG. 31C, when the DC motor 864 is energized, the shaft 896 rotates the eccentrically mounted actuation disk 900, which exerts a force against a base surface 914 of the U-shaped channel 908. The eccentric mounting of the actuation disk on the shaft defines a first perimeter portion 916 and a second perimeter portion 918. The first perimeter portion 916 includes a portion of the disk perimeter surface 910 that is relatively distant from the shaft 896, and the second perimeter portion 918 includes a portion of the disk perimeter surface that is relatively close to the shaft. When the DC motor is energized, the actuation disk 900 rotates to place the first perimeter portion 916 of the actuation disk into contact with the bottom guide extension 874. As such, the actuation disk imparts a downward force on the bottom guide extension. The downward force imparted by the actuation disk is greater than the biasing force of the spring, and as such, the bottom guide pivots about the hinge downwardly away from the cam member (direction B in FIG. 31C). In turn, the cam roller can roll along the length of the cam surface unimpeded by friction forces. Once the bottom guide is disengaged from the cam roller, as shown in FIG. 31C, the DC motor can be de-energized. The upward force exerted by the spring member on the bottom guide acts to hold the bottom guide extension against the actuation disk. The actuation disk maintains the bottom guide in the disengaged position shown in FIG. 31C until the DC motor is re-energized.

When the DC motor 864 is re-energized, the actuation disk rotates to place the second perimeter portion 918 of the actuation disk 900 into contact with the bottom guide extension 874. At the same time, the biasing force of the spring member 840' pulls the bottom guide 858 upward (direction A in FIG. 31D). As such, the channel member 906 imparts an upward force on the outer perimeter of the actuation disk 900, which causes the bottom guide 858 to move upward toward the cam member and press against the outer rolling surface 860 of the cam roller 804. As the bottom guide moves upward, the bottom guide extension 874 presses against the outer perimeter surface of the actuation disk 900. Once the actuation disk rotates to a position in which the second perimeter portion 918 is adjacent the base surface 914 of the U-shaped channel 908, the DC motor can again be de-energized. As previously mentioned, the biasing force from the spring member 840' pulling upward the bottom guide extension 874 causes the bottom guide 858 to press against the outer rolling surface 860 of the cam roller 804. As such, frictional forces are created between the outer roller surface of the cam roller and the cam member as well as the bottom guide. The frictional forces acting on the cam roller are sufficient enough to limit or prevent the cam roller from rolling along the length of the cam surface.

Figure 32A:
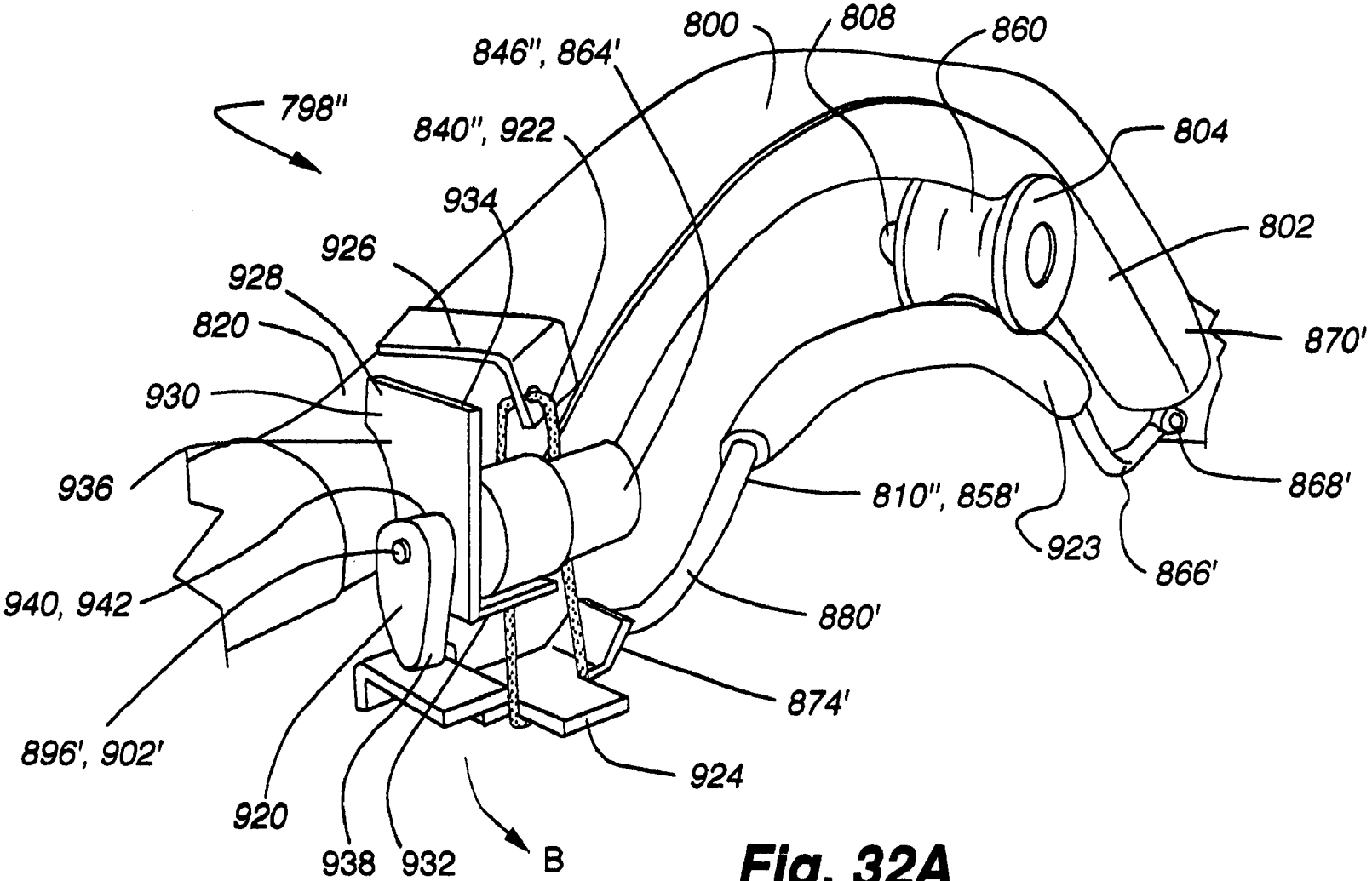
FIG. 32A shows a third embodiment of a releasable connection mechanism with the locking member disengaged from the cam roller.
Figure 32B:
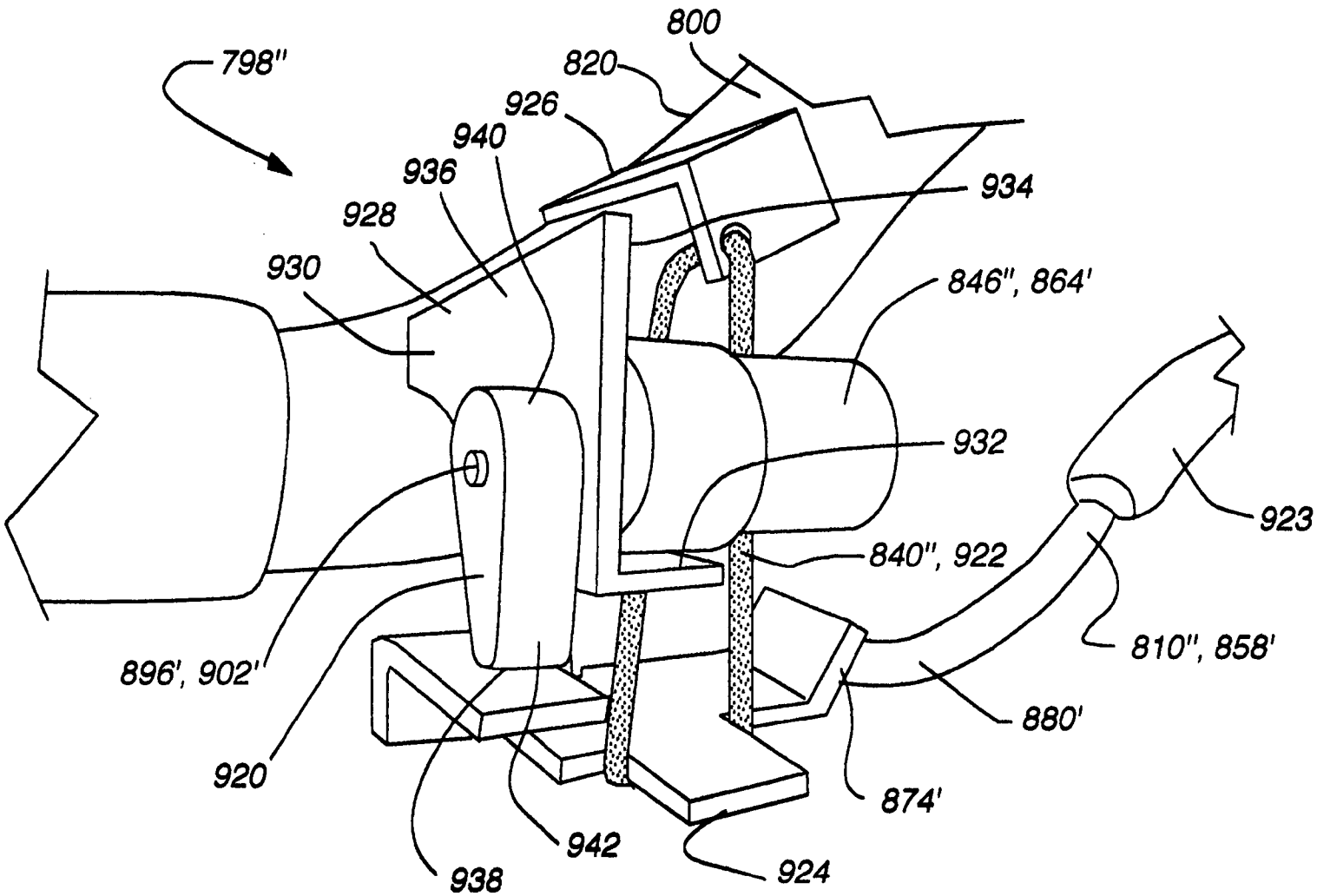
FIG. 32B is a detailed view of an actuation device, spring member, and bottom guide extension shown in FIG. 32A.
Figure 32C:
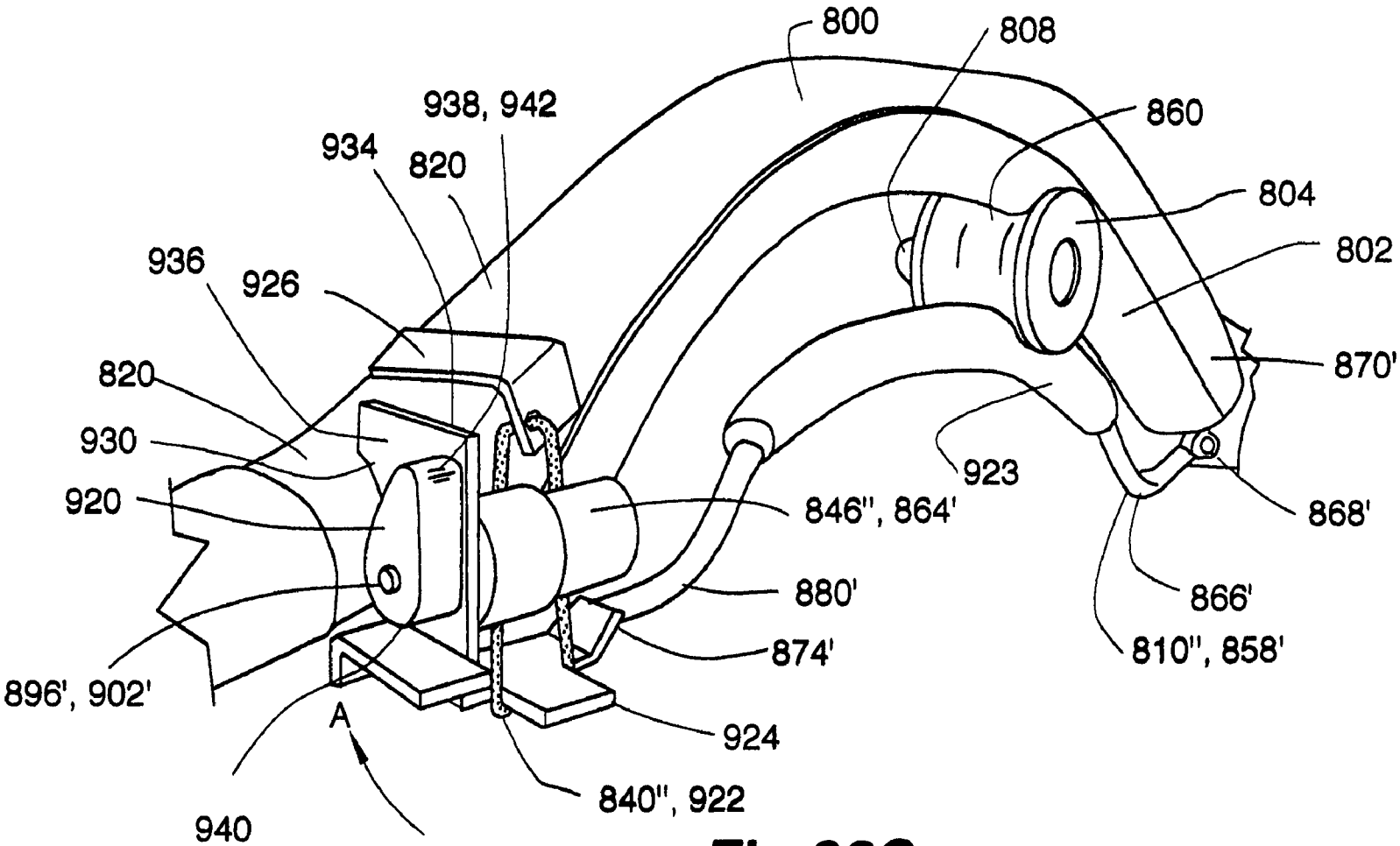
FIG. 32C shows the releasable connection mechanism of FIG. 32A with the locking member engaged with the cam roller.

FIGS. 32A-32C show a third embodiment of a releasable connection mechanism 798". The third embodiment of the releasable connection mechanism 798", like the second embodiment 798', includes an actuation device 846" in the form of a DC motor 864' to pivot a locking member 810" a bottom guide 858' in and out of engagement with the cam roller 804. Although the actuation devices shown in FIGS. 31A-32C are described as DC motors, it is to be appreciated that other embodiments can include rotary solenoids.

Although the third embodiment 798" functions similar to the second embodiment 798' described above with reference to FIGS. 31A-31D, there are some structural differences between the second and third embodiments. For example, the third embodiment 798" utilizes an oblong actuation member 920 connected with the DC motor 864", as opposed to an actuation disk, to pivot the bottom guide. In addition, the third embodiment utilizes a spring member 840" in the form of an elastic band 922, as opposed to a coil spring to apply a biasing force to engage the guide member with the cam roller.

Similar to the guide member described above with reference to FIGS. 31A-31C, the bottom guide 858' shown in FIGS. 32A and 32C is pivotally connected with the cam member 800. As shown in FIGS. 32A and 32C, the bottom guide 858' extends in an arc along the length of the cam member. Similar to the second embodiment, the arc is generally parallel with the arc defined by the cam member. A first end portion 866' of the bottom guide 858' is pivotally connected with the cam member 800 through a hinge 868' near a first end portion 870' of the cam member 800. As with the second embodiment described above, it is to be appreciated that the bottom guide need not be connected with the cam member through a hinge. For example, the first end portion of the bottom guide may be integrally connected with the cam member and made from a resilient material that allows the bottom guide to bend up and down relative to the cam member. As shown in FIGS. 32A and 32C, the releasable connection mechanism 798" can also include a sleeve or pad 923 extending along a portion of the length of the bottom guide 858'. The pad 923 can help prevent damage to the cam roller 804 when the bottom guide is pivoted upward and into engagement with the cam roller. It also to be appreciated that the pad can extend the entire length of the bottom guide.

Still referring to FIGS. 32A-32C, the elastic band 922 is connected with the cam member 800 and the bottom guide 858'. More particularly, opposing end portions of the elastic band 922 are connected with a first connection tab 924 on a bottom guide extension 874' and a band connector plate 926 connected with the top surface 820 of the cam member 800. As shown in FIG. 32, the bottom guide extension 874' extends from a second end portion 880' of the bottom guide 858' under an L-shaped bracket 928 connected with a second end portion 882' of the cam member 800. The elastic band 922 can be connected in tension between the first connection tab and the band connector plate. As such, the elastic band provides a biasing force that causes the bottom guide to pivot about the hinge 868' upwardly (direction A in FIG. 32C) toward the cam member to press against the outer rolling surface 860 of the cam roller. It is to be appreciated that other embodiments of the present invention may be configured in other ways to provide the biasing force, such as with a spring or a spring loaded hinge.

As shown in FIG. 32B, the DC motor is mounted on the L-shaped bracket 928 connected with the second end portion 882' of the cam member 800. The L-shaped bracket includes a laterally extending portion 930 and a longitudinally extending portion 932. It is to be appreciated that the L-shaped bracket can be connected with the cam member in various ways, such as by welding or with fasteners. The DC motor 864' is connected with a first side 934 of the laterally extending portion 930 of the L-shaped bracket and includes a shaft 896' extending through the L-shaped bracket. The oblong-shaped actuation member 920 is connected with an end portion 902' of the shaft 896' adjacent a second side 936 of the laterally extending portion 930 of the L-shaped bracket. As discussed in more detail below, when the DC motor 864' is energized, the shaft 896' and actuation member 920 rotate together, which in turn, pivots the bottom guide downward (direction B in FIG. 32A).

When the DC motor 864' is energized, the actuation member 920 rotates and exerts a downward force on the bottom guide extension 874', which pivots the bottom guide 858' downward. As shown in FIG. 32B, the oblong shape of the actuation member 920 defines a first perimeter portion 938 and a second perimeter portion 940. The first perimeter portion includes a portion of an actuation member perimeter surface 942 that is relatively distant from the shaft 896', and the second perimeter portion 940 includes a portion of the actuation member perimeter surface that is relatively close to the shaft. When the DC motor is energized, the actuation member rotates to place the first perimeter portion into contact with the bottom guide extension. As such, the actuation member imparts a downward force on the bottom guide extension. The downward force imparted by the actuation member is greater than the biasing force of the elastic band 922, and as such, the bottom guide 858' pivots about the hinge 868' downwardly away from the cam member (direction B in FIG. 32A). In turn, the cam roller 804 can roll along the length of the cam surface unimpeded by the bottom guide. Once the bottom guide is disengaged from the cam roller, as shown in FIG. 32A, the DC motor can be de-energized. The upward force exerted by the spring member on the bottom guide acts to hold the bottom guide extension against the actuation member. The actuation member maintains the bottom guide in the disengaged position shown in FIG. 32A until the DC motor is re-energized.

When the DC motor 864' is re-energized, the actuation member 920 rotates to place the second perimeter portion 940 of the actuation member 920 into contact with the bottom guide extension 874'. At the same time, the biasing force of the spring member 840' pulls the bottom guide upward 858' (direction A in FIG. 32C). As such, the bottom guide extension 874' imparts an upward force on the outer perimeter of the actuation member 920, which causes the bottom guide 858' to move upward toward the cam member and press against the outer rolling surface 860 of the cam roller 804. As the bottom guide moves upward, the bottom guide extension 874' presses against the outer perimeter surface of the actuation member 920. Once the actuation member rotates to a position in which the second perimeter portion 940 is contact with or located above the bottom guide extension, the DC motor can again be de-energized. It is to be appreciated that the DC motors and solenoids depicted and discussed herein can be spring-loaded, and as such, need not require externally applied forces to automatically retract or rotate a plunger or shaft, respectively, when de-energized. Still referring to FIGS. 32A-32C, the bottom guide 858' presses against the outer rolling surface 860 of the cam roller, which in turn, creates frictional forces between the outer rolling surface 860 of the cam roller 804 and the cam member 800 as well as the bottom guide 858'. The frictional forces created by the biasing force acting on the cam roller are sufficient enough to limit or prevent the cam roller from rolling along the length of the cam surface.

Figure 33A:
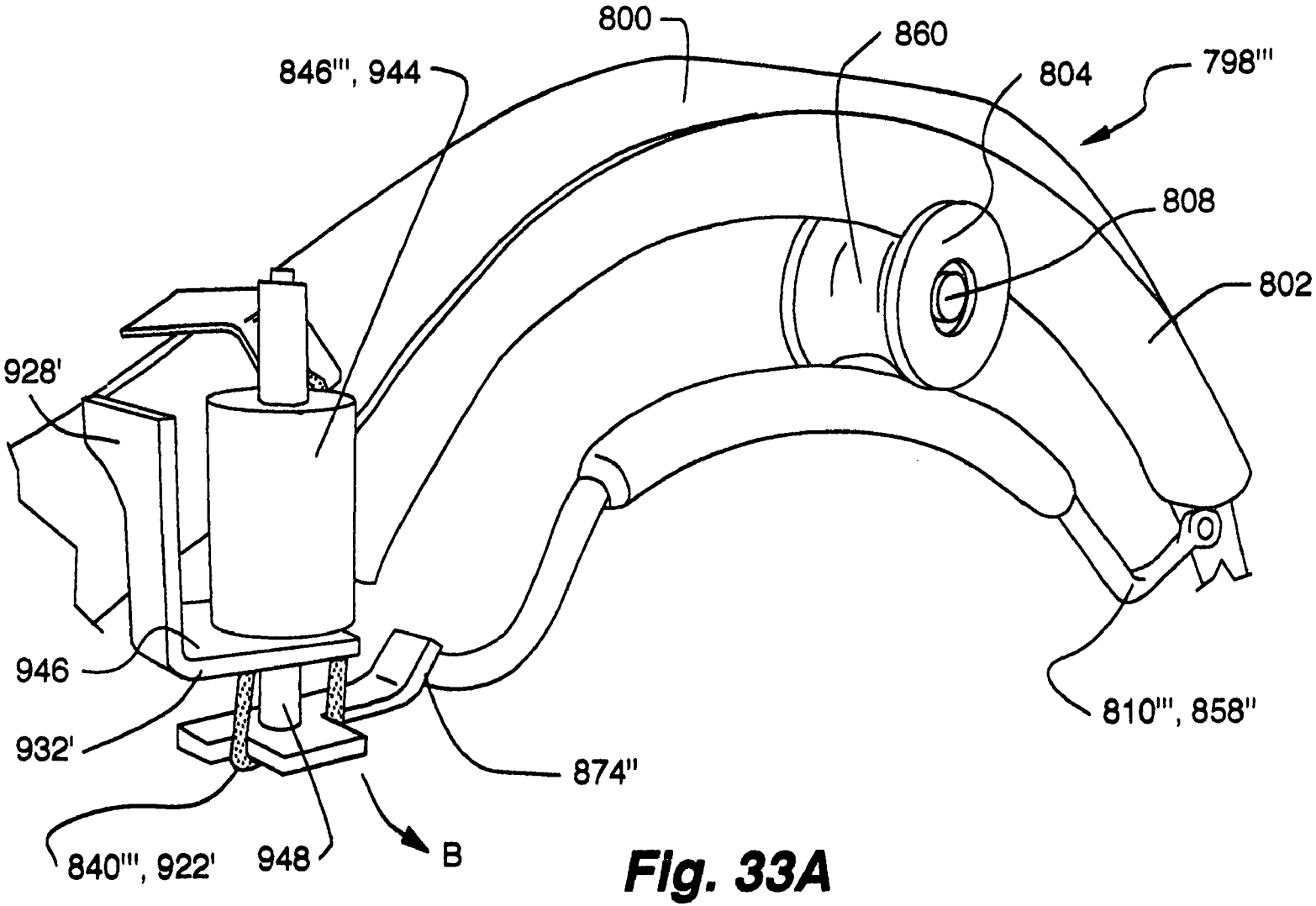
FIG. 33A shows a fourth embodiment of a releasable connection mechanism with the locking member disengaged from the cam roller.
Figure 33B:
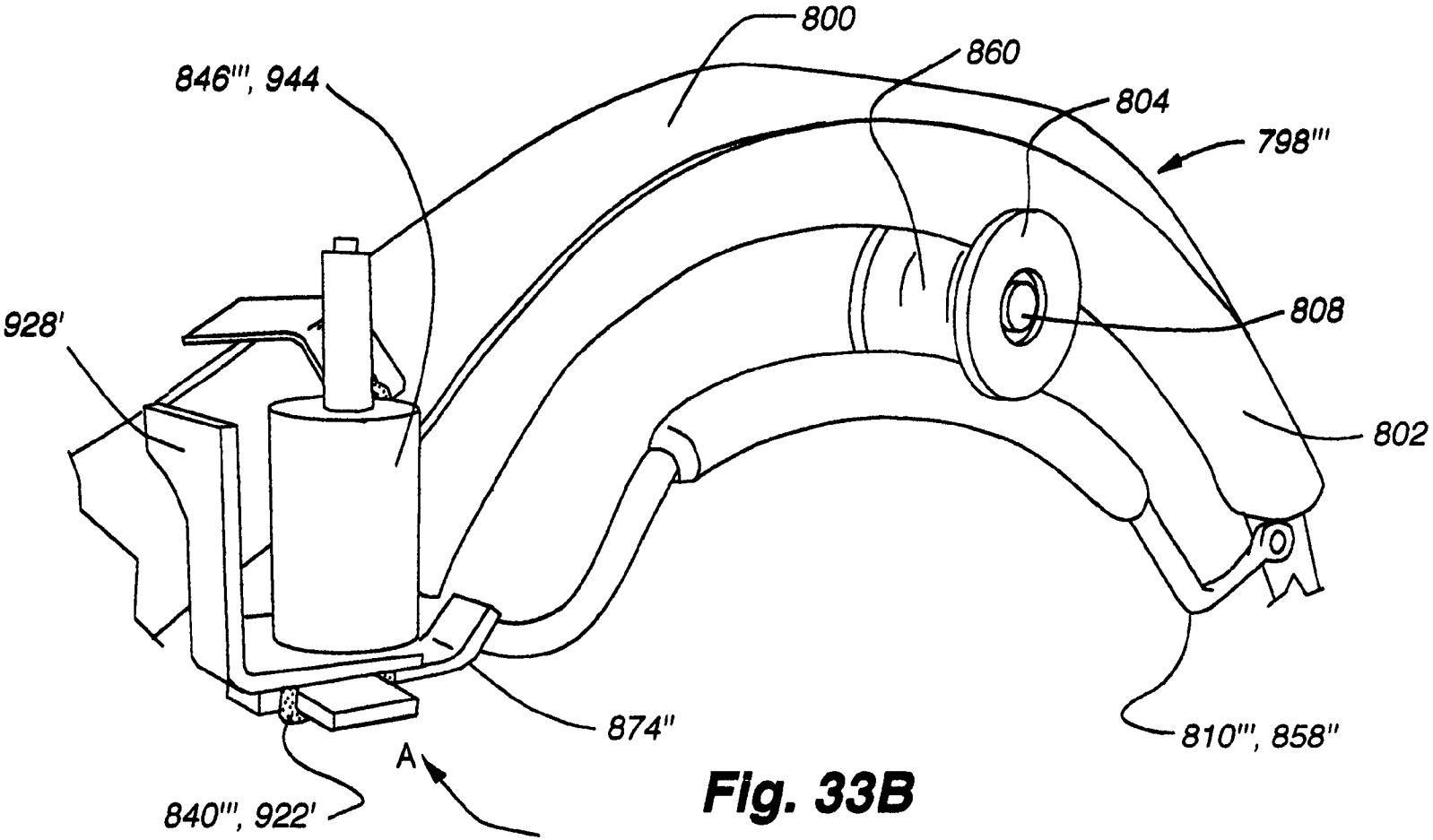
FIG. 33B shows the releasable connection mechanism of FIG. 33A with the locking member engaged with the cam roller.

A fourth embodiment of a releasable connection mechanism 798'" is shown in FIGS. 33A and 33B. The fourth embodiment 798'" includes a L-shaped bracket 928', a locking member 810'" in the form of a bottom guide 858", a bottom guide extension 874", and a spring member 840'" in the form of an elastic band 922', which are all substantially similar to those described above with reference to the third embodiment 798". However, unlike the third embodiment 798", the activation device 846'" of the fourth embodiment 798''' includes a linear solenoid 944, as opposed to a DC motor, to pivot the guide member about the hinge.

As shown in FIGS. 33A and 33B, the L-shaped bracket 928' is substantially the same L-shaped bracket described above with respect to the third embodiment 798''. However, the linear solenoid 944 is connected with an upper side 946 of a longitudinally extending portion 932' of the L-shaped bracket 928''. The solenoid includes a plunger 948 extending through the longitudinally extending portion 932' of the L-shaped bracket 928'. As discussed in more detail below, when the solenoid 944 is energized, the plunger 948 presses downward against the bottom guide extension 874''. As shown in FIG. 33B, when the solenoid is de-energized, the biasing force from the elastic band 922' pulls upward on the bottom guide extension 874'', which causes the bottom guide to pivot about the hinge 868'' upwardly toward the cam member. As such, the bottom guide 858'' presses against the outer rolling surface 860 of the cam roller 804. As described above, the friction forces acting on the cam roller 804 are sufficient enough to limit or prevent the cam roller from rolling along the length of the cam surface. As shown in FIG. 33A, when the solenoid 944 is energized, the plunger 948 presses downward against the bottom guide extension 874''. The downward force imparted by the plunger is greater than the biasing force of the elastic band 922', and as such, the bottom guide pivots about the hinge downwardly away from the cam member (direction B in FIG. 33A). As shown in FIG. 33A, the plunger 948 extends a sufficient distance downward to cause the bottom guide to move far enough away from the cam member 800 such that the cam roller 804 can roll along the length of the cam surface unimpeded by the bottom guide 858'.

Although various representative embodiments of this invention have been described above with a certain degree of particularity, those skilled in the art could make numerous alterations to the disclosed embodiments without departing from the spirit or scope of the inventive subject matter set forth in the specification and claims. All directional references (e.g., upper, lower, upward, downward, left, right, leftward, rightward, top, bottom, above, below, vertical, horizontal, clockwise, and counterclockwise) are only used for identification purposes to aid the reader's understanding of the embodiments of the present invention, and do not create limitations, particularly as to the position, orientation, or use of the invention unless specifically set forth in the claims. Joinder references (e.g., attached, coupled, connected, and the like) are to be construed broadly and may include intermediate members between a connection of elements and relative movement between elements. As such, joinder references do not necessarily infer that two elements are directly connected and in fixed relation to each other.

In some instances, components are described with reference to "ends" having a particular characteristic and/or being connected with another part. However, those skilled in the art will recognize that the present invention is not limited to components which terminate immediately beyond their points of connection with other parts. Thus, the term "end" should be interpreted broadly, in a manner that includes areas adjacent, rearward, forward of, or otherwise near the terminus of a particular element, link, component, part, member or the like. In methodologies directly or indirectly set forth herein, various steps and operations are described in one possible order of operation, but those skilled in the art will recognize that steps and operations may be rearranged, replaced, or eliminated without necessarily departing from the spirit and scope of the present invention. It is intended that all matter contained in the above description or shown in the accompanying drawings shall be interpreted as illustrative only and not limiting. Changes in detail or structure may be made without departing from the spirit of the invention as defined in the appended claims.

What is claimed is:

1. An exercise device comprising:

a frame;

at least one swing link pivotally connected with the frame;

at least one crank arm pivotally connected with the frame and configured to rotate about a crank axis, the at least one crank arm including at least one cam roller;

at least one link comprising a cam link including at least one cam member, the at least one link movingly coupled with the at least one crank arm and operably coupled with the at least one swing link, the at least one link coupled with the at least one crank arm to allow relative movement between the at least one link and the at least one crank arm along at least a first portion of the at least one link, the at least one cam roller adapted to rollingly engage the at least one cam member;

at least one foot link including a foot engaging portion for engagement by a user, the at least one foot link operatively associated with the at least one link and the at least one swing link;

the at least one swing link, the at least one crank arm, the at least one link, and the at least one foot link configured for the user to move the foot engaging portion of the at least one foot link in a travel path; and at least one locking member movable to operably engage the at least one link and the at least one crank arm to reduce relative movement between the at least one link and the at least one crank arm along at least the first portion of the at least one link, the at least one locking member pivotally connected with the cam link, the at least one locking member movable between a first position and a second position; wherein:

when the at least one locking member is in the first position, the at least one locking member is connected with the at least one cam roller to limit the at least one cam roller from rolling along a length of the at least one cam member; and when the at least one locking member is in the second position, the at least one locking member is disconnected from the at least one cam roller.

2. The exercise device of claim 1, further comprising:

at least one axle rotatably supporting the at least one cam roller; and wherein the at least one locking member comprises a plate defining a channel adapted to receive a portion of the at least one axle when the at least one locking member is in the first position.

3. The exercise device of claim 1, wherein the at least one locking member comprises a guide member pivotally connected with the at least one cam member and extending along a length of the at least one cam member, and wherein the at least one cam roller is between the at least one cam member and the guide member.

4. The exercise device of claim 1, further comprising an actuation device operably coupled with the at least one locking member.

5. The exercise device of claim 4, wherein the actuation device comprises a solenoid.

6. The exercise device of claim 5, wherein the solenoid comprises a linear solenoid.

7. The exercise device of claim 4, wherein the actuation device comprises a DC motor.

8. The exercise device of claim 7, when the solenoid is energized, the at least one locking member is moved to the second position.

9. The exercise device of claim 1, further comprising a spring member operably coupled with the at least one locking member.

10. The exercise device of claim 9, wherein the spring member comprises an elastic band.

11. The exercise device of claim 9, wherein the spring member comprises a coil spring.

12. The exercise device of claim 9, wherein the spring member is biased to hold to the at least one locking member in the first position.

13. An exercise device comprising:

a frame;

at least one crank arm pivotally connected with the frame;

at least one roller rotatably connected with the at least one crank arm;

at least one linkage assembly operably coupled with the frame and including a cam member rollingly engaged with the at least one roller to allow the at least one roller to roll along at least a first portion of the cam member and a foot member including a foot engaging portion for engagement by a user;

the at least one crank arm and the at least one linkage assembly configured for the user to move the foot engaging portion of the foot member in a travel path;

at least one locking member selectively movable to operably engage the at least one roller and the cam member to limit movement of the at least one roller rolling along at least the first portion of the cam member;

an axle rotatably supporting the at least one roller; and the at least one locking member comprises a plate pivotally connected with the cam member and defining a channel adapted to receive a portion of the axle.

14. The exercise device of claim 13, further comprising an actuation device operably connected with the at least one locking member.

15. The exercise device of claim 14, wherein the actuation device comprises a solenoid.

16. The exercise device of claim 15, wherein the solenoid comprises a linear solenoid.

17. The exercise device of claim 13, further comprising a spring member operably coupled with the at least one locking member.

18. The exercise device of claim 17, wherein the spring member comprises a coil spring.

19. The exercise device of claim 17, wherein the spring member comprises an elastic band.

20. An exercise device comprising:

a frame;

at least one crank arm pivotally connected with the frame and configured to rotate about a crank axis;

at least one linkage assembly operably coupled with the frame and including at least one link movingly coupled with the at least one crank arm and a foot member including a foot engaging portion for engagement by a user, the at least one crank arm and the at least one linkage assembly configured for the user to move the foot engaging portion of the foot member in a variable stride path;

a means for selectively engaging the at least one link and the at least one crank arm to limit the variable stride path, the means for selectively engaging comprising a locking member;

at least one roller;

an axle connected with the at least one crank arm and rotatably supporting the at least one roller; and the locking member comprises a plate pivotally connected with the at least one link and defining a channel adapted to receive a portion of the axle.

21. The exercise device of claim 20, wherein the means for selectively engaging the at least one link and the at least one crank arm selectively provides a fixed stride path.

22. The exercise device of claim 20, wherein the means for selectively engaging further comprises an actuation device operably connected with the locking member.

23. The exercise device of claim 22, wherein the actuation device comprises a solenoid.

24. The exercise device of claim 23, wherein the solenoid is a linear solenoid.

25. The exercise device of claim 20, wherein the means for selectively engaging further comprises a spring member operably coupled with the locking member.

26. The exercise device of claim 25, wherein the spring member comprises a coil spring.

27. The exercise device of claim 25, wherein the spring member is an elastic band.

* * * * *